US012708141B2

(12) United States Patent
Lee et al.

(10) Patent No.: US 12,708,141 B2
(45) Date of Patent: Aug. 18, 2026

(54) CARTRIDGE AND AEROSOL-GENERATING DEVICE INCLUDING THE SAME

(71) Applicant: KT&G CORPORATION, Daejeon (KR)

(72) Inventors: Jongsub Lee, Sungnam-si (KR); Jueon Park, Seoul (KR); Byungsung Cho, Gwangmyung-si (KR)

(73) Assignee: KT&G CORPORATION, Daejeon (KR)

( * ) Notice: Subject to any disclaimer, the term of this patent is extended or adjusted under 35 U.S.C. 154(b) by 395 days.

(21) Appl. No.: 18/566,969

(22) PCT Filed: Jun. 22, 2022

(86) PCT No.: PCT/KR2022/008894

§ 371 (c)(1),
(2) Date: Dec. 4, 2023

(87) PCT Pub. No.: WO2022/270919

PCT Pub. Date: Dec. 29, 2022

(65) Prior Publication Data

US 2024/0260656 A1 Aug. 8, 2024

(30) Foreign Application Priority Data

Jun. 25, 2021 (KR) ..... 10-2021-0082963

(51) Int. Cl.
*A24F 40/42* (2020.01)
*A24F 40/44* (2020.01)
(Continued)

(52) U.S. Cl.
CPC ..... *A24F 40/42* (2020.01); *A24F 40/44* (2020.01); *A24F 40/48* (2020.01); *A24F 40/51* (2020.01)

(58) Field of Classification Search
CPC ..... A24F 40/10; A24F 40/20; A24F 40/30; A24F 40/42
See application file for complete search history.

(56) References Cited

U.S. PATENT DOCUMENTS

2018/0184722 A1 7/2018 Murison et al.
2020/0345066 A1* 11/2020 Kim et al. ..... A24F 40/42
2020/0367568 A1 11/2020 Lim et al.

FOREIGN PATENT DOCUMENTS

CN 206482014 9/2017
CN 208242854 12/2018
(Continued)

OTHER PUBLICATIONS

WO2018112766A1_Espacenet_Machine Translation (Year: 2018).*
(Continued)

*Primary Examiner* — Philip Y Louie
*Assistant Examiner* — Ronnie Kirby Jordan
(74) *Attorney, Agent, or Firm* — LEE, HONG, DEGERMAN, KANG & WAIMEY

(57) ABSTRACT

A cartridge and an aerosol-generating device are disclosed. The cartridge of the disclosure includes a container provided therein with a first chamber and an elongated insertion space; a second chamber in communication with the insertion space; a wick disposed in the second chamber and in communication with the first chamber; a heater configured to heat the wick; a chamber inlet open at one side of the second chamber in a direction intersecting a longitudinal direction of the insertion space; and a first flow guide disposed opposite the chamber inlet with respect to the second chamber to cover an opposite side of the second chamber, wherein the first flow guide comprises a curved surface recessed to be curved toward the insertion space.

15 Claims, 81 Drawing Sheets

(51) Int. Cl.
*A24F 40/48* (2020.01)
*A24F 40/51* (2020.01)

(56) References Cited

FOREIGN PATENT DOCUMENTS

| | | | |
|---|---|---|---|
| CN | 109982589 | 7/2019 | |
| CN | 210538906 | 5/2020 | |
| EP | 3360429 | 8/2018 | |
| EP | 3383461 | 7/2020 | |
| EP | 3818871 | 5/2021 | |
| KR | 10-2016-0147253 | 12/2016 | |
| KR | 10-2018-0111460 | 10/2018 | |
| KR | 10-2019-0049392 | 5/2019 | |
| KR | 10-2019-0049406 | 5/2019 | |
| KR | 10-2019-0051787 | 5/2019 | |
| KR | 10-2020-0057004 | 5/2020 | |
| KR | 10-2020-0057490 | 5/2020 | |
| KR | 10-2020-0084912 | 7/2020 | |
| KR | 10-2203852 | 1/2021 | |
| WO | WO-2018112766 A1 * | 6/2018 | ..... A24F 40/10 |

OTHER PUBLICATIONS

PCT International Application No. PCT/KR2022/008894, International Search Report dated Oct. 18, 2022, 5 pages.
Korean Intellectual Property Office Application No. 10-2021-0082963, Notice of Allowance dated Apr. 20, 2023, 2 pages.
European Patent Office Application Serial No. 22828766.0, Search Report dated Apr. 9, 2025, 12 pages.
The State Intellectual Property Office of the People's Republic of China Application Serial No. 202280043381.4, Office Action dated Mar. 31, 2026, 9 pages.

* cited by examiner

【FIG. 1】
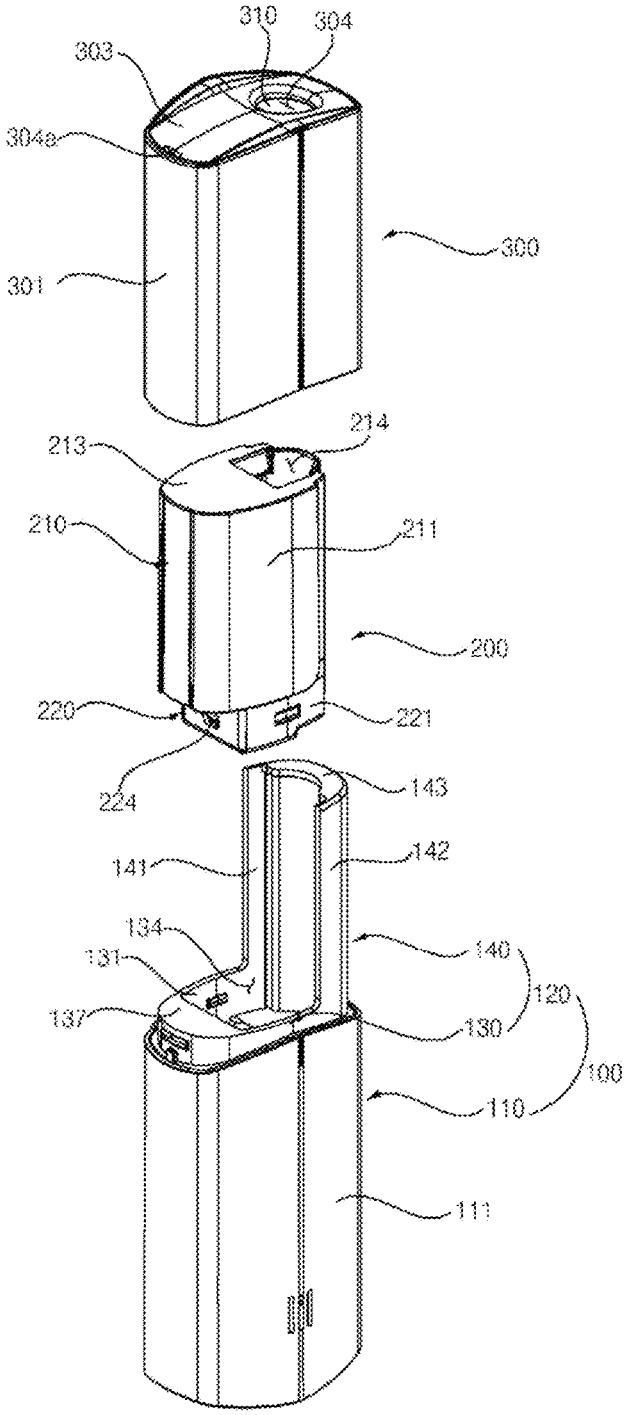

【FIG. 2】
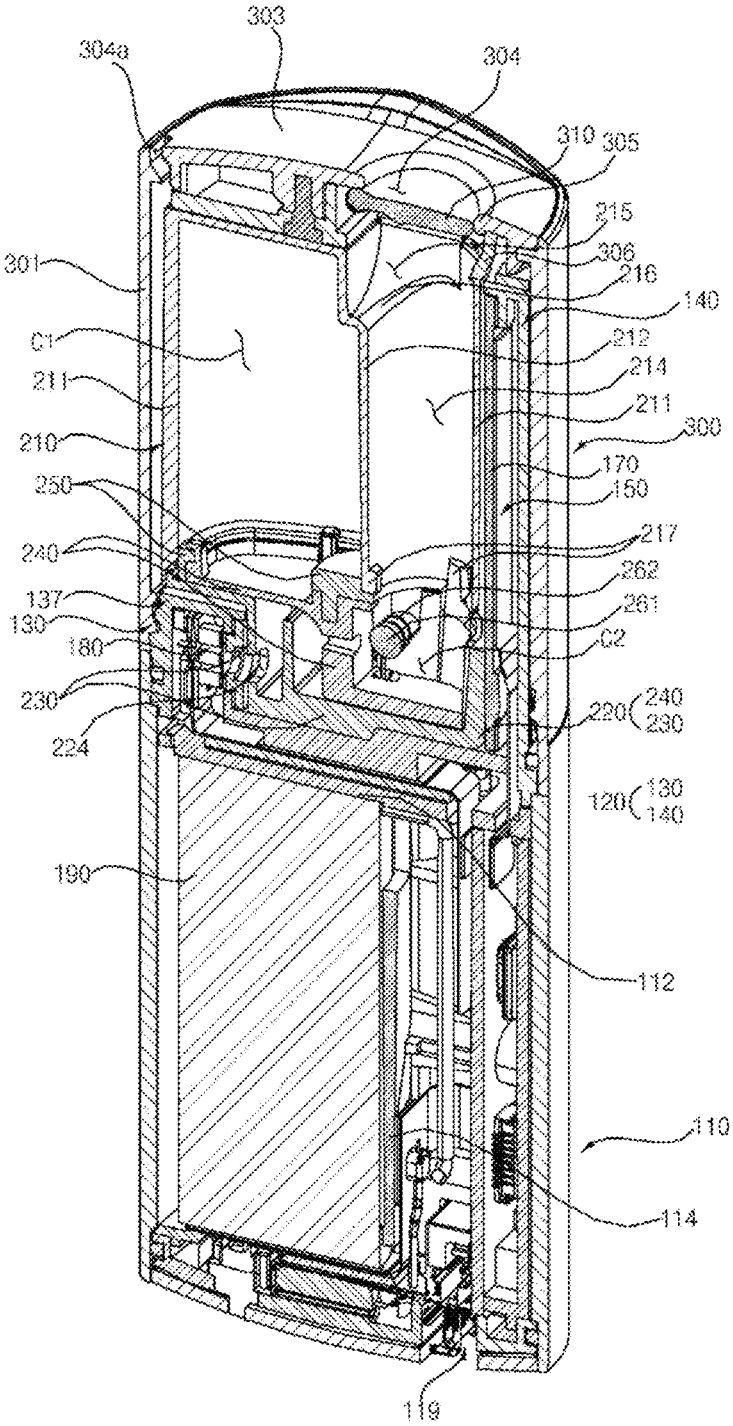

【FIG. 3】
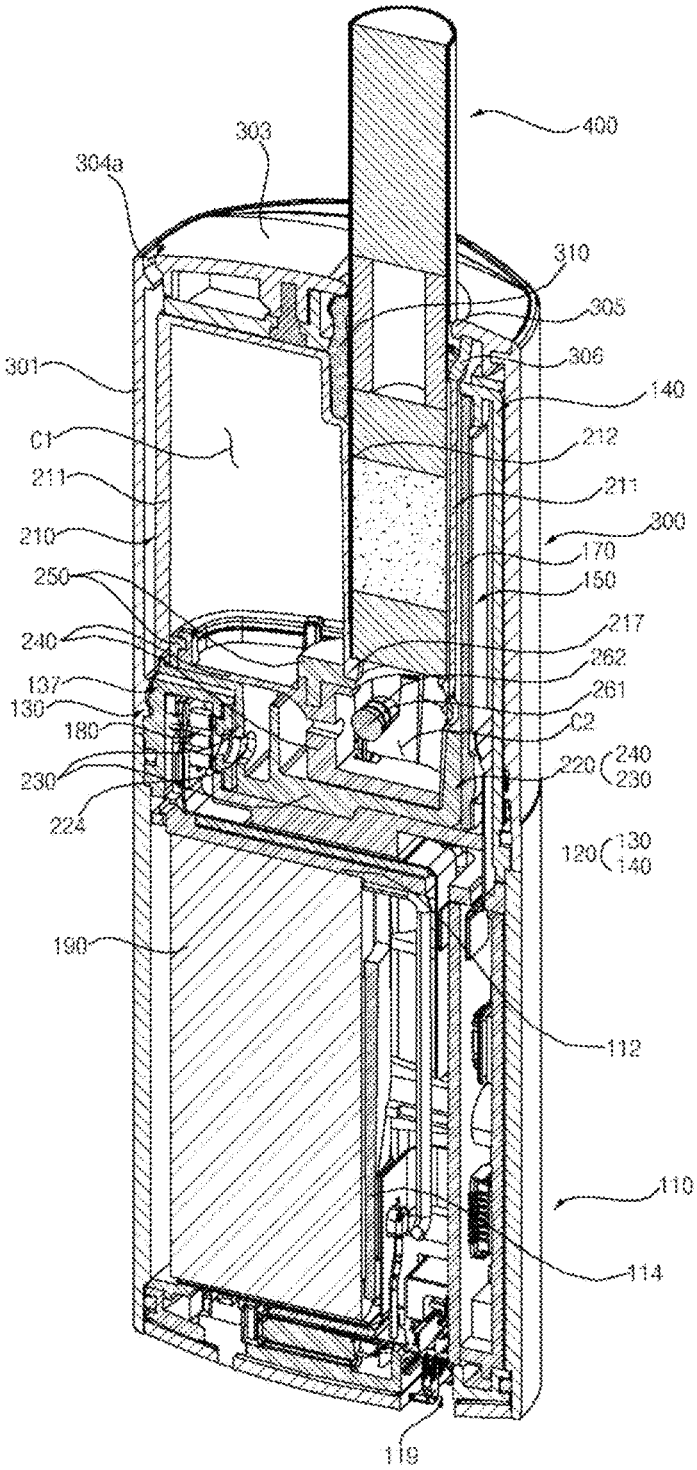

【FIG. 4】
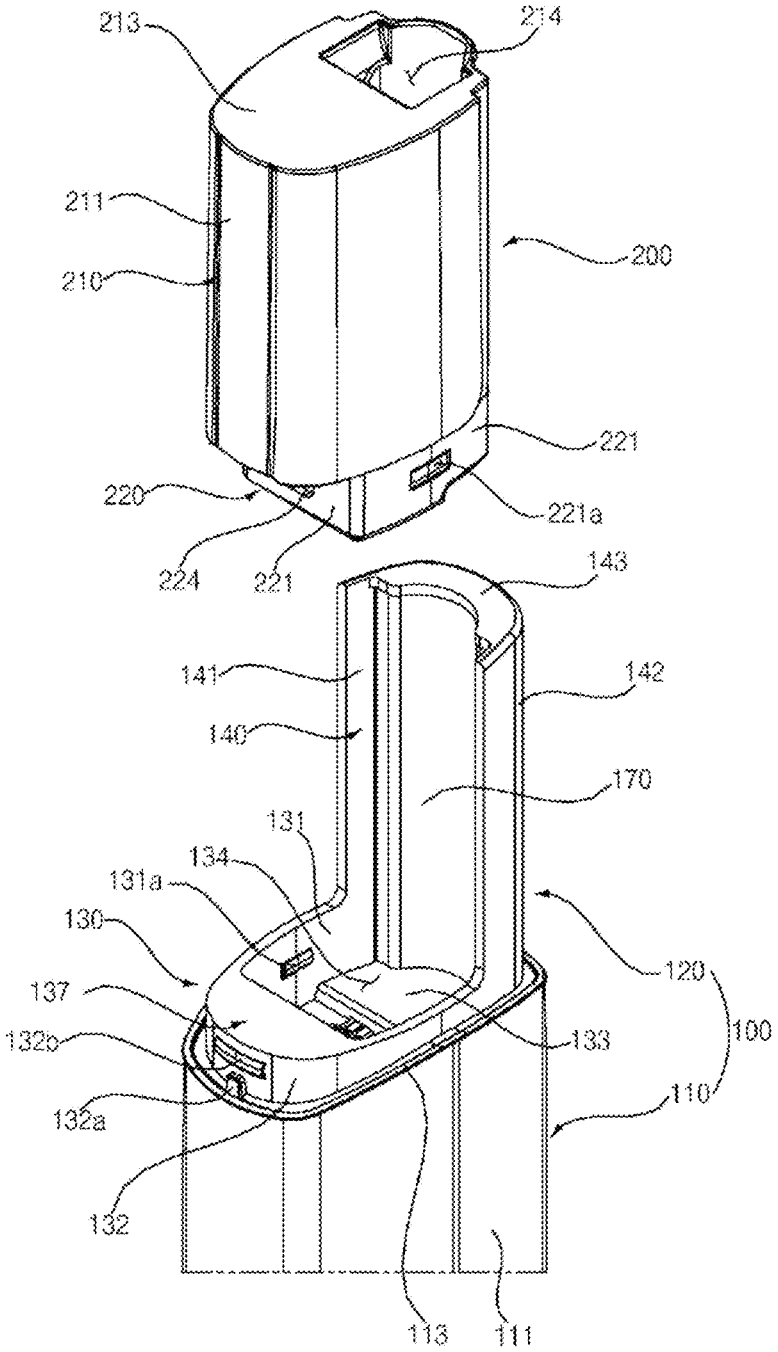

【FIG. 5】
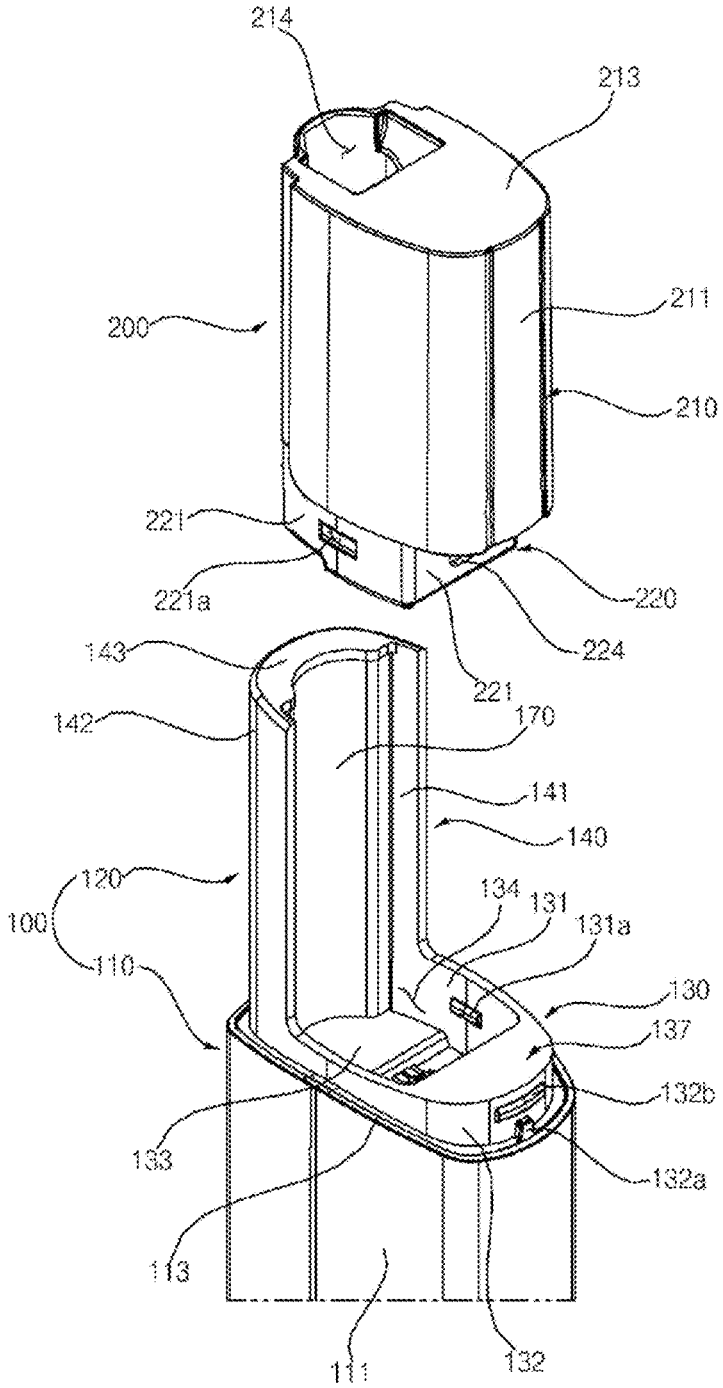

【FIG. 6】
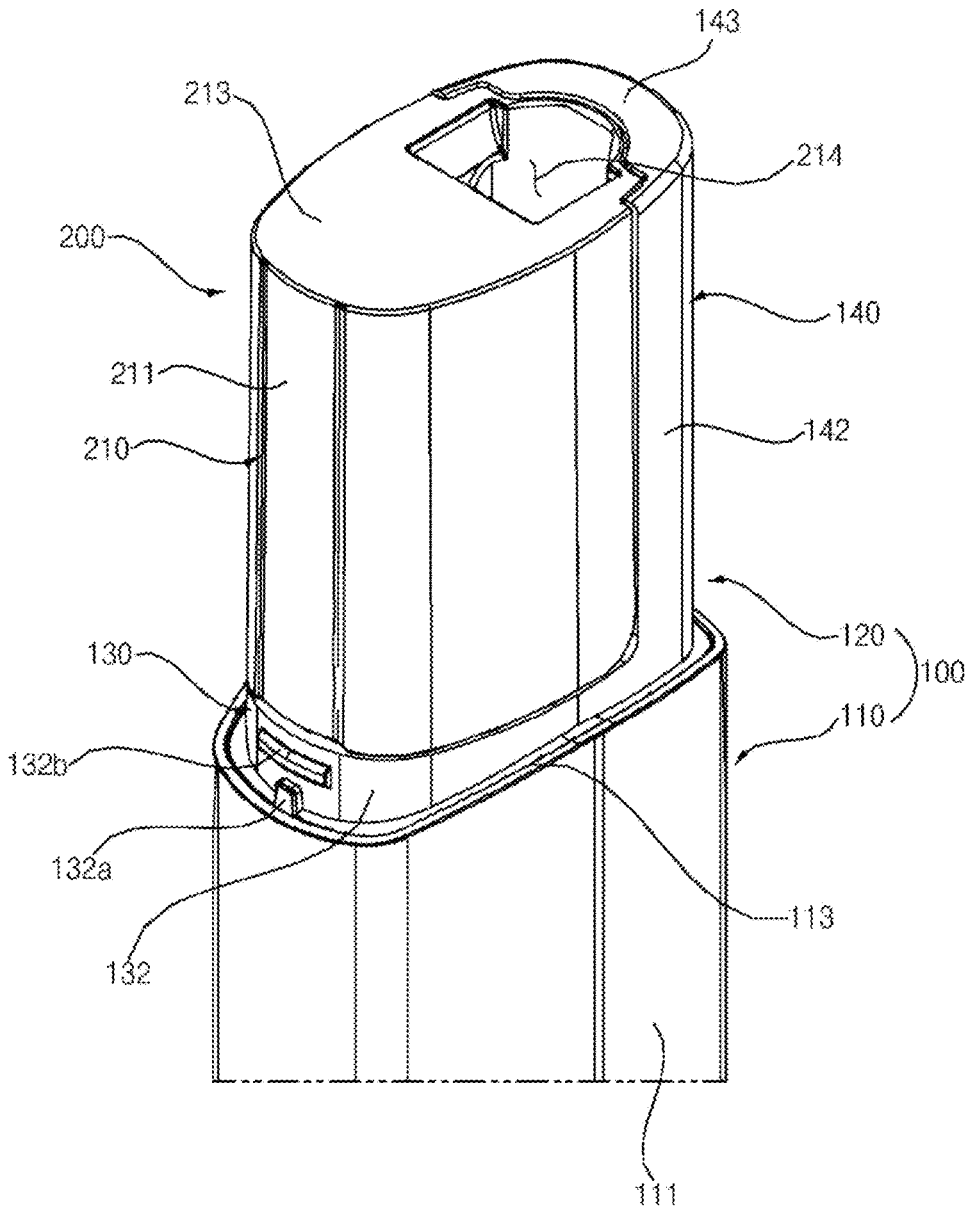

【FIG. 7】
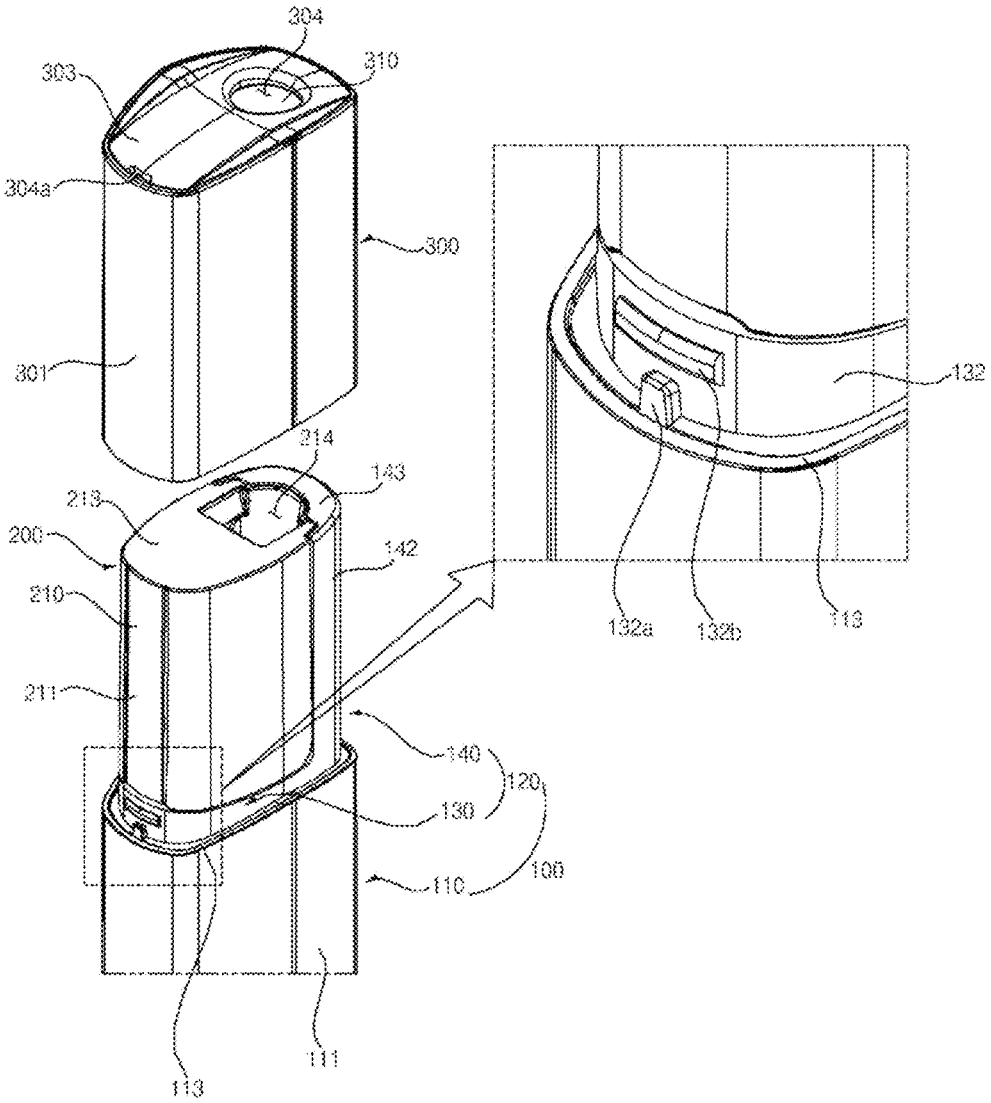

【FIG. 8】
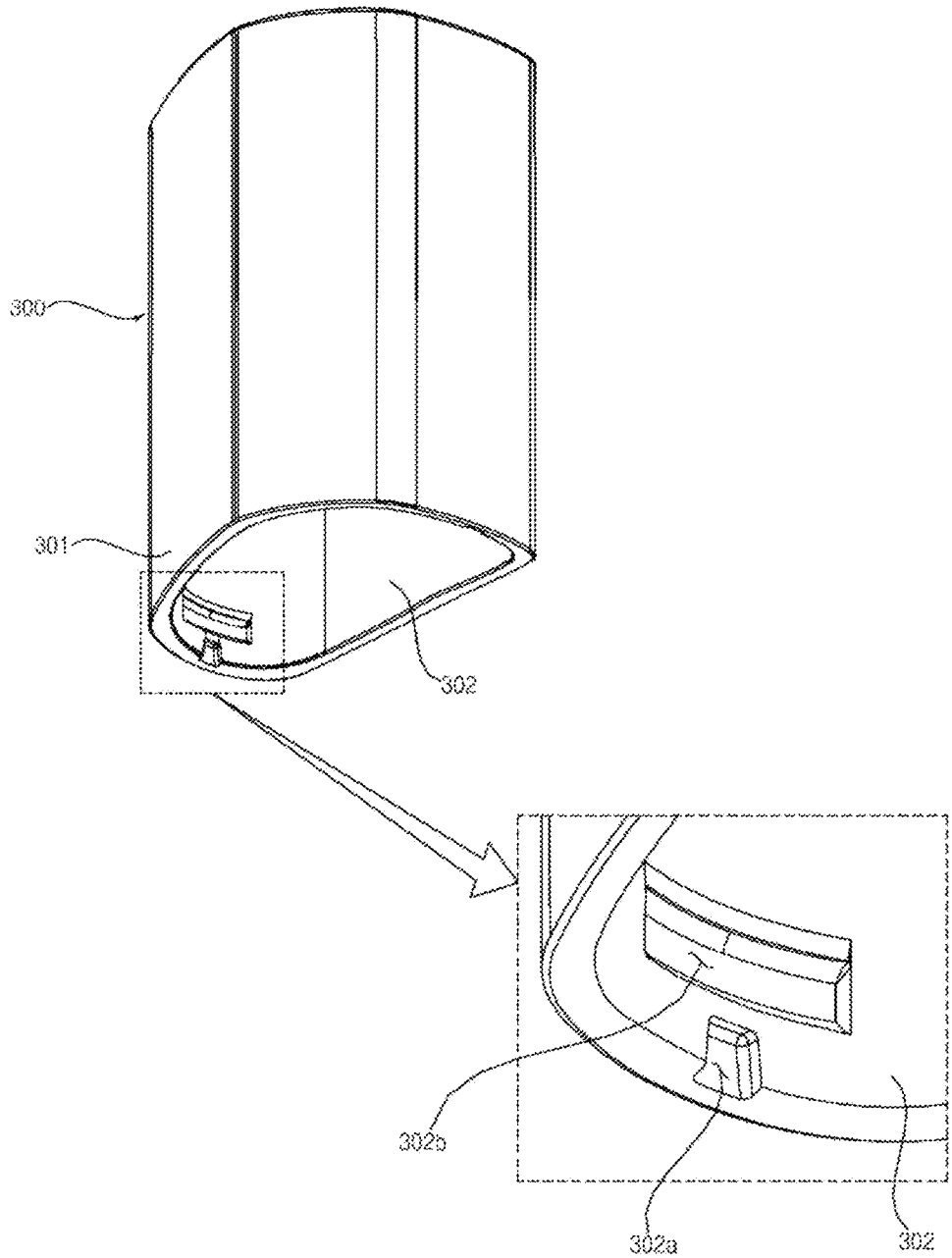

【FIG. 9】
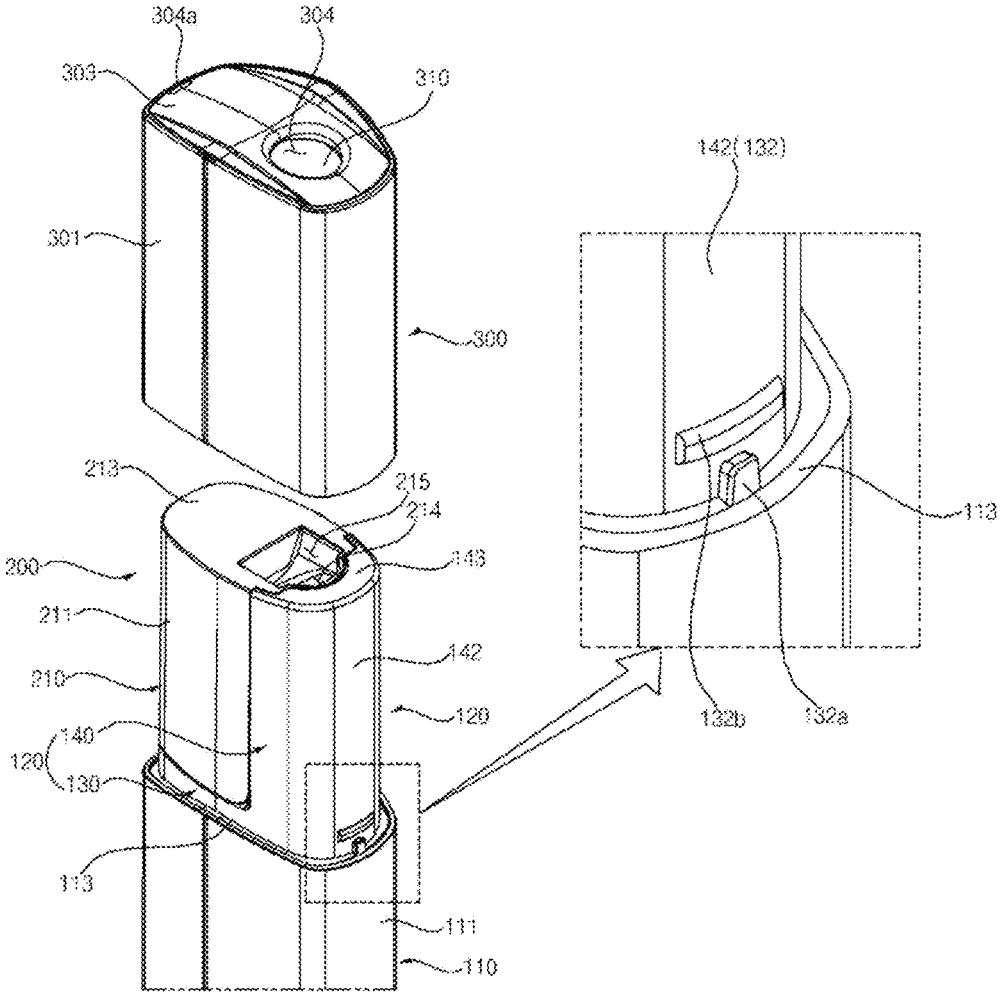

【FIG. 10】
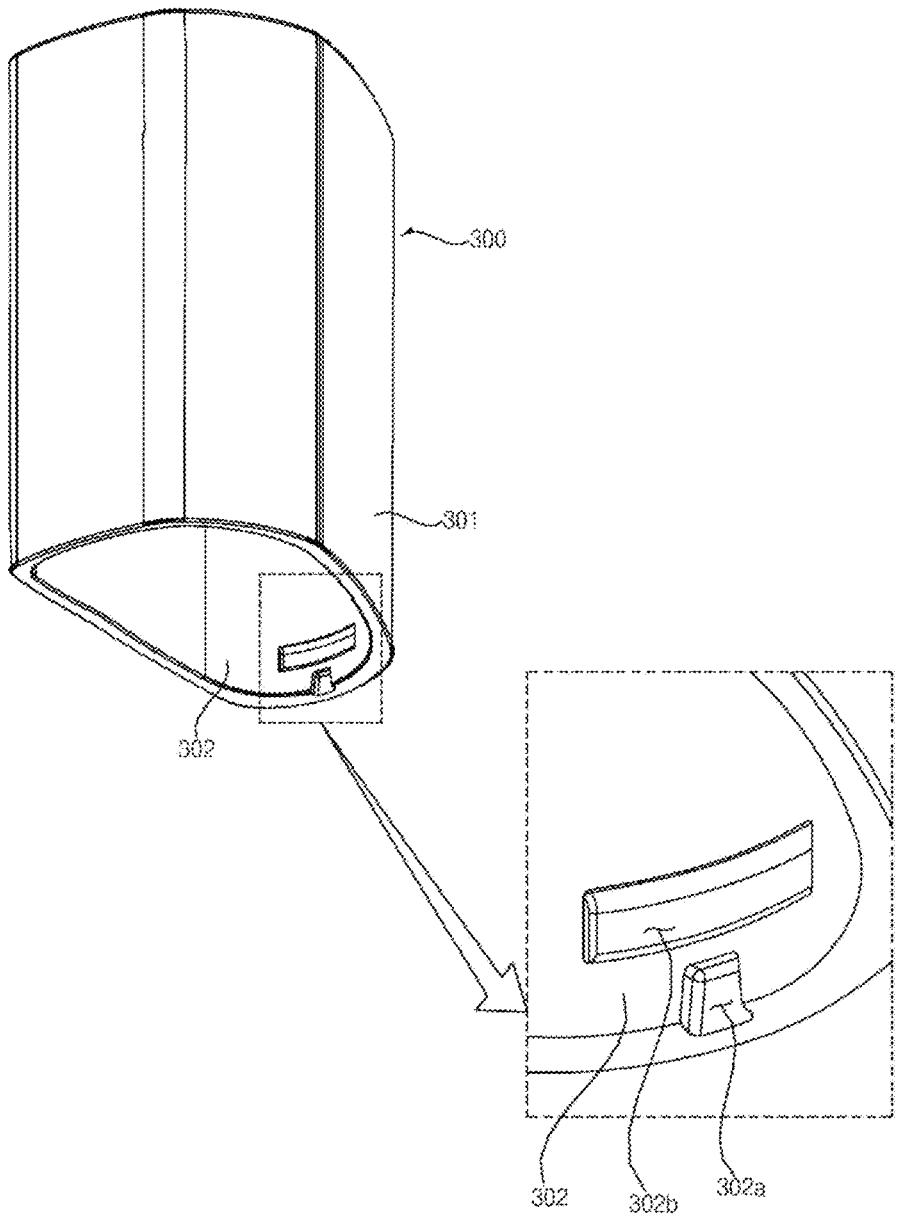

【FIG. 11】
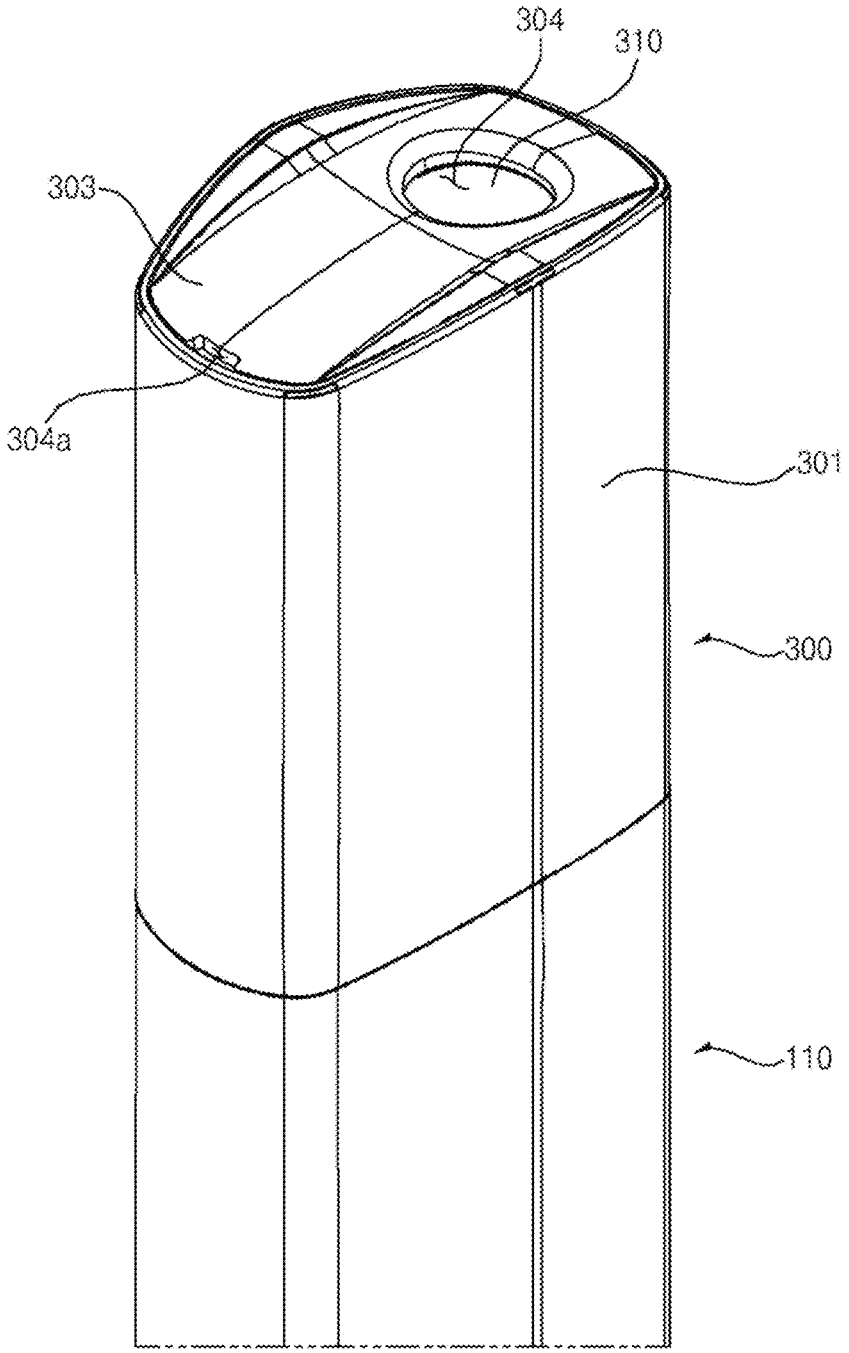

【FIG. 12】
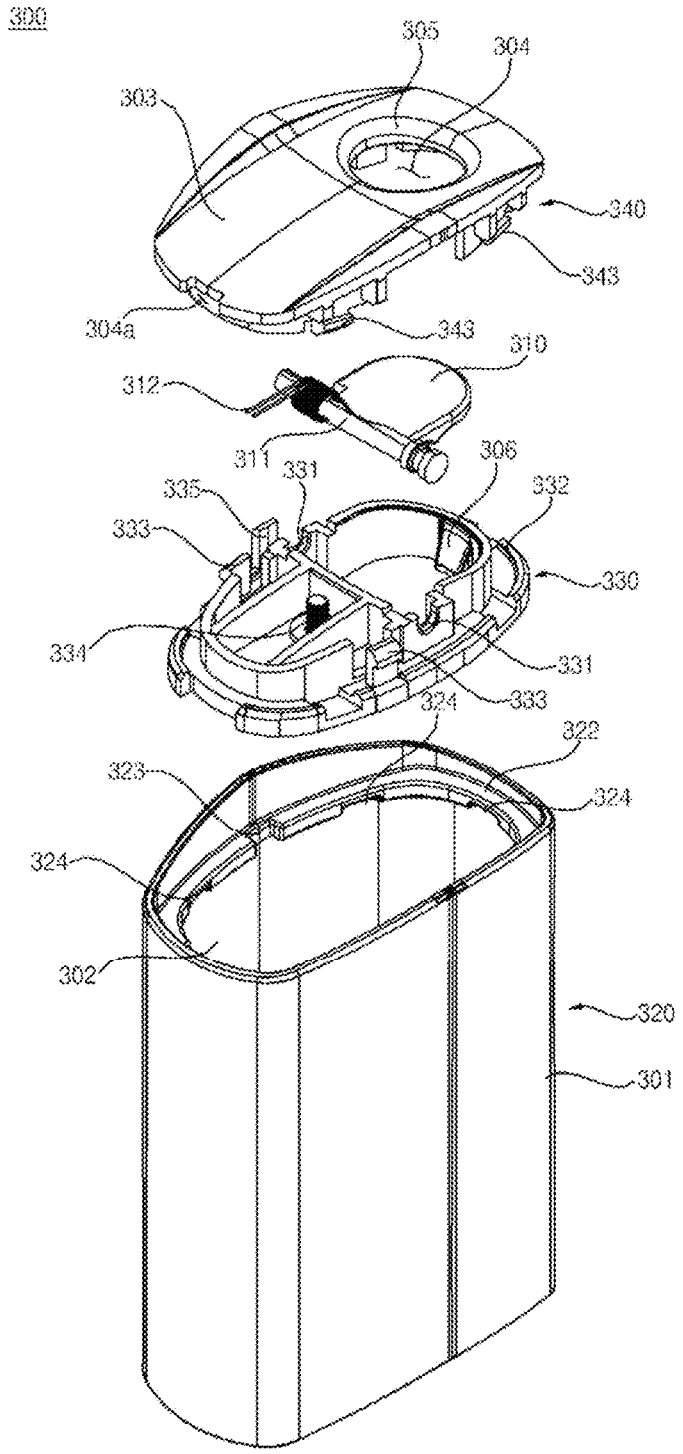

【FIG. 13】
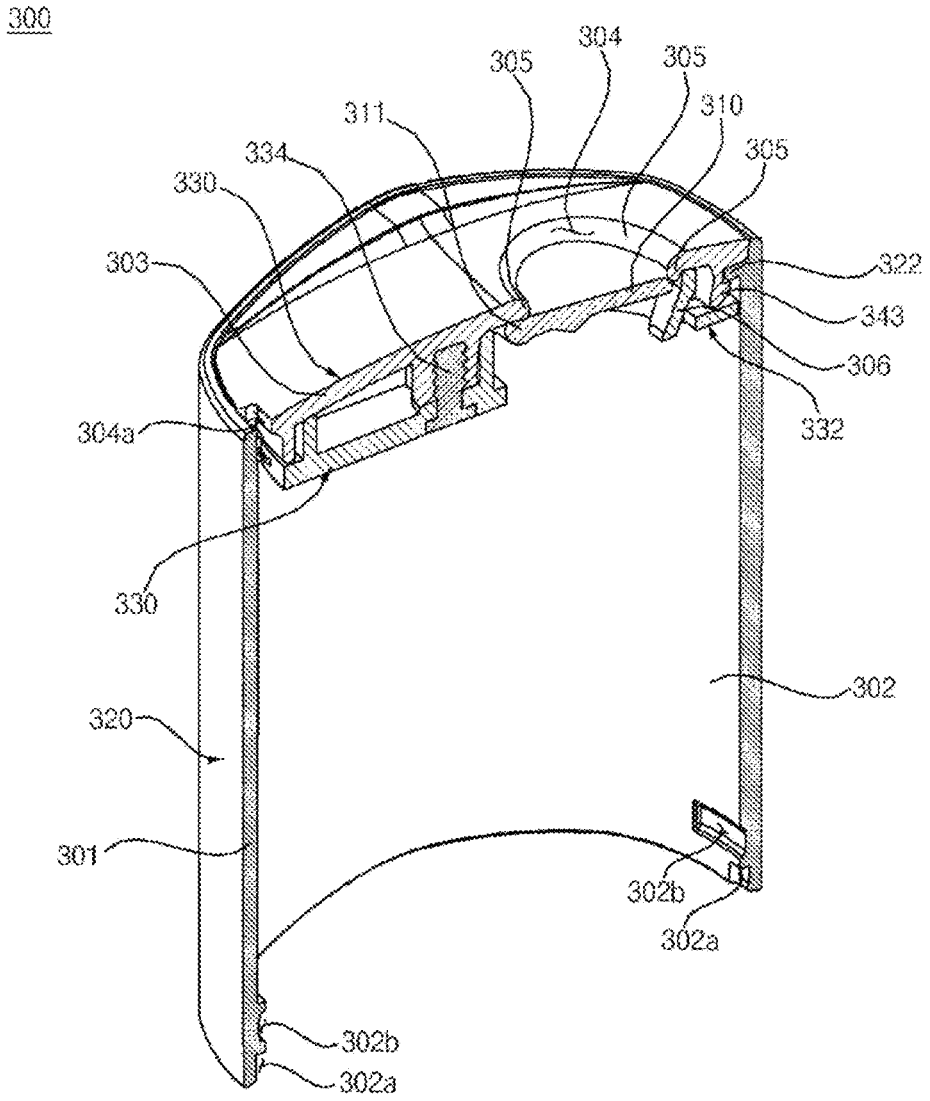

【FIG. 14】
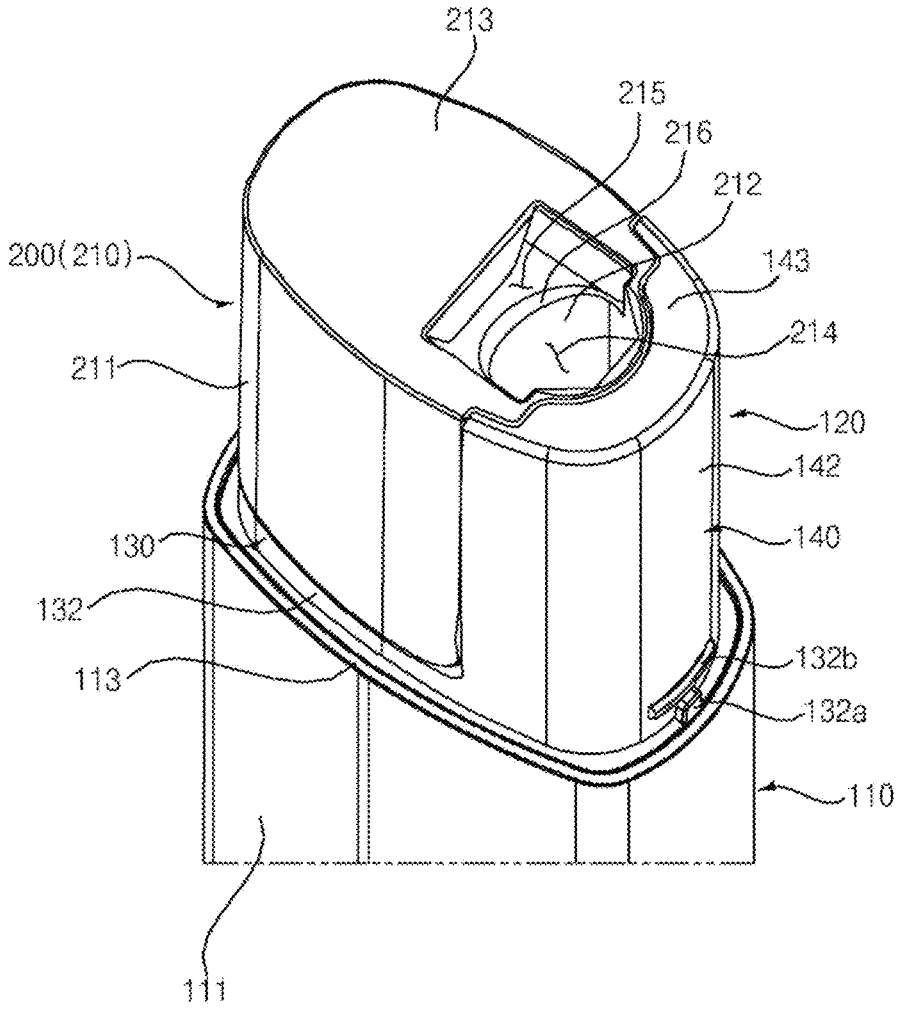

【FIG. 15】
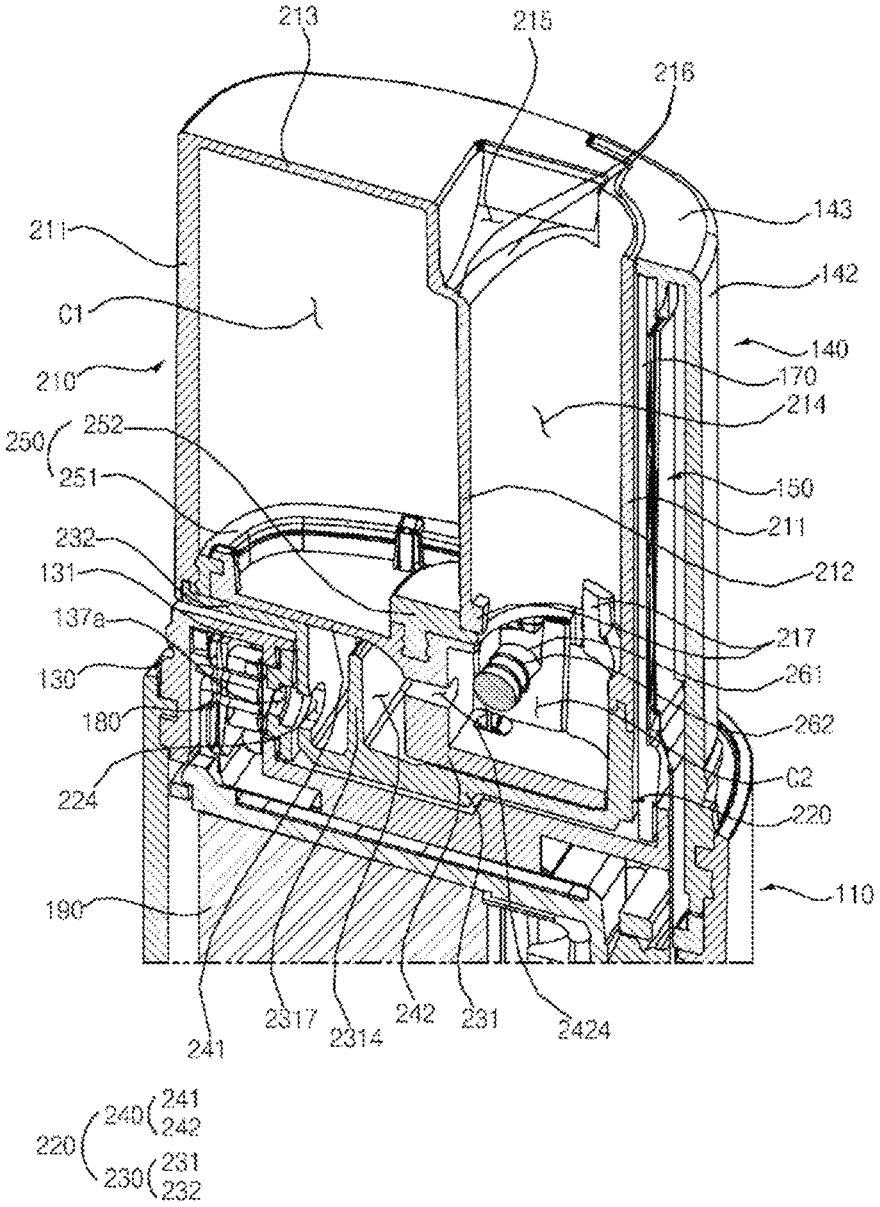

【FIG. 16】
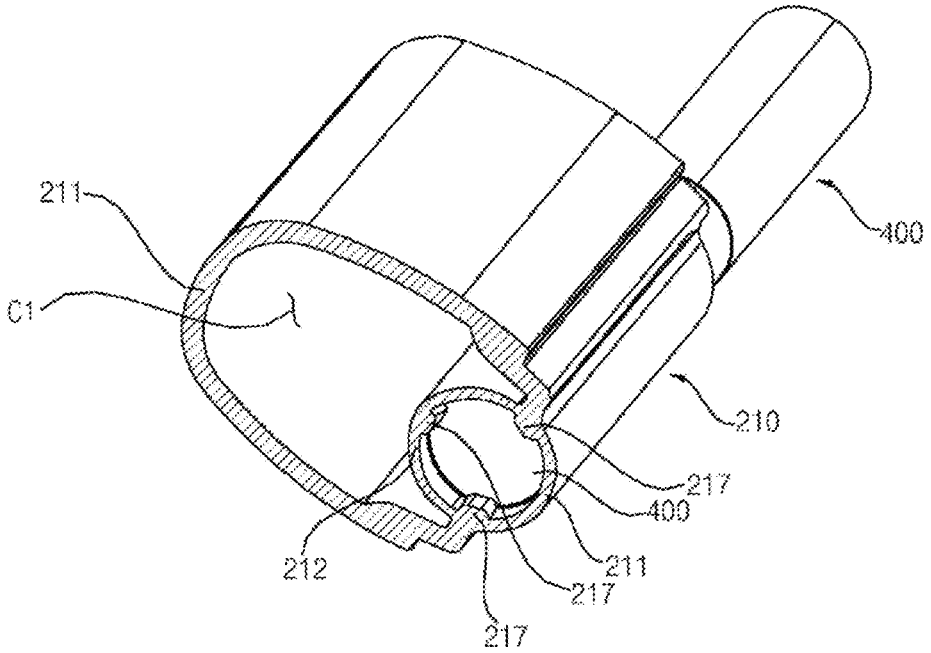

【FIG. 17】
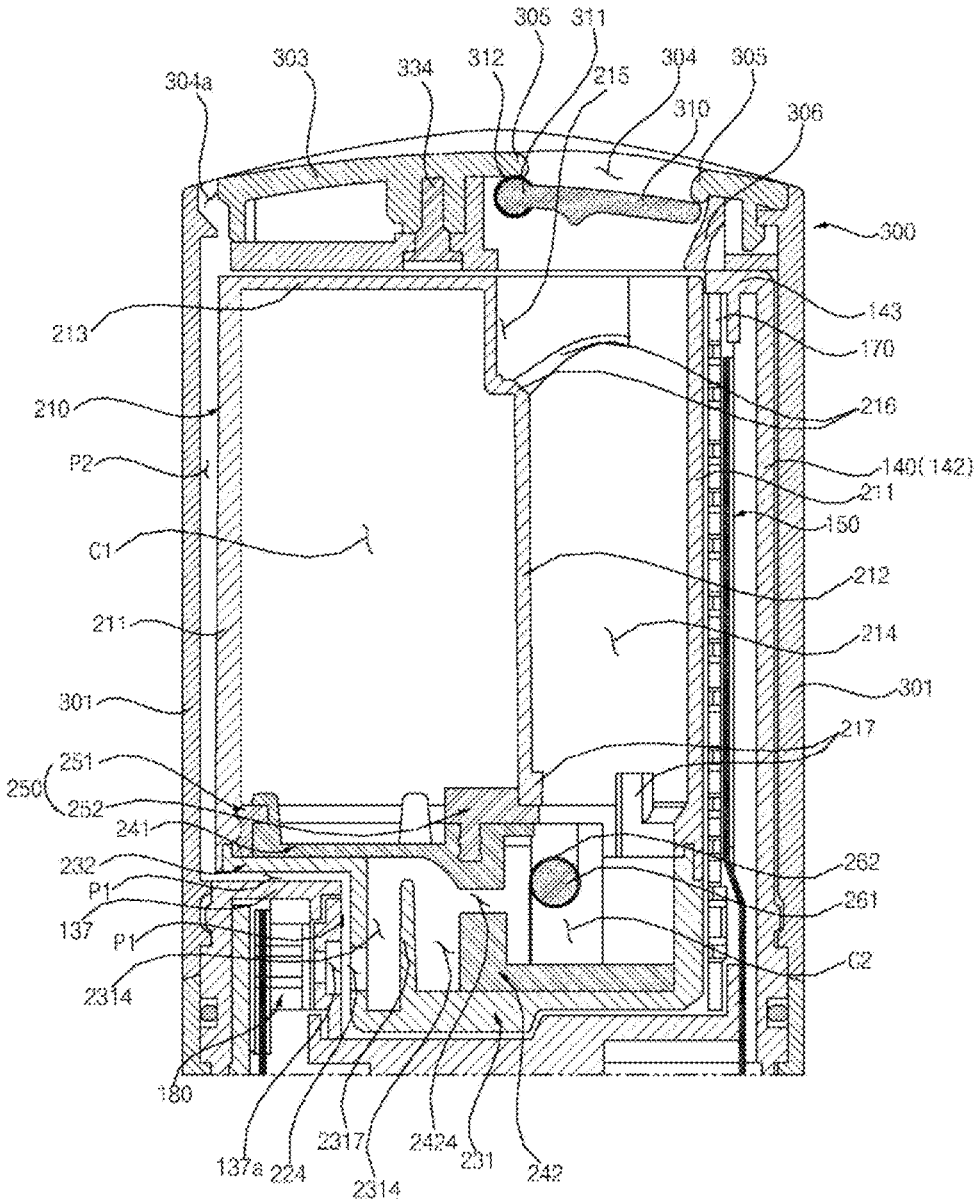

【FIG. 18】
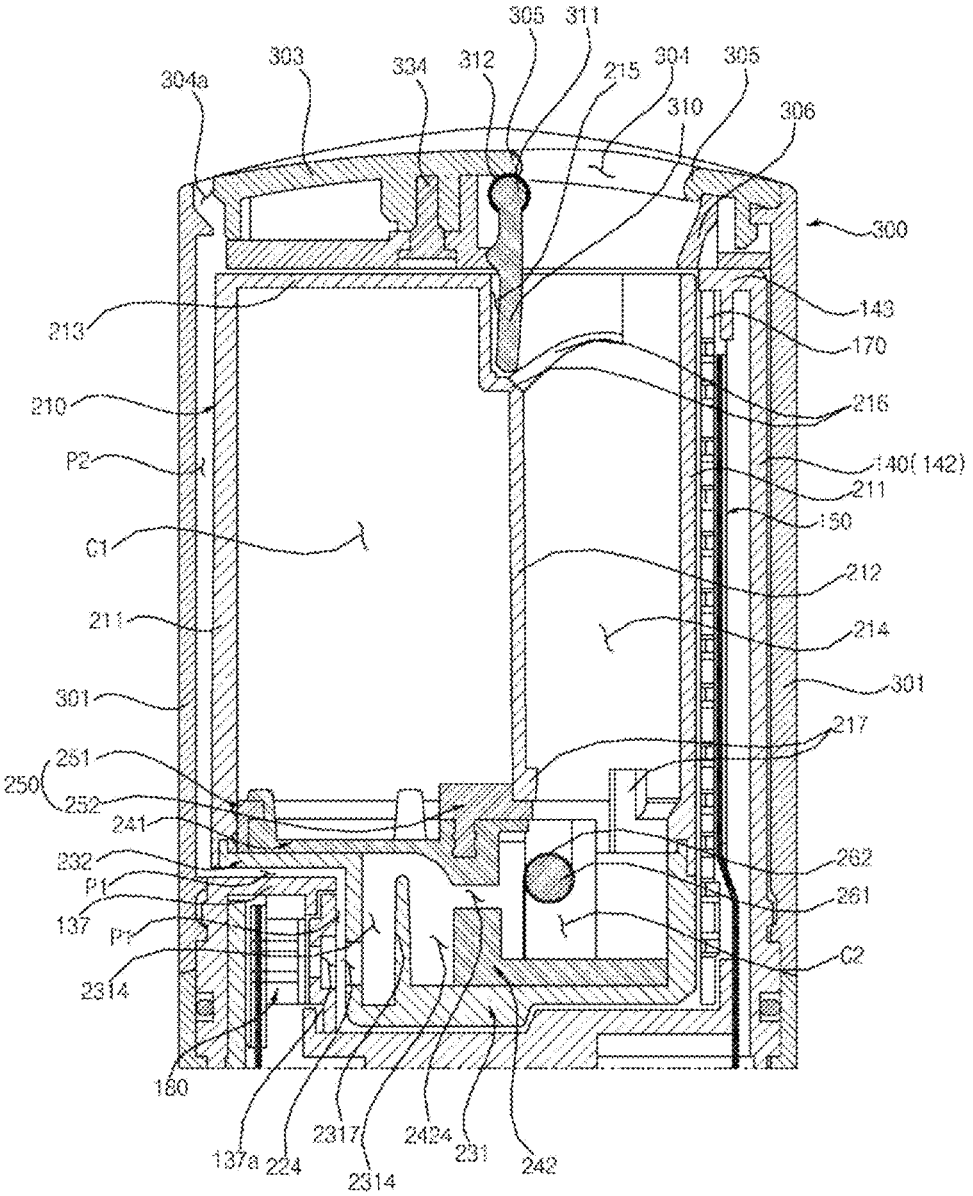

【FIG. 19】
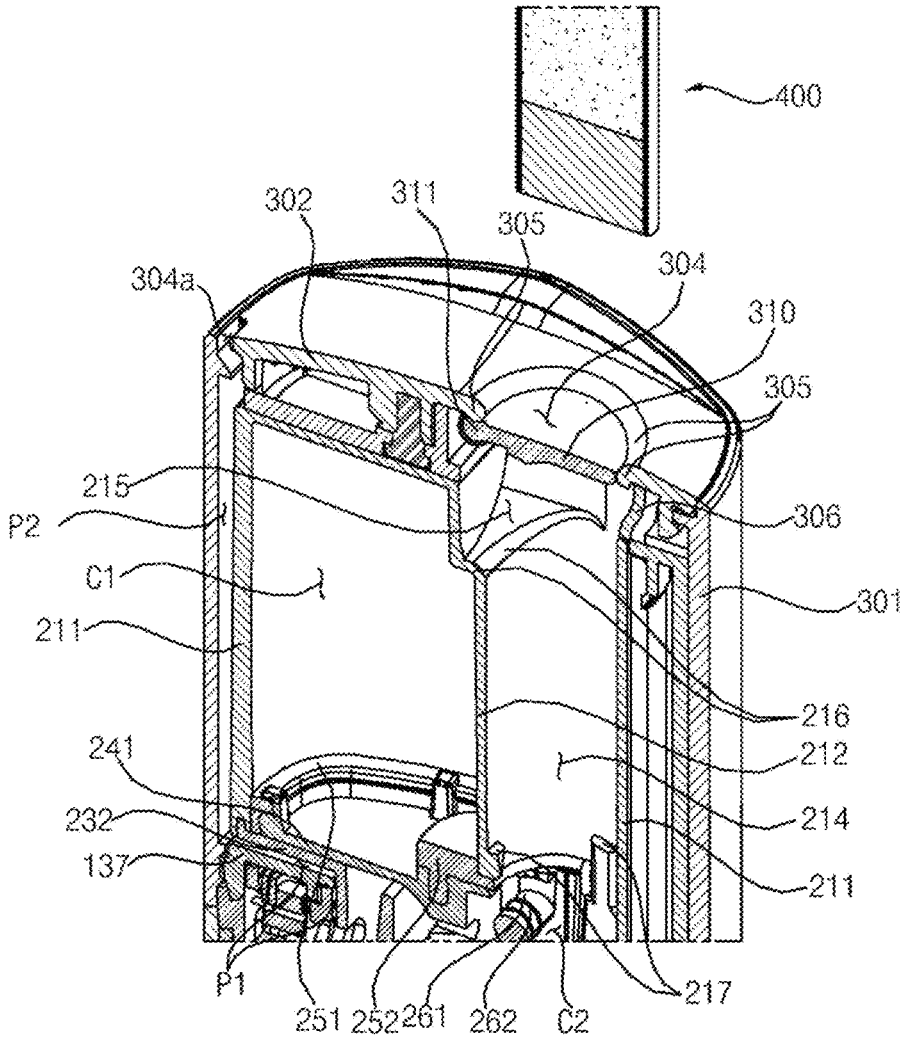

【FIG. 20】
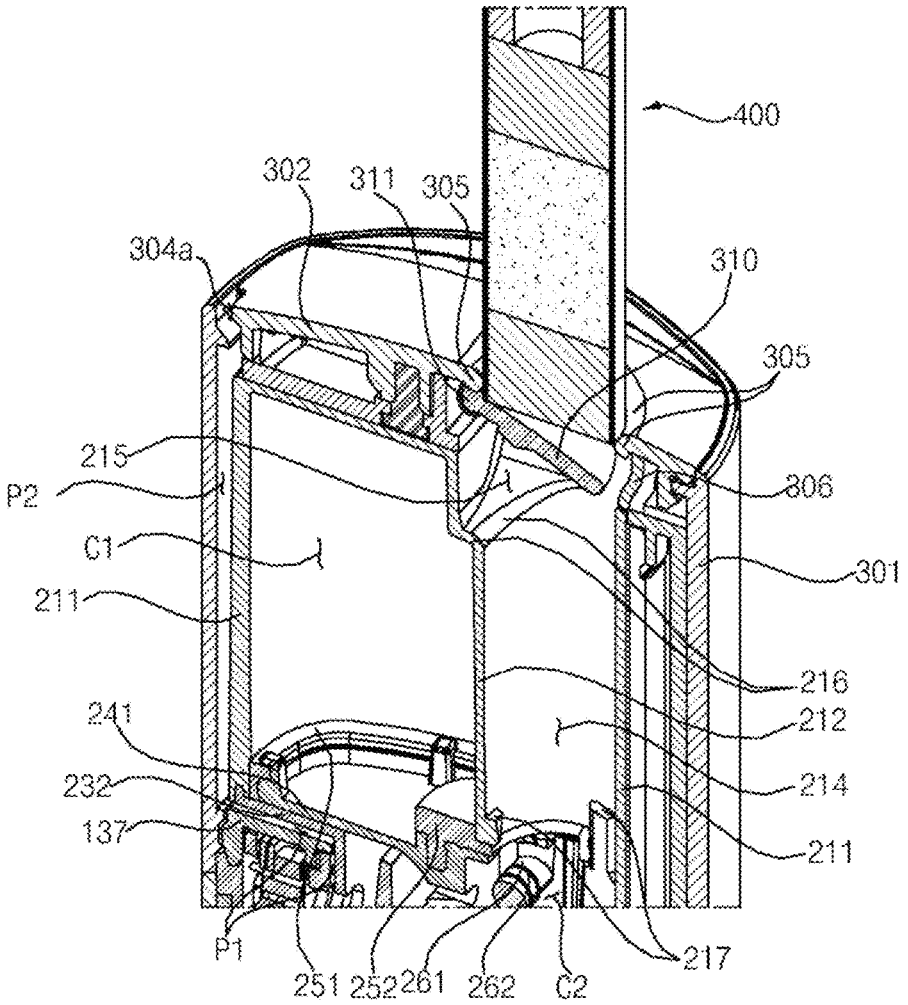

【FIG. 21】
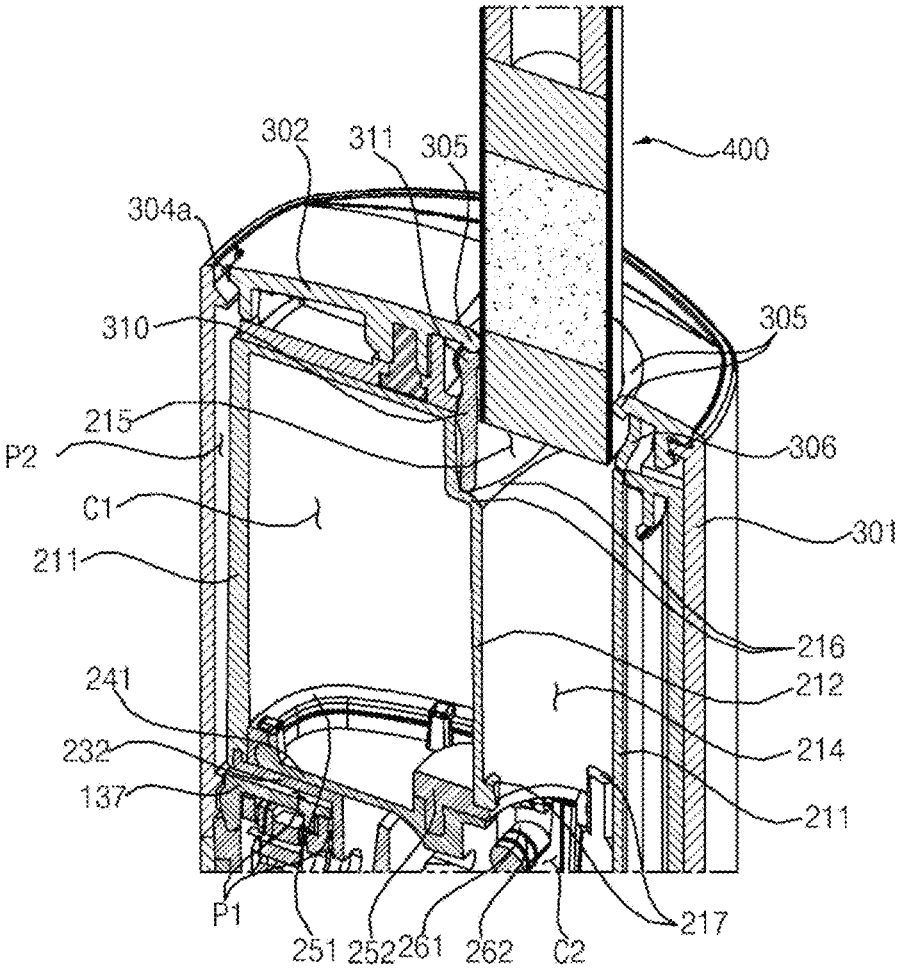

【FIG. 22】
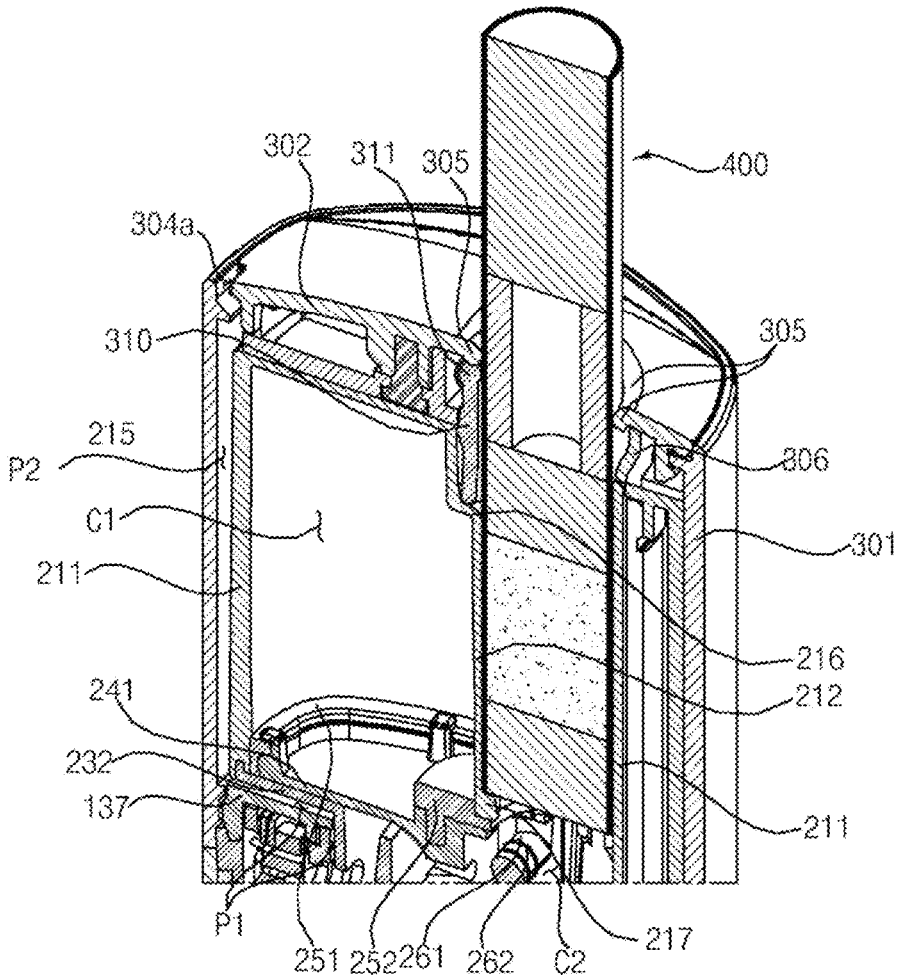

【FIG. 23】
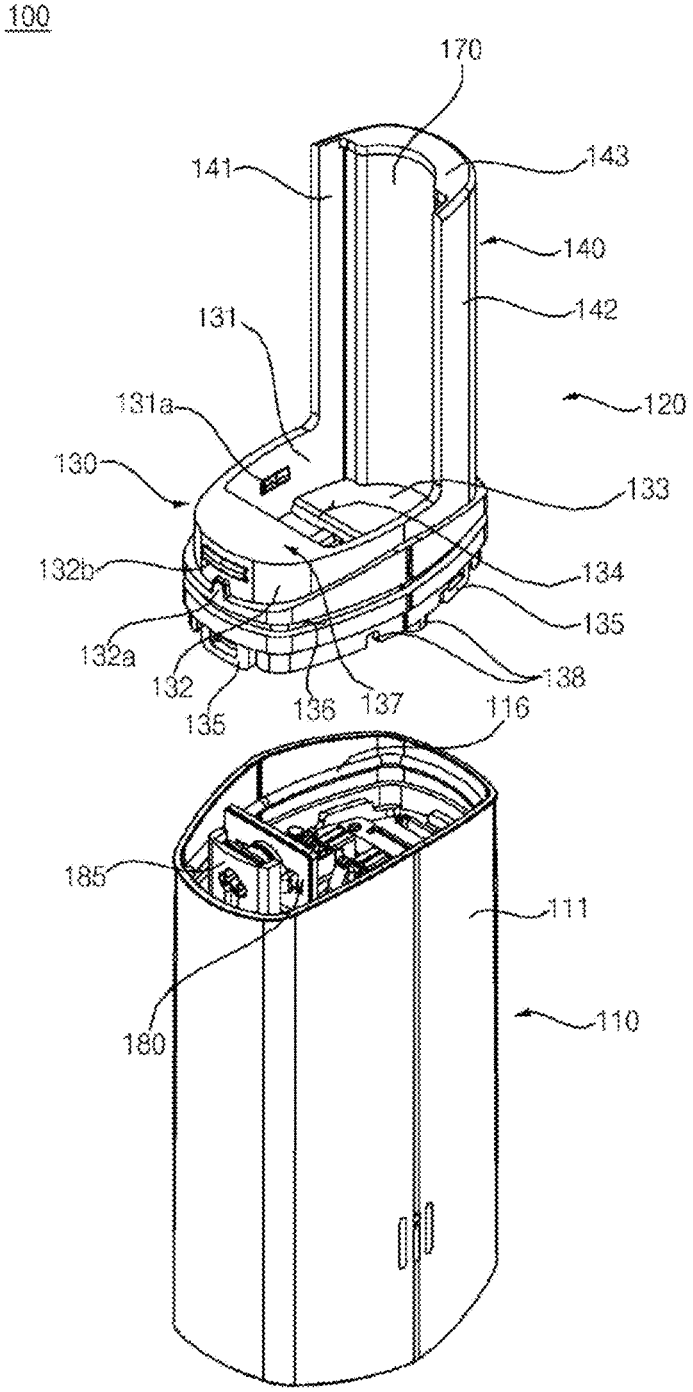

【FIG. 24】
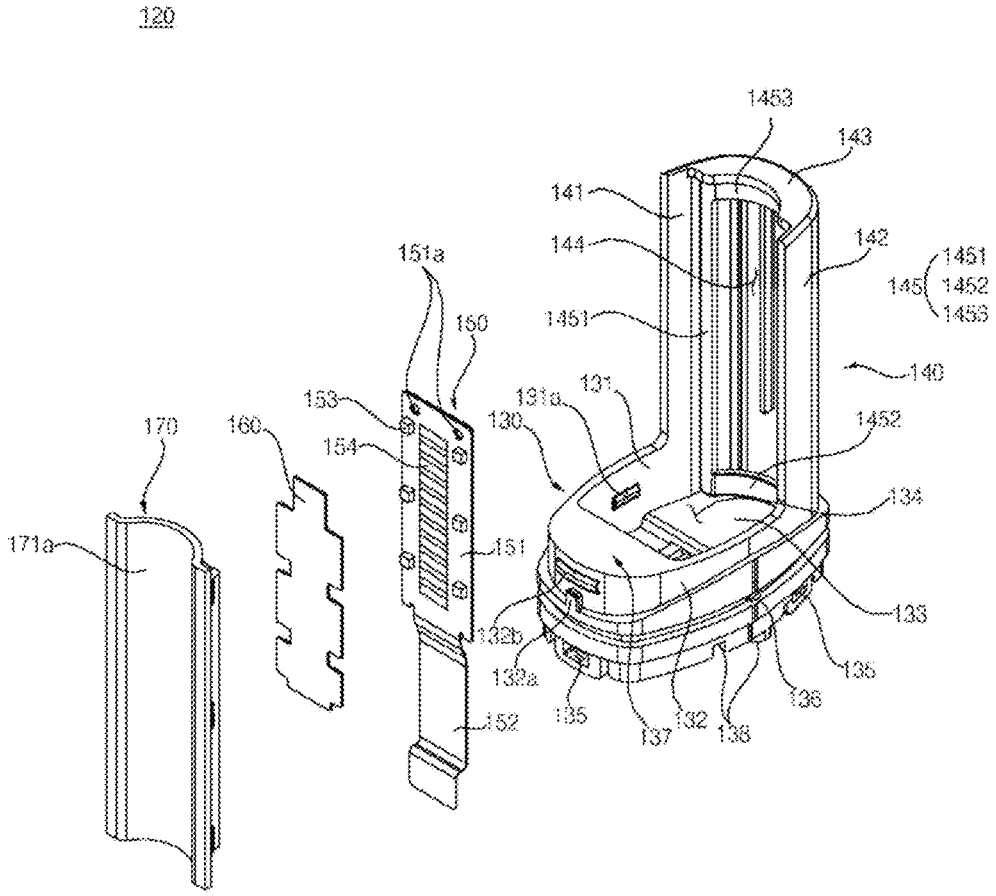

【FIG. 25】
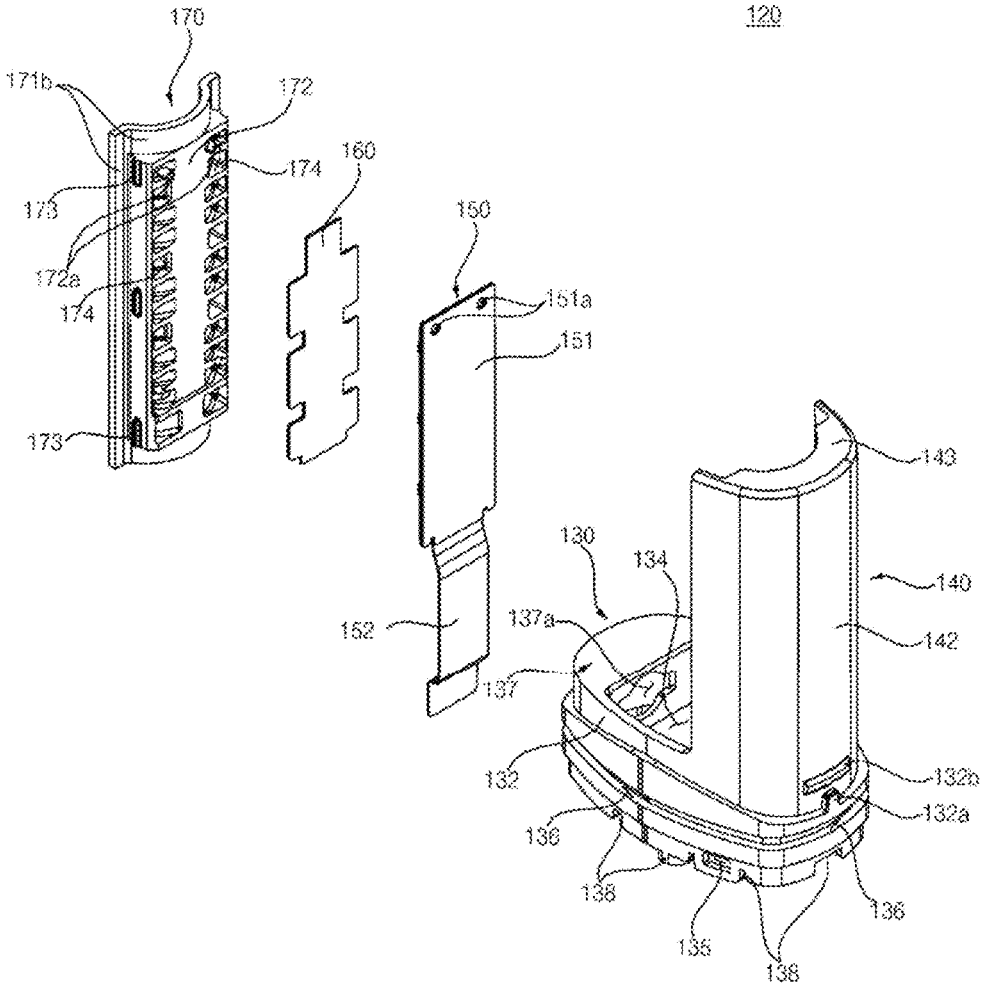

【FIG. 26】
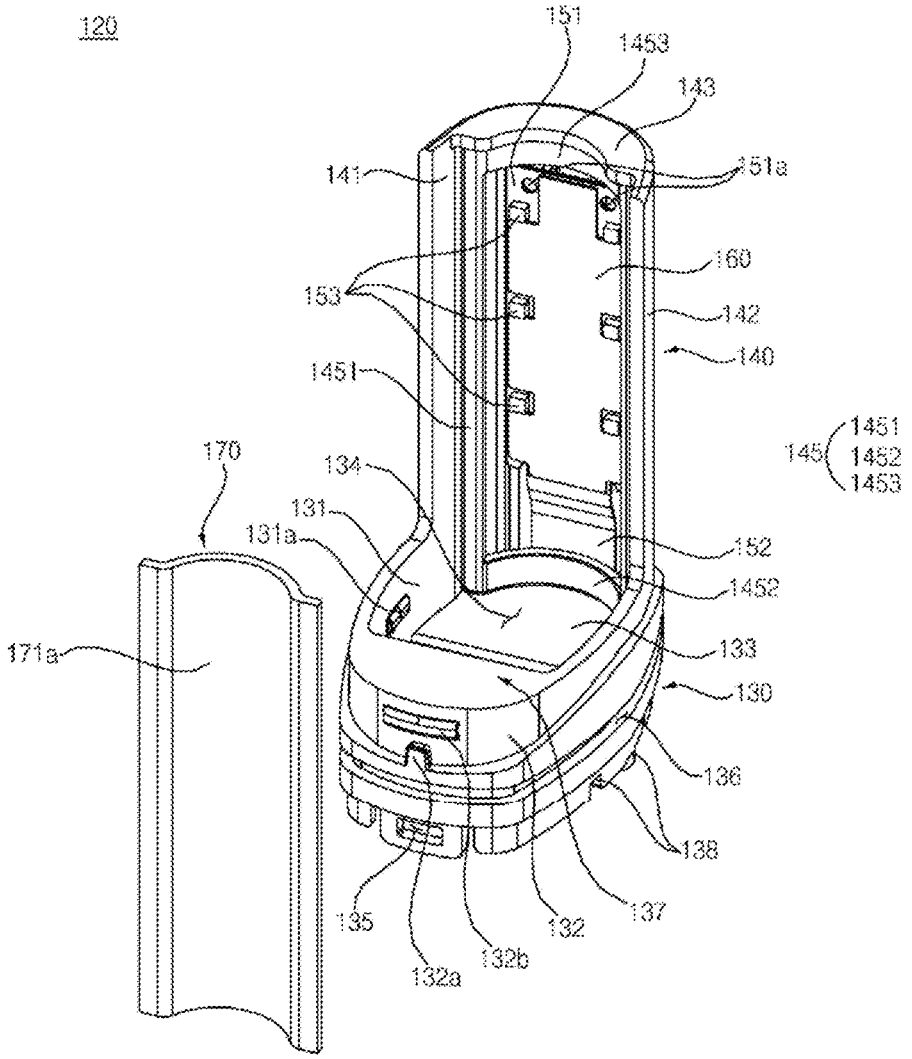

【FIG. 27】
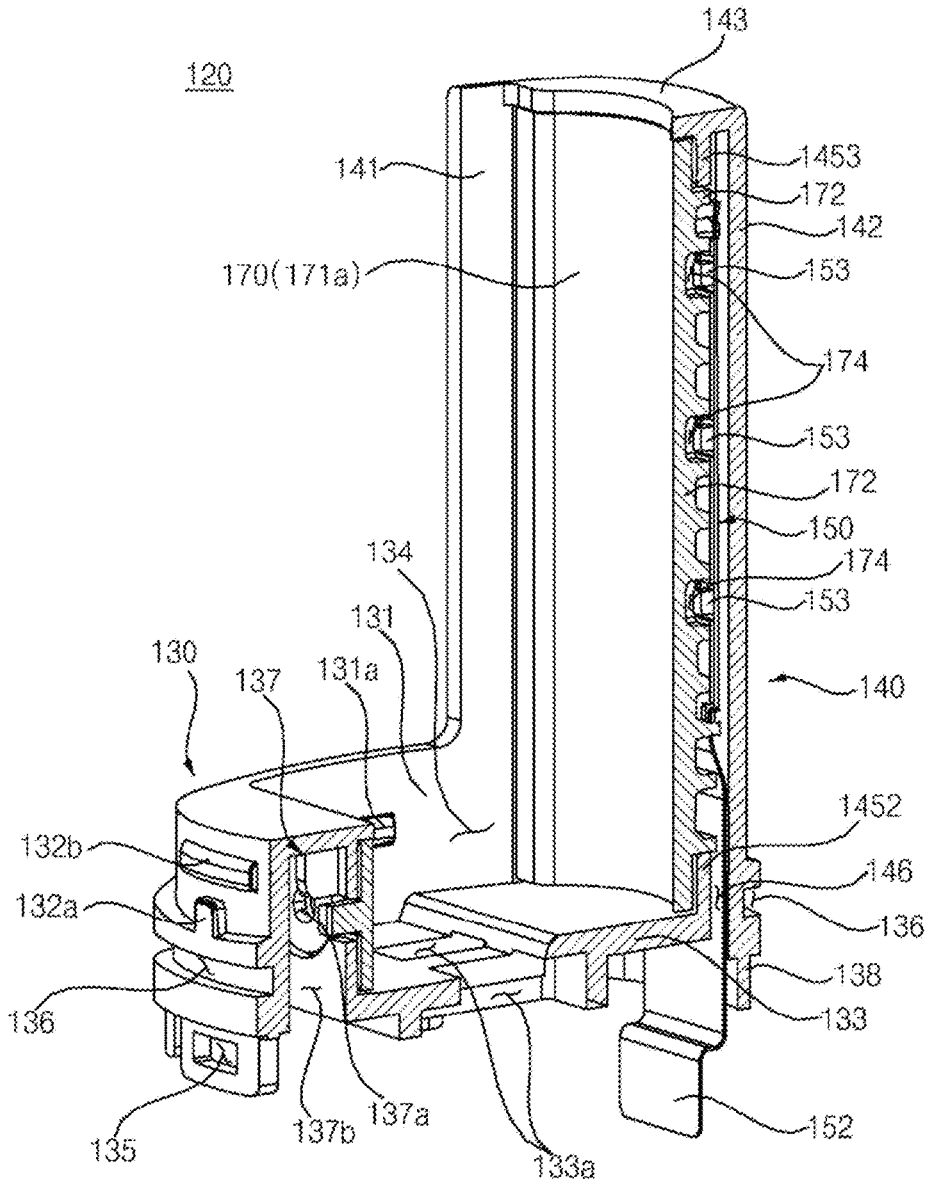

【FIG. 28】
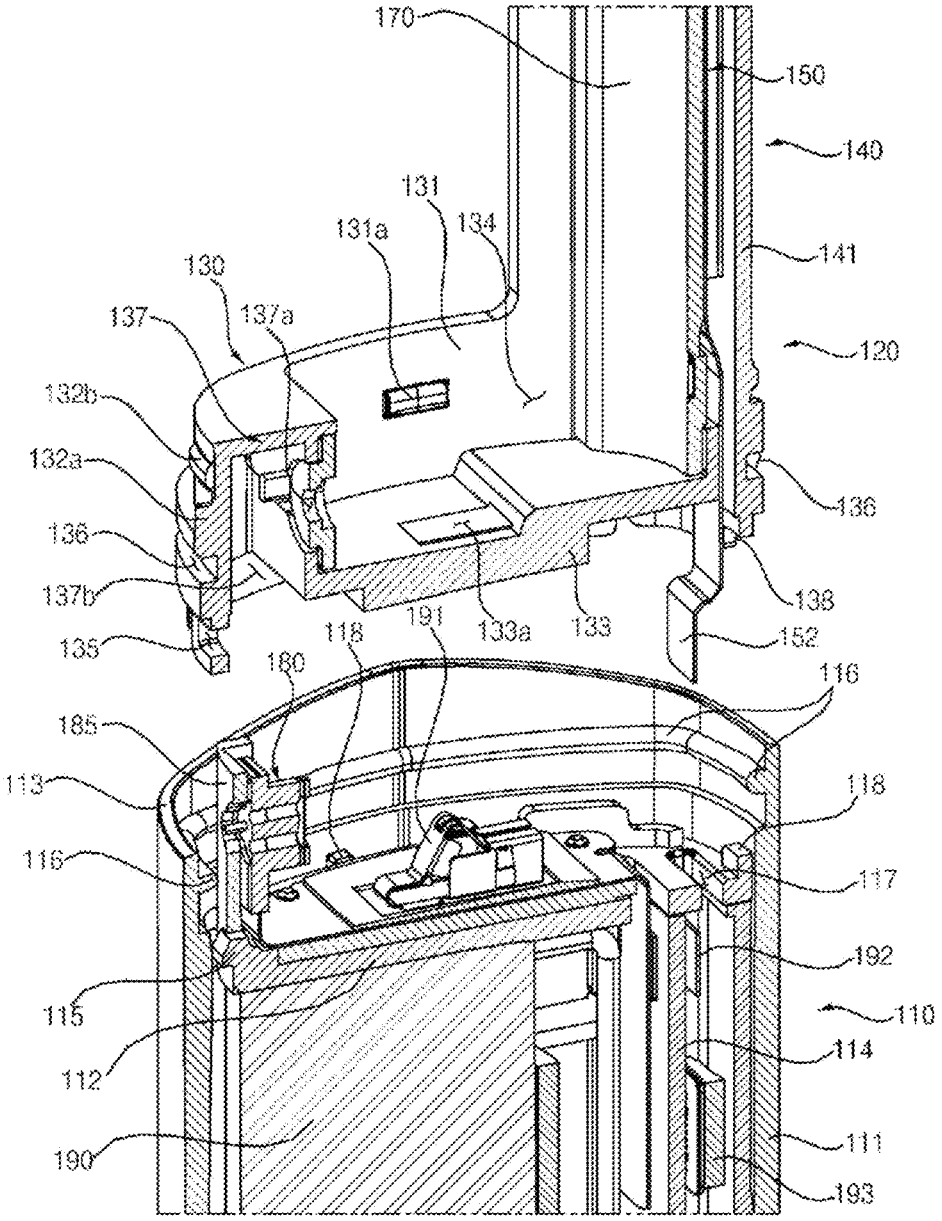

【FIG. 29】
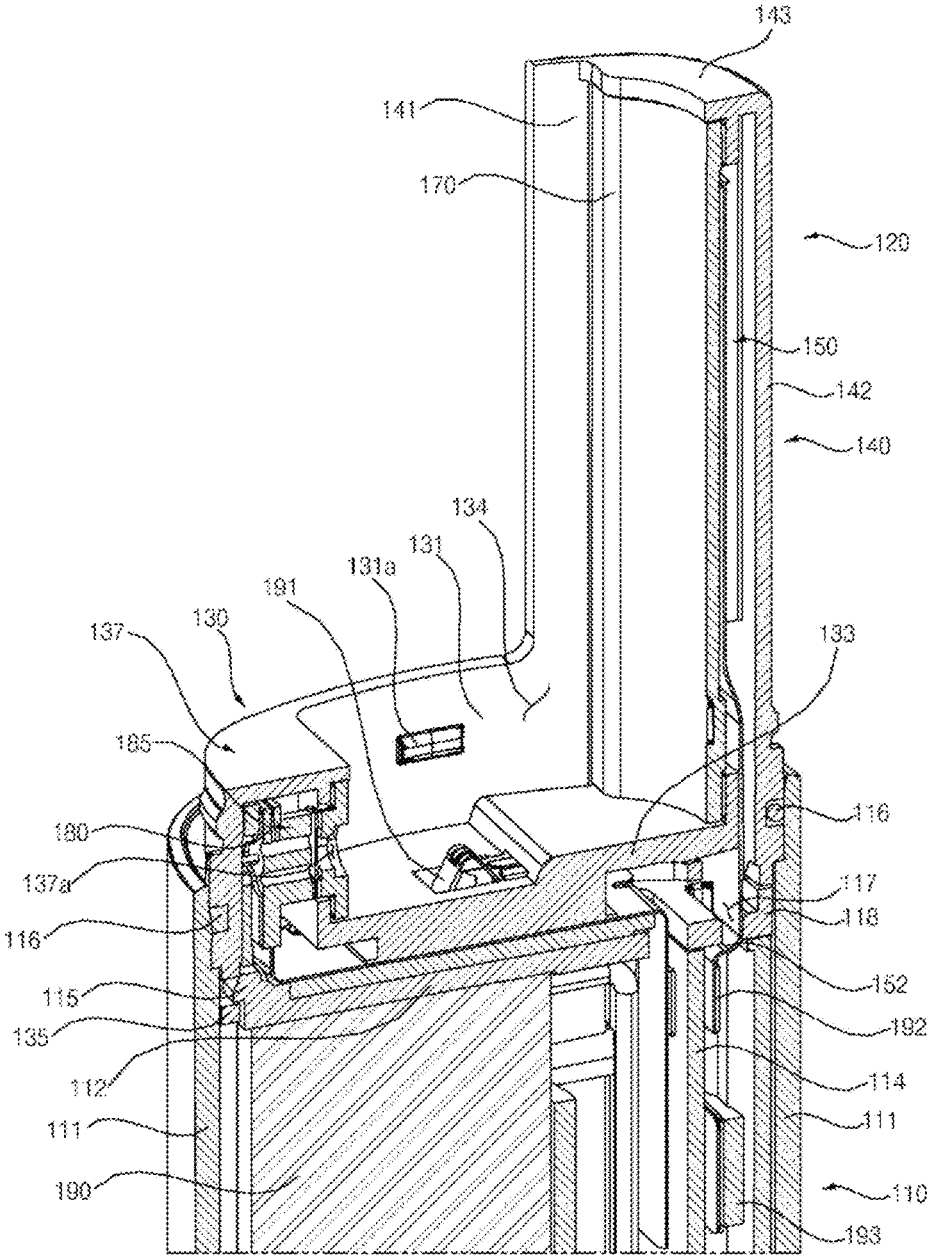

【FIG. 30】
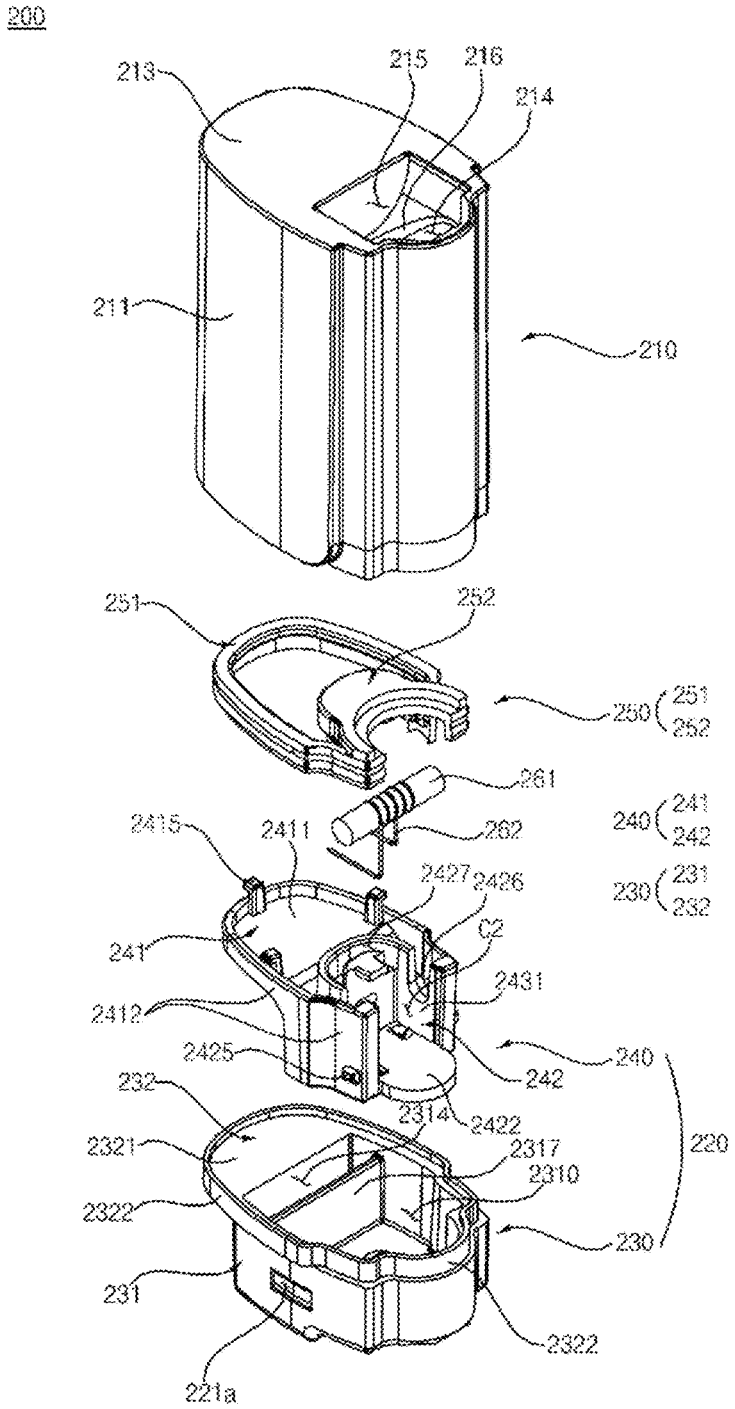

【FIG. 31】
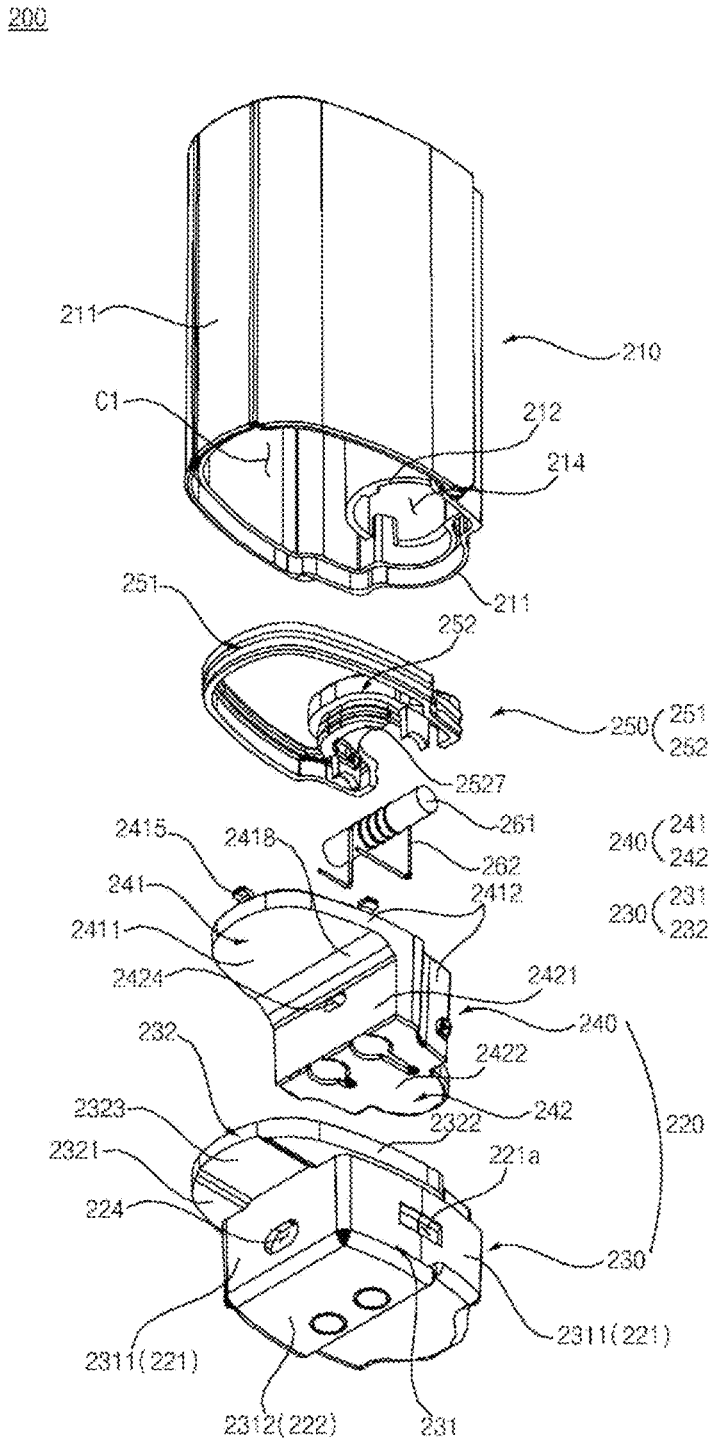

【FIG. 32】
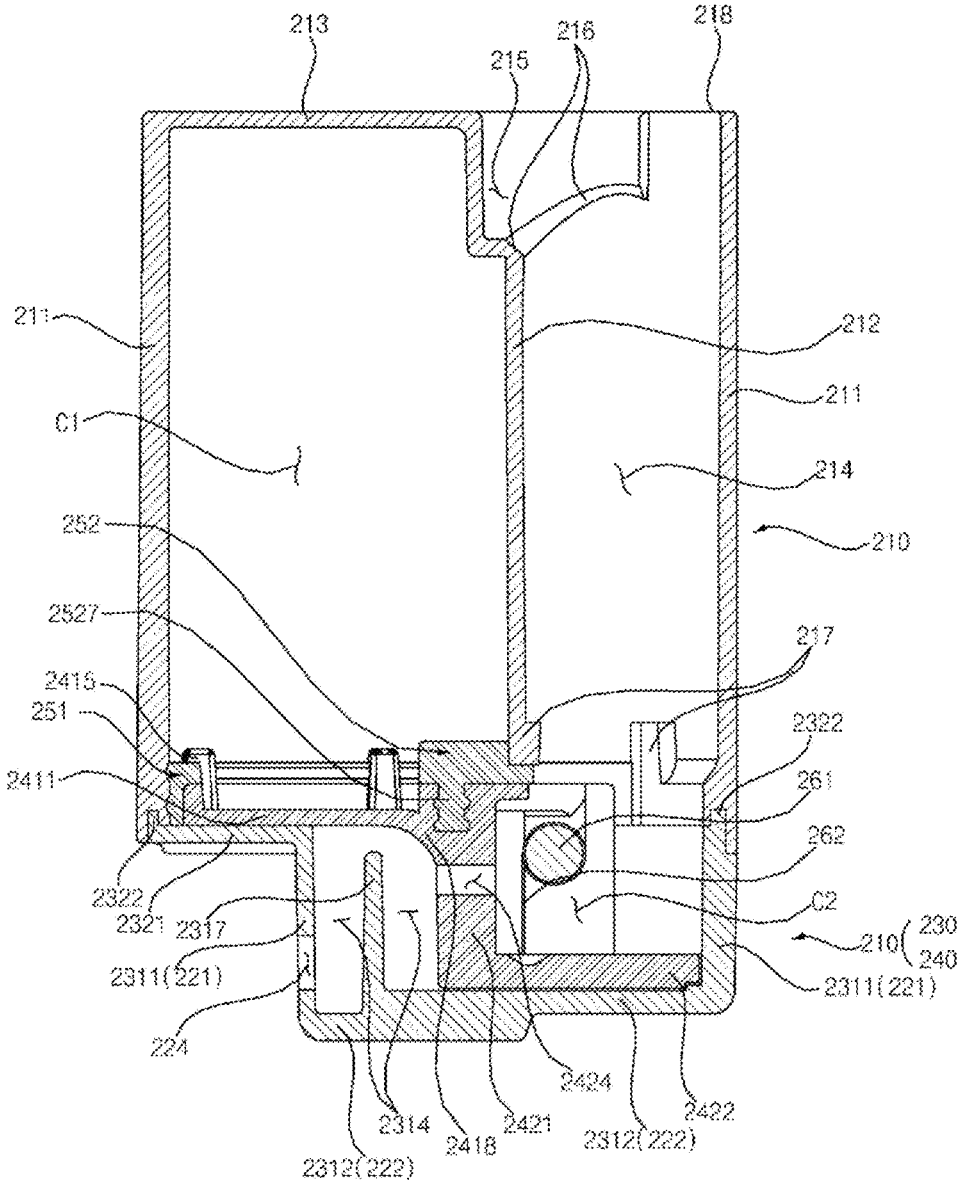

【FIG. 33】
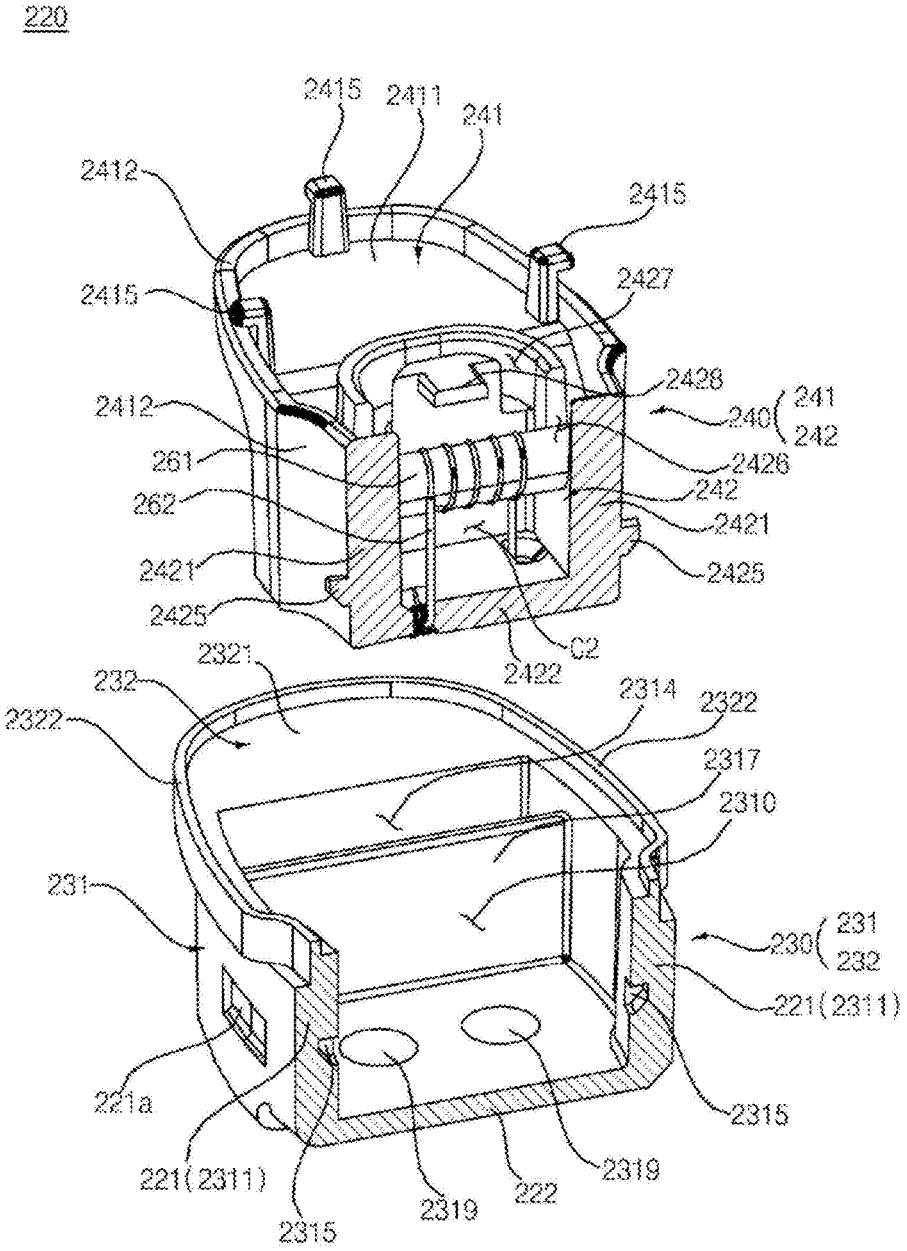

【FIG. 34】
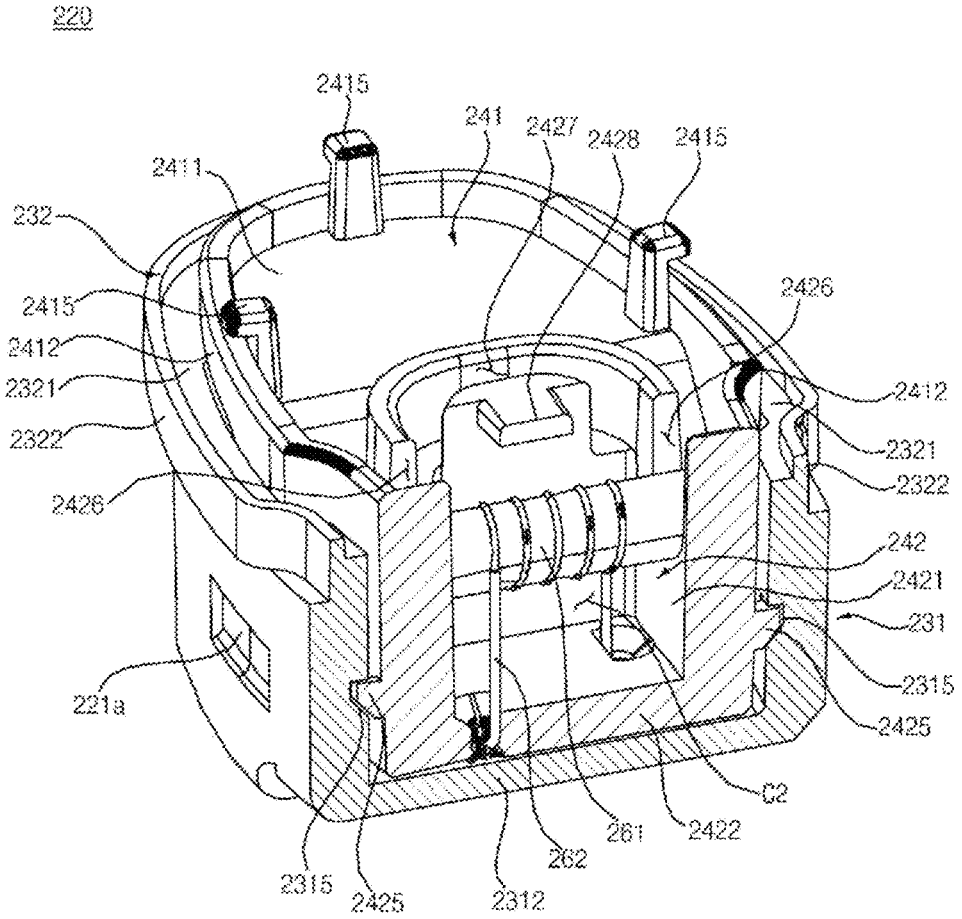

【FIG. 35】
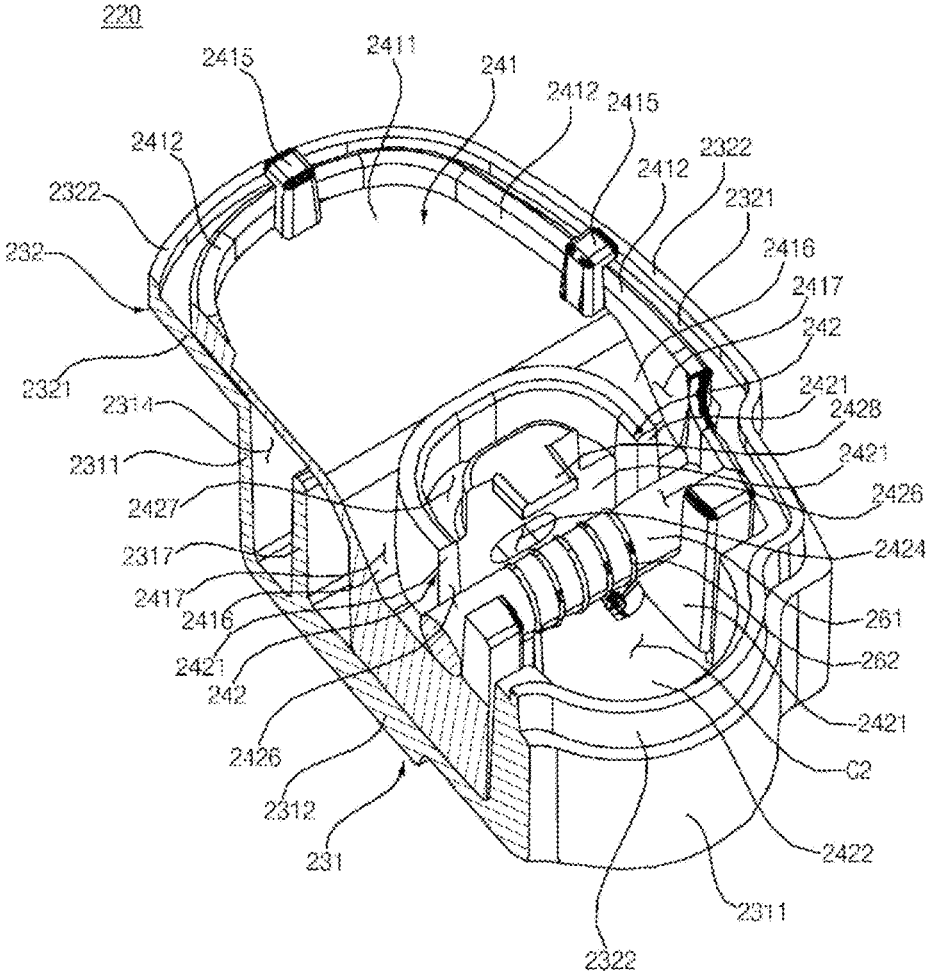

【FIG. 36】
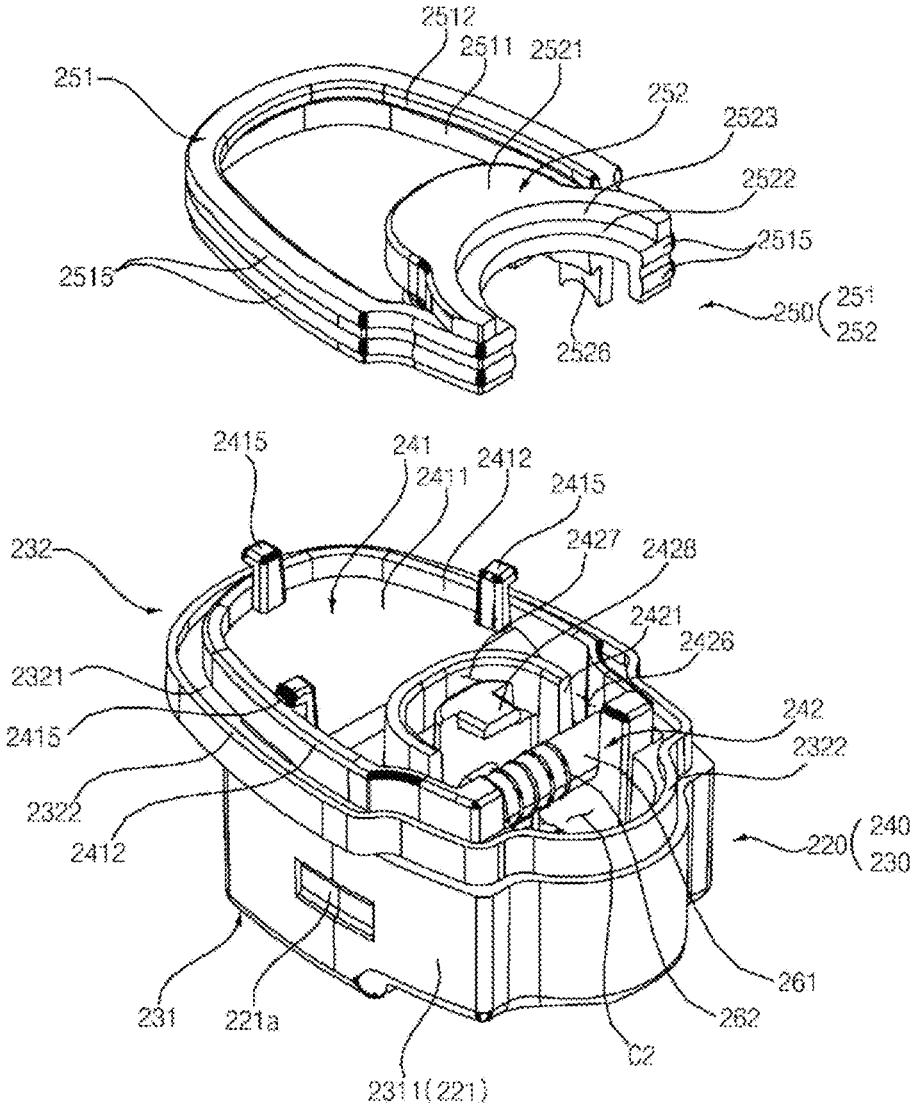

【FIG. 37】
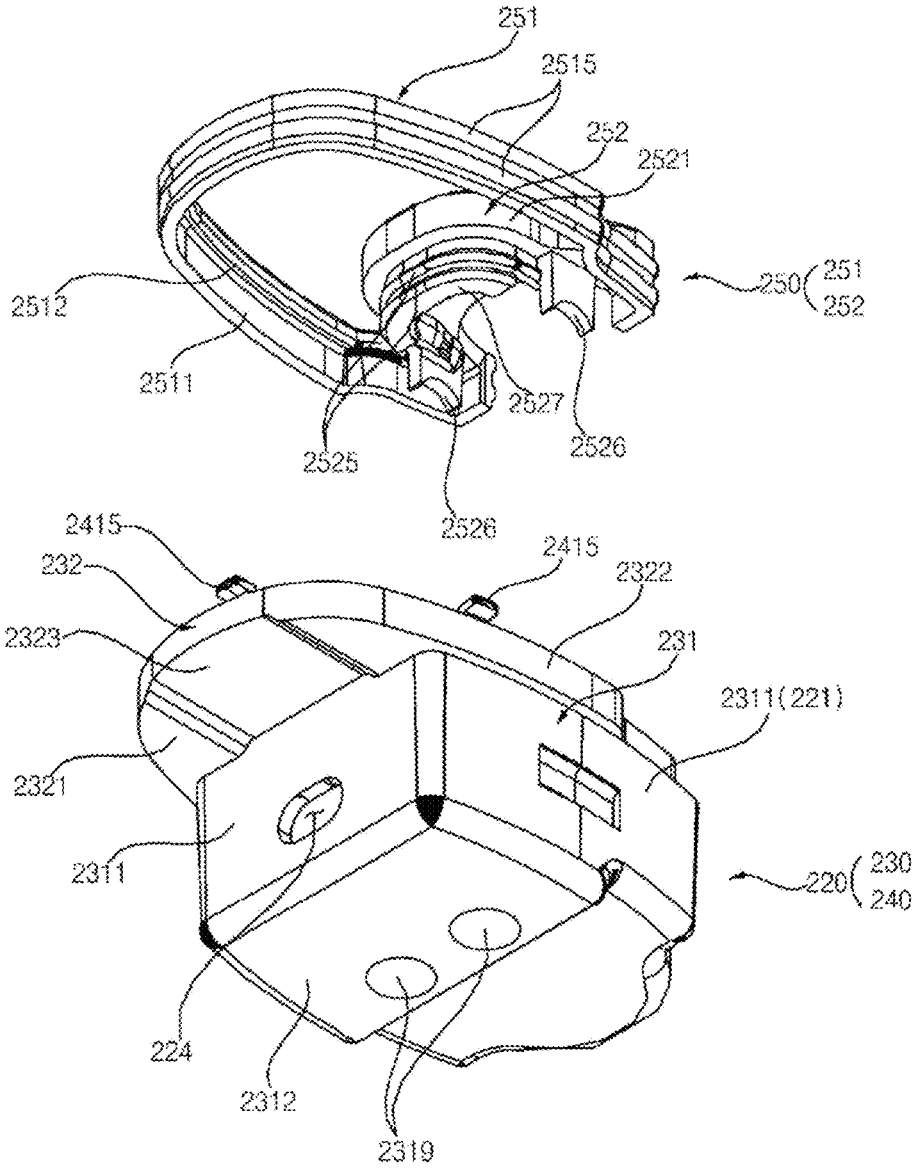

【FIG. 38】
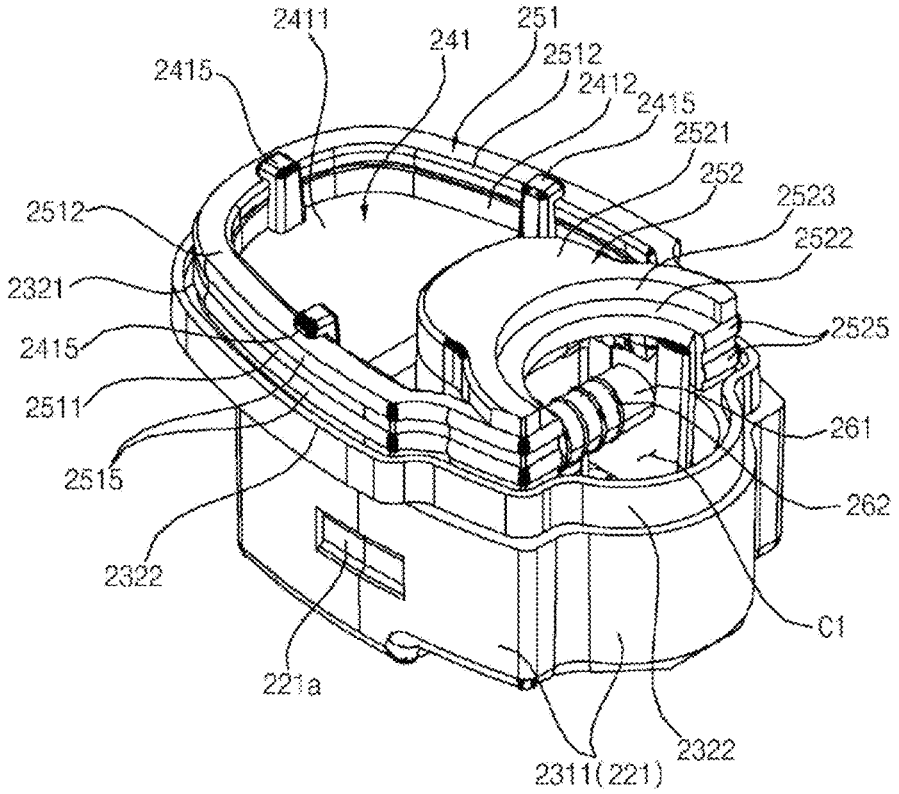

【FIG. 39】
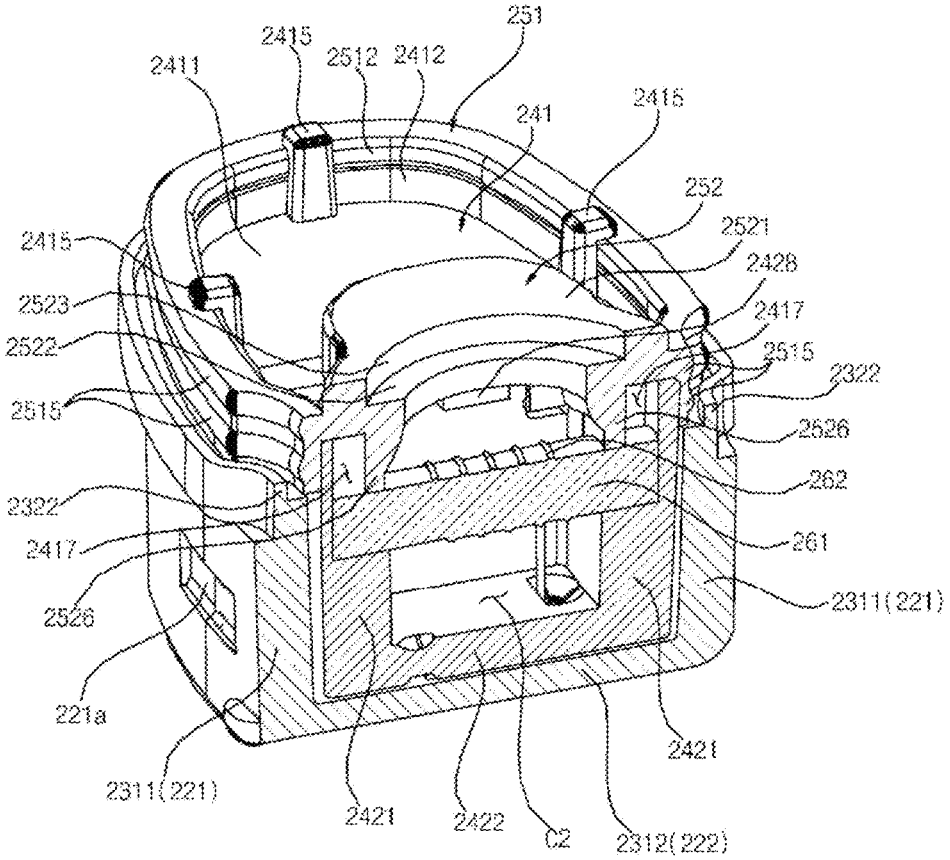

【FIG. 40】
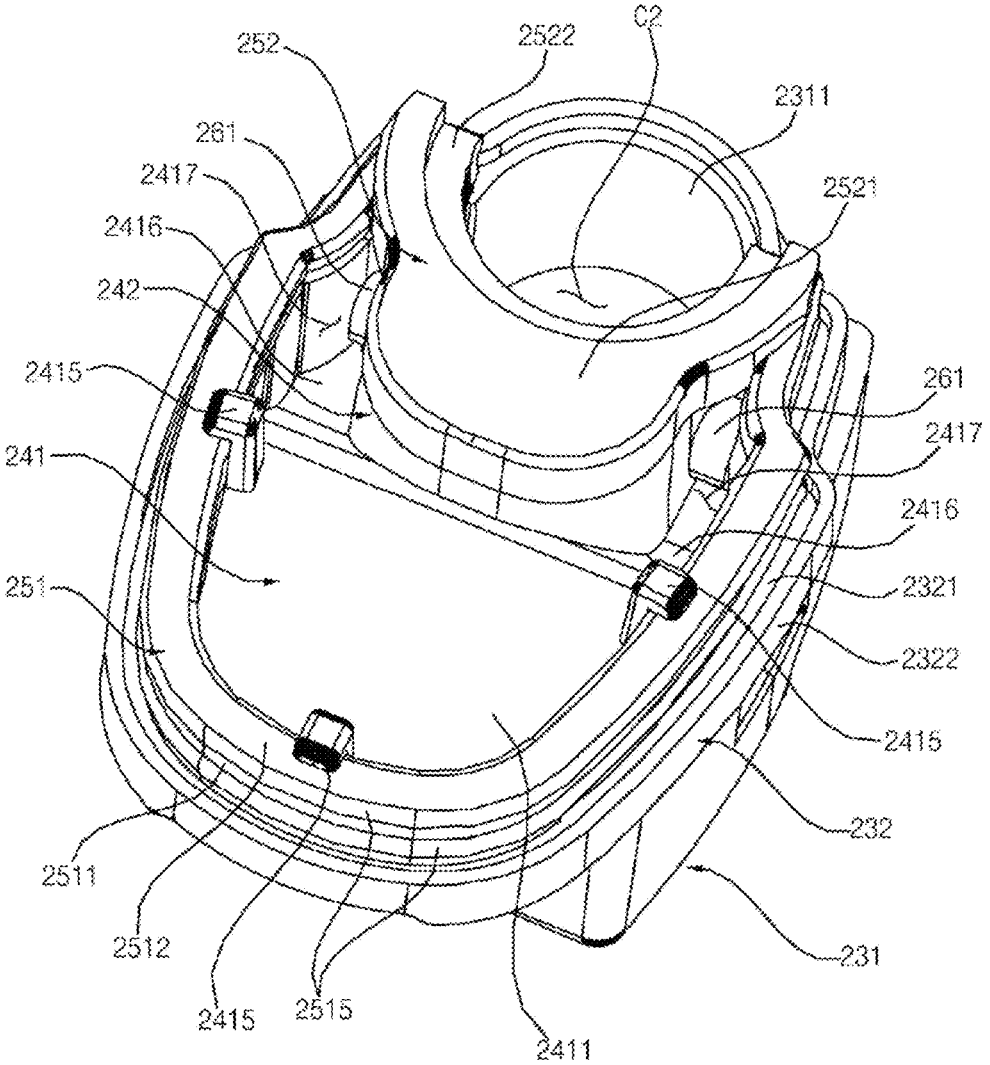

【FIG. 41】
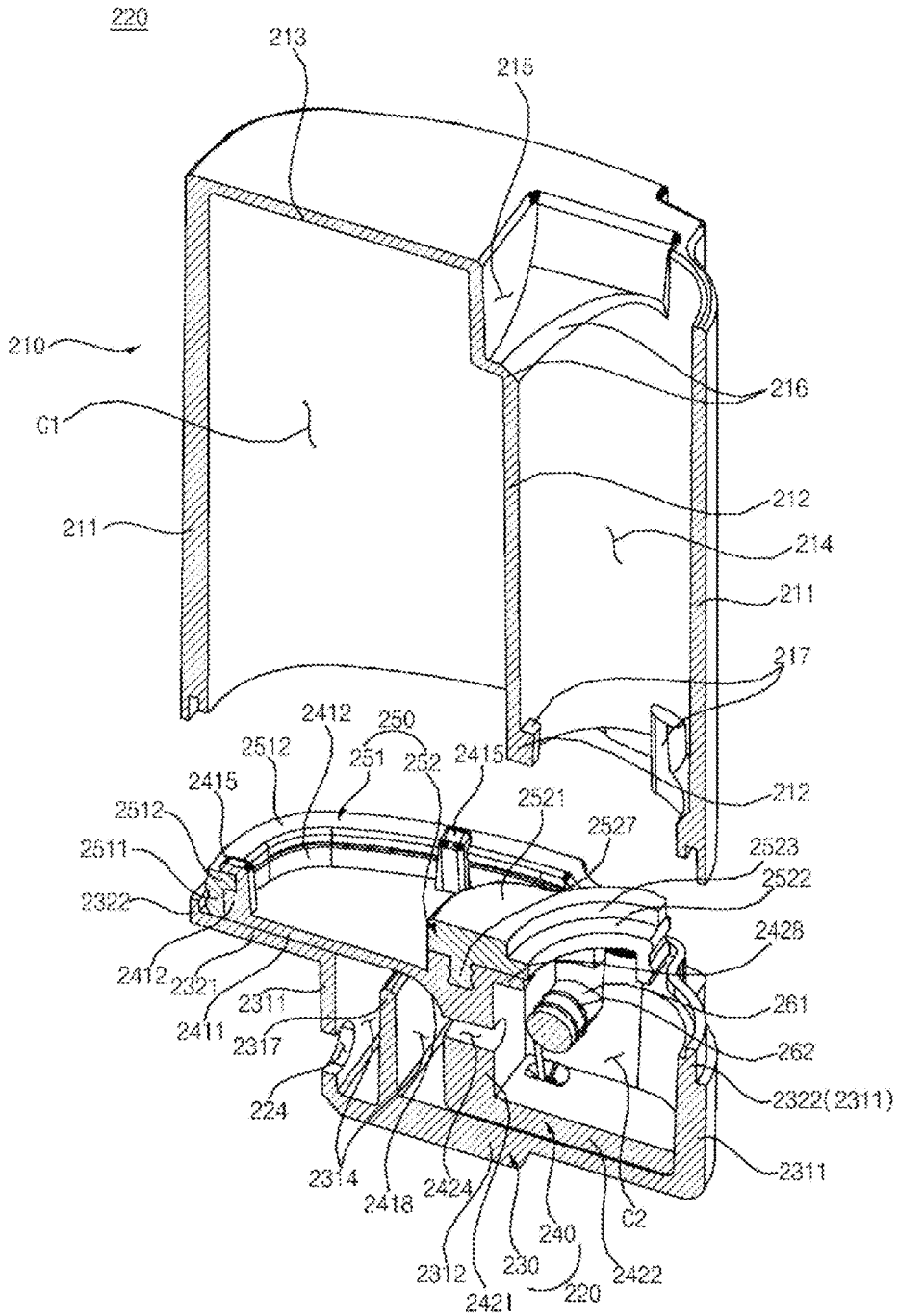

【FIG. 42】
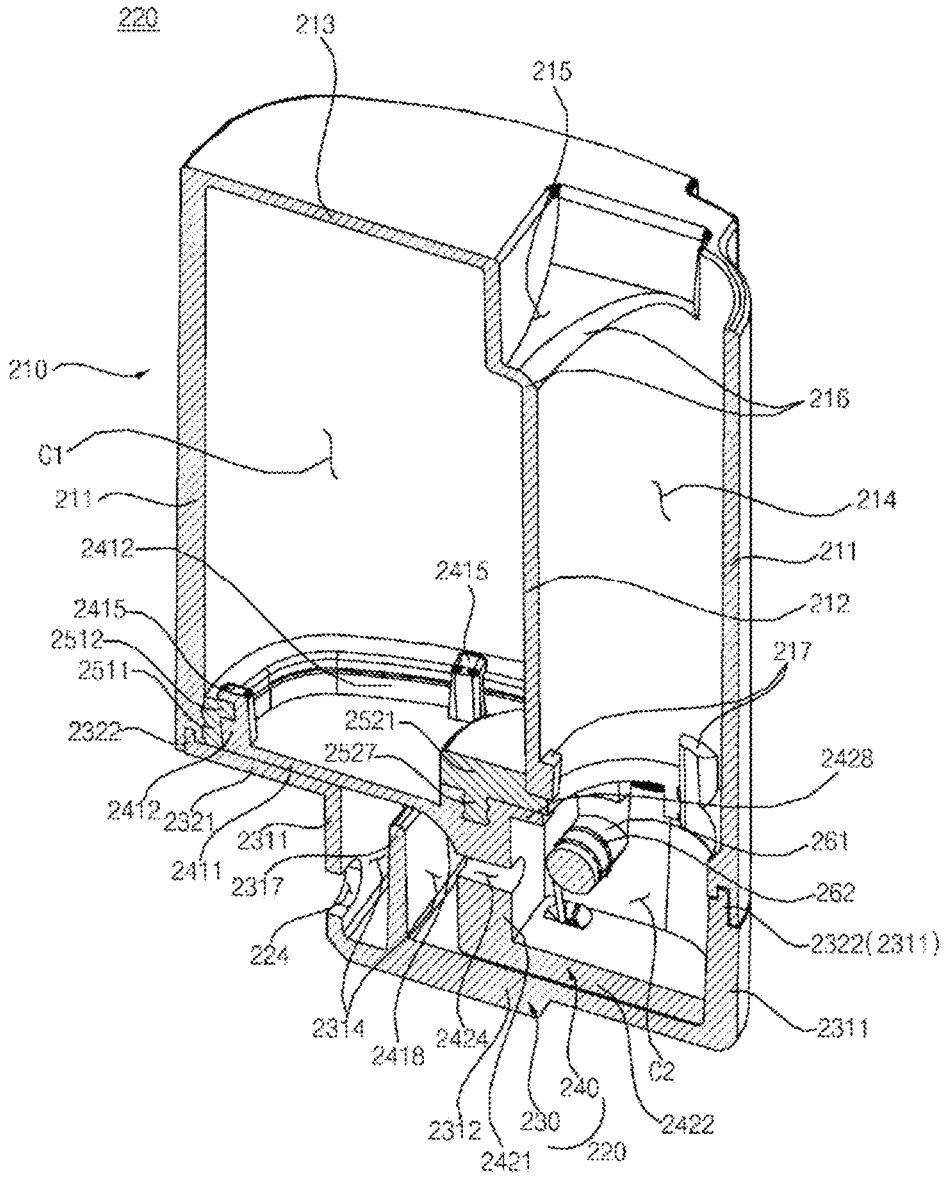

【FIG. 43】
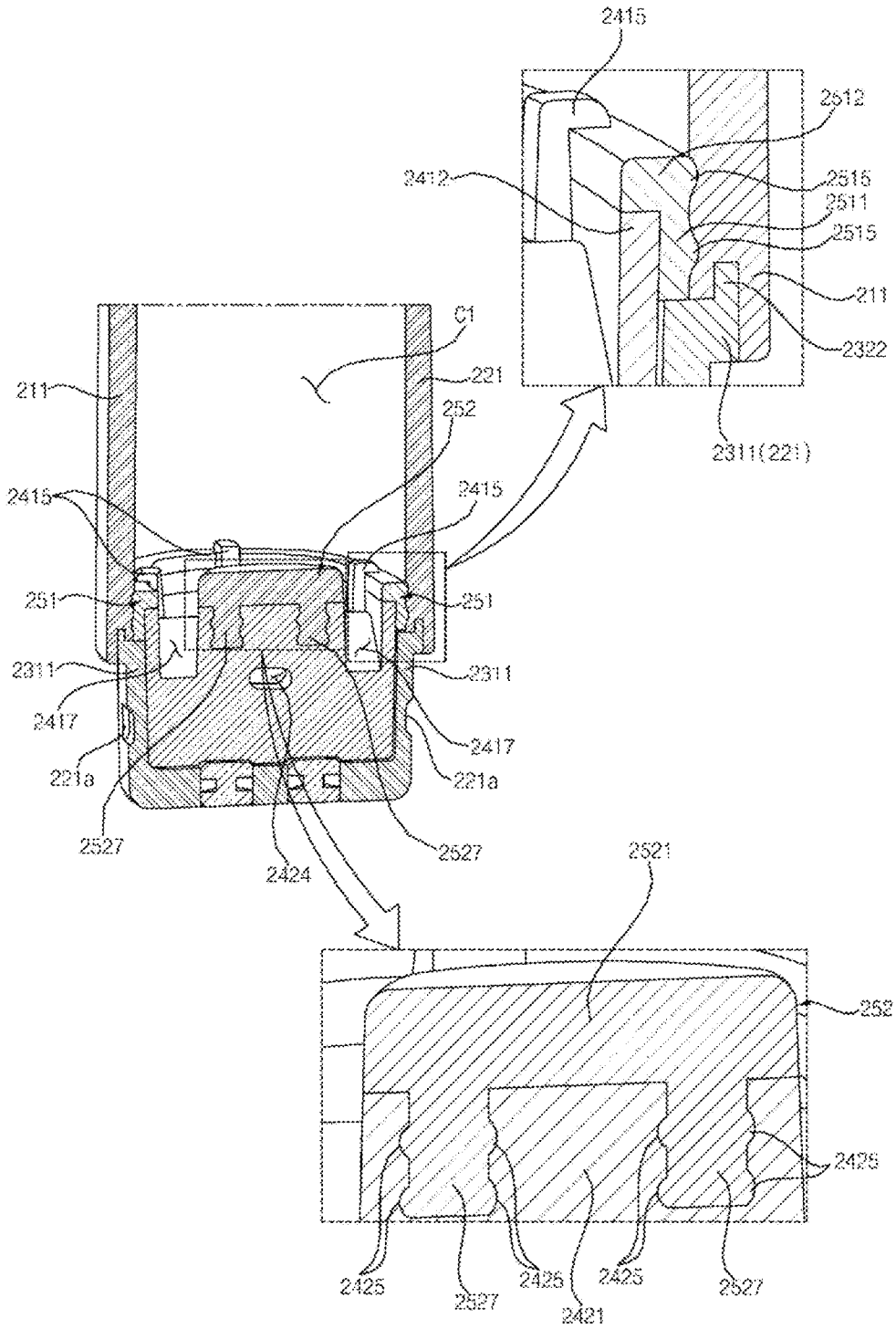

【FIG. 44】
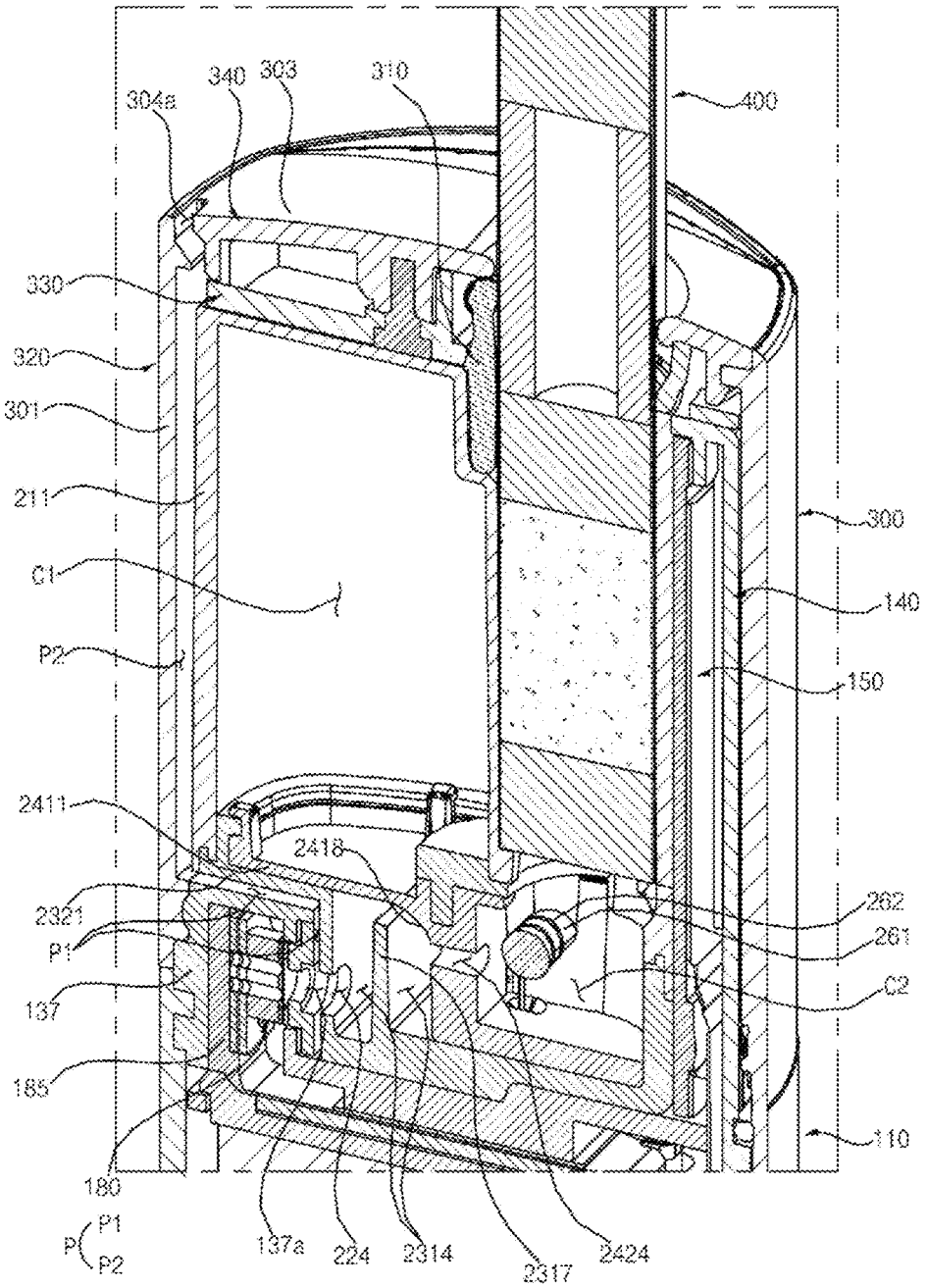

【FIG. 45】
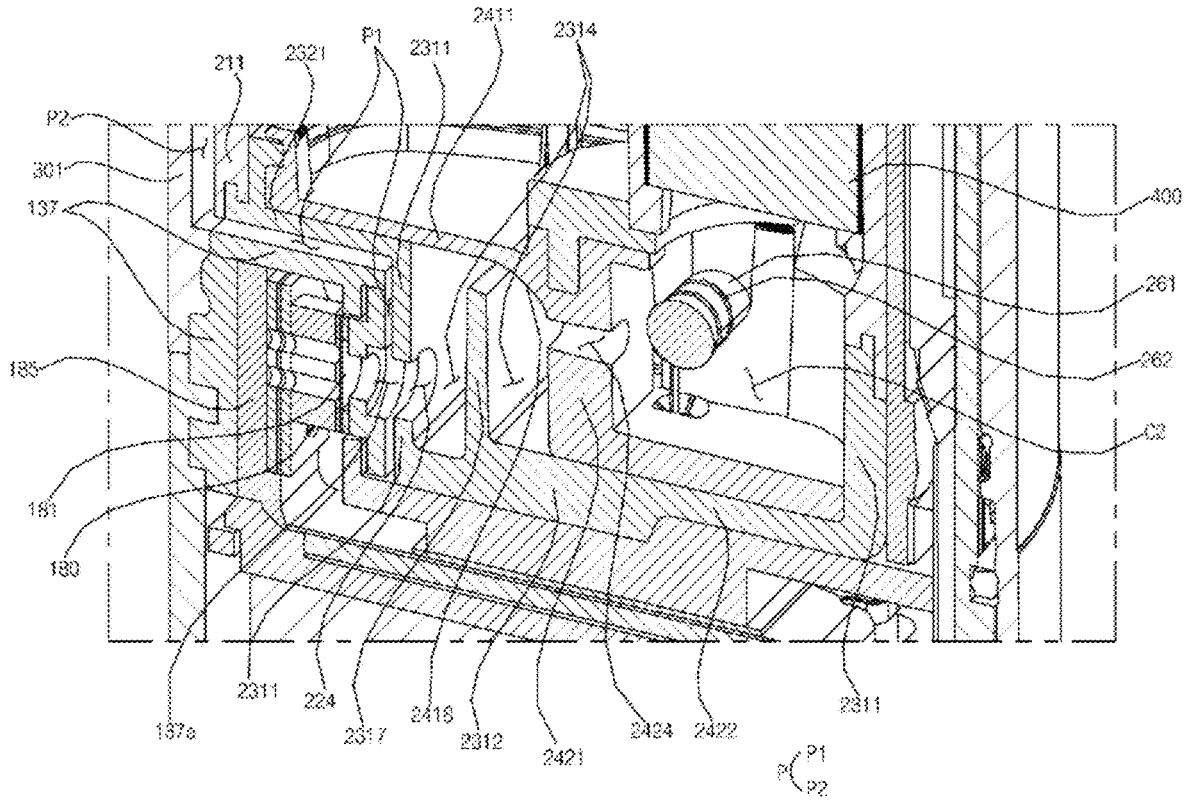

【FIG. 46】
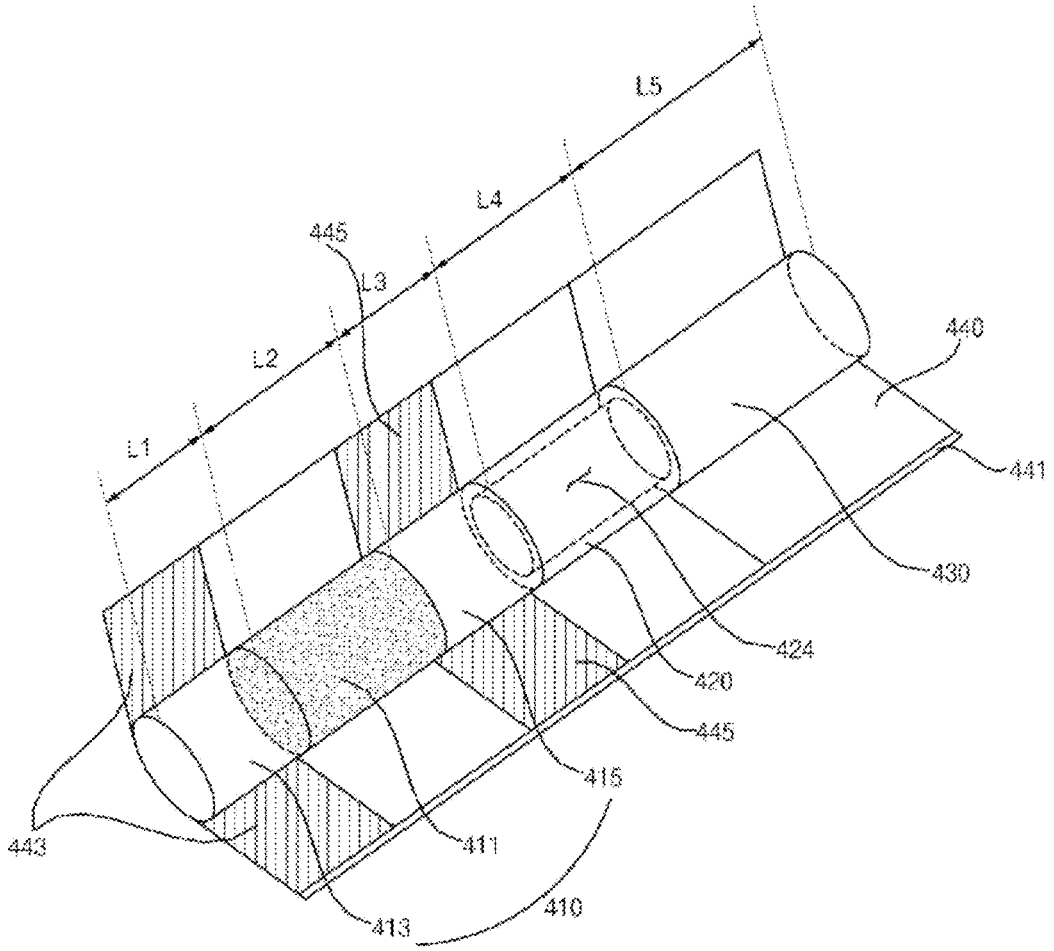

【FIG. 47】
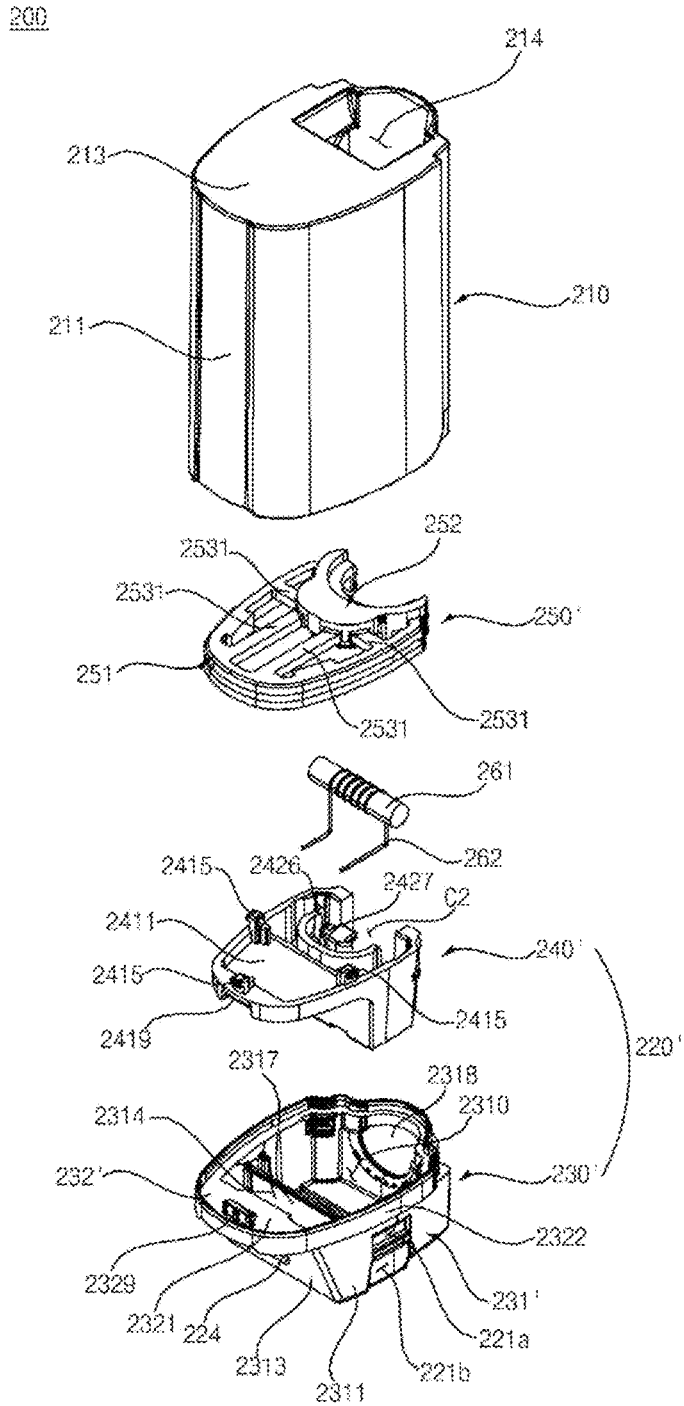

【FIG. 48】
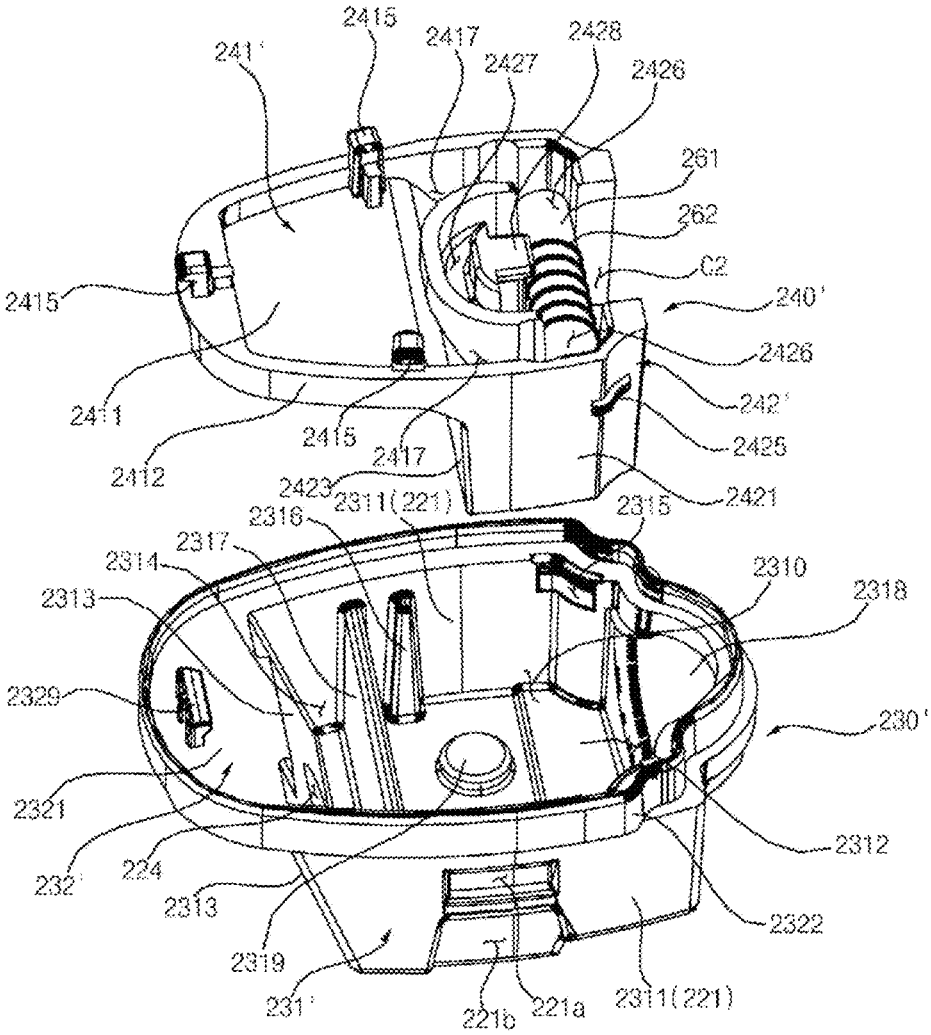

【FIG. 49】
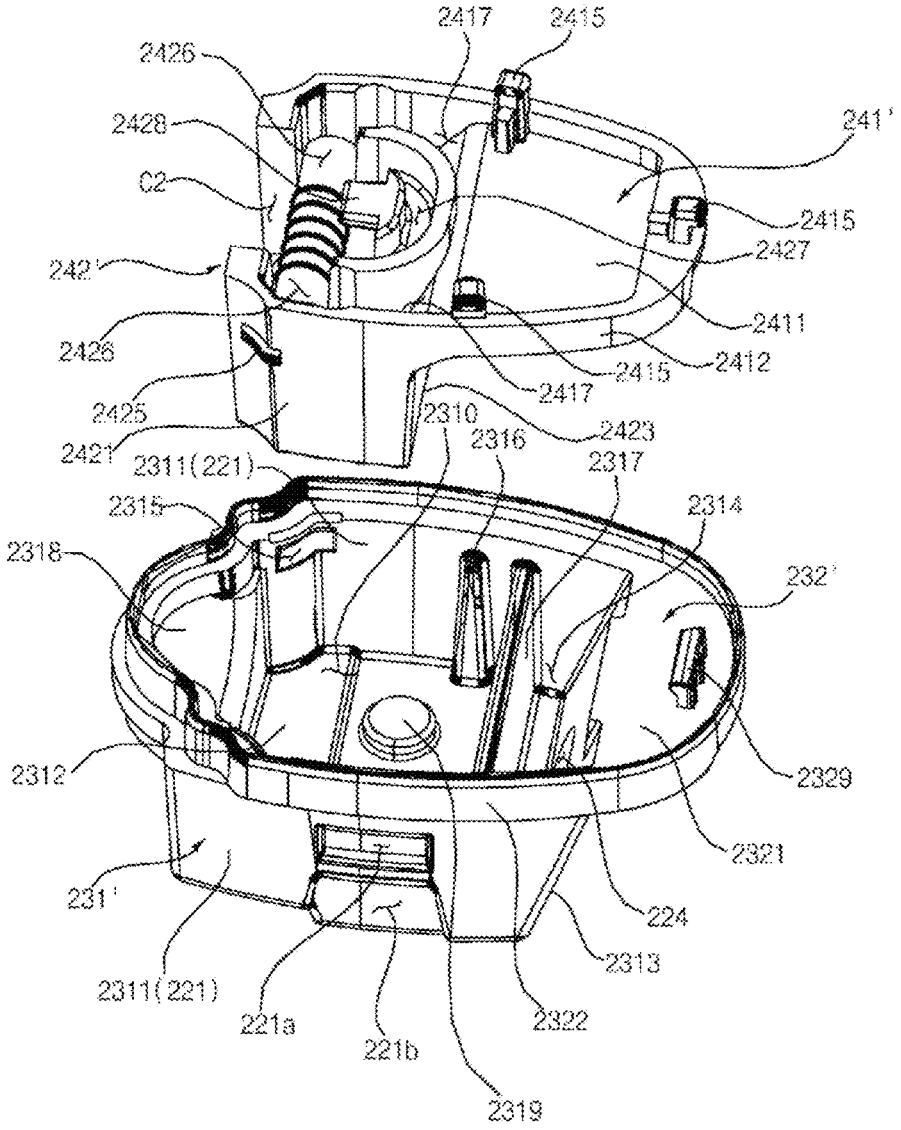

【FIG. 50】
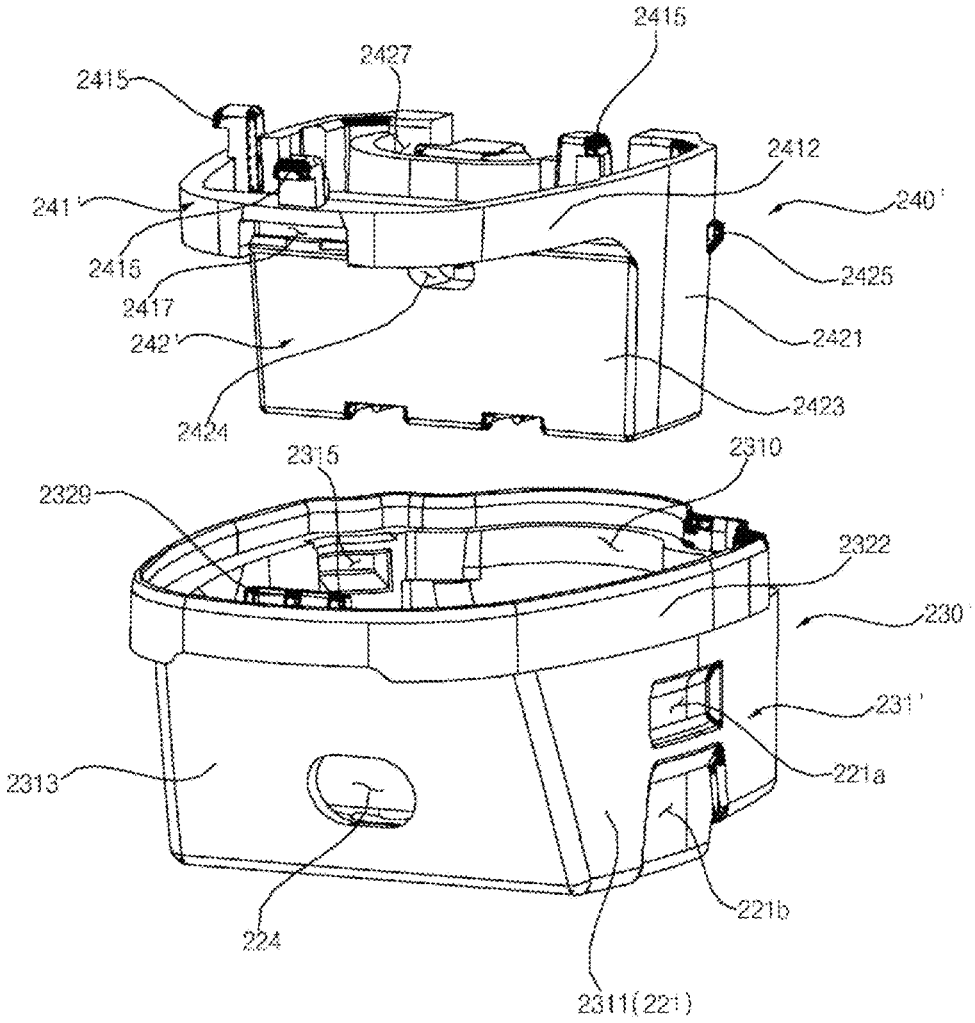

【FIG. 51】
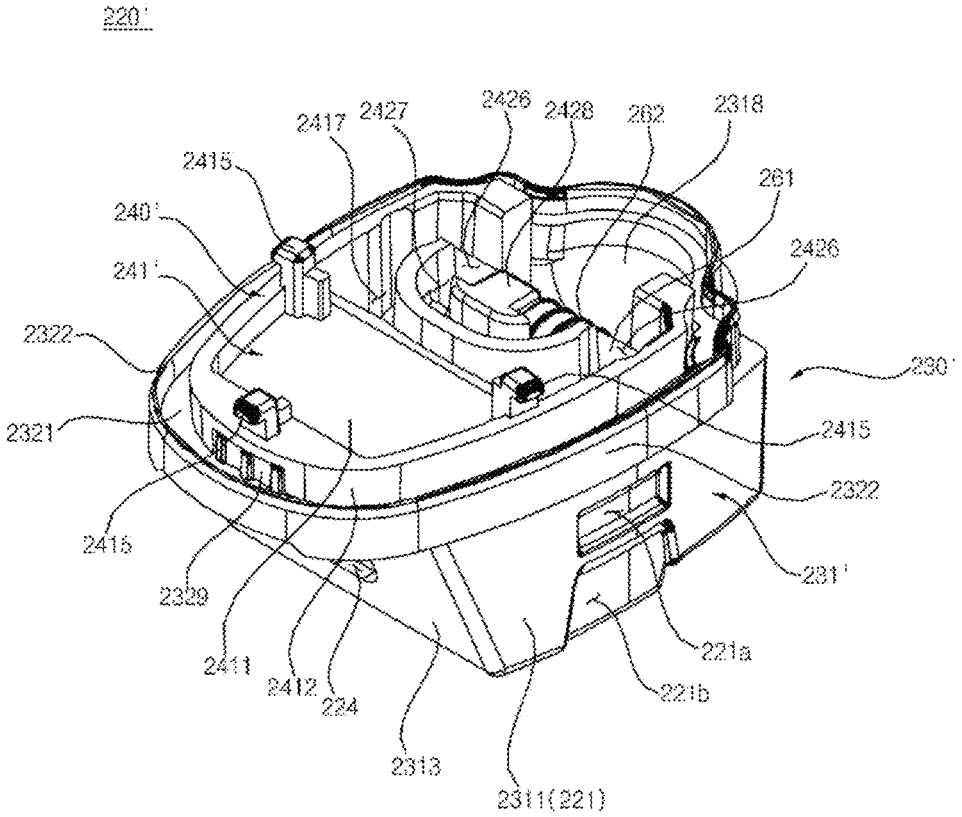

【FIG. 52】
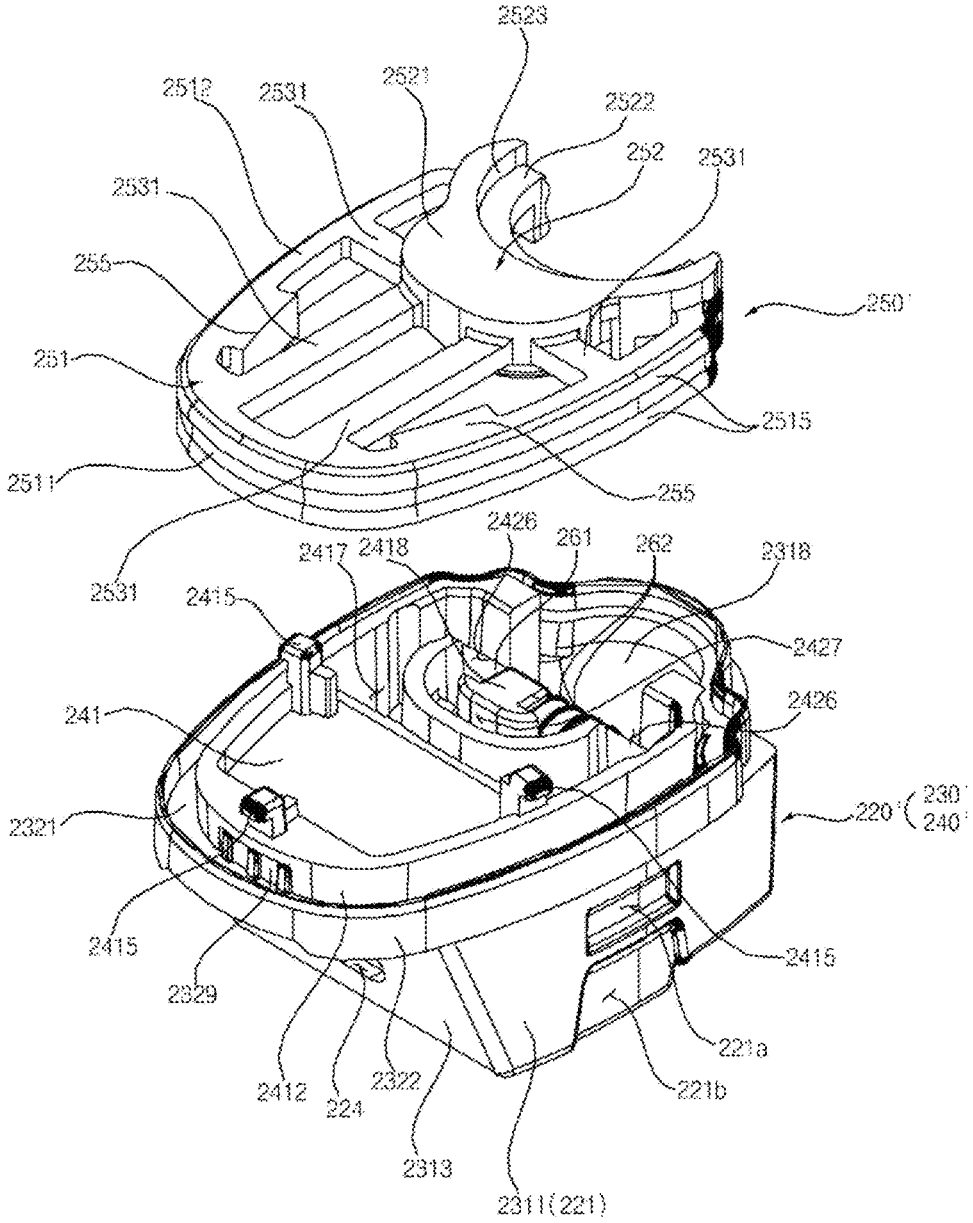

【FIG. 53】
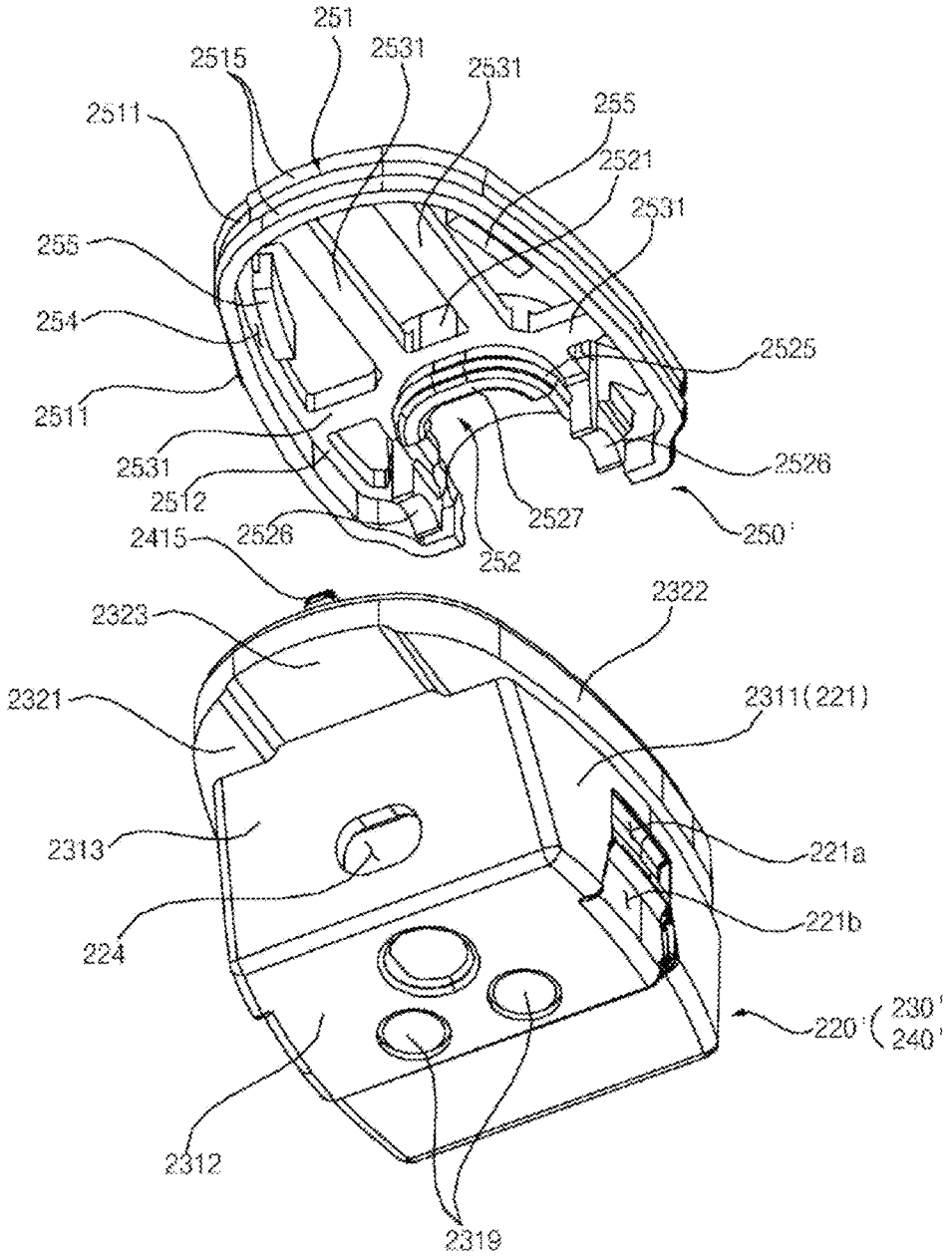

【FIG. 54】
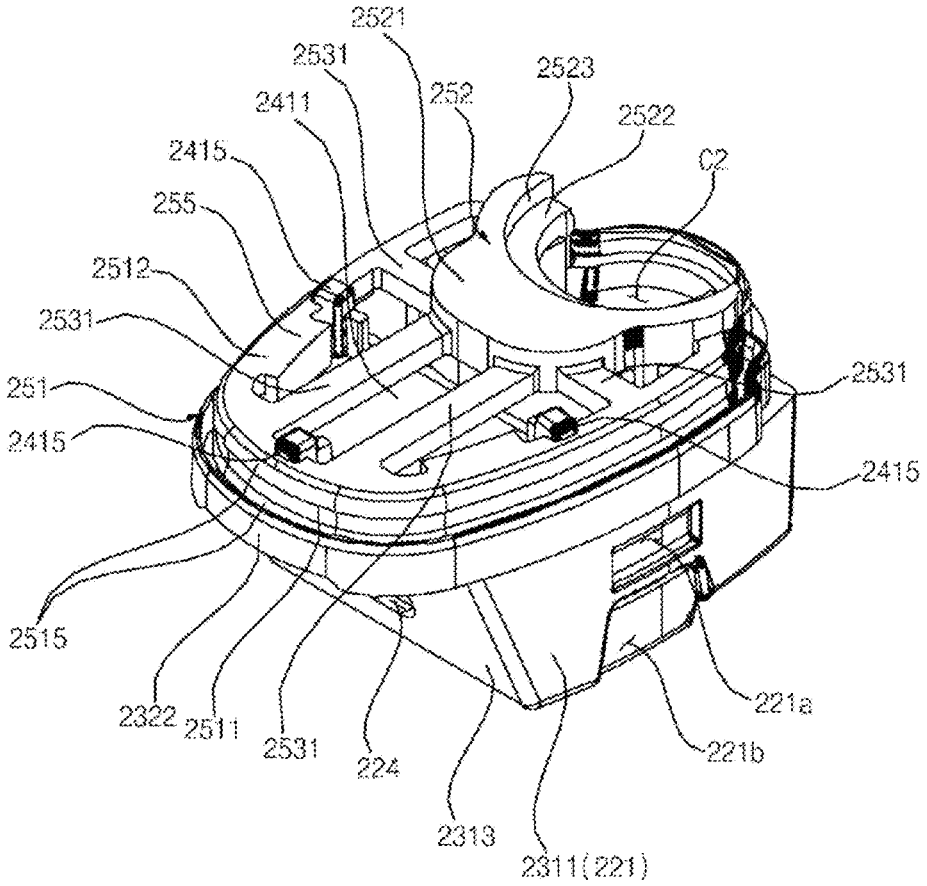

【FIG. 55】
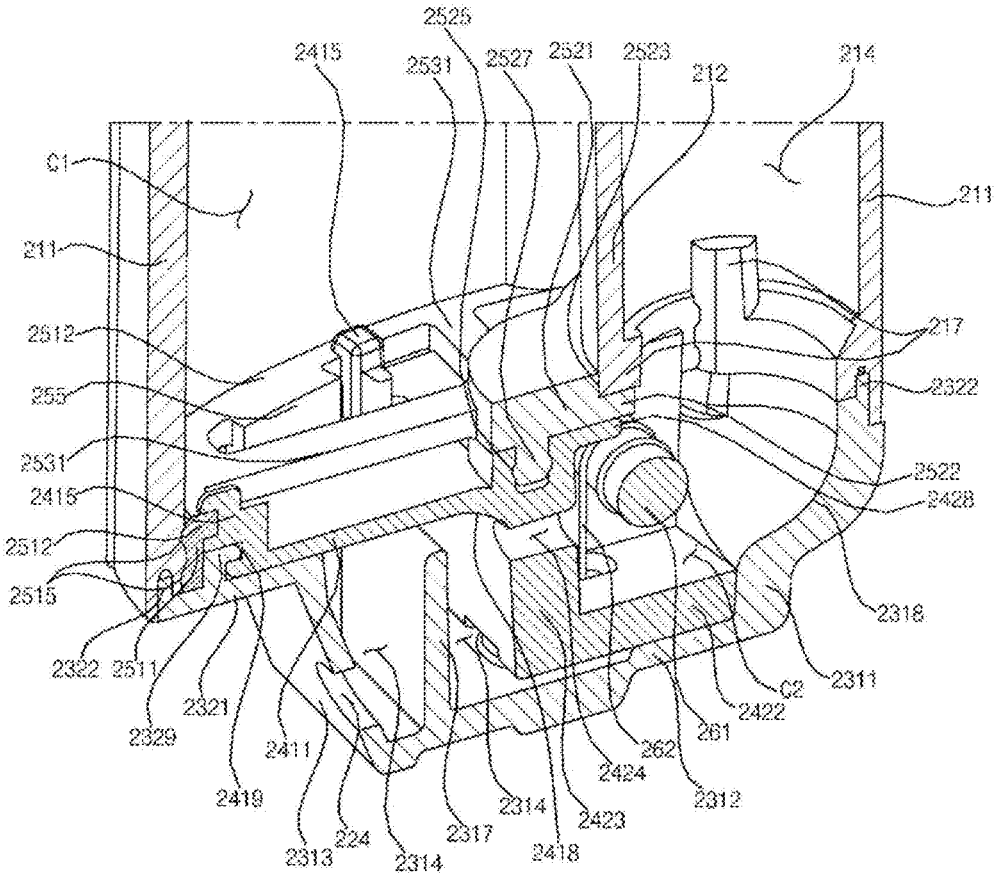

【FIG. 56】
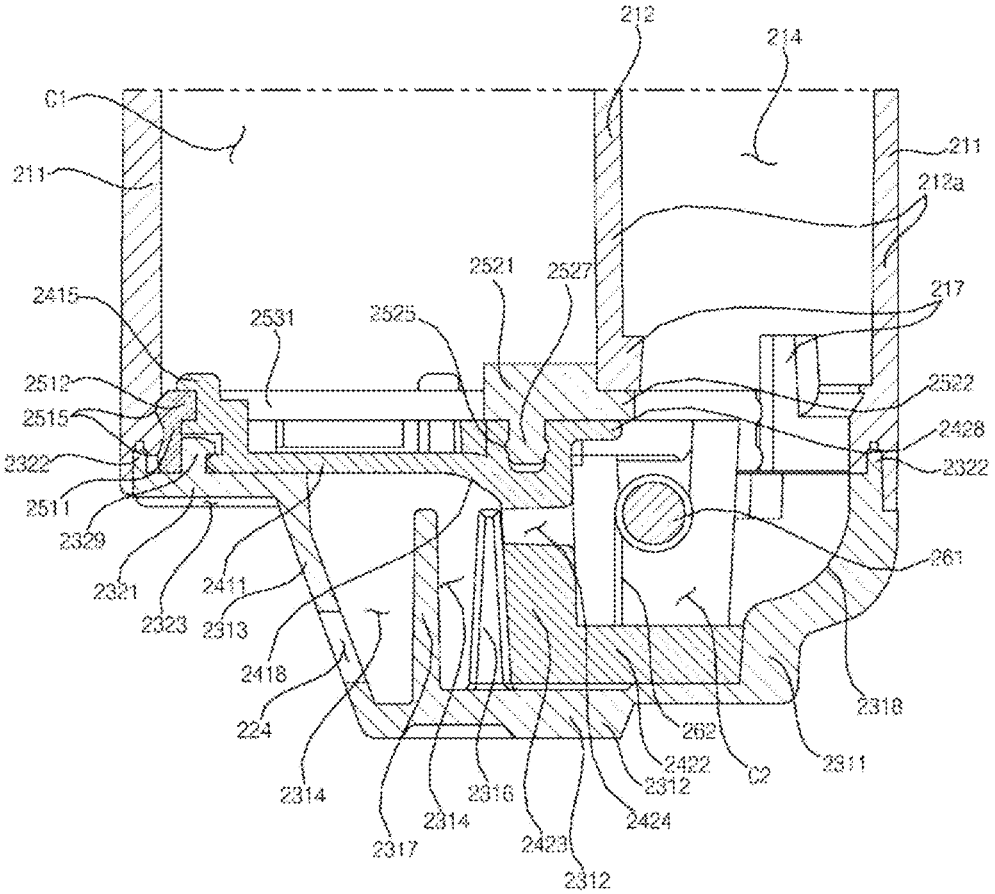

【FIG. 57】
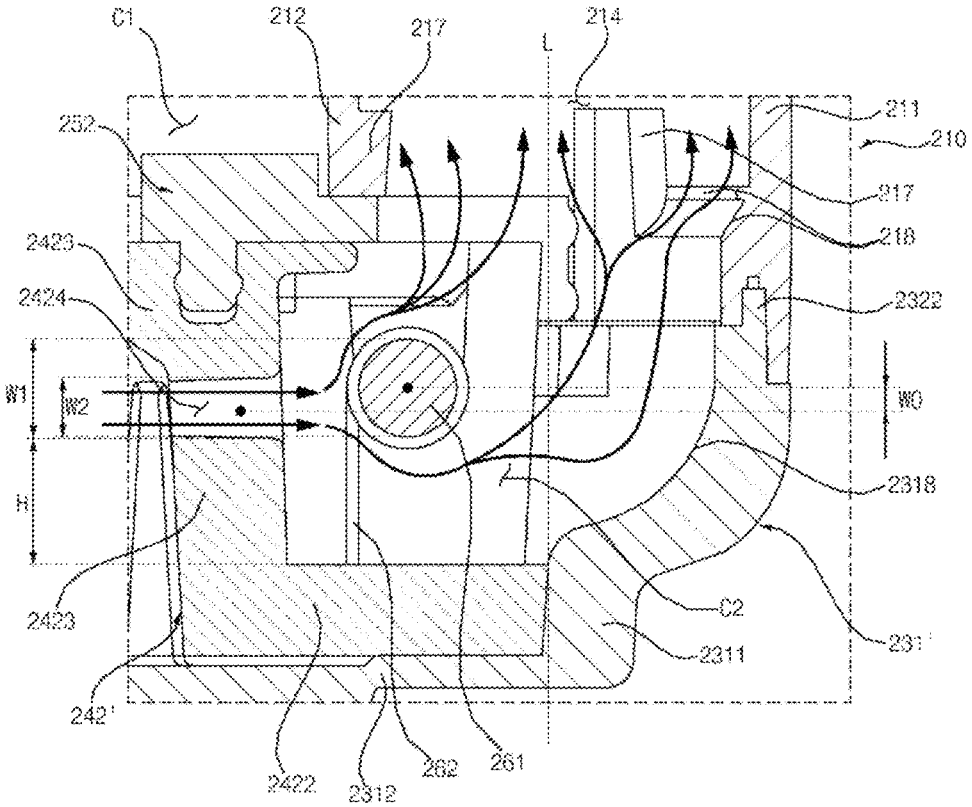

【FIG. 58】
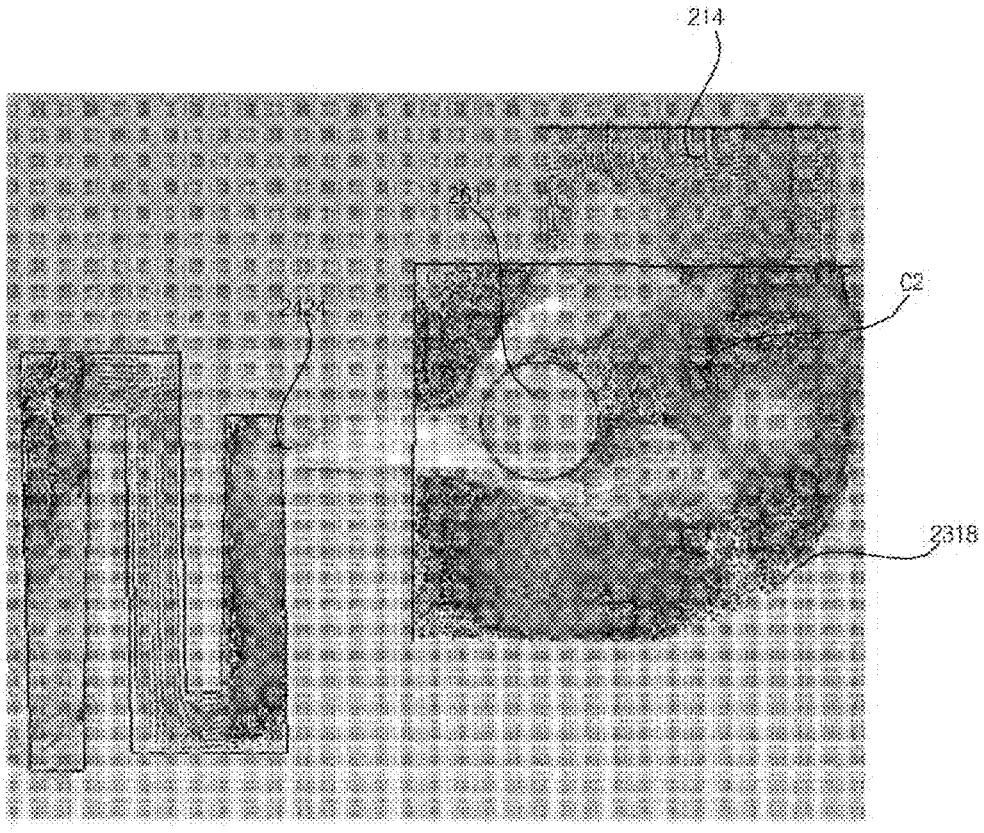

【FIG. 59】
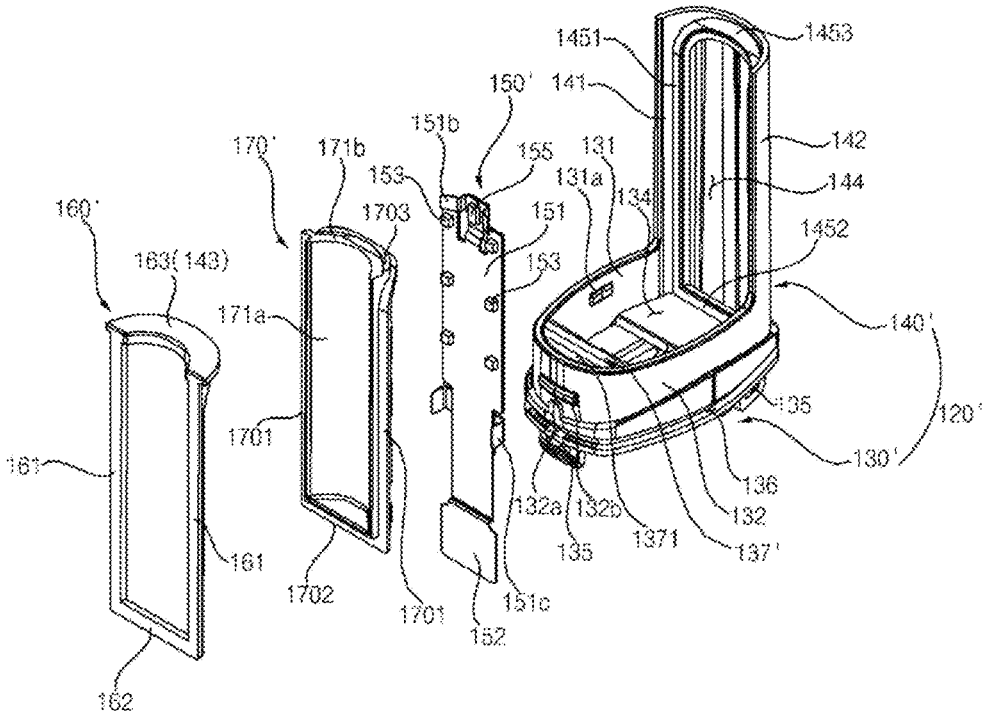

【FIG. 60】
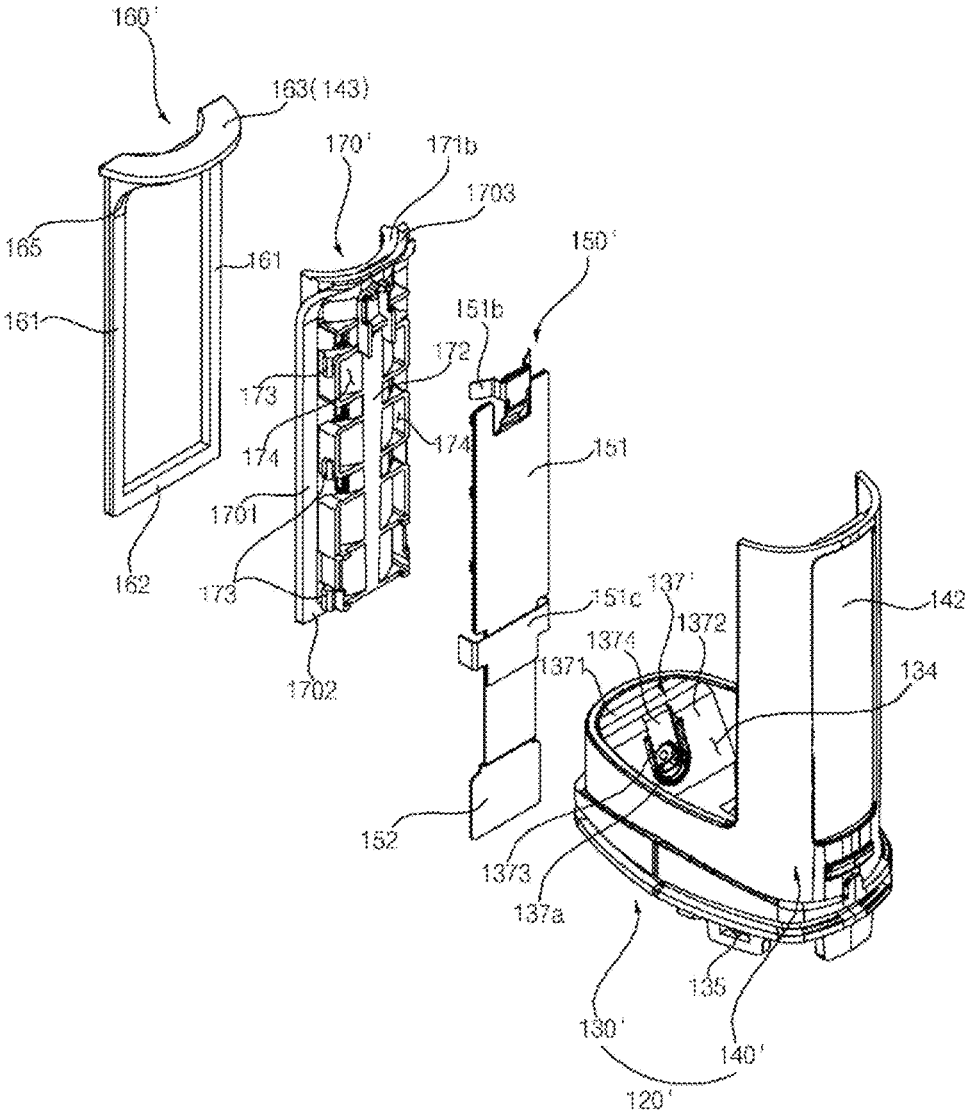

【FIG. 61】
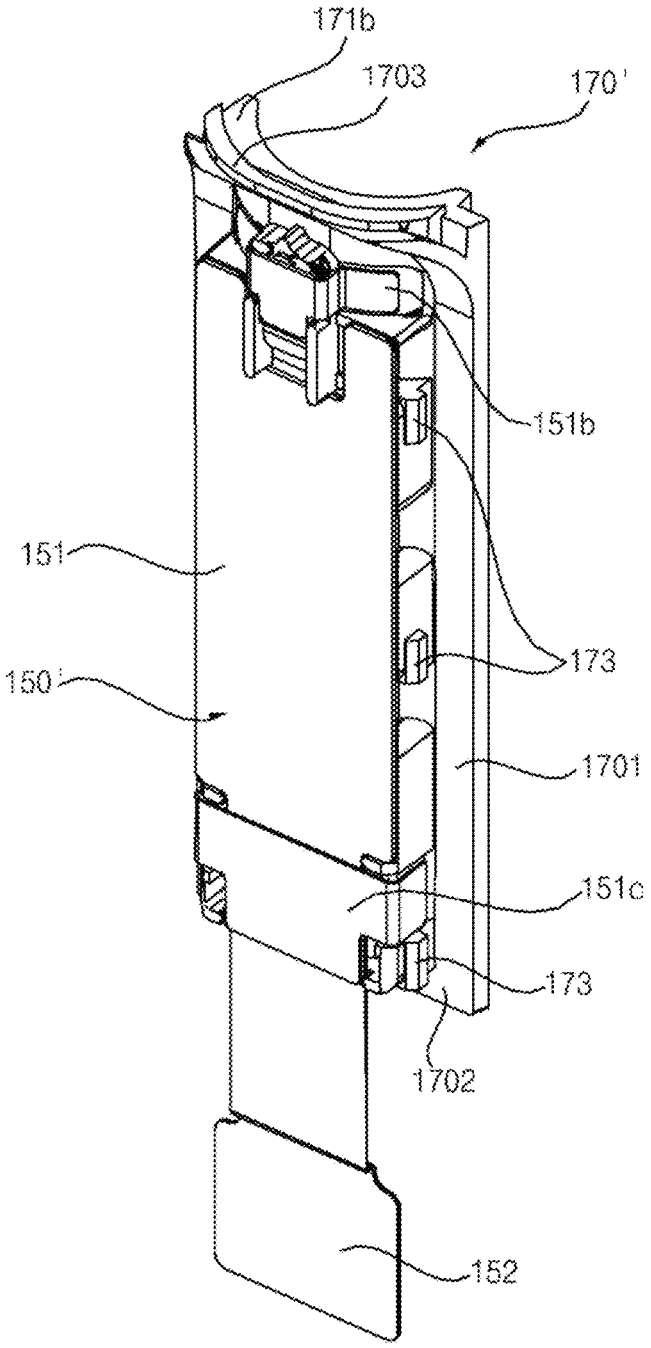

【FIG. 62】
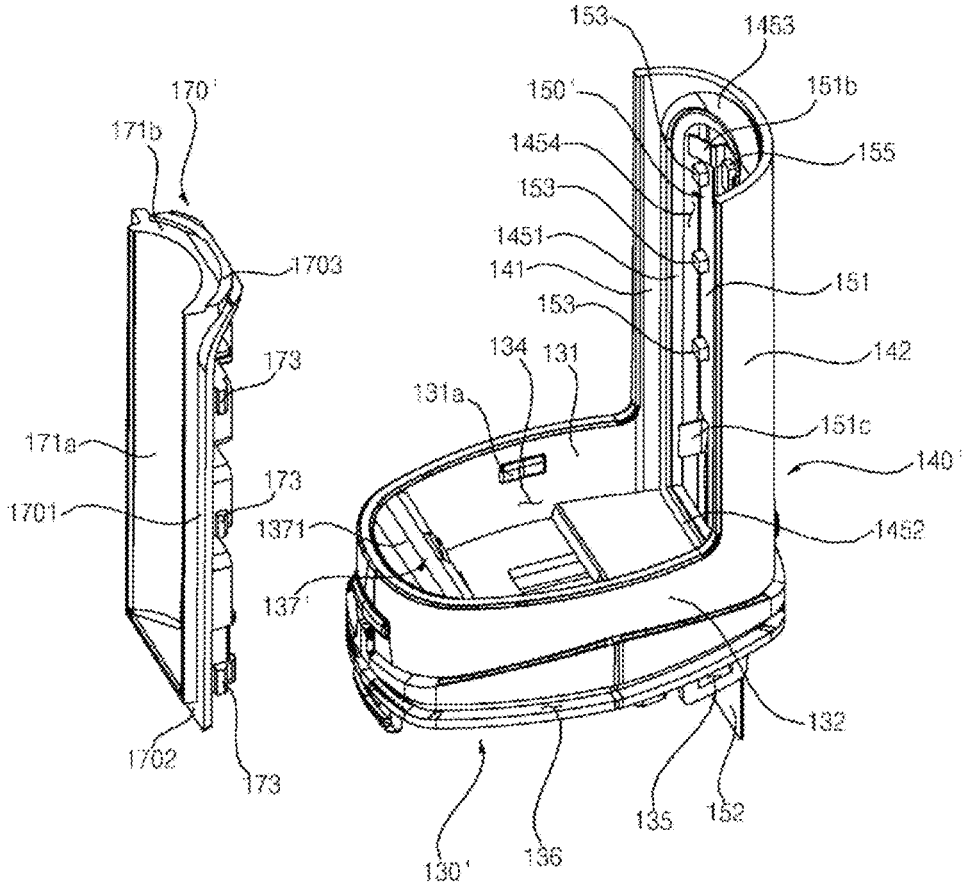

【FIG. 63】
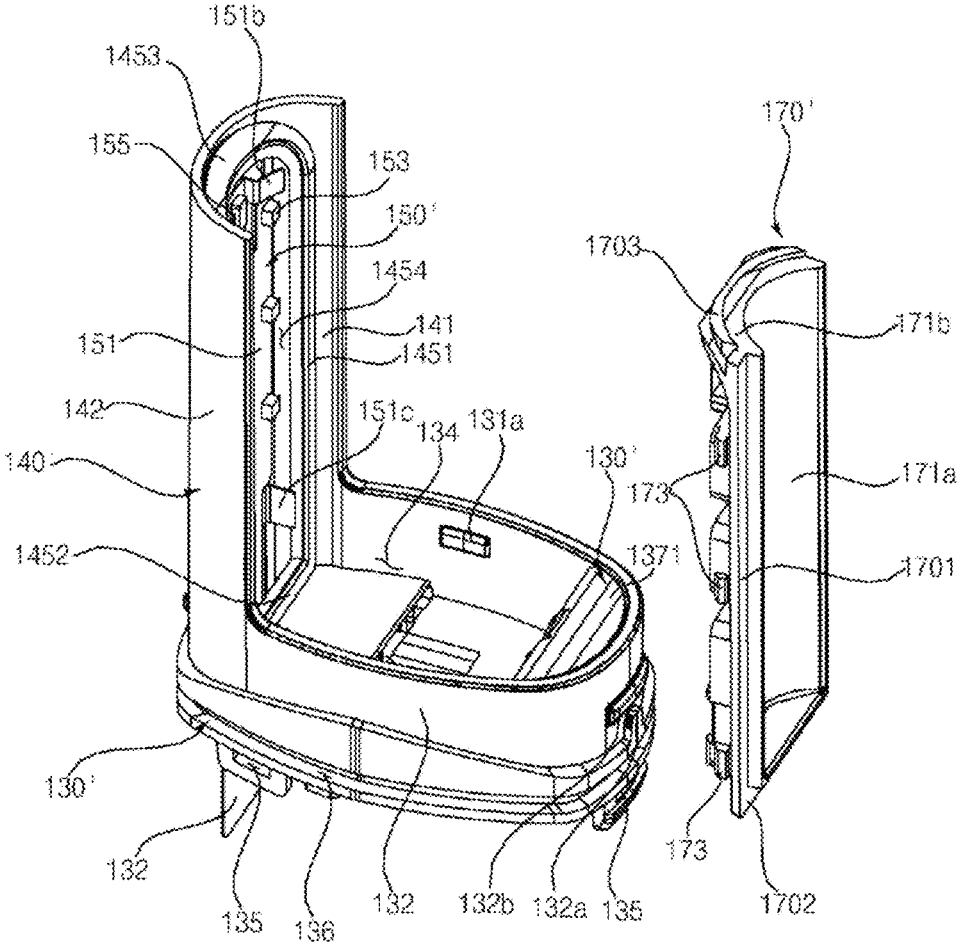

【FIG. 64】
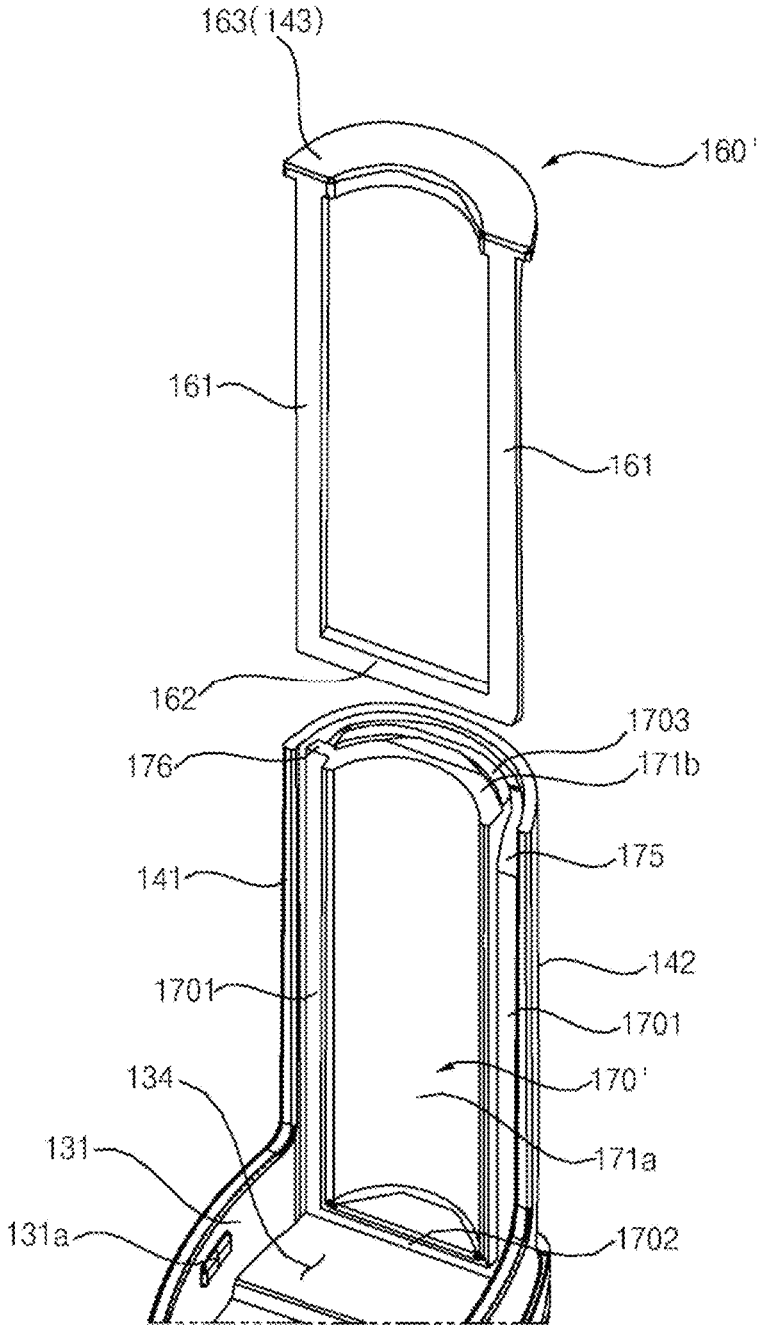

【FIG. 65】
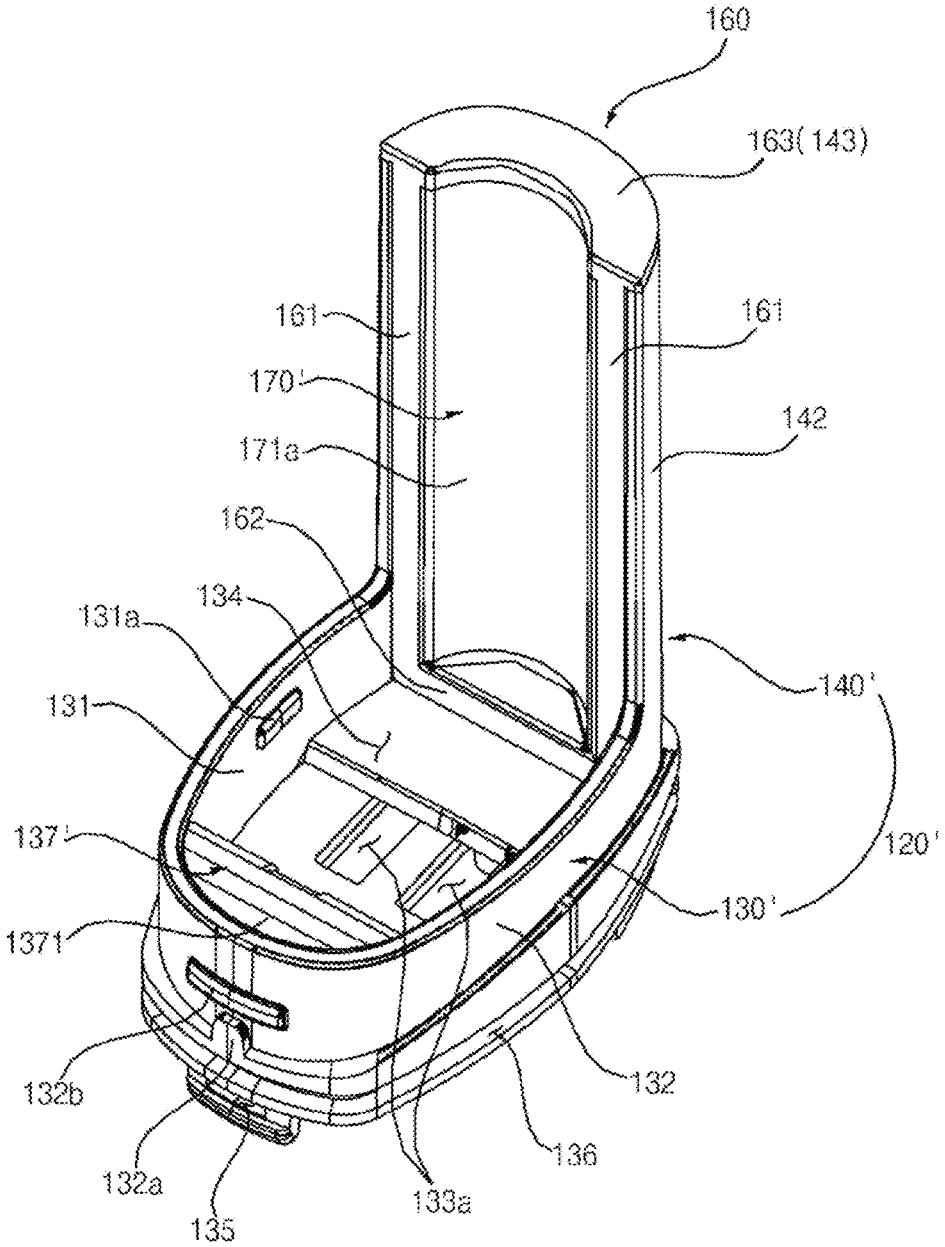

【FIG. 66】
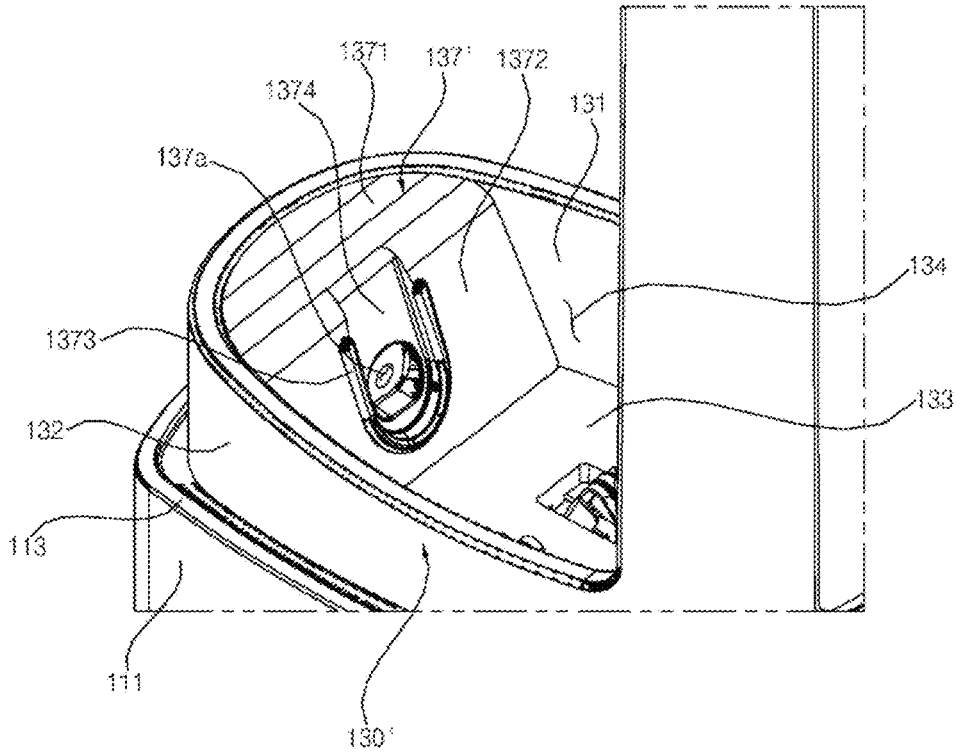

【FIG. 67】
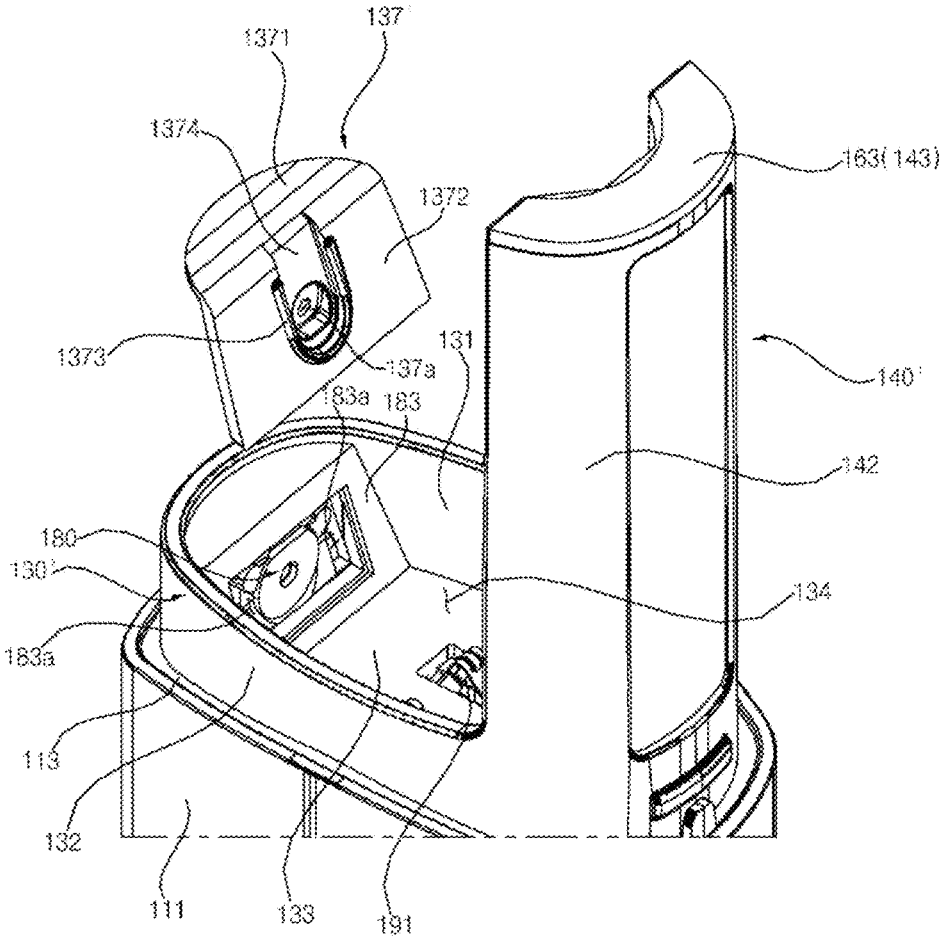

【FIG. 68】
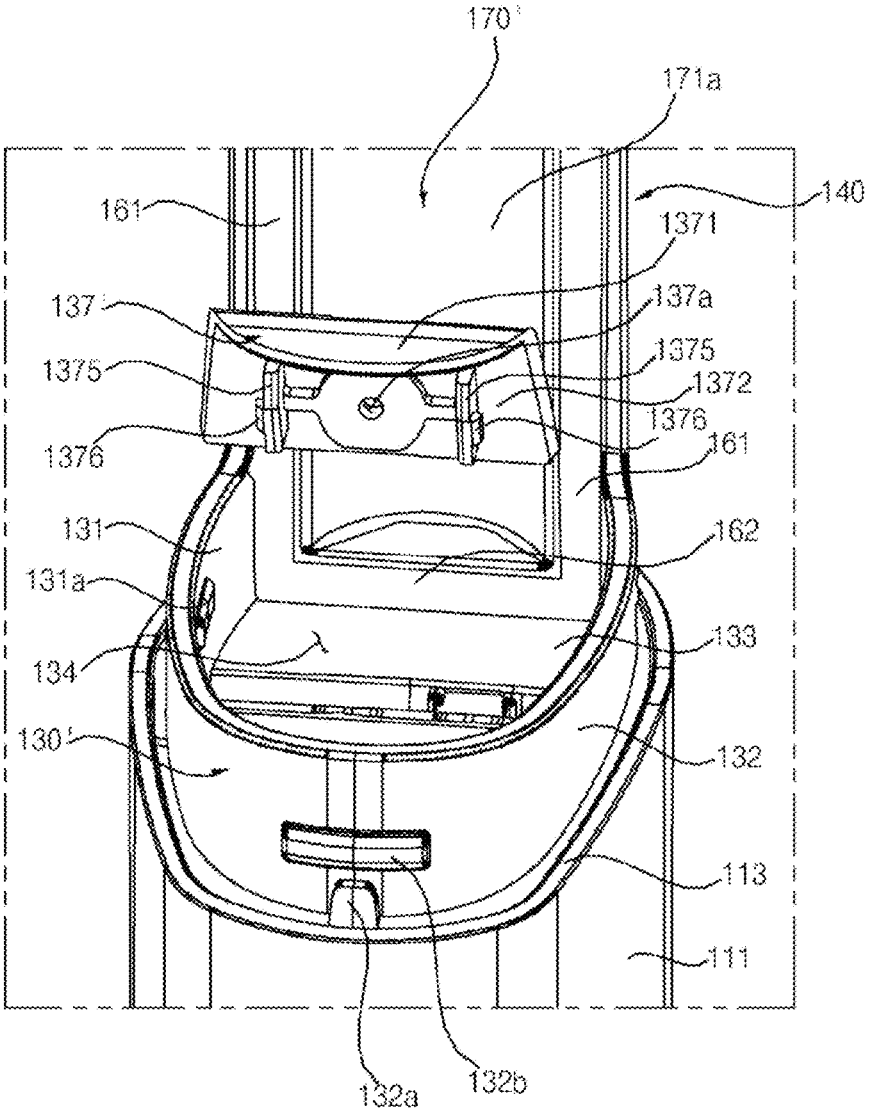

【FIG. 69】
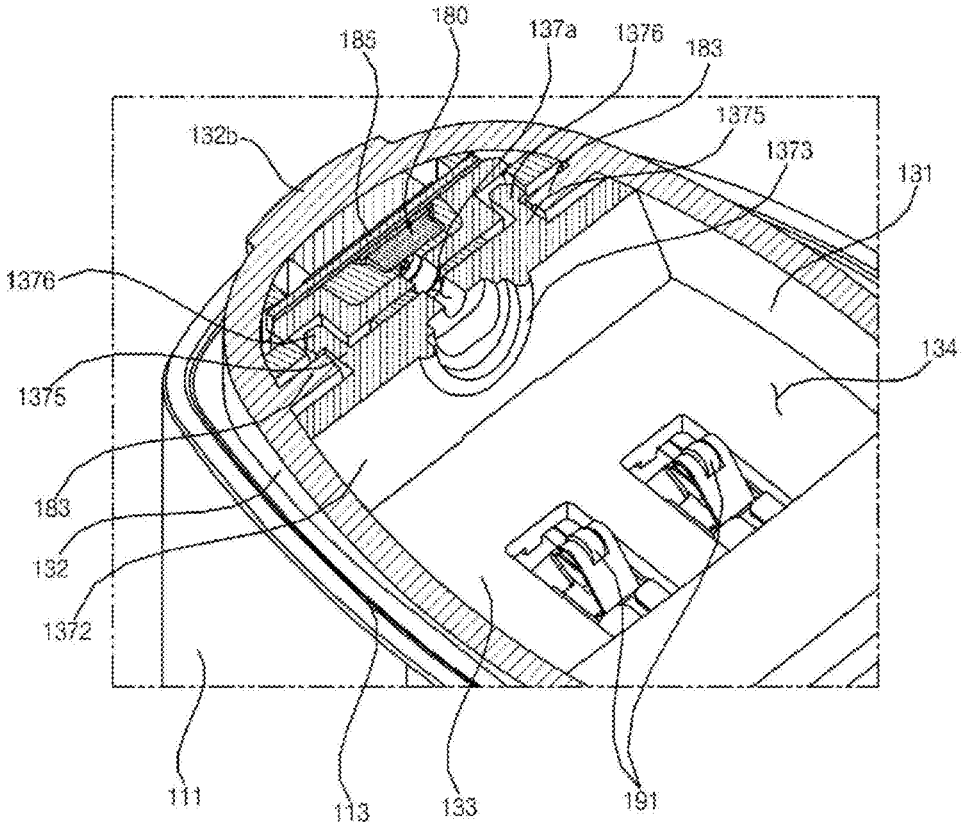

【FIG. 70】
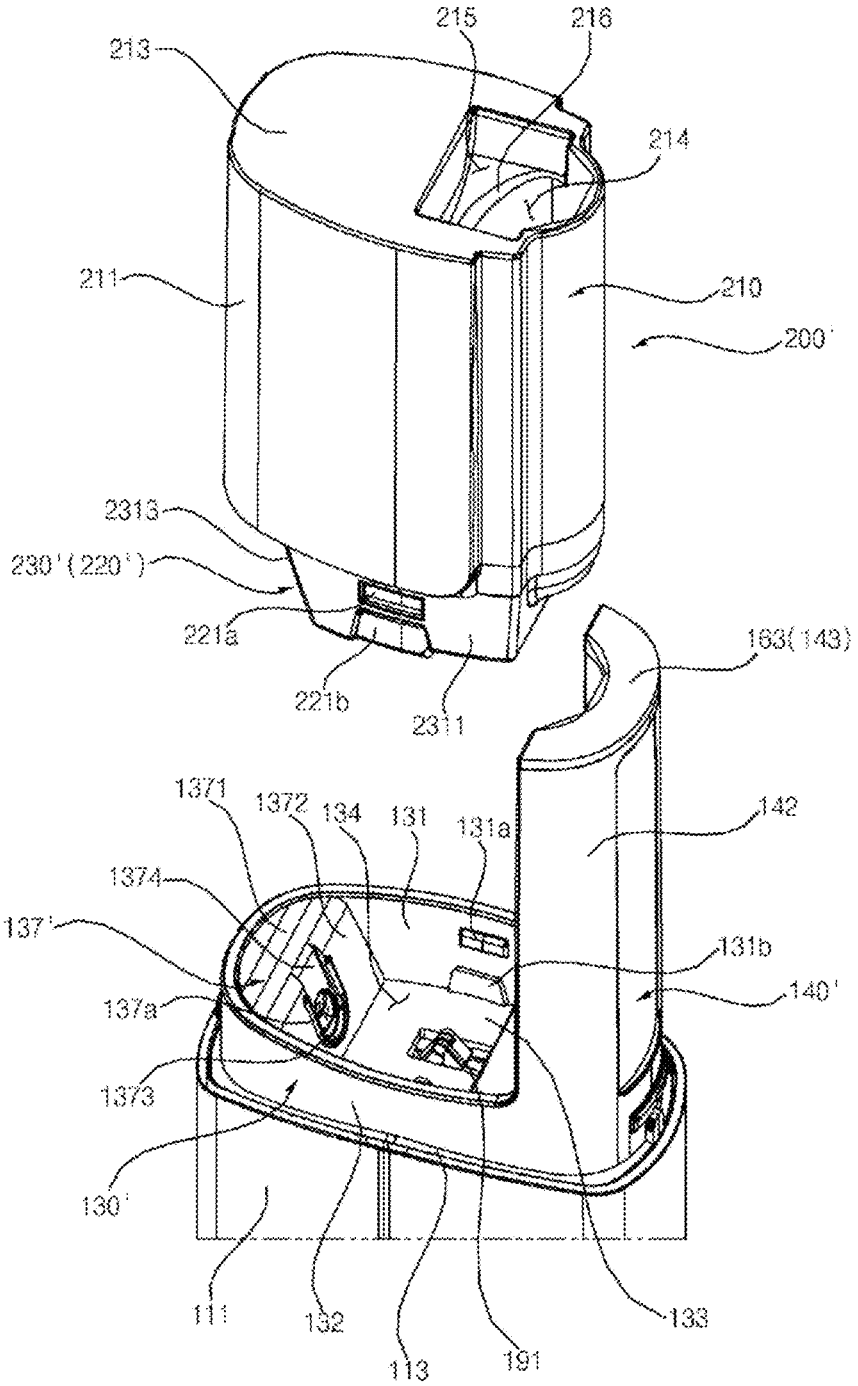

【FIG. 71】
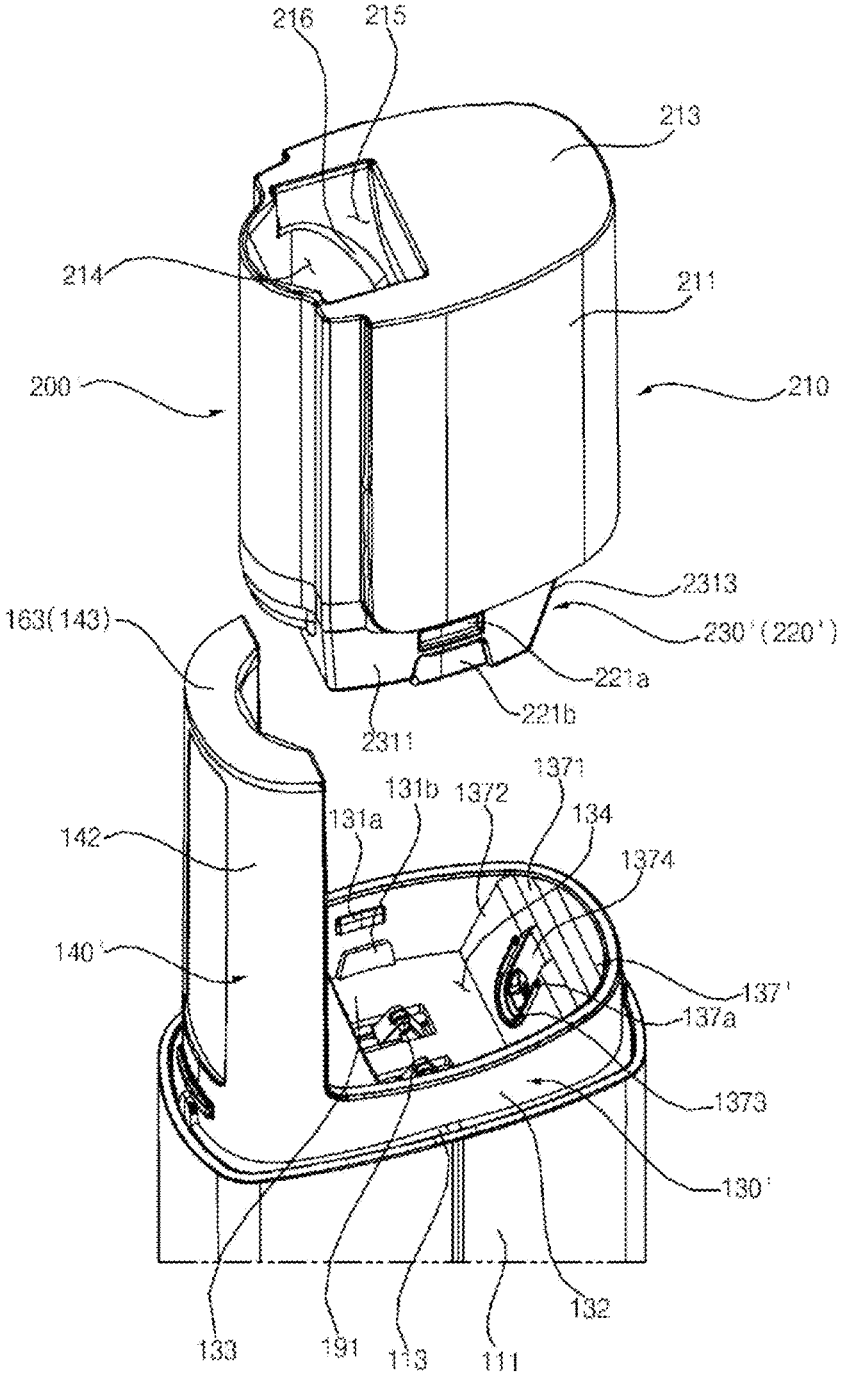

【FIG. 72】
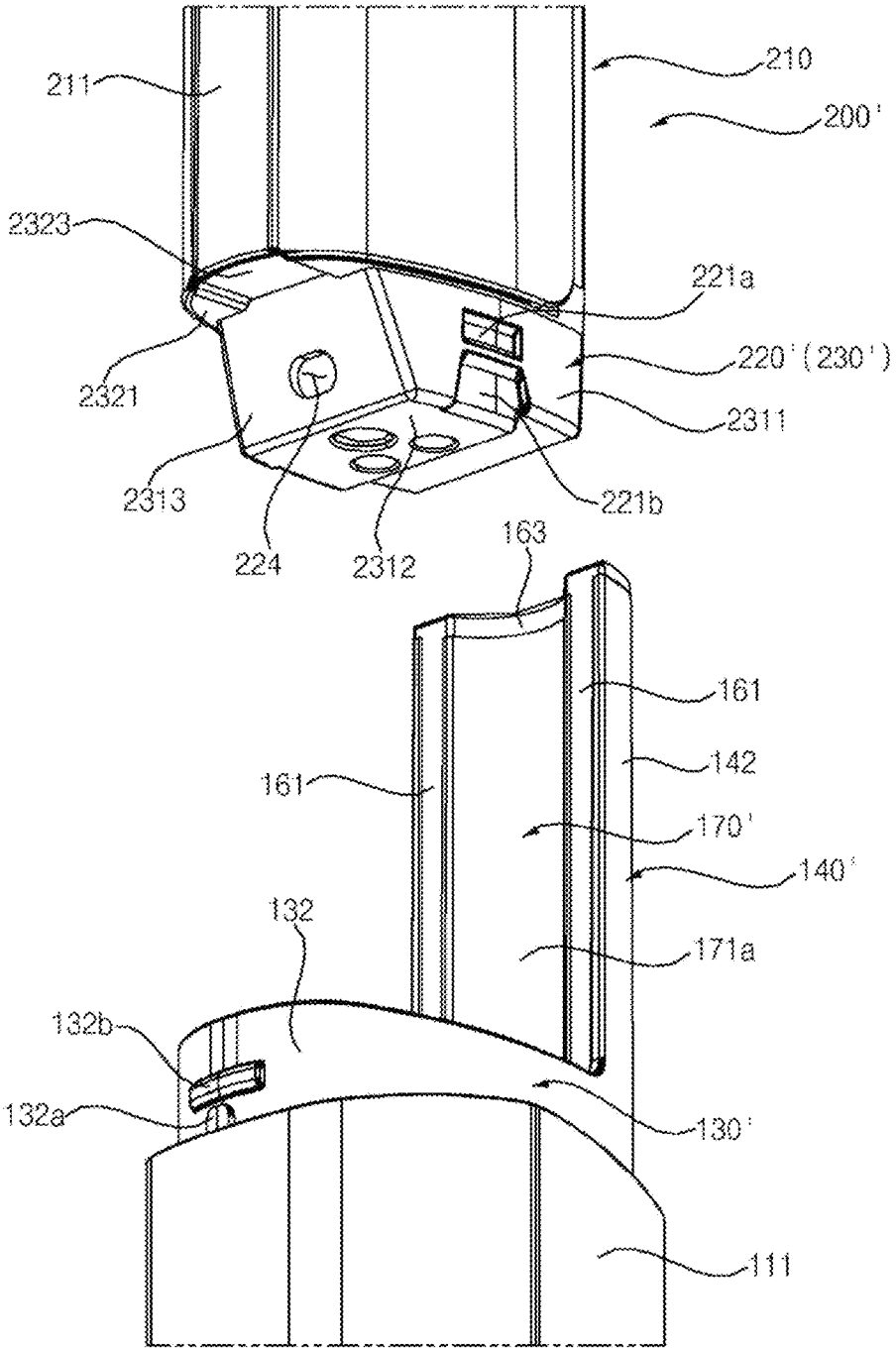

【FIG. 73】
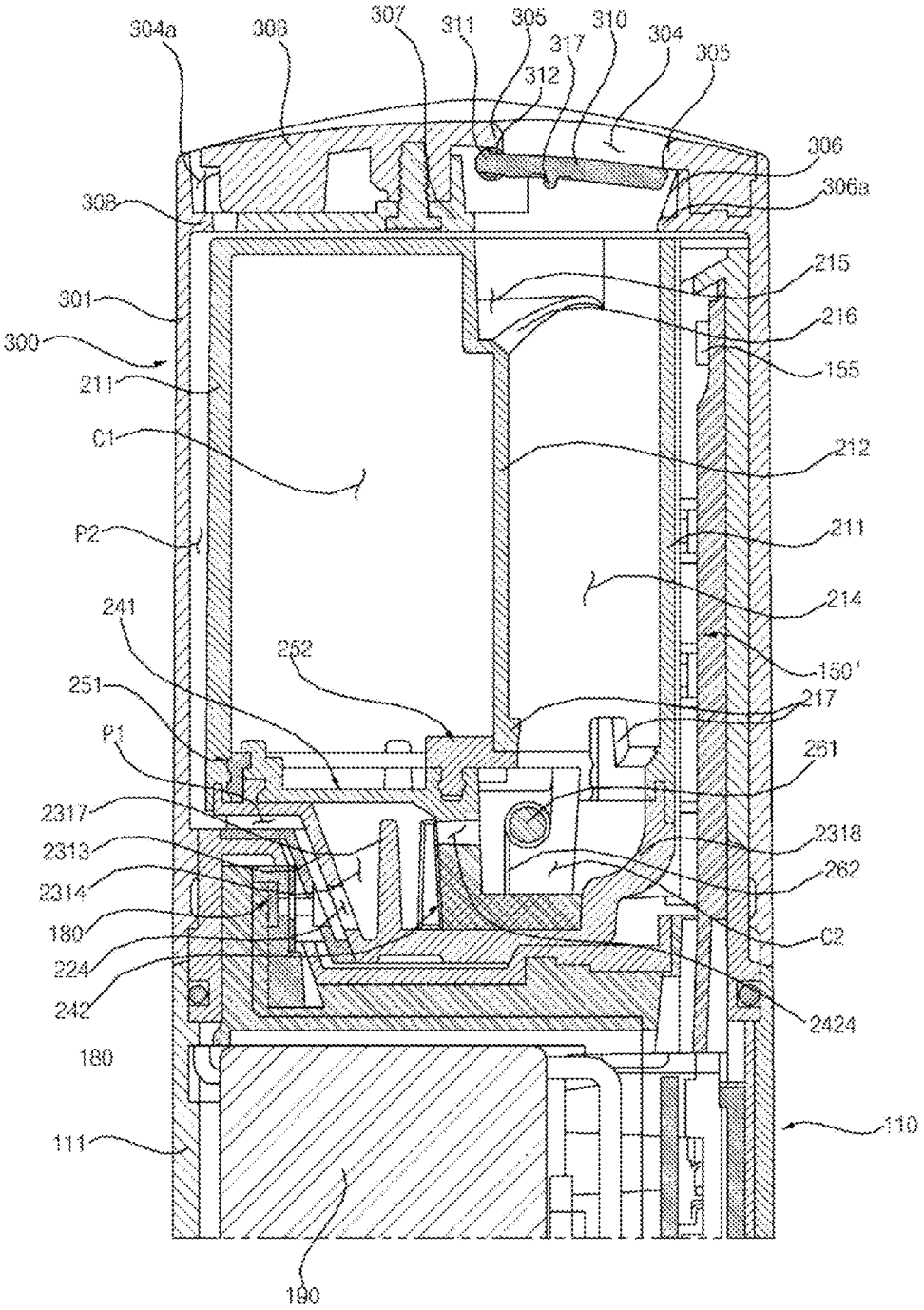

【FIG. 74】
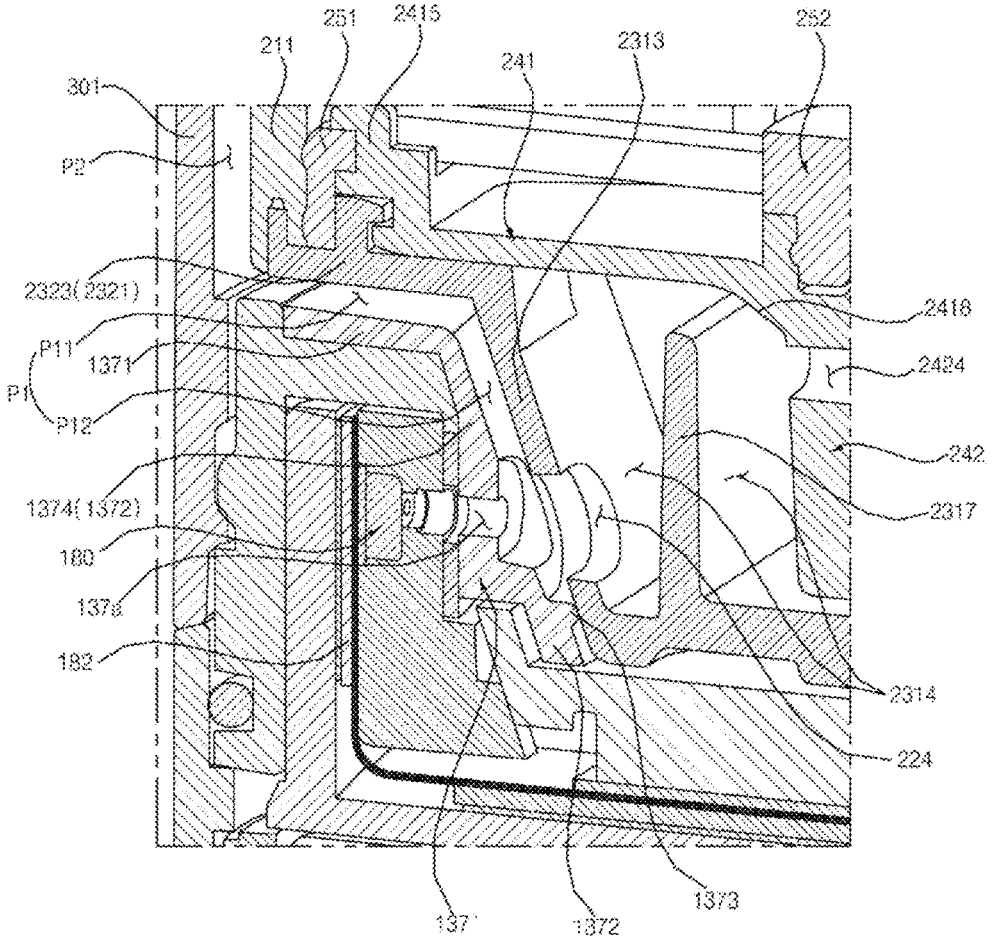

【FIG. 75】
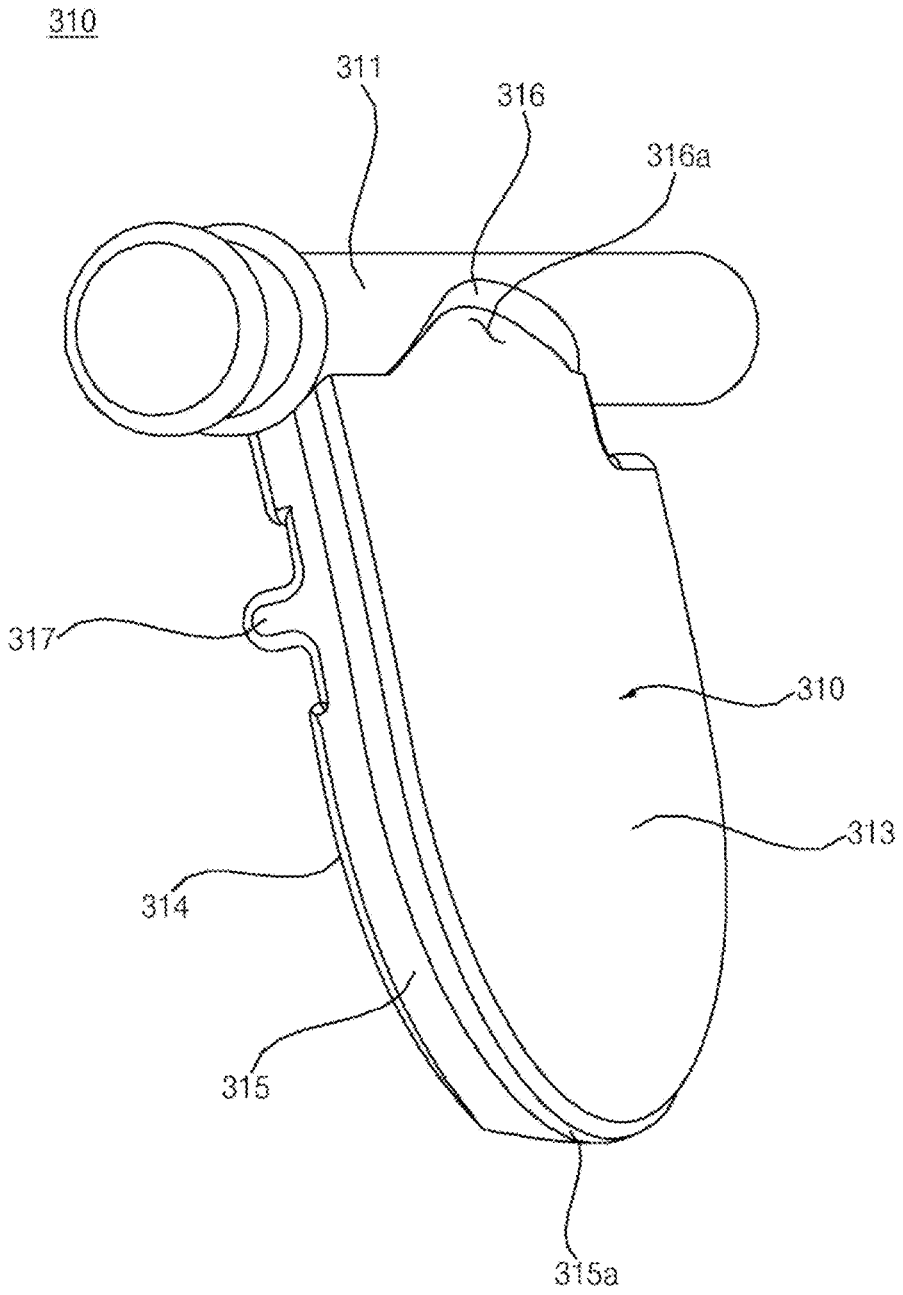

【FIG. 76】
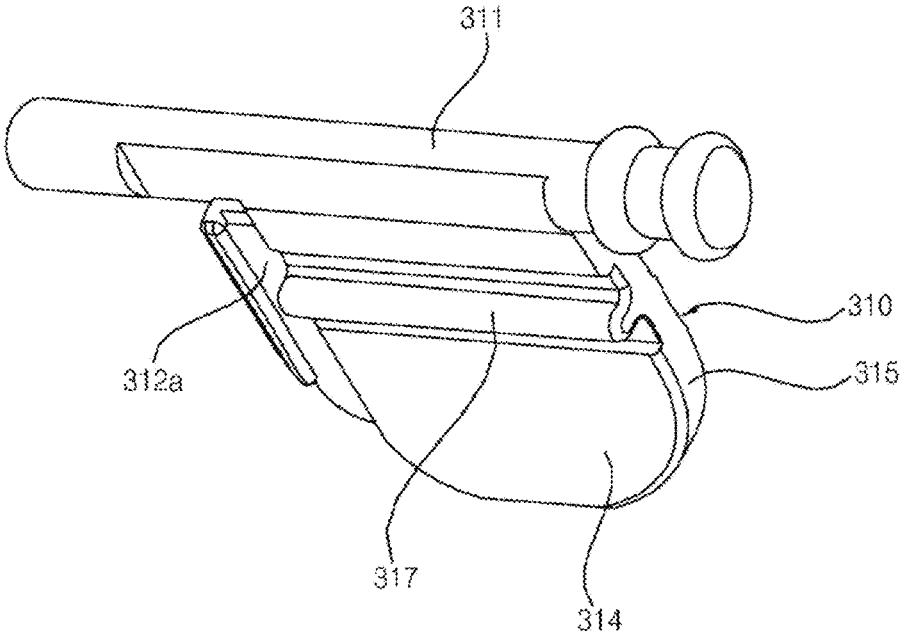

【FIG. 77】
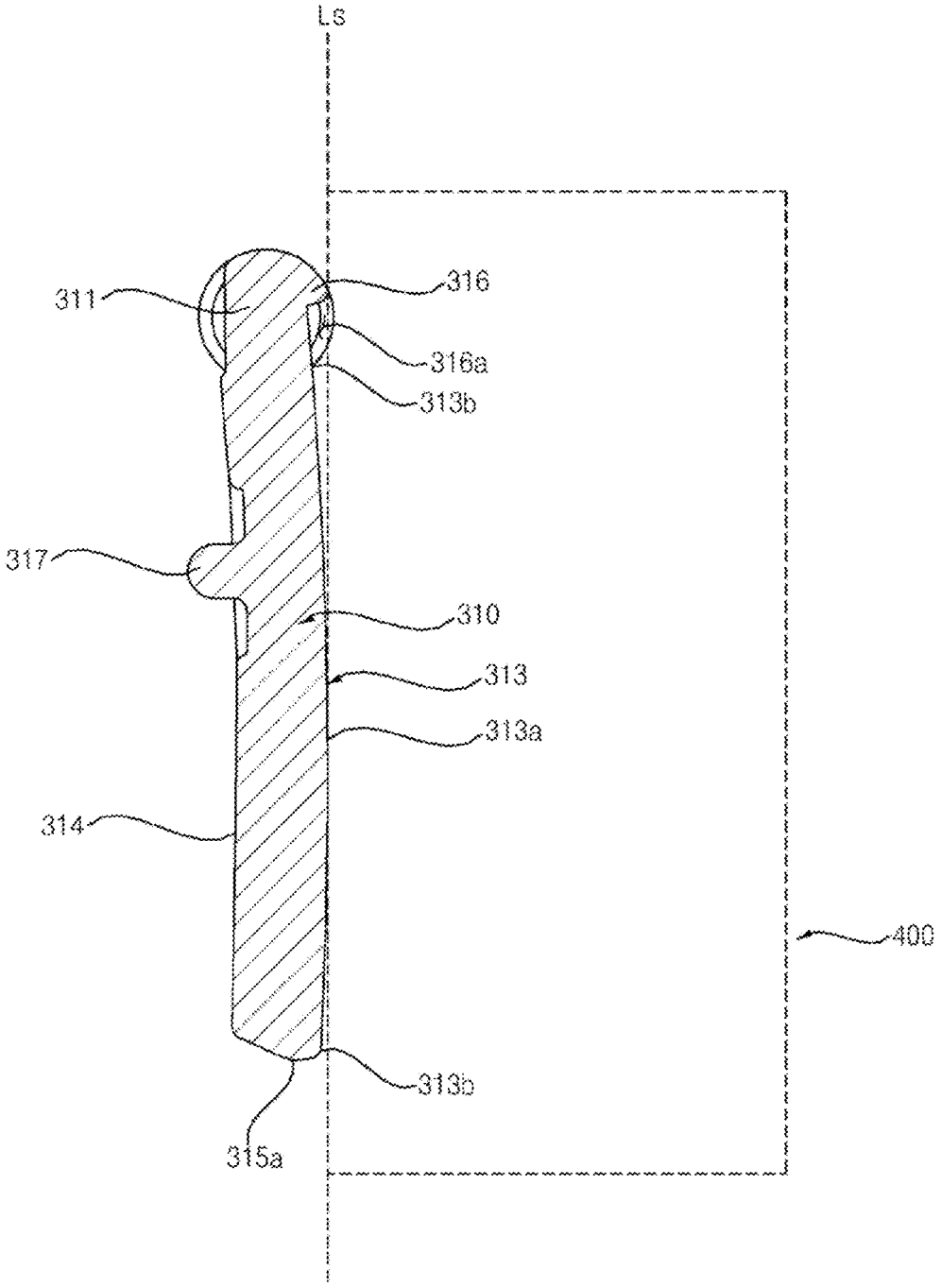

【FIG. 78】
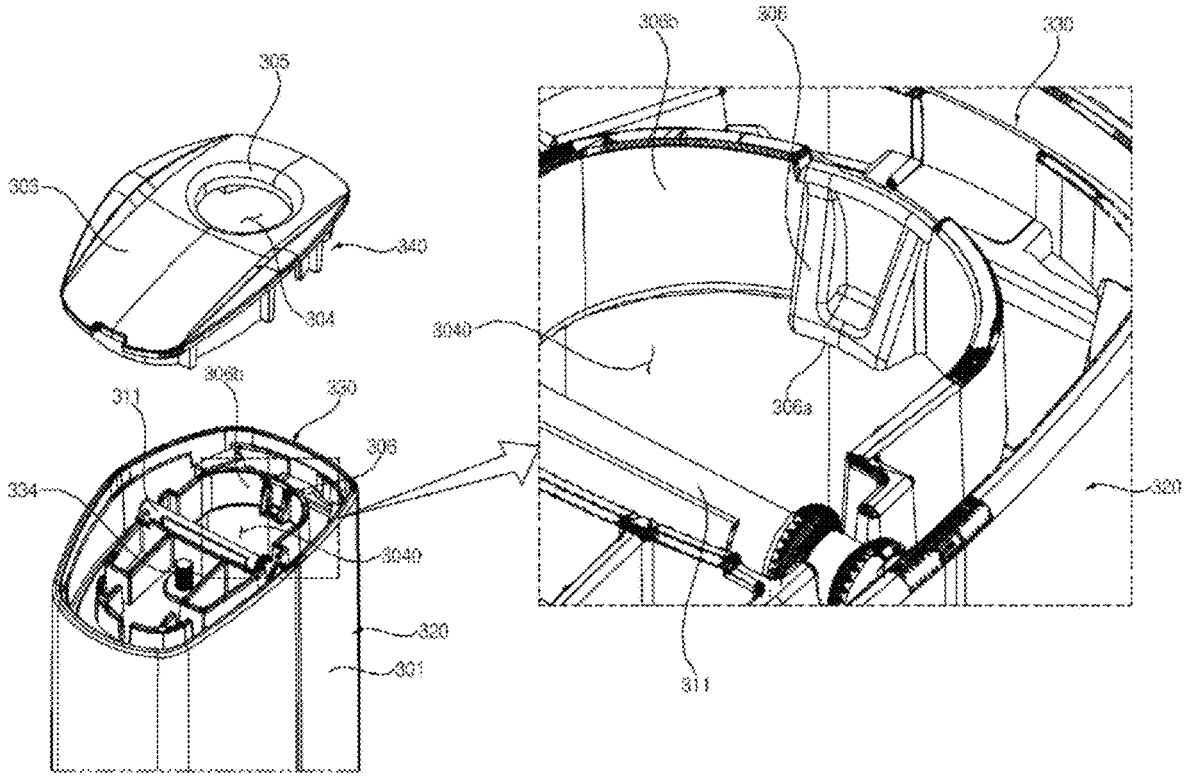

【FIG. 79】
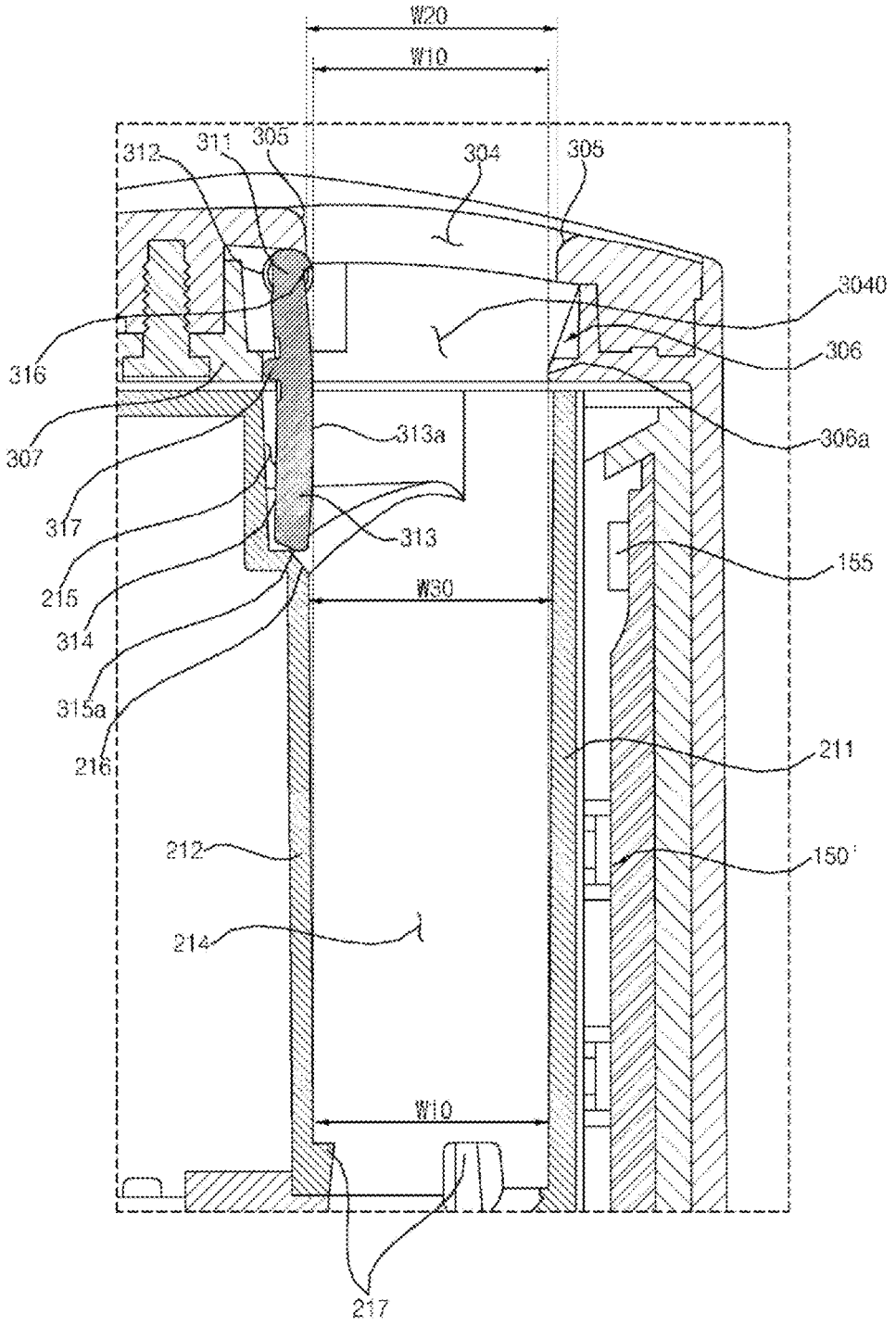

【FIG. 80】
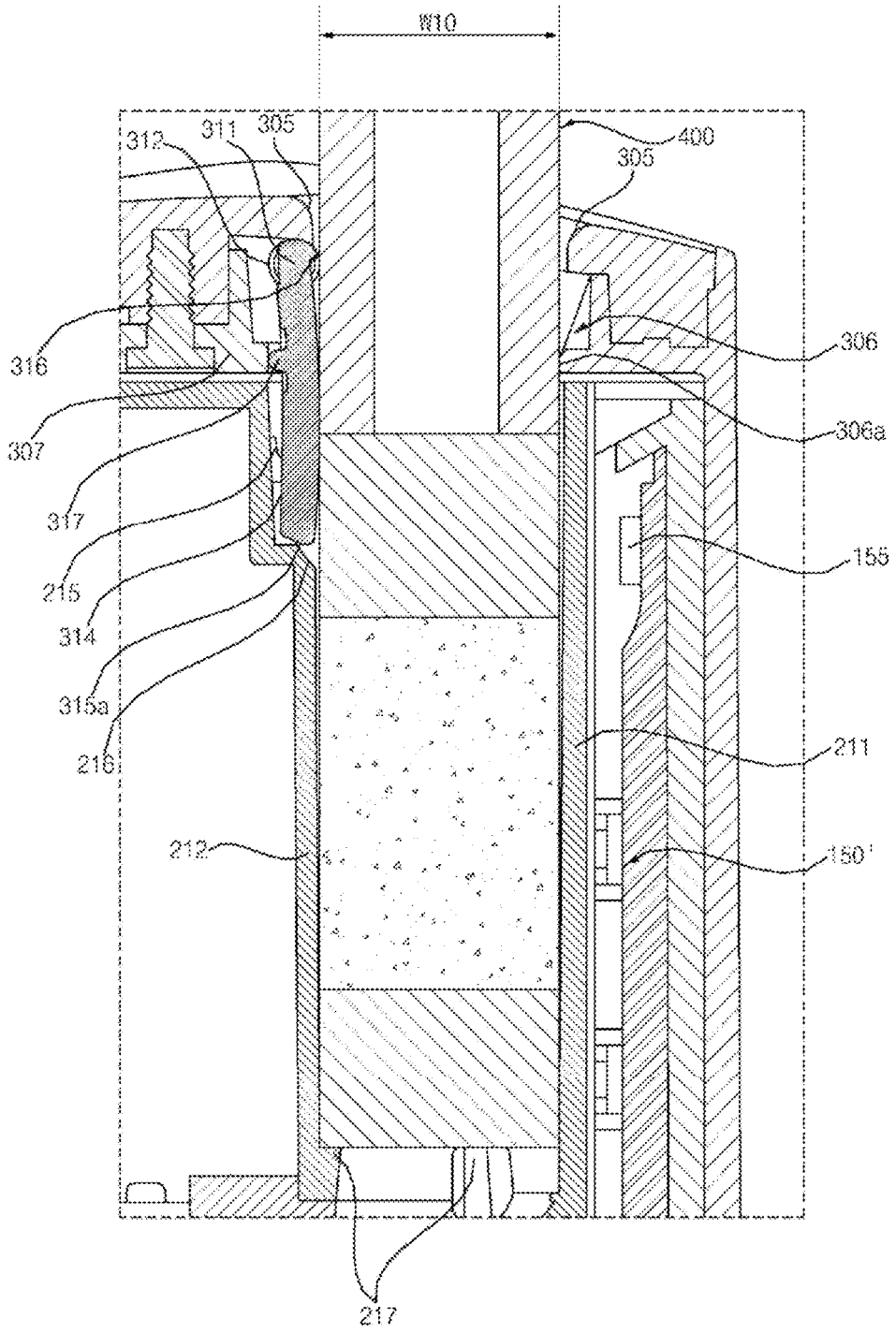

【FIG. 81】
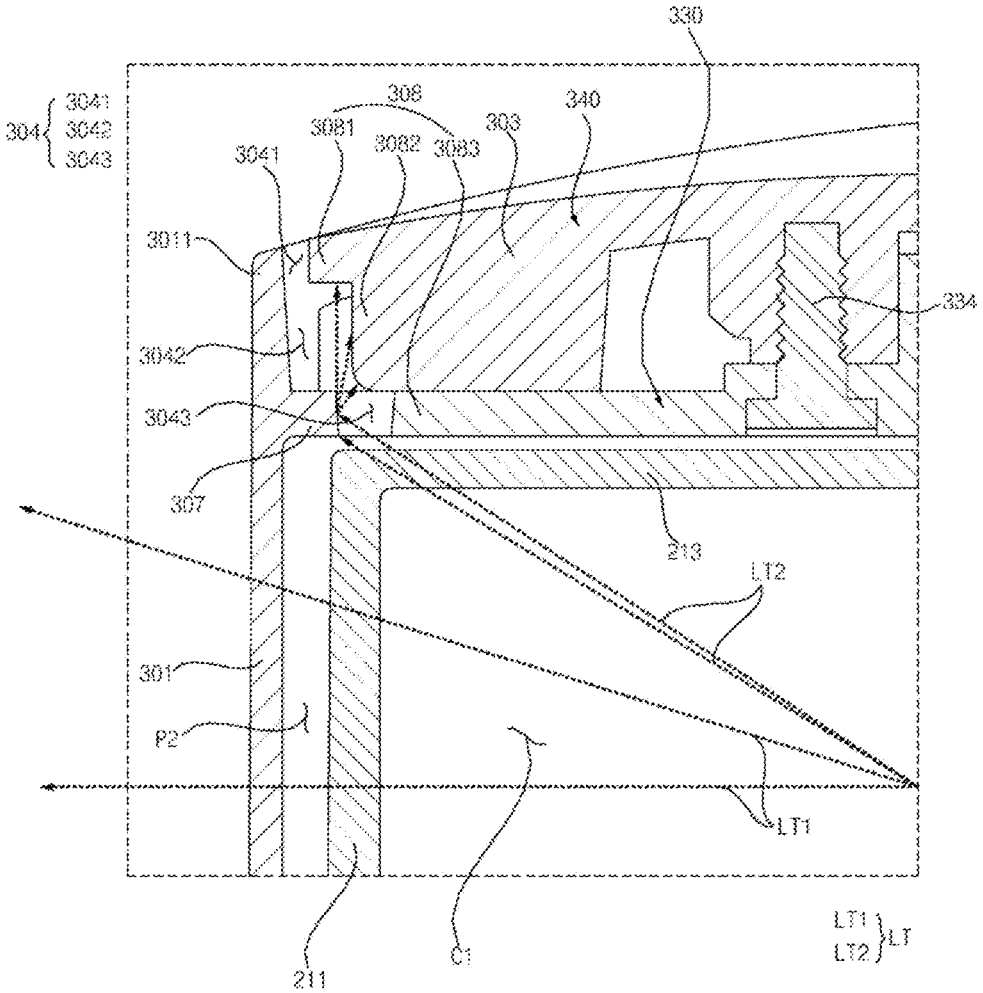

CARTRIDGE AND AEROSOL-GENERATING DEVICE INCLUDING THE SAME

CROSS-REFERENCE TO RELATED APPLICATIONS

This application is the National Stage filing under 35 U.S.C. 371 of International Application No. PCT/KR2022/008894, filed on Jun. 22, 2022, which claims the benefit of earlier filing date and right of priority to Korean Application No. 10-2021-0082963, filed on Jun. 25, 2021, the contents of which are all hereby incorporated by reference herein their entirety.

TECHNICAL FIELD

The present disclosure relates to a cartridge and an aerosol-generating device.

BACKGROUND ART

An aerosol-generating device is a device that extracts certain components from a medium or a substance by forming an aerosol. The medium may contain a multicomponent substance. The substance contained in the medium may be a multicomponent flavoring substance. For example, the substance contained in the medium may include a nicotine component, an herbal component, and/or a coffee component. Recently, various research on aerosol-generating devices has been conducted.

DISCLOSURE OF INVENTION

Technical Problem

It is an object of the present disclosure to solve the above and other problems.

It is another object of the present disclosure to provide a cartridge capable of improving gas flow efficiency and inhalation convenience and an aerosol-generating device including the same.

It is still another object of the present disclosure to provide a cartridge capable of improving assembly convenience and an aerosol-generating device including the same.

It is still another object of the present disclosure to provide a cartridge capable of ensuring stable coupling between components and an aerosol-generating device including the same.

It is still another object of the present disclosure to provide an aerosol-generating device capable of ensuring the stability of a stick insertion structure.

It is still another object of the present disclosure to provide a cartridge capable of improving the efficiency of use of a liquid storage space and an aerosol-generating device including the same.

Solution to Problem

In accordance with an aspect of the present disclosure for accomplishing the above objects, there is provided a cartridge including a container provided therein with a first chamber and an elongated insertion space; a second chamber in communication with the insertion space; a wick disposed in the second chamber and in communication with the first chamber; a heater configured to heat the wick; a chamber inlet open at one side of the second chamber in a direction intersecting a longitudinal direction of the insertion space;

and a first flow guide disposed opposite the chamber inlet with respect to the second chamber to cover an opposite side of the second chamber, wherein the first flow guide comprises a curved surface recessed to be curved toward the insertion space.

Advantageous Effects of Invention

According to at least one of embodiments of the present disclosure, a cartridge capable of improving gas flow efficiency and inhalation convenience and an aerosol-generating device including the same may be provided.

According to at least one of embodiments of the present disclosure, a cartridge capable of improving assembly convenience and an aerosol-generating device including the same may be provided.

According to at least one of embodiments of the present disclosure, a cartridge capable of ensuring stable coupling between components and an aerosol-generating device including the same may be provided.

According to at least one of embodiments of the present disclosure, an aerosol-generating device capable of ensuring the stability of a stick insertion structure may be provided.

According to at least one of embodiments of the present disclosure, a cartridge capable of improving the efficiency of use of a liquid storage space and an aerosol-generating device including the same may be provided.

Additional applications of the present disclosure will become apparent from the following detailed description. However, because various changes and modifications will be clearly understood by those skilled in the art within the spirit and scope of the present disclosure, it should be understood that the detailed description and specific embodiments, such as preferred embodiments of the present disclosure, are merely given by way of example.

BRIEF DESCRIPTION OF DRAWINGS

The above and other objects, features, and other advantages of the present disclosure will be more clearly understood from the following detailed description taken in conjunction with the accompanying drawings, in which:

FIGS. 1 to 81 are views showing examples of an aerosol-generating device according to embodiments of the present disclosure.

BEST MODE FOR CARRYING OUT THE INVENTION

Hereinafter, the embodiments disclosed in the present specification will be described in detail with reference to the accompanying drawings, and the same or similar elements are denoted by the same reference numerals even though they are depicted in different drawings, and redundant descriptions thereof will be omitted.

In the following description, with respect to constituent elements used in the following description, the suffixes "module" and "unit" are used only in consideration of facilitation of description, and do not have mutually distinguished meanings or functions.

In addition, in the following description of the embodiments disclosed in the present specification, a detailed description of known functions and configurations incorporated herein will be omitted when the same may make the subject matter of the embodiments disclosed in the present specification rather unclear. In addition, the accompanying drawings are provided only for a better understanding of the embodiments disclosed in the present specification and are not intended to limit the technical ideas disclosed in the present specification. Therefore, it should be understood that the accompanying drawings include all modifications, equivalents, and substitutions within the scope and sprit of the present disclosure.

It will be understood that although the terms "first", "second", etc., may be used herein to describe various components, these components should not be limited by these terms. These terms are only used to distinguish one component from another component.

It will be understood that when a component is referred to as being "connected to" or "coupled to" another component, it may be directly connected to or coupled to another component, or intervening components may be present. On the other hand, when a component is referred to as being "directly connected to" or "directly coupled to" another component, there are no intervening components present.

As used herein, the singular form is intended to include the plural forms as well, unless the context clearly indicates otherwise.

Referring to FIG. 1, an aerosol-generating device may include at least one of a body 100, a cartridge 200, or a cap 300.

The body 100 may include at least one of a lower body 110 or an upper body 120. The lower body 110 may accommodate various components necessary for power supply or control, such as a battery or a controller. The lower body 110 may form the external appearance of the aerosol-generating device. The upper body 120 may be disposed on the lower body 110. The cartridge 200 may be coupled to the upper body 120. The body 100 may be referred to as a main body 100.

The upper body 120 may include at least one of a mount 130 or a column 140. The mount 130 may be disposed on the lower body 110. The mount 130 may provide a space 134 into which the lower portion of the cartridge 200 is inserted. The mount 130 may have an open upper side, and may define therein the space 134. The mount 130 may surround the lower portion of the cartridge 200 inserted into the space 134. The mount 130 may fix the cartridge 200. The mount 130 may support the lower portion of the cartridge 200.

The column 140 may be disposed on the lower body 110. The column 140 may have an elongated shape. The column 140 may extend upwards from one side of the mount 130. The column 140 may face one side wall of the cartridge 200. The column 140 may be disposed parallel to the cartridge 200. The column 140 may have a shape that covers the side wall of the cartridge 200. The column 140 may support the side wall of the cartridge 200.

A first chamber C1 may be formed in a portion of the inside of a first container 210, and an insertion space 214 may be formed in another portion of the inside of the first container 210. The insertion space 214 may be disposed adjacent to the column 140. The column 140 may be disposed adjacent to the other portion of the inside of the first container 210 in which the insertion space 214 is formed.

The cartridge 200 may be detachably coupled to the body 100. The cartridge 200 may provide space for storing liquid therein. The cartridge 200 may have the insertion space 214 formed therein. One end of the insertion space 214 may be open to form an opening. The insertion space 214 may be exposed to the outside through the opening. The opening may be defined as one end of the insertion space 214.

The cartridge 200 may include at least one of a first container 210 or a second container 220. The second container 220 may be coupled to the first container 210.

The first container 210 may be coupled to the upper side of the second container 220. The first container 210 may provide space for storing liquid therein. The first container 210 may have an open upper side, and may have formed therein the insertion space 214, which is elongated in the vertical direction. A stick 400 (refer to FIG. 3) may be inserted into the insertion space 214. One side wall of the first container 210 may face the column 140. The column 140 may cover the side wall of the first container 210. The first container 210 may be disposed on the mount 130.

The second container 220 may be coupled to the lower side of the first container 210. The second container 220 may provide space for mounting a wick 261 (refer to FIG. 2) and a heater 262 (refer to FIG. 2) therein. The second container 220 may be inserted into the space 134 provided by the mount 130. The space 134 in the mount 130 may be referred to as a cartridge accommodation space 134. The mount 130 may surround the second container 220. The second container 220 may be coupled to the mount 130.

The cap 300 may be detachably coupled to the body 100. The cap 300 may cover the cartridge 200. The cap 300 may cover at least a portion of the body 100. The cap 300 may protect the cartridge 200 and/or at least a portion of the body 100 from the outside. A user may separate the cap 300 from the body 100 in order to replace the cartridge 200.

The cap 300 may be coupled to the upper portion of the body 100. The cap 300 may be coupled to the upper side of the lower body 110. The cap 300 may cover the upper body 120. The cap 300 may cover the cartridge 200. A side wall 301 of the cap 300 may surround the side portion of the cartridge 200. The side wall 301 of the cap 300 may surround the side portion of the upper body 120. An upper wall 303 of the cap 300 may cover the upper portion of the cartridge 200. The upper wall 303 of the cap 300 may cover the upper portion of the column 140.

The cap 300 may have an insertion hole 304 formed therein. The upper wall 303 of the cap 300 may be open to form the insertion hole 304. The insertion hole 304 may be formed at a position corresponding to the insertion space 214. The insertion hole 304 may communicate with one end or the upper end of the insertion space 214.

The cap 300 may have a cap inlet 304*a* formed therein. One side of the cap 300 may be open to form the cap inlet 304*a*. For example, the upper wall 303 of the cap 300 may be open to form the cap inlet 304*a*. For example, the side wall 301 of the cap 300 may be open to form the cap inlet 304*a*. The cap inlet 304*a* may communicate with the outside. Air may be introduced into the aerosol-generating device through the cap inlet 304*a*.

Referring to FIGS. 1 and 2, the cartridge 200 may be coupled to the body 100. The cartridge 200 may provide the first chamber C1 for storing liquid therein. The cartridge 200 may provide the insertion space 214, which is formed separately from the first chamber C1. The cartridge 200 may have formed therein an opening. One end of the insertion space 214 may be open to form the opening in the cartridge 200. The opening may expose the insertion space 214 to the outside.

The first container 210 may include an outer wall 211, which surrounds an inner space formed therein. The first container 210 may include an inner wall 212, which partitions the space surrounded by the outer wall 211 into the first chamber C1 on one side and the elongated insertion space 214 on another side. The insertion space 214 may have a shape that is elongated in the vertical direction. The inner wall 212 of the first container 210 may be formed inside the first container 210. A stick 400 (refer to FIG. 3) may be inserted into the insertion space 214.

The second container 220 may be coupled to the first container 210. The second container 220 may include a second chamber C2 communicating with the insertion space 214. The second chamber C2 may be formed in the second container 220. The second chamber C2 may be connected to the opposite end or the lower end of the insertion space 214.

One side of the cartridge 200 may be open to form a cartridge inlet 224. The outer wall of the second container 220 may be open to form the cartridge inlet 224. The cartridge inlet 224 may communicate with the insertion space 214. The cartridge inlet 224 may communicate with the second chamber C2. The cartridge inlet 224 may be formed in a side wall 221 of the second container 210.

The wick 261 may be disposed in the second chamber C2. The wick 261 may be connected to the first chamber C1. The wick 261 may receive liquid from the first chamber C1. The heater 262 may heat the wick 261. The heater 262 may be disposed in the second chamber C2. The heater 262 may be wound around the wick 261 multiple times. The heater 262 may be electrically connected to a battery 190 and/or a control device. The heater 262 may be a resistive coil. When the heater 262 generates heat and thus the wick 261 is heated, the liquid supplied to the wick 261 is atomized, and accordingly, an aerosol may be generated in the second chamber C2.

Accordingly, the first chamber C1 in the first container 210, in which the liquid is stored, may be disposed so as to surround the stick 400 (refer to FIG. 3) and/or the insertion space 214, into which the stick 400 is inserted, with the result that the efficiency of use of space for storing the liquid may be improved.

In addition, the distance from the stick 400 to the wick 261, which is connected to the first chamber C1, and the heater 262 may be reduced, thus making it possible to increase the efficiency of transfer of heat from the aerosol.

A printed circuit board (PCB) assembly 150 may be mounted in the column 140. At least one of a light source 153 or a sensor 154 may be mounted on a PCB 151 of the PCB assembly 150 (refer to FIG. 24). The PCB assembly 150 may be mounted so as to face the side portion of the cartridge 200. The light source 153 of the PCB assembly 150 may provide light to the cartridge 200. The sensor 154 of the PCB assembly 150 may sense information about the inside and the outside of the cartridge 200. The sensor 154 mounted on the PCB assembly 150 may be referred to as a first sensor 154.

A sensor 180 may be mounted on one side of the upper portion of the lower body 110. The sensor 180 may be disposed above a partition wall 112 of the lower body 110. The sensor 180 may sense the flow of air that is introduced into the cartridge 200. The sensor 180 may be an airflow sensor or a pressure sensor. The sensor 180 may be referred to as a second sensor 180.

The sensor 180 may be inserted into the mount 130. The sensor 180 may be disposed so as to face the side portion of the mount. The sensor 180 may be disposed adjacent to the cartridge inlet 224. The sensor 180 may be disposed so as to face the cartridge inlet 224.

The lower body 110 may accommodate the battery 190 therein. The lower body 110 may accommodate various control devices therein. The battery 190 may supply power to various components of the aerosol-generating device. The battery 190 may be charged through a charging port 119, which is formed in one side or the lower portion of the lower body 110.

The partition wall 112 of the lower body 110 may cover the upper portion of the battery 190. The partition wall 112 of the lower body 110 may be disposed below the mount 130 and/or the column 140. A body frame 114 of the lower body 110 may support the side portion of the battery 190. The body frame 114 may separate the space in which the battery 190 is accommodated from the space in which the control devices are accommodated.

Referring to FIGS. 2 and 3, the stick 400 may have an elongated shape. The stick 400 may contain a medium therein. The stick 400 may be inserted into the insertion space 214.

A cover 310 may open and close the insertion space 214. The cover 310 may open and close an opening that exposes the insertion space 214 to the outside. The cover 310 may be mounted adjacent to the opening in the insertion space 214. The cover 310 may be mounted adjacent to one end or the upper end of the insertion space 214. For example, the cover 310 may be mounted to the upper end of the first container 210 at a position adjacent to the insertion space 214. For example, the cover 310 may be mounted to the cap 300 at a position adjacent to the insertion space 214.

The cover 310 may be pivotably mounted. The cover 310 may be pivoted to open and close the insertion space 214. The cover 310 may be pivoted toward the inside of the insertion space 214 to open the insertion space 214. The direction in which the cover 310 is pivoted to open the insertion space 214 may be referred to as a first direction. The cover 310 may be pivoted toward the outside of the insertion space 214 to close the insertion space 214. The direction in which the cover 310 is pivoted to close the insertion space 214 may be referred to as a second direction.

When an end of the stick 400 is brought into contact with the cover 310 and pushes the cover 310, the cover 310 may be pivoted in the first direction to open the insertion space 214. The stick 400 may push the cover 310, and may be inserted into the insertion space 214. When the stick 400 is separated from the insertion space 214, the cover 310 may be pivoted in the second direction to close the insertion space 214.

A spring 312 (refer to FIG. 12) may provide elastic force to the cover 310 in the second direction. One end of the spring 312 may support the cover 310, and the other end of the spring 312 may support the upper end of the first container 210 or the cap 300. The spring 312 may be wound around a pivot shaft of the cover 310.

The cover 310 may be mounted near the insertion hole 304 in the cap 300. The cover 310 may be pivotably mounted to the cap 300. The cover 310 may be pivoted to open and close the insertion hole 304. The cover 310 may be pivoted in the first direction to open the insertion hole 304. The cover 310 may be pivoted in the second direction to close the insertion hole 304.

The stick 400 may be inserted into the insertion space 214 through the insertion hole 304 in the cap 300. When the end of the stick 400 is brought into contact with the cover 310 and pushes the cover 310, the cover 310 may be pivoted in the first direction to open the insertion space 214 and the insertion hole 304. The stick 400 may push the cover 310, and may be inserted into the insertion space 214 through the insertion hole 304. When the stick 400 is separated from the insertion space 214, the cover 310 may be pivoted in the second direction to close the insertion space 214 and the insertion hole 304.

When the stick 400 is inserted into the insertion space 214, one end of the stick 400 may be exposed to the outside of the cap 300, and the other end of the stick 400 may be disposed above the second chamber C2 at a position adjacent to the second chamber C2. The user may hold the exposed end of the stick 400 in the mouth, and may inhale air.

Air may be introduced into the aerosol-generating device through the cap inlet 304*a*. The air introduced through the cap inlet 304*a* may flow into the cartridge inlet 224. The air may flow into the cartridge 200 through the cartridge inlet 224. The air that has passed through the cartridge inlet 224 may be introduced into the second chamber C2, and may then flow toward the insertion space 214. The air may pass through the stick 400 together with the aerosol generated in the second chamber C2.

As described above, when the stick 400 is inserted into the insertion space 214, the insertion space 214 may be opened by the pivoting movement of the cover 310.

In addition, simultaneously with separation of the stick 400 from the insertion space 214, the insertion space 214 may be automatically closed by the pivoting movement of the cover 310.

In addition, the inside of the insertion space 214 may be protected from external foreign substances.

Referring to FIGS. 4 to 6, the cartridge 200 may be detachably coupled to the upper body 120. The upper body 120 may be disposed on the lower body 110. The upper body 120 may include at least one of the mount 130 or the column 140.

The mount 130 may provide a space 134 having an open top. The inner side surface 131 and the bottom 133 of the mount 130 may surround at least a portion of the space 134. The inner side wall 141 of the column 140 may surround one side of the space 134. The second container 220 may be inserted into the space 134 provided by the mount 130. The mount 130 may surround the second container 220 inserted into the space 134.

The cartridge 200 may be coupled to the mount 130 in a snap-fit manner. The second container 220 may be coupled to the mount 130 in a snap-fit manner. The second container 220 may be detachably engaged with the mount 130. When the second container 220 is inserted into the space 134 in the mount 130, a depressed portion 221*a* formed in the second container 220 and a protruding portion 131*a* formed on the mount 130 may be engaged with each other.

The depressed portion 221*a* may be formed so as to be recessed into the side wall 221 of the second container 220. The depressed portion 221*a* may be formed in a plural number, and the plurality of depressed portions 221*a* may be respectively formed in one side and the opposite side of the side wall 221 of the container 220. The protruding portion 131*a* may be formed so as to protrude from the inner side surface 131 of the mount 130. The protruding portion 131*a* may be provided in a plural number, and the plurality of protruding portions 131*a* may be respectively formed on one side and the opposite side of the inner side surface 131 of the mount 130. The protruding portions 131*a* may be formed at positions corresponding to the depressed portions 221*a*.

When the second container 220 is coupled to the mount 130, the first container 210 may be disposed on the mount 130. The first container 210 may have a shape that protrudes further in a lateral direction than the second container 220. The second container 220 may be inserted into the space 134 surrounded by the mount 130, and the first container 210 may cover the upper portion of the mount 130.

The mount 130 may support the lower portion of the cartridge 200. The mount 130 may support the side portion and the bottom of the second container 220. The mount 130 may support the lower edge of the first container 210.

The column 140 may extend upwards from one side of the mount 130. The column 140 may surround one side of the space 134 in the mount 130. The inner side wall 141 of the column 140 may be integrally formed with and extend from the inner side surface 131 of the mount 130. The outer side wall 142 of the column 140 may be integrally formed with and extend from the outer side surface 132 of the mount 130.

The column 140 may extend to a height corresponding to the height of the cartridge 200. The upper wall 143 of the column 140 may be formed to a height corresponding to the upper end of the cartridge 200. The column 140 may be formed parallel to the cartridge 200.

The insertion space 214 in the cartridge 200 may be formed adjacent to one side wall of the cartridge 200. The insertion space 214 may be formed adjacent to the column 140. The column 140 may cover the side wall of the cartridge 200, in which the insertion space 214 is formed. The side wall of the cartridge 200 may slide along the inner side wall 141 of the column 140, and may be inserted into the mount 130. The column 140 may support the side wall of the cartridge 200.

A window 170, which protects the PCB assembly 150 (refer to FIG. 3), may be disposed so as to cover the inner side wall 141 of the column 140. The window 170 may be disposed between the cartridge 200 and the column 140. The window 170 may extend in the vertical direction along the column 140. The window 170 may cover one side wall of the cartridge 200, in which the insertion space 214 is formed. The window 170 may support the side wall of the cartridge 200.

Accordingly, the cartridge 200 may be detachably coupled to the body 100.

In addition, the cartridge 200 may be coupled to the body 100, and may thus be stably supported thereby.

Referring to FIGS. 7 to 11, the cap 300 may be detachably coupled to the body 100. The cap 300 may protect the cartridge 200 and a portion of the body 100 from the outside. The user may separate the cap 300 from the body in order to replace the cartridge 200.

The upper body 120 may have coupling protrusions 132*a* and 132*b* formed on the outer side surfaces 132 and 142 thereof. The coupling protrusions 132*a* and 132*b* may be formed on the outer side surface 132 of the mount 130. The coupling protrusions 132*a* and 132*b* may be formed on the outer side wall 142 of the column 140. The coupling protrusions 132*a* and 132*b* may include a first coupling protrusion 132*a* and a second coupling protrusion 132*b*. The first coupling protrusion 132*a* and the second coupling protrusion 132*b* may be arranged vertically relative to each other.

The first coupling protrusion 132*a* may be formed so as to protrude outwards from the outer side surface of the upper body 120. The first coupling protrusion 132*a* may be provided in a plural number. One of the plurality of first coupling protrusions 132*a* may be formed so as to protrude outwards from the outer side surface 132 of the mount 130. This first coupling protrusion 132*a* may be formed at a position opposite the column 140. The other of the plurality of first coupling protrusions 132*a* may be formed so as to protrude outwards from the outer side wall 142 of the column 140.

The first coupling protrusion 132*a* may protrude further outwards than the second coupling protrusion 132*b*. The first coupling protrusion 132*a* may be disposed below the second coupling protrusion 132*b*. The first coupling protrusion 132*a* may be narrower than the second coupling protrusion 132*b*. The first coupling protrusion 132*a* may have a shape in which the width thereof in the lateral direction is relatively small. The first coupling protrusion 132*a* may have a shape in which the width thereof gradually decreases from the lower side thereof toward the upper side thereof.

The second coupling protrusion 132*b* may be formed so as to protrude outwards from the outer side surface of the upper body 120. The second coupling protrusion 132*b* may protrude in a convex or round shape. The second coupling protrusion 132*b* may be provided in a plural number. One of the plurality of second coupling protrusions 132*b* may be formed so as to protrude outwards from the outer side surface 132 of the mount 130. This second coupling protrusion 132*b* may be formed at a position opposite the column 140. This second coupling protrusion 132*b* may have a shape that is elongated along the circumference of the outer side surface 132 of the mount 130. The other of the plurality of second coupling protrusions 132*b* may be formed so as to protrude outwards from the outer side wall 142 of the column 140. This second coupling protrusion 132*b* may have a shape that is elongated along the circumference of the outer side wall 142 of the column 140.

Coupling recesses 302*a* and 302*b* may be formed in the inner side surface 302 of the cap 300. The coupling recesses 302*a* and 302*b* may be formed at positions corresponding to the coupling protrusions 132*a* and 132*b*. When the cap 300 covers the cartridge 200 and the upper body 120, the coupling protrusions 132*a* and 132*b* may be fitted into the coupling recesses 302*a* and 302*b*, and accordingly, the cap 300 may be coupled to the upper body 120. The coupling recesses 302*a* and 302*b* may include a first coupling recess 302*a* and a second coupling recess 302*b*. The first coupling recess 302*a* and the second coupling recess 302*b* may be arranged vertically relative to each other.

The first coupling recess 302*a* may be formed so as to be recessed outwards in the inner side surface 302 of the cap 300. The first coupling recess 302*a* may be formed in the inner side surface 302 of the cap 300 at a position corresponding to the first coupling protrusion 132*a*. The first coupling recess 302*a* may be formed in a plural number. The first coupling recesses 302*a* may have a shape in which the width thereof gradually decreases toward the upper side thereof. The first coupling protrusion 132*a* may be inserted into the first coupling recess 302*a*. When the first coupling protrusion 132*a* is inserted into the first coupling recess 302*a*, the first coupling protrusion 132*a* and the first coupling recess 302*a* may guide placement of the cap 300 at the correct position.

The second coupling recess 302*b* may be formed so as to be recessed outwards in the inner side surface 302 of the cap 300. The second coupling recess 302*b* may be recessed in a convex or round shape. The second coupling recess 302*b* may be formed in the inner side surface 302 of the cap 300 at a position corresponding to the second coupling protrusion 132*b*. The second coupling recess 302*b* may be formed in a plural number. The second coupling recesses 302*b* may have a shape that is elongated along the circumference of the inner side surface 302 of the cap 300. The second coupling protrusion 132*b* may be inserted into and engaged with the second coupling recess 302*b* in a snap-fit manner. The second coupling protrusion 132*b* and the second coupling recess 302*b* may be detachably engaged with each other.

An upper edge 113 of the lower body 110 may protrude further outwards than the upper body 120. The upper edge 113 of the lower body 110 may extend along the circumference of the upper body 120. The upper edge 113 of the lower body 110 may be disposed below the upper body 120. When the cap 300 is coupled to the body 100, the lower end of the side wall 301 of the cap 300 may be brought into contact with the upper edge 113 of the lower body 110. The upper edge 113 of the lower body 110 may prevent the cap 300 from moving to a position below the upper body 120.

Referring to FIGS. 12 and 13, the cap 300 may include at least one of a cap body 320, a lower head 330, or an upper head 340. The cover 310 may be pivotably mounted to the cap 300. The cover 310 may be disposed so as to close the insertion hole 304. The cover 310 may have a plate shape. The cover 310 may include a peripheral portion formed to be round along the circumference of the insertion hole.

A shaft 311 may be formed at an end of the cover 310. The shaft 311 may be integrally formed with the cover 310. The shaft 311 may have a shape that is elongated in one direction. The cover 310 may pivot about the direction in which the shaft 311 extends. The shaft 311 may function as a pivot shaft of the cover 310. The shaft 311 may protrude from the end of the cover 310 in two opposite directions. The shaft 311 may be referred to as a cover shaft 311.

The spring 312 may be coupled to the cover 310. One end of the spring 312 may support the cover 310, and the other end of the spring 312 may support one side of the cap 300 (refer to FIGS. 17 and 18). The other end of the spring 312 may support the upper head 340. The spring 312 may move the cover 310 in the second direction using the elastic force or the restoring force thereof. The cover 310 may be moved in the second direction by the spring 312, thereby closing the insertion space 214 (refer to FIG. 17) and/or the insertion hole 304. The spring 312 may be wound around the shaft 311. One end of the spring 312 wound around the shaft 311 may extend toward the cover 310, and the other end thereof may extend in a direction opposite the one end thereof.

The cap body 320 may form the side wall 301 of the cap 300. The cap body 320 may have a vertically open and hollow shape. The cap body 320 may cover the side portion of the cartridge 200 and the side portion of the upper body 120. The cap body 320 may include a coupling rib 322. The coupling rib 322 may be formed so as to protrude inwards from the inner side surface 302 of the cap body 320. The coupling rib 322 may have a shape that extends along the circumference of the side wall 301 of the cap body 320. The coupling rib 322 may be formed at the upper portion of the cap body 320.

The coupling rib 322 may have formed therein at least one of a first rib recess 323 or a second rib recess 324. The first rib recess 323 may be formed so as to be recessed outwards in the coupling rib 322. The first rib recess 323 may be formed in one side of the coupling rib 322. The second rib recess 324 may be formed in a manner such that the lower portion of the coupling rib 322 is recessed upwards. The second rib recess 324 may be formed in a plural number, and the plurality of second rib recesses 324 may be arranged along the circumference of the coupling rib 322.

The lower head 330 and the upper head 340 may be coupled to each other in the vertical direction to form the upper portion of the cap 300. The lower head 330 may be coupled to the lower side of the upper head 340. The lower head 330 may surround the lower side of the insertion hole 304.

The lower head 330 may have shaft recesses 331 formed therein. The shaft recesses 331 may be formed in two opposite sides of the lower head 330. The shaft recesses 331 may have a shape that is concavely recessed downwards.

The shaft 311 may be rotatably inserted into the shaft recesses 331. Each of the two opposite ends of the shaft 311 may be inserted into a respective one of the pair of shaft recesses 331.

The lower head 330 may include a head rib 332. The head rib 332 may have a shape that extends along the circumference of the lower head 330. The head rib 332 may be disposed below the coupling rib 322. The head rib 332 may catch on the lower portion of the coupling rib 322.

The lower head 330 may include a first head latch 333. The head latch 333 may be formed so as to protrude upwards from the head rib 332. When the head rib 332 is disposed adjacent to the lower side of the coupling rib 322, the head latch 333 may catch on the upper portion of the coupling rib 322.

The lower head 330 may include a guide bar 335. The guide bar 335 may be formed on one side of the head rib 332. The guide bar 335 may have a shape that is elongated upwards. When the head rib 332 is disposed adjacent to the lower side of the coupling rib 322, the guide bar 335 may be inserted into the first rib recess 323. The guide bar 335 may be inserted into the first rib recess 323, thereby guiding the disposition of the lower head 330.

A screw 334 may fix the lower head 330 and the upper head 340 to each other. The screw 334 may penetrate the lower portion of the lower head 330, and may be fixed to the upper head 340.

The cap 300 may include a second guide 306. The second guide 306 may be formed at the lower head 330. The second guide 306 may be formed near the insertion hole 304. The second guide 306 may be disposed below the insertion hole 304. The second guide 306 may be disposed between the insertion hole 304 and the insertion space 214. The second guide 306 may be formed so as to be inclined downwards. The second guide 306 may extend from a portion near the insertion hole 304 in the cap 300 so as to be inclined toward one end or the upper end of the insertion space 214 (refer to FIG. 17).

The upper head 340 may be coupled to the upper portion of the cap body 320 to form the upper wall 303 of the cap 300. The upper wall 303 of the cap 300 may be referred to as an upper head wall 303. The upper head 340 may be coupled to the upper side of the lower head 330. The circumference of the upper head wall 303 may catch on the upper side of the coupling rib 322.

The upper head 340 may include a second head latch 343. The second head latch 343 may be formed so as to protrude downwards from the circumference of the upper head wall 303. When the circumference of the upper head wall 303 catches on the coupling rib 322, the second head latch 343 may be engaged with the second rib recess 324 formed in the coupling rib 322.

The cap 300 may have formed therein the insertion hole 304, which communicates with one end of the insertion space 214. The cap 300 may include an insertion hole wall 305, which defines the circumference of the insertion hole 304. A portion of the upper head wall 303 of the cap 300 may be open to form the insertion hole 304. The insertion hole wall 305 may have a shape that extends in a circumferential direction. The inner circumferential surface of the insertion hole wall 305 may surround the circumference of the insertion hole 304.

The inner circumferential surface of the insertion hole wall 305 may be formed to be round. The inner circumferential surface of the insertion hole wall 305 may be formed to be convex inwards. The inner circumferential surface of the insertion hole wall 305 may have a shape that gradually narrows the insertion hole 304 and then gradually widens the insertion hole 304 from the upper side thereof toward the lower side thereof.

An end portion or the circumference of the cover 310 may catch on the lower side of the insertion hole wall 305. When the cover 310 closes the insertion hole 304, the insertion hole wall 305 may come into contact with the cover 310, thereby restricting the movement of the cover 310. The insertion hole wall 305 may come into contact with the end portion or the circumference of the cover 310, thereby preventing the cover 310 from pivoting to a position above the insertion hole 304. The cover 310 may be larger than the insertion hole 304.

Referring to FIGS. 14 and 15, the cartridge 200 may have a cover recess 215 formed therein. The cover recess 215 may be adjacent to the opening in the insertion space 214. The cover recess 215 may be recessed from the insertion space 214 in the direction in which the circumference of the insertion space 214 expands. The cover recess 215 may be recessed outwards from the insertion space 214. The cover recess 215 may be recessed from the insertion space 214 in a radially outward direction. The cover recess 215 may be recessed from the insertion space 214 toward the first chamber C1. The cover recess 215 may provide space in which to place the cover 310.

The cover recess 215 may be formed in the first container 210 at a position near one end or the upper end of the insertion space 214. The cover recess 215 may be formed in a manner such that the circumference of the end portion of the insertion space 214 is recessed outwards. The cover 310 may be received in the cover recess 215 (refer to FIGS. 17 and 18). When the cover 310 opens the opening in the insertion space 214, the cover 310 may be received in the cover recess 215. When the cover 310 opens the opening in the insertion space 214, the cover 310 may pivot in the first direction to be received in the cover recess 215.

The cover recess 215 may be formed in a manner such that one end portion or the upper end portion of the inner wall 212 of the first container 210 is recessed outwards from the insertion space 214. The cover recess 215 may be formed in a manner such that the inner wall 212 of the first container 210 is recessed from the insertion space 214 toward the first chamber C1. The inner wall 212 of the first container 210 may define the cover recess 215. The inner wall 212 of the first container 210 may surround at least a portion of the cover recess 215. The inner wall 212 of the first container 210 may be contiguous with the bottom of the cover recess 215. The inner wall 212 of the first container 210 may cover a part of the side portion of the cover recess 215.

The cartridge 200 may include a first guide 216, which is formed at a position adjacent to the upper portion of the insertion space 214 so as to be inclined in the downward direction of the insertion space 214. The first guide 216 may be formed at the upper end portion of the inner wall 212 of the first container 210. The first guide 216 may be referred to as a first stick guide 216.

The first guide 216 may be contiguous with the bottom of the cover recess 215. The first guide 216 may be formed on the inner wall 212 of the first container 210 at a position that is contiguous with the bottom of the cover recess 215. The first guide 216 may be formed between the bottom of the cover recess 215 and the insertion space 214. The first guide 216 may be disposed below the cover recess 215. The first guide 216 may be formed so as to be inclined from the bottom of the cover recess 215 toward the lower side of the insertion space 214.

The first guide 216 may extend in the circumferential direction along at least a portion of the insertion space 214. The first guide 216 may extend in the circumferential direction along the inner wall 212 of the first container 210. The first guide 216 may come into contact with an end portion of the stick 400 (refer to FIG. 3), and may guide insertion of the stick 400 into the insertion space 214.

Referring to FIG. 15, the cartridge 200 may include at least one of a first container 210, a second container 220, a sealing member 250, a wick 261, or a heater 262. The second container 220 may include at least one of a lower case 230 or a frame 240.

The first container 210 may provide the first chamber C1 and the insertion space 214. The inner wall 212 of the first container 210 may partition the space surrounded by the outer wall 211 of the first container 210 into the first chamber C1 on one side and the insertion space 214 on another side.

The outer wall 211 and the inner wall 212 of the first container 210 may surround the side portion of the first chamber C1. The outer wall 211 and the inner wall 212 of the first container 210 may be connected to each other so as to have an extended shape that surrounds the circumference of the first chamber C1. The upper wall 213 of the first container 210 may cover the upper portion of the first chamber C1. The upper wall 213 of the first container 210 may be connected to the outer wall 211 and the inner wall 212 of the first container 210.

The outer wall 211 and the inner wall 212 of the first container 210 may surround the side portion of the insertion space 214. The insertion space 214 may have a shape that is elongated in the vertical direction. The insertion space 214 may have a shape corresponding to the circumference of the stick 400 (refer to FIG. 3). The insertion space 214 may have a substantially cylindrical shape. The outer wall 211 and the inner wall 212 of the first container 210 may be connected to each other, and may thus have a shape that extends in the circumferential direction so as to surround the circumference of the insertion space 214. The insertion space 214 may have open upper and lower end portions.

The second container 220 may provide the second chamber C2. The second chamber C2 may be disposed below the insertion space 214. The second chamber C2 may communicate with the insertion space 214.

The second container 220 may include at least one of a lower case 230 or a frame 240. The lower case 230 may form the external appearance of the second container 220. The lower case 230 may be coupled to the outer wall 211 or the circumference of the first container 210. The lower case 230 may provide an accommodation space therein. The lower case 230 may support the frame 240. The side wall of the lower case 230 may be open to form the cartridge inlet 224. The cartridge inlet 224 may be formed at a position higher than the bottom of the lower case 230.

Accordingly, it is possible to prevent the liquid in the second chamber C2 from leaking out of the cartridge 200 through the cartridge inlet 224.

The lower case 230 may include at least one of an accommodation portion 231 or an extension portion 232. The accommodation portion 231 may provide an accommodation space therein. The accommodation portion 231 may surround the accommodation space. The accommodation portion 231 may accommodate at least a portion of the frame 240 therein. The side wall of the accommodation portion 231 may be the side wall 221 of the second container 220 (refer to FIG. 4). The side wall of the accommodation portion 231 may be open to form the cartridge inlet 224. The extension portion 232 may extend outwards from the upper end of one side of the accommodation portion 231. The extension portion 232 may support a portion of the frame 240. The accommodation portion 231 may be referred to as a case portion 231.

The frame 240 may be disposed in the lower case 230. The frame 240 may define the second chamber C2. The frame 240 may surround at least a portion of the second chamber C2. The lower case 230 may surround the remaining portion of the second chamber C2. The frame 240 may form the bottom of the first chamber C1.

The frame 240 may include at least one of a first frame portion 241 or a second frame portion 242. The first frame portion 241 may form the bottom of the first chamber C1. The first chamber C1 may be surrounded by the outer wall 211, the inner wall 212, the upper wall 213, and the first frame portion 241 of the first container 210.

The second frame portion 242 may surround at least a portion of the second chamber C2. The second frame portion 242 may define the second chamber C2. The side wall of the second frame portion 242 may surround at least a part of the side portion of the second chamber C2. The bottom of the second frame portion 242 may form the bottom of the second chamber C2. A chamber inlet 2424 may be formed in the side wall of the second frame portion 242. The chamber inlet 2424 may communicate with the second chamber C2. The second frame portion 242 may be disposed adjacent to the lower side of the inner wall 212 of the first container 210. The chamber inlet 2424 may be formed at a position higher than the bottom of the second chamber C2.

The first frame portion 241 and the second frame portion 242 may be connected to each other. The first frame portion 241 may extend from the second frame portion 242 so as to cover the bottom of the first chamber C1.

The accommodation portion 231 may accommodate the second frame portion 242 therein. The accommodation portion 231 may support the bottom of the second frame portion 242. The accommodation portion 231 may define the second chamber C2 together with the second frame portion 242. The extension portion 232 may support the first frame portion 241. The second frame portion 242 may be disposed in the accommodation portion 231, and the first frame portion 241 may be disposed on the extension portion 232.

A connection passage 2314 may be formed in the accommodation portion 231. The frame 240 may define the connection passage 2314 in the lower case 230. The connection passage 2314 may be formed between the cartridge inlet 224 and the chamber inlet 2424 to interconnect the cartridge inlet 224 and the chamber inlet 2424. The first frame portion 241 may cover the upper portion of the connection passage 2314. The second frame portion 242 may cover the side portion of the connection passage 2314.

A blocking wall 2317 may be formed in the connection passage 2314. The blocking wall 2317 may be formed between the cartridge inlet 224 and the chamber inlet 2424. The blocking wall 2317 may have an elongated shape. The blocking wall 2317 may extend upwards from the bottom of the lower case 230 or the bottom of the frame 240. The blocking wall 2317 may extend to a position higher than the cartridge inlet 224. The blocking wall 2317 may extend to a position higher than the chamber inlet 2424.

Accordingly, it is possible to prevent the liquid in the second chamber C2 from leaking out of the cartridge 200 through the cartridge inlet 224.

A sealing member 250 may be disposed between the first chamber C1 and the second container 220. The sealing member 250 may surround and be in close contact with the edge of the first chamber C1. The sealing member 250 may be made of an elastic material. For example, the sealing member 250) may be made of a material such as rubber or silicon. The sealing member 250 may prevent the liquid stored in the first chamber C1 from leaking from the first chamber C1 into gaps between components.

The sealing member 250 may include at least one of a first sealing portion 251 or a second sealing portion 252. The first sealing portion 251 may extend along the outer wall 211 of the first container 210. The first sealing portion 251 may surround the edge of the outer wall 211 of the first container 210. The first sealing portion 251 may be disposed between and be in close contact with the outer wall 211 of the first container 210 and the frame 240. The first sealing portion 251 may be disposed between and be in close contact with the outer wall 211 of the first container 210 and the first frame portion 241.

Accordingly, it is possible to prevent the liquid stored in the first chamber C1 from leaking through the gap between the outer wall 211 of the first container 210 and the frame 240.

The second sealing portion 252 may extend from the first sealing portion 251 along the inner wall 212 of the first container 210. The second sealing portion 252 may surround and be in close contact with the edge of the inner wall 212 of the first container 210. The second sealing portion 252 may be disposed between and be in close contact with the inner wall of the first container 210 and the frame 240. The second sealing portion 252 may be disposed between and be in close contact with the inner wall of the first container 210 and the second frame portion 242. The second sealing portion 252 may be inserted into the frame 240. The second sealing portion 252 may be inserted into the second frame portion 242. The lower end of the inner wall 212 of the first container 210 may press the second sealing portion 252 toward the frame 240.

Accordingly, it is possible to prevent the liquid stored in the first chamber C1 from leaking into the gap between the inner wall 212 of the first container 210 and the frame 240.

The mount 130 may include a sensor accommodation portion 137. The sensor accommodation portion 137 may provide space that is formed at the lower portion of one side wall of the mount 130. The second sensor 180 may be accommodated in the sensor accommodation portion 137. The lower case 230 may cover the sensor accommodation portion 137. The lower case 230 may surround one side of the sensor accommodation portion 137. One side wall of the accommodation portion 231 of the lower case 230 may face the side portion of the sensor accommodation portion 137. The extension portion 232 of the lower case 230 may cover the upper portion of the sensor accommodation portion 137.

A gap through which air flows may be formed between the sensor accommodation portion 137 and the lower case 230. Air may pass through the gap between the sensor accommodation portion 137 and the lower case 230, and may be introduced into the cartridge inlet 224. The second sensor 180 may sense the flow of air into the cartridge inlet 224 through the gap between the sensor accommodation portion 137 and the lower case 230.

Referring to FIGS. 15 and 16, the cartridge 200 may include a stick stopper 217, which protrudes inwards from the circumference of the insertion space 214 at a position adjacent to the opposite end or the lower end of the insertion space 214. The stick stopper 217 may protrude in the radially inward direction. The stick stopper 217 may be formed on the outer wall 211 and/or the inner wall 212 of the first container 210.

The stick stopper 217 may be provided in a plural number. Three stick stoppers 217 may be provided. A plurality of stick stoppers 217 may be arranged along the circumference of the insertion space 214. The stick stoppers 217 may be arranged in the circumferential direction. The stick stoppers 217 may be spaced apart from each other. The stick stoppers 217 may be formed in the shape of a rib or a ring that extends in the circumferential direction along the circumference of the insertion space 214. The stick 400 may be seated over the stick stoppers 217. The stick stoppers 217 may have a shape that gradually widens in the upward direction.

Accordingly, when the stick 400 is inserted into the insertion space 214, the end of the stick 400 may be brought into contact with the stick stoppers 217, with the result that the stick 400 may be prevented from moving to the second chamber C2 beyond the insertion space 214.

In addition, it is possible to minimize a reduction in the amount of air flowing from the second chamber C2 to the insertion space 214.

In addition, the stick stoppers 217 may not impede the aerosol generated in the second chamber C2 from extracting a certain component from the medium in the stick 400.

Referring to FIGS. 17 and 18, the pivot shaft or the shaft 311 of the cover 310 may be disposed above the insertion space 214. The pivot shaft or the shaft 311 of the cover 310 may be disposed between the insertion space 214 and the insertion hole 304. The cover 310 may be pivoted toward the inside of the insertion space 214 to open the insertion space 214 and/or the insertion hole 304. The direction in which the cover 310 is pivoted toward the inside of the insertion space 214 may be defined as a first direction.

When the cover 310 is pivoted in the first direction to open the insertion space 214, the cover 310 may be received in the cover recess 215. When the cover 310 opens the insertion space 214, the cover 310 may be received in the cover recess 215, and may overlap the inner wall 212 of the first container 210, which is disposed below the cover recess 215. When the cover 310 opens the insertion space 214, the cover 310 may be disposed parallel to the inner wall 212 of the first container 210, which is located below the cover recess 215.

The first guide 216 may be formed so as to be inclined from the bottom of the cover recess 215 toward the lower side of the insertion space 214. The first guide 216 may be formed so as to be inclined such that the insertion space 214 is gradually narrowed toward the lower side thereof. When the cover 310 opens the insertion space 214, the first guide 216 may be disposed adjacent to one end of the cover 310 at a position below the cover 310. When the cover 310 opens the insertion space 214, the first guide 216 may protrude toward the insertion space 214 further than the end of the cover 310.

The cover 310 may be pivoted toward the outside of the insertion space 214 to close the insertion space 214 and/or the insertion hole 304. The direction in which the cover 310 is pivoted toward the outside of the insertion space 214 may be defined as a second direction. One end of the spring 312 may support the cover 310, and the other end of the spring 312 may support the cap 300. The spring 312 may provide elastic force to the cover 310 in the direction in which the cover 310 closes the insertion space 214. The cover 310 may be pivoted in the second direction by the spring 312.

The second guide 306 may be formed so as to be inclined such that the inner space is gradually narrowed toward the lower side thereof. The second guide 306 may be disposed adjacent to the pivoting radius of the cover 310. The second guide 306 may be disposed outside the pivoting radius of the cover 310. The second guide 306 may extend so as to be inclined along the pivoting radius of the cover 310.

One end of the second guide 306 may be adjacent to the insertion hole 304. The end of the second guide 306 may be disposed outside the insertion hole 304. The end of the second guide 306 may be disposed below the insertion hole wall 305. The insertion hole wall 305 may protrude further inwards than the end of the second guide 306. When the cover 310 is pivoted in the second direction to close the insertion space 214, the cover 310 may be brought into contact with the insertion hole wall 305, and thus movement thereof may be restricted.

The other end of the second guide 306 may be adjacent to the insertion space 214. The other end of the second guide 306 may be adjacent to the outer wall 211 of the first container 210, which forms the circumference of the insertion space 214. The other end of the second guide 306 may be disposed above the outer wall 211 of the first container 210, which defines the insertion space 214. The second guide 306 may have a shape that extends so as to be inclined from one end thereof to the other end thereof.

Referring to FIGS. 19 to 22, the stick 400 may push the cover 310 in the inward direction of the insertion space 214 or in the first direction. When the stick 400 pushes the cover 310 and is inserted into the insertion space 214, the cover 310 may open the insertion space 214 and/or the insertion hole 304.

Referring to FIGS. 19 and 20, when the end of the stick 400 passes through the insertion hole 304, the end of the stick 400 may be brought into contact with the insertion hole wall 305. When the end of the stick 400 is brought into contact with the insertion hole wall 305, the insertion hole wall 305 may guide the stick 400 to the correct position in the insertion hole 304. After passing through the insertion hole 304, the end of the stick 400 may push the cover 310 so that the cover 310 is pivoted in the first direction.

Referring to FIGS. 20 and 21, when the stick 400 completely passes through the insertion hole 304, the cover 310 may be received in the cover recess 215. The cover 310 may overlap the inner wall 212 of the first container 210, thereby forming one side wall of the insertion space 214 together with the inner wall 212 of the first container 210.

Referring to FIGS. 21 and 22, the stick 400 may slide along the surface of the cover 310, and may be inserted into the insertion space 214. The second guide 306 may be disposed at a position opposite the pivot shaft of the cover 310 with respect to the insertion hole 304. The second guide 306 may be disposed at a position opposite the cover recess 215. When the stick 400 is inserted into the insertion space 214, the end of the stick 400 may be brought into contact with the second guide 306. When the end of the stick 400 is brought into contact with the second guide 306, the second guide 306 may guide the stick 400 to the correct position in the insertion space 214.

The first guide 216 may be disposed at a position opposite the second guide 306. The first guide 216 may be disposed below the second guide 216. The first guide 216 may be disposed below the cover recess 215. The first guide 216 may be disposed below the cover 310. The first guide 216 may extend in the circumferential direction along the inner wall 212 of the first container 210. When the stick 400 is inserted into the insertion space 214, the end of the stick 400 may be brought into contact with the first guide 216. After being guided to the correct position by contact with the second guide 306, the end of the stick 400 may be brought into contact with the first guide 216. When the end of the stick 400 is brought into contact with the first guide 216, the first guide 216 may guide the stick 400 to the correct position in the insertion space 214.

The end of the stick 400 inserted into the insertion space 214 may be brought into contact with the stick stopper 217. The stick stopper 217, with which the end of the stick 400 comes into contact, may prevent the stick 400 from moving to a region below the insertion space 214 or to the second chamber C2.

Accordingly, when the user pushes the cover 310 using the stick 400, the stick 400 may be guided to the correct position so as to smoothly pass through the insertion hole 304 and to push the cover 310.

In addition, when the stick 400 pushes the cover 310 and thus the cover 310 is disposed in the insertion space 214, the cover 310 is received in the cover recess 215, so the stick 400 may be brought into close contact with the wall defining the insertion space 214.

In addition, since the stick 400 is in close contact with the wall defining the insertion space 214, when the user inhales air through the stick 400, it is possible to prevent unnecessary flow of air between the insertion space 214 and the stick 400 and to reduce waste of inhalation force, thereby preventing deterioration in air flow efficiency.

In addition, even though the cover 310 applies external force to the end of the stick 400 in the second direction when the user pushes the cover 310 using the stick 400, the stick 400 may be guided so as to be correctly inserted into the insertion space 214.

In addition, it is possible to prevent the stick 400 from moving to the inside of the second chamber C2.

Referring to FIG. 23, the upper body 120 may be coupled to the upper portion of the lower body 110. The mount 130 may cover the upper portion of the lower body 110. The lower portion of the mount 130 may be surrounded by the upper portion of the side wall 111 of the lower body 110. The mount 130 may be coupled to the upper portion of the lower body 110. The mount 130 may be coupled to the lower body 110 in a snap-fit manner. The mount 130 may be engaged with the lower body 110 so as not to be separated therefrom.

The second sensor 180 may be disposed on one side of the upper portion of the lower body 110. A sensor support portion 185 may have a shape that extends upwards from the upper portion of the lower body 110. The sensor support portion 185 may support the second sensor 180. The second sensor 180 may be coupled to the sensor support portion 185. The second sensor 180 may be coupled to the sensor support portion 185 so as to be oriented in the lateral direction. The sensor accommodation portion 137 of the mount 130 may accommodate and cover the second sensor 180 and the sensor support portion 185.

Referring to FIGS. 24 to 26, a fastening hole 135 may be formed in the lower portion of the mount 130. The fastening hole 135 may be formed at a side part of the lower portion of the mount 130. The fastening hole 135 may be formed in a plural number, and the plurality of fastening holes 135 may be arranged along the circumference of the lower portion of the mount 130. A body latch 115 provided at the upper portion of the lower body 110 may be inserted into the fastening hole 135, whereby the mount 130 and the lower body 110 may be engaged with each other (refer to FIGS. 28 and 29).

A rib groove 136 may be formed in the outer side surface 132 of the mount 130. The rib groove 136 may have a shape that is recessed inwards from the outer side surface 132 of the mount 130. The rib groove 136 may have a shape that extends along the circumference of the outer side surface 132 of the mount 130. A body rib 116, which extends along the inner circumference of the upper portion of the lower body 110, may be inserted into the rib groove 136, whereby the mount 130 and the lower body 110 may be engaged with each other. The body rib 116 may be made of an elastic material. For example, the body rib 116 may be made of a material such as rubber or silicon. The body rib 116 may be in close contact with the rib groove 136. Accordingly, the position of the mount 130 may be reliably fixed to the lower body 110, and the upper body 120 may be prevented from shaking relative to the lower body 110 (refer to FIGS. 28 and 29).

A first fixing portion 138 may be formed at the lower portion of the mount 130. The first fixing portion 138 may be formed so as to be recessed upwards or to protrude downwards from the lower portion of the mount 130. The first fixing portion 138 may be formed at the circumference of the lower portion of the mount 130. The first fixing portion 138 may be formed in a plural number, and the plurality of first fixing portions 138 may be arranged along the circumference of the lower portion of the mount 130. A second fixing portion 118, which is provided at the upper portion of the lower body 110, may be coupled to the first fixing portion 138. Accordingly, the position of the mount 130 may be reliably fixed to the lower body 110, and the upper body 120 may be prevented from shaking relative to the lower body 110 (refer to FIGS. 28 and 29).

The upper body 120 may include the column 140, which extends upwards. The column 140 may extend upwards from one side of the mount 130. The side walls 141 and 142 of the column 140 may be connected to the side walls 131 and 132 of the mount 130. The column 140 may cover a portion of the space 134 provided by the mount 130. The inner wall 141 of the column 140 may have a shape that is concavely recessed outwards. The column 140 may face the side portion of the cartridge 200 (refer to FIG. 6). The column 140 may cover one side portion of the cartridge 200. The column 140 may be open toward one side portion of the cartridge 200.

The column 140 may accommodate the PCB assembly 150. The PCB assembly 150 may provide light to the cartridge 200, or may sense information about the cartridge 200. For example, the information about the cartridge 200 may include at least one of information about a change in the remaining amount of liquid stored in the first chamber C1 in the cartridge 200, information about the type of liquid stored in the first chamber C1 in the cartridge 200, information about whether the stick 400 is inserted into the insertion space 214 in the cartridge 200, information about the type of stick 400 inserted into the insertion space 214 in the cartridge 200, information about the extent of use or the availability of the stick 400 inserted into the insertion space 214 in the cartridge 200, information about whether the cartridge 200 having the stick 400 inserted into the insertion space 214 is coupled to the body 100, or information about the type of cartridge 200 coupled thereto. The information about the cartridge 200 is not limited to the aforementioned information. The column 140 may accommodate a light source 153 configured to emit light. The column 140 may accommodate a first sensor 154 configured to sense information about the cartridge 200.

The column 140 may provide a mounting space 144 therein. The mounting space 144 may have a shape that extends vertically along the column 140. The inner side wall 141 of the column 140 may surround the mounting space 144. The mounting space 144 may be open toward the space 134 in the mount 130. The mounting space 144 may be open toward one side portion of the cartridge 200.

The PCB assembly 150 may be mounted in the mounting space 144. A plate 160 may cover the PCB assembly 150, and may be disposed in the mounting space 144. The window 170 may cover the PCB assembly 150 and the mounting space 144. The PCB assembly 150, the plate 160, and the window 170 may be sequentially stacked. The mounting space 144 may be referred to as an assembly accommodation space 144.

The PCB assembly 150 may include at least one of a printed circuit board (PCB) 151, a light source 153, or a first sensor 154. The light source 153 may be mounted on the PCB 151. At least one light source 153 may be provided. The first sensor 154 may be mounted on the PCB. The light source 153 and the first sensor 154 may be mounted at different positions on a single PCB. The first sensor 154 may be mounted in a region avoiding the at least one light source 153.

The PCB assembly 150 may be disposed inside the column 140 so as to face the cartridge 200. The PCB assembly 150 may face the first container 210, which is provided with the first chamber C1 and the insertion space 214. The PCB assembly 150 may be elongated vertically along the column 140. A connector 152 for electrical connection may be formed at one end of the PCB assembly 150.

The PCB 151 may be elongated vertically along the column 140. The PCB 151 may be a flexible printed circuit board (FPCB). The connector 152 may be formed at one end of the PCB 151. A plurality of light sources 153 may be arranged on the PCB 151. The first sensor 154 may be located at the center of the PCB 151. The first sensor 154 may be located between the light sources 153, and at least one light source 153 may be disposed on each side of the first sensor 154. The plurality of light sources 153 may be arranged vertically along the PCB 151. The plurality of light sources 153 may be arranged in the longitudinal direction of the column 140. The first sensor 154 may be disposed so as to face the insertion space 214. The light sources 153 may be disposed so as to face the outside of the insertion space 214. The light sources 153 may emit light toward the outside of the insertion space 214 so that the light is provided to the first chamber C1. The light sources 153 may be LEDs.

Accordingly, the light sources 153 may provide uniform light to the first chamber C1.

In addition, it is possible to prevent the paths of light provided by the light sources 153 from being blocked by the stick 400 inserted into the insertion space 214.

The first sensor 154 may be elongated vertically along the PCB 151. The first sensor 154 may be elongated along the first container 210 or the insertion space 214. The first sensor 154 may face the insertion space 214. The first sensor 154 may sense information about the cartridge 200. For example, the first sensor 154 may sense at least one of information about a change in the remaining amount of liquid stored in the first chamber C1 in the cartridge 200, information about the type of liquid stored in the first chamber C1 in the cartridge 200, information about whether the stick 400 is inserted into the insertion space 214 in the cartridge 200, information about the type of stick 400 inserted into the insertion space 214 in the cartridge 200, information about the extent of use or the availability of the stick 400 inserted into the insertion space 214 in the cartridge 200, information about whether the cartridge 200 having the stick 400 inserted into the insertion space 214 is coupled to the body 100, or information about the type of cartridge 200 coupled thereto. The information about the cartridge 200 is not limited to the aforementioned information.

The first sensor 154 may sense a change in the electromagnetic characteristics of the cartridge 200 to sense information about the cartridge 200. The first sensor 154 may sense a change in electromagnetic characteristics caused by a neighboring object. For example, the first sensor 154 may be a capacitance sensor. For example, the first sensor 154 may be a magnetic proximity sensor. The type of first sensor 154 is not limited thereto. For example, when the stick 400 is inserted into the insertion space 214 in the cartridge 200 or when there is a change in the volume of the liquid stored in the first chamber C1, the electromagnetic characteristics sensed by the first sensor 154 may change, and the first sensor 154 may measure the change to sense information about the cartridge 200.

The window 170 may be coupled to the column 140. The window 170 may be formed of a transparent material. The window 170 may allow light to pass therethrough. The window 170 may be coupled to the column 140 to cover the PCB assembly 150 (refer to FIG. 26). The window 170 may have a shape that extends vertically along the column 140. The window 170 may be disposed between the column 140 and the cartridge 200. The window 170 may be disposed adjacent to the inner side wall 141 of the column 140. The window 170 may cover one side portion of the cartridge 200. The window 170 may face the side portion of the cartridge 200. The window 170 may be formed to be thin so that the PCB assembly 150 is adjacent to the cartridge 200.

One surface 171*a* of the window 170 may be in contact with the side portion of the cartridge 200 to support the cartridge 200 (refer to FIGS. 4 to 6). The opposite surface 171*b* of the window 170 may be in close contact with the PCB assembly 150 (refer to FIG. 27). The surface 171*a* of the window 170 may be referred to as the front surface of the window 170. The opposite surface 171*b* of the window 170 may be referred to as the rear surface of the window 170.

The surface 171*a* of the window 170 may have a shape corresponding to that of the outer wall 211 of the first container 210, which forms the circumference of the insertion space 214. The insertion space 214 may be adjacent to the column 140 and the PCB assembly 150 (refer to FIG. 15). The insertion space 214 may be located between the first chamber C1 and the column 140. The outer wall 211 of the first container 210, which surrounds the circumference of the insertion space 214, may have a round shape that extends along the circumference of the insertion space 214. The surface 171*a* of the window 170 may have a round shape that surrounds the outer side of the insertion space 214. The surface 171*a* of the window 170 may have a round shape that surrounds the outer wall 211 of the first container 210, which forms the circumference of the insertion space 214. The surface 171*a* of the window 170 may have a shape that is concave in the direction opposite the cartridge 200. The surface 171*a* of the window 170 may support one side wall of the cartridge 200.

At least one recess 174, in which the light source 153 is accommodated, may be formed in the opposite surface 171*b* of the window 170. The recess 174 may be referred to as a light source recess 174 or a window recess 174. The light source recess 174 may be recessed toward the surface 171*a* from the opposite surface 171*b* of the window 170. Each of the plurality of light source recesses 174 may accommodate and cover a respective one of the plurality of light sources 153. Each of the plurality of light source recesses 174 may be formed at a position corresponding to the position of a respective one of the plurality of light sources 153. The plurality of light source recesses 174 may be arranged vertically. The first sensor 154 may be located between the plurality of light source recesses 174, and at least one light source recess 174 may be disposed on each side of the first sensor 154.

The opposite surface 171*b* of the window 170 may include a planar portion 172, which is formed to be flat. The planar portion 172 may be in close contact with the PCB assembly 150. The planar portion 172 may be inserted into the mounting space 144 in the column 140 (refer to FIG. 24). The light source recess 174 may be formed by depressing the planar portion 172.

The PCB assembly 150 may have a plurality of through-holes 151*a* formed therein. The through-holes 151*a* may be formed at one side of the PCB 151. The through-holes 151*a* may be formed in the upper portion of the PCB 151. The through-holes 151*a* may be located above the light source 153 and/or the first sensor 154. The through-holes 151*a* may be located on both sides of the PCB 151.

The window 170 may include a plurality of penetrating protrusions 172*a*. The penetrating protrusions 172*a* may protrude from the opposite surface 171*b* of the window 170. The penetrating protrusions 172*a* may be formed at positions corresponding to the through-holes 151*a*. The penetrating protrusions 172*a* may protrude toward the through-holes 151*a*. The penetrating protrusions 172*a* may pass through the through-holes 151*a*. A plurality of penetrating protrusions 172*a* may be provided. Each of the plurality of penetrating protrusions 172*a* may pass through a respective one of the plurality of through-holes 151*a*. The penetrating protrusions 172*a* may pass through the through-holes 151*a*, so the PCB assembly 150 and the window 170 may be disposed at the correct positions.

The window 170 may include a latching protrusion 173. The latching protrusion 173 may be formed on the opposite surface 171*b* of the window 170. The latching protrusion 173 may protrude from each side of the planar portion 172. The latching protrusion 173 may be provided in a plural number, and the plurality of latching protrusions 173 may be arranged in the vertical direction. Each of the plurality of latching protrusions 173 may have a shape that is elongated vertically so as to correspond to a side flange portion 1451.

The column 140 may include a flange 145. The flange 145 may be disposed inside the inner side wall 141 of the column 140. The flange 145 may protrude inwards from the inner side wall 141 of the column 140. The flange 145 may be integrally formed with the column 140. The flange 145 may protrude toward the inside of the column 140 to form an edge. The flange 145 may extend along the circumference of the assembly accommodation space 144. The flange 145 may have an open center, through which the assembly accommodation space 144 and the cartridge accommodation space 134 may be connected to each other.

The flange 145 may include at least one of a side flange portion 1451, a lower flange portion 1452, or an upper flange portion 1453. The flange 145 may be formed in a manner such that the side flange portion 1451, the lower flange portion 1452, and the upper flange portion 1453 are connected to each other. The side flange portion 1451 may have a shape that is elongated in the longitudinal direction of the column 140. The side flange portion 1451 may be provided in a pair, and the pair of side flange portions 1451 may be spaced apart from each other and may be formed on both sides of the column 140. The lower flange portion 1452 and the upper flange portion 1453 may be disposed between the pair of side flange portions 1451, and may be connected thereto. The side flange portions 1451, the lower flange portion 1452, and the upper flange portion 1453 may be connected to each other to form the periphery of the flange 145. The region surrounded by the side flange portions 1451, the lower flange portion 1452, and the upper flange portion 1453 may be open, so the assembly accommodation space 144 and the cartridge accommodation space 134 may communicate with each other.

The opposite surface 171*b* of the window 170 may be attached to the flange 145. The edge of the opposite surface of the window 170 may be attached to the flange 145. The opposite surface 171*b* of the window 170 may be attached to the flange 145 using an adhesive member. The adhesive member may be, for example, a sheet of tape or glue. The adhesive member is not limited thereto. The latching protrusions 173 may be engaged with the flange 145, so the window 170 may be coupled to the flange 145. The latching protrusions 173 may be engaged with the side flange portions 1451. The flange 145 may have a shape corresponding to the shape of the opposite surface 171*b* of the window 170, which is adjacent to the edge of the window 170. The lower flange portion 1452 and the upper flange portion 1453 may have a concave shape.

Accordingly, the PCB assembly 150 may be protected from the outside, and may be prevented from becoming separated.

In addition, light emitted from the PCB assembly 150 may be provided to the cartridge 200.

In addition, the window 170, the cartridge 200, and the PCB assembly 150 may be reliably coupled or fixed to each other.

The plate 160 may cover the region in the PCB assembly 150 that avoids the at least one light source 153. The plate 160 may be attached to the PCB assembly 150 to cover the first sensor 154. The plate 160 may allow an electromagnetic wave to pass therethrough. The plate 160, through which an electromagnetic wave passes, may not allow visible light to pass therethrough, or may be translucent.

Printed circuits, which are connected to the light sources 153, may be printed on the region in the PCB 151 that is adjacent to the light sources 153. The plate 160 may cover the printed circuits printed on the PCB 151 in the vicinity of the light sources 153. The plate 160 may have a shape that extends vertically along the first sensor 154 and extends further from the vertically extending portion thereof toward the printed circuits.

The plate 160 may expose the light sources 153, rather than covering the same. The light sources 153 may be disposed on both sides of the first sensor 154, with the first sensor 154 interposed therebetween, and may be arranged in the vertical direction. Portions of the plate 160 that correspond to the positions of the light sources 153 may be open. When the plate 160 is attached to the PCB assembly 150, the light sources 153 may be exposed through the open portions of the plate 160.

Accordingly, light emitted from the light sources 153 may not be blocked, and the first sensor 154 and/or the printed circuits printed on the PCB 151 may not be exposed to the outside, and may be protected from the outside.

In addition, the first sensor 154 may sense a change in the electromagnetic characteristics of the surroundings in the state of being covered by the plate 160.

Referring to FIG. 27, the PCB assembly 150 may be disposed inside the column 140, and may be elongated along the column 140. The PCB 151 may be elongated along the column 140. The connector 152, which is formed at one end of the PCB assembly 150, may be exposed downwards from the upper body 120. The connector 152 may be exposed downwards from the column 140. The connector 152 may be exposed downwards from the mount 130. The lower end of the column 140 may be open to form a gap 146. The connector 152 may be exposed downwards through the gap 146. The gap 146 may communicate with the mounting space 144 (FIG. 24).

The mount 130 may include the sensor accommodation portion 137. The sensor accommodation portion 137 may be formed in one side wall of the mount 130. The sensor accommodation portion 137 may provide a space 137*b* formed in the side wall of the mount 130 so as to be open downwards to accommodate the second sensor 180 inserted thereinto. The space 137*b* provided by the sensor accommodation portion 137 may be referred to as a sensor accommodation space 137*b*. The inner side surface of the sensor accommodation portion 137 may form a portion of the inner side surface 131 of the mount 130. The outer side surface of the sensor accommodation portion 137 may form a portion of the outer side surface 132 of the mount 130. The sensor accommodation portion 137 may be formed at a position opposite the column 140 with respect to the cartridge accommodation space 134. The column 140 may extend upwards from one side of the mount 130, and the sensor accommodation portion 137 may be formed at the opposite side of the mount 130.

The inner side surface 131 of the sensor accommodation portion 137 may be open to form a sensing hole 137*a*. The sensing hole 137*a* may be formed between the sensor accommodation space 137*b* and the cartridge accommodation space 134 to interconnect the sensor accommodation space 137*b* and the cartridge accommodation space 134. The sensing hole 137*a* may be adjacent to the cartridge inlet 224 (refer to FIG. 15). The sensing hole 137*a* may face the cartridge inlet 224.

The sensing hole 137*a* may be open in the lateral direction. The side portion of the second container 220 may be open to form the cartridge inlet 224, and the sensing hole 137*a*, which is open in the lateral direction, may face the cartridge inlet 224 (refer to FIG. 15).

Referring to FIGS. 28 and 29, the partition wall 112 of the lower body 110 may cover the upper side of the battery 190. The partition wall 112 may be disposed in the upper portion of the lower body 110 in a direction intersecting the side wall 111 of the lower body 110. The partition wall 112 may cover the upper sides of internal components of the lower body 110. The partition wall 112 may separate the space in which internal components of the lower body 110 are mounted from the space in which the upper body 120 is coupled. The partition wall 112 may be disposed below the upper body 120. The side wall 111 of the lower body 110 may extend upwards beyond the partition wall 112, and may surround the circumference of the partition wall 112. The inner circumferential surface of the side wall 111 of the lower body 110, which extends above the partition wall 112, may surround the circumference of the lower portion of the mount 130.

The second sensor 180 may be mounted on one side of the upper portion of the lower body 110. The second sensor 180 may be disposed on the partition wall 112. The second sensor 180 may be disposed at a position corresponding to the sensor accommodation portion 137 of the mount 130. The sensor support portion 185 may extend upwards from one side of the partition wall 112 to support the second sensor 180. The second sensor 180 may be disposed so as to face the lateral direction.

The upper body 120 may be coupled to the upper side of the lower body 110. The body latch 115 may be formed at the upper portion of the lower body 110. The body latch 115 may be formed at one end of the partition wall 112. The body latch 115 may have a protruding shape. The body latch 115 may be inserted into the fastening hole 135 in the mount 130, so the mount 130 and the lower body 110 may be coupled to each other.

The body rib 116 may have a shape that protrudes from the inner circumferential surface of the side wall 111 of the lower body 110. The body rib 116 may have a shape that extends along the inner circumferential surface of the side wall 111 of the lower body 110. The body rib 116 may be made of an elastic material. For example, the body rib 116 may be made of a material such as rubber or silicon. The body rib 116 may be disposed above the partition wall 112. The body rib 116 may be inserted into and be in close contact with the rib groove 136 in the mount 130.

The second fixing portion 118 may be disposed in the upper portion of the lower body 110. The second fixing portion 118 may be formed at a position corresponding to the first fixing portion 138. The second fixing portion 118 may be formed near the partition wall 112. The second fixing portion 118 may have a shape that protrudes upwards or is recessed downwards. The second fixing portion 118 may be provided in a plural number. The second fixing portion 118 may be coupled to the first fixing portion 138 of the mount 130.

Accordingly, the upper body 120 may be coupled to the lower body 110.

In addition, the position of the mount 130 may be reliably fixed to the lower body 110, and the upper body 120 may be prevented from shaking relative to the lower body 110.

The bottom 133 of the mount 130 may be open to form a connection terminal hole 133*a*. The connection terminal hole 133*a* may have a slit shape. The connection terminal hole 133*a* may be formed in a pair (refer to FIG. 27). A first connection terminal 191 may be formed so as to protrude upwards from the partition wall 112. The first connection terminal 191 may be provided in a pair. The first connection terminal 191 and the connection terminal hole 133*a* may be formed at positions corresponding to each other. When the upper body 120 is coupled to the lower body 110, the first connection terminal 191 may pass through the connection terminal hole 133*a*, and may be exposed to the cartridge accommodation space 134. When the second cartridge 200 is coupled to the upper body 120, the heater 262 (refer to FIG. 15) may come into contact with the first connection terminal 191, and may be electrically connected to at least one of devices such as the battery 190 and the control device 193. The devices that are electrically connected to the heater are not limited thereto.

The PCB assembly 150 may be electrically connected to a device provided in the lower body 110 via the connector 152, which is exposed downwards from the upper body 120. One side of the partition wall 112 may be open to form a connector insertion hole 117. The connector insertion hole 117 may be formed at a position corresponding to the column 140. The connector insertion hole 117 may be open upwards. A connection terminal 192 may be located below the connector insertion hole 117 inside the lower body 110. When the upper body 120 is coupled to the lower body 110, the connector 152 may be inserted into the connector insertion hole 117, and may come into contact with the second connection terminal 192. When the connector 152 comes into contact with the second connection terminal 192, the PCB assembly 150 may be electrically connected to at least one of devices such as the battery 190 and the control device 193 via the connector 152. The devices that are electrically connected to the PCB assembly are not limited thereto.

When the upper body 120 is coupled to the lower body 110, the second sensor 180 may be inserted into the space 137*b* provided by the sensor accommodation portion 137. The sensor accommodation portion 137 may surround the second sensor 180. When the mount 130 is coupled to the lower body 110, the second sensor 180 may be inserted upwards from the lower side of the sensor accommodation space 137*b*. The sensing hole 137*a*, which is formed at the sensor accommodation portion 137, may be open toward the cartridge 200. The second sensor 180 may face the sensing hole 137*a* inside the sensor accommodation portion 137. The second sensor 180 may be disposed so as to face the cartridge inlet 224 (refer to FIG. 15) inside the sensor accommodation portion 137. The second sensor 180 may sense the flow of air around the sensing hole 137*a*.

Referring to FIGS. 30 to 32, the cartridge 200 may include at least one of the first container 210, the second container 220, the wick 261, or the heater 262. The cartridge 200 may include the sealing member 250).

The first container 210 may be formed to have a hollow shape. The outer wall 211 of the first container 210 may surround the inner space. The first container 210 may provide the first chamber C1 storing liquid therein. One side or the lower side of the first chamber C1 may be open. The first container 210 may include an insertion space 214 into which the stick 400 is capable of being inserted. The first chamber C1 and the stick 400 may be provided separately from each other inside the first container 210. The insertion space 214 may have two open opposite ends, and may be elongated. The insertion space 214 may be elongated vertically, and the upper and lower ends thereof may be open. The circumference of the insertion space 214 may extend in the circumferential direction. The insertion space 214 may have a cylindrical shape.

The inner wall 212 of the first container 210 may be located inside the first container 210, and may partition the inner space in the first container 210. The inner wall 212 of the first container 210 may partition the space surrounded by the outer wall 211 of the first container 210 into the first chamber C1 on one side and the insertion space 214 on the other side. The inner wall 212 of the first container 210 may extend in the circumferential direction to surround at least a portion of the circumference of the insertion space 214.

Accordingly, the efficiency of use of a liquid storage space may be improved, and the user may be provided with improved convenience during an inhalation operation.

The second container 220 may be coupled to the first container 210. The second container 220 may be coupled to one side or the lower side of the first container 210. The second container 220 may block the open side of the first chamber C1. The second container 220 may provide therein the second chamber C2 communicating with the insertion space 214. The wick 261 may be disposed in the second container 220.

The cartridge inlet 224 may allow the second chamber C2 to communicate with the outside of the cartridge 200. The cartridge inlet 224 may be formed at the outer wall of the second container 220. The cartridge inlet 224 may be formed in the side wall 221 of the second container 220. The cartridge inlet 224 may be open in the lateral direction. The cartridge inlet 224 may be formed at a position higher than the bottom 222 of the second container 220.

Accordingly, it is possible to prevent droplets in a connection passage 2314 from leaking out of the cartridge 200 through the cartridge inlet 224.

The second container 220 may include at least one of the lower case 230 or the frame 240. The lower case 230 may form the external appearance of the second container 220. The lower case 230 may be disposed below the first container 210. The lower case 230 may be coupled to the first container 210. The lower case 230 may be coupled to the outer wall 211 of the first container 210. The circumference of the lower case 230 may be coupled to the circumference of the first container 210. The cartridge inlet 224 may be formed at the outer wall of the lower case 230. The cartridge inlet 224 may be formed in the side wall 2311 of the lower case 230. The cartridge inlet 224 may be formed at a position higher than the bottom 2312 of the lower case 230. The lower case 230 may provide therein an accommodation space 2310. The lower case 230 may accommodate at least a portion of the frame 240 in the accommodation space 2310. The lower case 230 may support the frame 240.

The lower case 230 may include the accommodation portion 231. The accommodation portion 231 may provide therein an accommodation space 2310. The accommodation space 2310 may be formed at the accommodation portion 231 upwards. The accommodation portion 231 may surround the side portion and the lower portion of the accommodation space 2310. The side wall 2311 of the accommodation portion 231 may surround the side portion of the accommodation space 2310. The bottom 2312 of the accommodation portion 231 may cover the lower portion of the accommodation space 2310. The second chamber C2 may be formed at a position at which the accommodation space 2310 is formed. The accommodation portion 231 may surround a portion of the second chamber C2.

The cartridge inlet 224 may be formed at one side of the accommodation portion 231. The cartridge inlet 224 may be formed at the outer wall of the accommodation portion 231. The cartridge inlet 224 may be formed in one side wall 2311 of the accommodation portion 231. The cartridge inlet 224 may be adjacent to the lower side of the extension portion 232. The cartridge inlet 224 may be formed at a position higher than the bottom 2312 of the accommodation portion 231.

The accommodation portion 231 may provide therein a connection passage 2314. The connection passage 2314 may communicate with the cartridge inlet 224. The connection passage 2314 may be formed between the accommodation portion 231 and the frame 240. The connection passage 2314 may be surrounded by the accommodation portion 231 and the frame 240. The connection passage 2314 may be located between the cartridge inlet 224 and the chamber inlet 2424. The connection passage 2314 may interconnect the cartridge inlet 224 and the chamber inlet 2424.

The blocking wall 2317 may be formed in the connection passage 2314. The blocking wall 2317 may be formed so as to protrude upwards from the bottom of the connection passage 2314. The blocking wall 2317 may be formed so as to protrude upwards from the bottom 2312 of the accommodation portion 231 or the bottom of the frame 240. The connection passage 2314 may surround the blocking wall 2317. The blocking wall 2317 may be disposed between the cartridge inlet 224 and the chamber inlet 2424. The blocking wall 2317 may be disposed between the side wall 2311 of the accommodation portion 231 and the side wall 2421 of the second frame portion 242. The blocking wall 2317 may be formed parallel to the side wall 2311 of the accommodation portion 231. The blocking wall 2317 may face the side wall 2311 of the accommodation portion 231. The blocking wall 2317 may be formed parallel to the side wall 2421 of the second frame portion 242. The blocking wall 2317 may face the side wall 2421 of the second frame portion 242. The blocking wall 2317 may extend to a position higher than the cartridge inlet 224 and/or the chamber inlet 2424. The blocking wall 2317 may extend to a position lower than the extension portion 232 and/or a bottom portion 2411. The blocking wall 2317 may be elongated in a direction intersecting the direction in which the cartridge inlet 224 and/or the chamber inlet 2424 are open. The cartridge inlet 224 may face the blocking wall 2317. The chamber inlet 2424 may face the blocking wall 2317.

Accordingly, it is possible to prevent droplets generated in the second chamber C2 from leaking out of the cartridge 200 through the cartridge inlet 224.

The lower case 230 may include the extension portion 232 extending outwards from the accommodation portion 231. The extension portion 232 may extend outwards from the upper end of one side of the accommodation portion 231. The extension portion 232 may extend outwards from the side wall 2311 of the accommodation portion 231 in which the cartridge inlet 224 is formed. The extension portion 232 may be located below the first chamber C1. The extension portion 232 may support the first frame portion 241.

The lower case 230 may include a peripheral portion 2322, which is coupled to the circumference of the first container 210. The peripheral portion 2322 may extend from the upper end of the lower case 230 along the circumference of the lower case 230. The peripheral portion 2322 may extend along the circumference of each of the receiving portion 231 and the extension portion 232. The peripheral portion 2322 may have the shape of a continuous band. The peripheral portion 2322 may have a shape that protrudes upwards from the circumference of the lower case 230. The peripheral portion 2322 may be coupled to the lower end of the outer wall 211 of the first container 210. The lower end of the outer wall 211 of the first container 210 may be recessed upwards so that the peripheral portion 2322 is inserted thereinto. The peripheral portion 2322 and the outer wall 211 of the first container 210 may be attached to each other using an adhesive member. The adhesive member may be, for example, a sheet of tape or glue. The adhesive member is not limited thereto.

The frame 240 may be disposed between the lower case 230 and the first container 210. At least a portion of the frame 240 may be accommodated in the accommodation space 2310. The frame 240 may be coupled to the lower case 230 in the accommodation space 2310. The frame 240) may block the open side or the lower side of the first chamber C1. The frame 240) may form the bottom of the first chamber C1. The frame 240 may partition the inside of the lower case 230 to provide the second chamber C2. The frame 240) may surround at least a portion of the second chamber C2. The second chamber C2 may be surrounded by the frame 240) and the outer wall of the accommodation portion 231. The second chamber C2 may be formed below the insertion space 214. The second chamber C2 may communicate with the lower end of the insertion space 214. The chamber inlet 2424 may be formed at one side of the frame 240). The chamber inlet 2424 may communicate with the second chamber C2.

The frame 240) may include the first frame portion 241, which forms the bottom of the first chamber C1. The first frame portion 241 may block the open side of the first chamber C1. The frame 240 may include the second frame portion 242, which partitions the inside of the lower case 230 to provide the second chamber C2. The second frame portion 242 may be accommodated in the lower case 230. The second frame portion 242 may be connected to the first frame portion 241. The second frame portion 242 may surround at least a portion of the second chamber C2.

The second frame portion 242 may be accommodated in the accommodation space 2310. The side wall 2421 of the second frame portion 242 may surround at least a portion of the side portion of the second chamber C2. The bottom 2422 of the second frame portion 242 may form the bottom of the second chamber C2. The accommodation portion 231 may support the second frame portion 242. The bottom 2312 of the accommodation portion 231 may support the bottom 2422 of the second frame portion 242. The chamber inlet 2424 may be formed at the side wall 2421 of the second frame portion 242. The chamber inlet 2424 may be open in the lateral direction. The chamber inlet 2424 may be formed at a position higher than the bottom of the second chamber C2 or the bottom 2422 of the second frame portion 242.

Accordingly, it is possible to prevent droplets generated in the second chamber C2 from leaking out of the second chamber C2 through the chamber inlet 2424.

The first frame portion 241 may have a shape that extends outwards from one side of the second frame portion 242. The first frame portion 241 may extend in the direction in which the extension portion 232 extends from the upper portion of the accommodation space 2310. The first frame portion 241 may cover a portion of the upper side of the lower case 230. The lower case 230 may support a surface of the first frame portion 241.

The bottom portion 2411 of the first frame portion 241 may form the bottom of the first chamber C1. The bottom portion 2411 of the first frame portion 241 may extend outwards from the upper end of the side wall 2421 of the second frame portion 242. The bottom portion 2411 of the first frame portion 241 may extend in the direction in which the extension portion 232 is formed. The bottom portion 2411 of the first frame portion 241 may cover the extension portion 232 and the upper side of the connection passage 2314. The bottom portion 2411 of the first frame portion 241 may be supported by the extension portion 232.

The side wall 2412 of the first frame portion 241 may extend from one side of the circumference of the bottom 2422 of the second frame portion 242 along the circumference of the bottom portion 2411 of the first frame portion 241. The side wall 2412 of the first frame portion 241 may have the shape of a band that extends along the edge of the bottom portion 2411 of the first frame portion 241. The side wall 2412 of the first frame portion 241 may protrude upwards from the edge of the bottom portion 2411. The portion of the side wall 2412 of the first frame portion 241 that is adjacent to the second frame portion 242 may be accommodated in the accommodation space 2310. The side wall 2311 of the accommodation portion 231 may support the portion of the side wall 2412 of the first frame portion 241 that is adjacent to the second frame portion 242.

The side wall 2311 and the bottom 2312 of the accommodation portion 231 may surround one side of the connection passage 2314. The bottom portion 2411 of the first frame portion 241 and the side wall 2421 of the second frame portion 242 may surround the opposite side of the connection passage 2314. A round surface 2418 may extend to form a round shape between the first frame portion 241 and the second frame portion 242. The round surface 2418 may face one side of the connection passage 2314. The round surface 2418 may extend to form a round shape from the first frame portion 241 toward the chamber inlet 2424. The round surface 2418 may extend to form a round shape from the bottom portion 2411 of the first frame portion 241 toward the side wall 2421 of the second frame portion 242. The round surface 2418 may be located above the connection passage 2314. The round surface 2418 may be spaced upwards apart from the blocking wall 2317. A portion of the connection passage 2314 may be located between the round surface 2418 and the blocking wall 2317.

A hook 2415 may be formed at the first frame portion 241. The hook 2415 may be formed adjacent to the circumference of the first frame portion 241. The hook 2415 may protrude upwards from the bottom portion 2411 of the first frame portion 241, and may be bent outwards. The hook 2415 may be located adjacent to or in contact with the side wall 2412 of the first frame portion 241. The end of the hook 2415 may be bent outwards, and may be disposed above the side wall 2412 of the first frame portion 241. The hook 2415 may be provided in a plural number. The plurality of hooks 2415 may be arranged along the circumference of the first frame portion 241. Three hooks 2415 may be provided. The sealing member 250 may be engaged with the hook 2415.

The wick 261 may be disposed in the second chamber C2. The wick 261 may be connected to the first chamber C1. The wick 261 may receive the liquid stored in the first chamber C1 from the first chamber C1. The heater 262 may be disposed in the second chamber C2. The heater 262 may heat the wick 261. The heater 262 may be wound around the wick 261. The heater 262 may generate an aerosol in the second chamber C2 by heating the wick 261 containing the liquid. The wick 261 may be fixed to the second frame portion 242. A wick insertion recess 2426 may be formed in a manner such that the side wall 2421 of the second frame portion 242 is recessed downwards. A pair of wick insertion recesses 2426 may be formed in two opposite side portions of the side wall. Each of the two ends of the wick 261 may be inserted into and fixed to a respective one of the pair of wick insertion recesses 2426.

Air may be introduced into the cartridge 200 through the cartridge inlet 224. The air introduced through the cartridge inlet 224 may sequentially pass through the connection passage 2314, the chamber inlet 2424, the second chamber C2, and the insertion space 214. The air passing through the connection passage 2314 may flow along the round surface 2418 between the blocking wall 2317 and the round surface 2418, and may flow into the chamber inlet 2424. The air passing through the second chamber C2 may flow together with the aerosol generated in the second chamber C2.

Accordingly, it is possible to reduce air flow loss in the connection passage 2314.

In addition, the aerosol may be provided to the insertion space 214 and/or the stick 400 inserted into the insertion space 214.

The sealing member 250 may be disposed between the first container 210 and the second container 220. The sealing member 250 may be disposed between the first chamber C1, having an open side, and the second container 220, blocking the open side of the first chamber C1. The sealing member 250 may be disposed between or inserted into the gap between the first chamber C1 and the frame 240. The sealing member 250 may surround the lower edge of the first chamber C1. The sealing member 250 may be in close contact with the first container 210 and the frame 240. A portion of the sealing member 250 may be in close contact with the second container 220. The sealing member 250 may have the shape of a continuous band.

Accordingly, it is possible to prevent the liquid stored in the first chamber C1 from leaking into the gap formed in the coupling portion between the members defining the first chamber C1.

The sealing member 250 may include at least one of the first sealing portion 251 or the second sealing portion 252. The first sealing portion 251 may be disposed between or inserted into the gap between the outer wall 211 of the first container 210 and the first frame portion 241. The first sealing portion 251 may extend along the outer wall 211 of the first container 210. The first sealing portion 251 may be in close contact with the outer wall 211 of the first container 210 and the side wall 2411 of the first frame portion 241. The first sealing portion 251 may be engaged with the hooks 2415 formed at the first frame portion 241. The plurality of hooks 2415 may be arranged along the circumference of the first sealing portion 251. At least part of the first sealing portion 251 may be inserted into the gap between and be in close contact with the ends of the hooks 2415 and the side wall 2412 of the first frame portion 241.

The second sealing portion 252 may be connected to the first sealing portion 251. The second sealing portion 252 may be disposed between the inner wall 212 of the first container 210 and the second frame portion 242. The second sealing portion 252 may be disposed between the first chamber C1 and the second chamber C2. The second sealing portion 252 may extend from the first sealing portion 251 along the inner wall 212 of the first container 210. The second sealing portion 252 may be in close contact with the inner wall 212 of the first container 210 and the upper end of the second frame portion 242. The inner wall 212 of the first container 210 may press the upper portion of the second sealing portion 252 toward the second frame portion 242. A part of the second sealing portion 252 may be inserted into the second frame portion 242.

Referring to FIGS. 33 and 34, the frame 240 may be coupled to the inside of the lower case 230. The frame 240 may be coupled to the lower case 230 in a snap-fit manner in the accommodation space 2310 in the lower case 230. The frame 240 and the lower case 230 may be coupled to each other so as not to be separated from each other.

The side wall 2311 of the accommodation portion 231 may surround the side portion of the accommodation space 2310. A fastening recess 2315 may be formed so as to be recessed outwards from the inner surface of the side wall 2311 of the accommodation portion 231 that faces the accommodation space 2310. The fastening recess 2315 may be formed in a plural number. The plurality of fastening recesses 2315 may be formed in two opposite side portions of the side wall 2311 of the accommodation portion 231. The fastening recess 2315 may extend so as to be inclined outwards from the lower portion thereof toward the upper portion thereof. The upper end of the fastening recess 2315 may be formed horizontally, rather than at an incline.

The side wall 2421 of the second frame portion 242 may surround at least part of the side portion of the second chamber C2. The bottom 2422 of the second frame portion 242 may form the bottom of the second chamber C2. The side wall 2421 of the second frame portion 242 may extend upwards from the bottom 2422 of the second frame portion 242. The side wall 2421 of the second frame portion 242 may be connected to the side wall 2412 of the first frame portion 241.

A fastening protrusion 2425 may be formed on the side wall 2421 of the second frame portion 242 and/or on the side wall 2412 of the first frame portion 241 that is inserted into the accommodation space 2310. The fastening protrusion 2425 may be formed at a position corresponding to the fastening recess 2315 in the accommodation portion 231. The fastening protrusion 2425 may be formed in a plural number. The plurality of fastening protrusions 2425 may be formed on two opposite side portions of the frame 240. The fastening protrusion 2425 may have a shape corresponding to that of the fastening recess 2315. The fastening protrusion 2425 may extend so as to be inclined outwards from the lower portion thereof toward the upper portion thereof. The upper end of the fastening protrusion 2425 may be formed horizontally, rather than at an incline. The fastening protrusion 2425 may be inserted or fastened into the fastening recess 2315.

When the frame 240 is coupled to the lower case 230, the bottom portion 2321 of the extension portion 232 may support the bottom portion 2411 of the first frame portion 241. When the frame 240 is coupled to the lower case 230, the bottom 2312 of the accommodation portion 231 may support the bottom portion 2422 of the second frame portion 242. The fastening recess 2315 in the lower case 230 may support the fastening protrusion 2425 of the frame 240.

Accordingly, the lower case 230 and the frame 240 may be coupled and fixed to each other.

In the vicinity of the first chamber C1, the peripheral portion 2322 of the lower case 230 may have a shape corresponding to that of the side wall 2412 of the first frame portion 241. In the vicinity of the first chamber C1, each of the peripheral portion 2322 of the lower case 230 and the side wall 2412 of the first frame portion 241 may have the shape of a continuous band. In the vicinity of the first chamber C1, a gap may be formed between the peripheral portion 2322 of the lower case 230 and the side wall 2412 of the first frame portion 241. The bottom portion 2321 of the extension portion 232 may face the gap formed between the peripheral portion 2322 of the lower case 230 and the side wall 2412 of the first frame portion 241.

Referring to FIG. 35, the first frame portion 241 may include an inclined portion 2416 that is inclined downwards toward the wick 261. The inclined portion 2416 may be inclined downwards from the first chamber C1. The inclined portion 2416 may extend so as to be inclined downwards from the bottom portion 2411 of the first frame portion 241. The inclined portion 2416 may be inclined from the bottom of the first chamber C1 toward the second chamber C2. The inclined portion 2416 may form a portion of the bottom of the first chamber C1. The ends of the wick 261 may be located at the end of the inclined portion 2416, and may be connected to the first chamber C1. The inclination of the inclined portion 2416 may gradually become gentler toward the bottom portion 2411 and/or the ends of the wick 261.

The inclined portion 2416 may be provided in a pair. The pair of inclined portions 2416 may be located on respective sides of the second frame portion 242, which defines the second chamber C2. The center of the wick 261 may be disposed in the second chamber C2, and each of the two ends of the wick 261 may be located at the end of a respective one of the pair of inclined portions 2416, and may be connected to the first chamber C1. The inclined portions 2416 may be located between the side wall 2412 of the first frame portion 241 and the side wall 2421 of the second frame portion 242.

Accordingly, the liquid stored in the first chamber C1 may be easily supplied to the wick 261.

In addition, the liquid may be supplied to the wick 261 rather than remaining in the first chamber C1.

Referring to FIGS. 36 to 38, the sealing member 250 may be coupled to the upper side of the second container 220. The sealing member 250 may be in close contact with the edge of the lower case 230. The sealing member 250 may be in close contact with the edge of the frame 240. The sealing member 250 may be coupled or fastened to the frame 240. The sealing member 250 may surround the lower edge of the first chamber C1.

The sealing member 250 may include the first sealing portion 251. The first sealing portion 251 may extend along the circumference of the first frame portion 241. The first sealing portion 251 may extend along the side wall 2412 of the first frame portion 241. The first sealing portion 251 may be disposed further outwards than the side wall 2412 of the first frame portion 241, and may surround and be in close contact with the side wall 2412 of the first frame portion 241. The first sealing portion 251 may be disposed further inwards than the peripheral portion 2322 of the lower case 230. The first sealing portion 251 may be in close contact with the bottom 2321 of the extension portion 232 between the peripheral portion 2322 of the lower case 230 and the side wall 2412 of the first frame portion 241.

The inner circumferential surface of the first sealing portion 251 may be in close contact with at least a portion of the edge or the side wall 2412 of the first frame portion 241. The inner circumferential surface of the first sealing portion 251 may be in close contact with the outer circumferential surface of the side wall 2412 of the first frame portion 241 and the upper portion of the side wall 2412 of the first frame portion 241.

The first sealing portion 251 may include at least one of a first part 2511 or a second part 2512. The first part 2511 may be in close contact with the side portion of the edge of the first frame portion 241 or the outer circumferential surface of the side wall 2412. The first part 2511 may be disposed between the outer wall 211 of the first container 210 and the side portion of the edge of the first frame portion 241. The first part 2511 of the sealing portion 251 may be disposed between the outer wall 211 of the first container 210 and the side wall 2412 of the first frame portion 241.

The second part 2512 of the first sealing portion 251 may be bent and protrude inwards from the first part 2511 of the first sealing portion 251. The second part 2512 may be bent and extend inwards from the upper portion of the first part 2511. The second part 2512 may be in close contact with the upper portion of the edge of the first frame portion 241 or the upper portion of the side wall 2412.

The first sealing portion 251 may include a first uneven portion 2515. The first uneven portion 2515 may be formed on the outer circumferential surface of the first sealing portion 251. The first uneven portion 2515 may extend along the outer circumferential surface of the first sealing portion 251. At least one first uneven portion 2515 may be formed. A plurality of first uneven portions 2515 may be arranged vertically. Among the plurality of uneven portions 2515, at least one uneven portion may be formed at a height corresponding to each of the first part 2511 and the second part 2512 of the first sealing portion 251. For example, one of two first uneven portions 2515 may be formed at a height corresponding to the first part 2511, and the other thereof may be formed at a height corresponding to the second part 2512.

The first sealing portion 251 may be engaged with the hooks 2415. The plurality of hooks 2415 may be arranged along the circumference of the first frame portion 241, and may be engaged with the circumference of the first sealing portion 251. The end of each of the hooks 2415 may be bent and extend outwards, and may be disposed above the side wall 2412 of the first frame portion 241. The end of each of the hooks 2415 may be bent and extend outwards, and may be in close contact with the upper portion of the circumference of the first sealing portion 251.

The second part 2512 of the first sealing portion 251 may be inserted into the gap between and be in close contact with the end of each of the hooks 2415 and the side wall 2412 of the first frame portion 241. The end of each of the hooks 2415 may press the upper portion of the second part 2512.

The sealing member 250 may include the second sealing portion 252. The second sealing portion 252 may extend from the first sealing portion 251 along the circumference of the second frame portion 242. The second sealing portion 252 may extend to form a round shape along the circumference of the upper end of the second chamber C2. The second sealing portion 252 may extend to form a round shape along the circumference of the lower end of the insertion space 214 (refer to FIG. 41). The second sealing portion 252 and the first sealing portion 251 may be connected to each other so as to form a continuous shape. The second sealing portion 252 may be in close contact with the upper portion of the second frame portion 242. A second sealing portion body 2521 may cover the upper portion of the second frame portion 242.

The second sealing portion 252 may be inserted into the upper part of the second frame portion 242. The second sealing portion 252 may include a sealing protrusion 2527. The sealing protrusion 2527 may protrude downwards from the lower part of the second sealing portion 252. The sealing protrusion 2527 may have a round shape that extends along the shape of the second sealing portion 252. The sealing protrusion 2527 may be formed so as to protrude downwards from the second sealing portion body 2521.

The sealing protrusion groove 2427 may be formed so as to be recessed downwards from the upper part of the second frame portion 242. The sealing protrusion groove 2427 may be formed in a shape corresponding to that of the sealing protrusion 2527. The sealing protrusion groove 2427 may extend to form a round shape along the shape of the second sealing portion 252. The sealing protrusion 2527 may be inserted into or be in close contact with the sealing protrusion groove 2427. When the sealing protrusion 2527 is inserted into the sealing protrusion groove 2427, the second sealing portion body 2521 may cover the region around the sealing protrusion groove 2427.

The side wall 2421 of the second frame portion 242 may surround the side portion of the second chamber C2, and may be disposed so as to correspond to the inner wall of the first container 210 (refer to FIG. 42). The sealing protrusion groove 2427 may be formed in a manner such that the upper portion of the side wall 2421 of the second frame portion 242 is recessed. The sealing protrusion groove 2427 may be formed between the first chamber C1 and the second chamber C2. When the sealing protrusion 2527 is inserted into the sealing protrusion groove 2427, the second sealing portion body 2521 may cover the upper portion of the side wall 2421 of the second frame portion 242.

The second sealing portion 252 may include a second uneven portion 2525. The second uneven portion 2525 may be formed on at least one of the inner circumferential surface or the outer circumferential surface of the sealing protrusion 2527 (refer to FIG. 43). The second uneven portion 2525 may extend along at least one of the inner circumferential surface or the outer circumferential surface of the sealing protrusion 2527. At least one second uneven portion 2525 may be formed. A plurality of second uneven portions 2525 may be arranged vertically. When the sealing protrusion 2527 comes into close contact with the sealing protrusion groove 2427, the second uneven portions 2525 may come into close contact with the side portion of the sealing protrusion groove 2427.

Accordingly, the sealing member 250 may be stably coupled and fixed without using a separate adhesive member.

The second sealing portion 252 may include at least one of a lower support surface 2522 or a side support surface 2523. The lower support surface 2522 and the side support surface 2523 may be formed in a manner such that the upper part of the second sealing portion 252 is recessed downwards. The lower support surface 2522 and the side support surface 2523 may be formed in a manner such that the second sealing portion body 2521 is recessed downwards. The lower support surface 2522 may face the upward direction. The side support surface 2523 may face the lateral direction. The lower support surface 2522 and the side support surface 2523 may extend in the circumferential direction.

A wick holder 2526 may protrude in the downward direction of the second sealing portion 252. The lower end of the wick holder 2526 may be concavely recessed upwards in a shape corresponding to that of the circumference of the wick 261. The wick holder 2526 may be formed at a position corresponding to the wick insertion recess 2426. Each of the wick holder 2526 and the wick insertion recess 2426 may be formed in a pair. The wick holder 2526 may protrude downwards from the second sealing portion body 2521.

The second frame portion 242 may include a support portion 2428. The support portion 2428 may protrude from the upper end of the side wall 2421 of the second frame portion 242 toward the second chamber C2. The support portion 2428 may be adjacent to the wick insertion recess 2426. The support portion 2428 may be disposed above the chamber inlet 2424 (refer to FIG. 35). The support portion 2428 may be formed on the upper end of the side wall 2421 of the second frame portion 242, in which the chamber inlet 2424 is formed. The support portion 2428 may support the sealing member 250). The support portion 2428 may support the second sealing portion 252. The support portion 2428 may support the lower side of the second sealing portion body 2521.

Referring to FIG. 39, the wick holder 2526 may be inserted into or be in close contact with the wick insertion recess 2426. The wick holder 2526 may press the end of the wick 261, inserted into the wick insertion recess 2426, downwards. Each of the pair of wick holder 2526 may press a respective one of the two ends of the wick 261, which is inserted into a respective one of the pair of wick insertion recesses 2426, downwards. The wick holder 2526 may be in close contact with the wick 261 and the side wall 2421 of the second frame portion 242, in which the wick insertion recess 2426 is formed.

Accordingly, the wick 261 may be stably coupled or fixed, and the liquid supplied to the wick 261 may be prevented from leaking to the region around the wick 261.

Referring to FIG. 40, a connection space 2417 may interconnect the first chamber C1 and the second chamber C2. The connection space 2417 may be formed between the first chamber C1 and the second chamber C2, or may be formed in a portion of the first chamber C1 that is adjacent to the second chamber C2. The connection space 2417 may be referred to as a chamber connection space 2417.

The end of the wick 261 may be disposed in the connection space 2417. The end of the wick 261 may pass through the gap between the wick insertion recess 2426 and the wick holder 2526, and may be exposed to the connection space 2417. The connection space 2417 may be provided in a pair. Each of the pair of connection spaces 2417 may be disposed adjacent to a respective one of the two ends of the wick 261. The pair of connection spaces 2417 may be formed between the first sealing portion 251 and the second sealing portion 252. The inclined portions 2416 may be formed below the connection spaces 2417. Each of the pair of inclined portions 2416 may be formed below a respective one of the pair of connection spaces 2417.

Referring to FIGS. 41 and 42, the side wall 2421 of the second frame portion 242 may surround the side portion of the second chamber C2. The side wall 2421 of the second frame portion 242 may be adjacent to the lower end of the inner wall 212 of the first container 210.

The lower support surface 2522 and the side support surface 2523 may surround and be in close contact with the lower edge of the inner wall 212 of the first container 210. The lower support surface 2522 may support the lower end surface of the inner wall 212 of the first container 210. The lower support surface 2522 may extend along the circumference of the inner wall 212 of the first container 210.

The side support surface 2523 may extend along the circumference of the inner wall 212 of the first container 210. The side support surface 2523 may support the side surface that is adjacent to the lower end surface of the inner wall 212 of the first container 210.

The support portion 2428 may be disposed below the inner wall 212 of the first container 210. The support portion 2428 may be located along a line extrapolated from the inner wall 212 of the first container 210.

The first container 210 may be coupled to the second container 220. The outer wall 211 of the first container 210 may be coupled to the circumference of the lower case 230. The lower end of the outer wall 211 of the first container 210 may be recessed upwards so that the peripheral portion 2322 is inserted thereinto. The outer wall 211 of the first container 210 may be attached to the peripheral portion 2322.

When the first container 210 is coupled to the lower case 230, the first sealing portion 251 may be in close contact with the first frame portion 241 and the outer wall 211 of the first container 210.

When the first container 210 is coupled to the lower case 230, the inner wall 212 of the first container 210 may press the second sealing portion 252 toward the second frame portion 242. When the inner wall 212 of the first container 210 presses the second sealing portion 252, the second sealing portion 252 may come into close contact with the inner wall 212 of the first container 210 and the second frame portion 242. The second sealing portion 252 may transmit the force received from the inner wall 212 of the first container 210 to the first sealing portion 251 and the second frame portion 242.

Accordingly, the number of parts that are coupled using adhesive members may be reduced, and the number of parts for coupling components may be reduced. As a result, the structure for coupling components in the cartridge 200 may be simplified, and manufacturing efficiency may be improved.

In addition, the sealing member 250 may be stably coupled or fixed without using a separate adhesive member, and may be in close contact with neighboring components, thereby hermetically sealing the same.

Referring to FIG. 43, a plurality of first uneven portions 2515 may be formed on the outer circumferential surface of the first sealing portion 251. When the first container 210 is coupled to the second container 220, the first uneven portions 2515 may be in close contact with the outer wall 211 of the first container 210.

At least one of the first uneven portions 2515 may be formed at a height corresponding to the first part 2511 of the first sealing portion 251. The outer wall 211 of the first container 210 may be in close contact with the first uneven portions 2515 formed at a height corresponding to the first part 2511.

Accordingly, the first sealing portion 251 may receive force in the inward direction of the outer wall 211 of the first container 210, and thus may come into closer contact with the side portion of the side wall 2412 of the first frame portion 241.

At least one of the first uneven portions 2515 may be formed at a height corresponding to the second part 2512 of the first sealing portion 251. The outer wall 211 of the first container 210 may be in close contact with the first uneven portions 2515 formed at a height corresponding to the second part 2512.

Accordingly, when the outer wall 211 of the first container 210 is coupled to the lower case 230, the second part 2512 of the first sealing portion 251 may receive force in the inward and downward direction, thereby pressing the upper portion of the side wall 2412 of the first frame portion 241 downwards.

In addition, the entire first sealing portion 251 may be in close contact with the outer wall 211 of the first container 210 and the first frame portion 241, thereby preventing leakage of the liquid.

Referring to FIGS. 44 and 45, the cap 300 may be coupled to the body 100, and may cover the cartridge 200. The cap 300 may be detachably coupled to the body 100. The cap inlet 304*a* may be formed in one side of the cap 300. The cap inlet 304*a* may be formed in the upper end of the cap 300. The cap inlet 304*a* may communicate with the outside.

An inflow passage P may be formed between the cap 300 and the cartridge 200. The inflow passage P may interconnect the cap inlet 304*a* and the cartridge inlet 224. The inflow passage P may include a passage portion formed between the side portion of the cap 300 and the side portion of the cartridge 200. The inflow passage P may extend from the cap inlet 304*a* along the gap between the side portion of the cap 300 and the side portion of the cartridge 200. The inflow passage P may be elongated vertically. The inflow passage P may extend from the first chamber C1 adjacent to the cap inlet 304*a* toward the second chamber C2 between the side portion of the cap 300 and the side portion of the cartridge 200.

The inflow passage P may be formed between the side wall 301 of the cap 300 and the side portion of the cartridge 200. The inflow passage P may be formed between the cap body 320 and the side portion of the cartridge 200. The inflow passage P may be formed between the outer wall 211 of the first container 210, which surrounds the side portion of the first chamber C1, and the cap 300.

The inflow passage P may include a first passage P1. The first passage P1 may be formed between the mount 130 and the cartridge 200. The first passage P1 may be formed between the mount 130) and the second container 220. The first passage P1 may be formed between the lower case 230 and the sensor accommodation portion 137. The first passage P1 may be connected to the cartridge inlet 224. The first passage P1 may interconnect a second passage P2 and the cartridge inlet 224. The first passage P1 may be located below the first container 210 and the first chamber C1.

The first passage P1 may be formed between the sensor accommodation portion 137 and the extension portion 232. In the extension portion 232, a passage-forming portion 2323 (refer to FIG. 37) may be recessed upwards from the sensor accommodation portion 137 to form at least a portion of the first passage P1. The passage-forming portion 2323 may be formed in a manner such that the bottom 2321 of the extension portion 232 is recessed upwards from the sensor accommodation portion 137. The extension portion 232 may be supported by the sensor accommodation portion 137. The passage-forming portion 2323 may form a gap between the sensor accommodation portion 137 and the extension portion 232.

The first passage P1 may include a first upper passage portion P11, which is formed between the sensor accommodation portion 137 and the extension portion 232, and a first side passage portion P12, which extends from the first upper passage portion P11 to the cartridge inlet 224. The passage-forming portion 2323 (refer to FIG. 37) may form the first upper passage portion P11. The first side passage portion P12 may be formed between the sensor accommodation portion 137 and the side portion of the second container 220. The first side passage portion P12 may be formed between the sensor accommodation portion 137 and the case portion 231. The first side passage portion P12 may be formed between the side portion of the sensor accommodation portion 137 and the side portion of the lower case 230.

The inflow passage P may include a second passage P2. The second passage P2 may be formed between the side portion of the cap 300 and the side portion of the first container 210. The second passage P2 may be formed between the side portion of the cap 300 and the side portion of the first chamber C1. The second passage P2 may interconnect the cap inlet 304*a* and the first passage P1. The second passage P2 may extend from the cap inlet 304*a* toward the first passage P1 along the gap between the side portion of the cap 300 and the side portion of the first container 210. The second passage P2 may extend from the cap inlet 304*a* toward the first passage P1 along the gap between the side portion of the cap 300 and the side portion of the first chamber C1. The second passage P2 may be elongated vertically.

The second sensor 180 may be accommodated in the sensor accommodation portion 137. The sensor accommodation portion 137 may surround the second sensor 180. The sensor accommodation portion 137 may have a sensing hole 137*a* formed therein so as to be open toward the cartridge 200. The sensing hole 137*a* may be open toward the cartridge inlet 224. The sensing hole 137*a* may be located between the second sensor 180 and the cartridge 200. The sensing hole 137*a* may be located between the second sensor 180 and the cartridge inlet 224. The second sensor 180 may be disposed so as to face the sensing hole 137*a*. The second sensor 180 may be disposed so as to face the cartridge inlet 224. The second sensor 180 may be disposed adjacent to the cartridge inlet 224. The second sensor 180 may sense the flow of air passing through the cartridge inlet 224.

A waterproof film 181 may be disposed between the second sensor 180 and the sensing hole 137*a*. The waterproof film 181 may be coupled or attached to one side of the second sensor 180. The waterproof film 181 may be attached to the sensing surface of the second sensor 180. The waterproof film 181 may be disposed between the second sensor 180) and the cartridge inlet 224. The waterproof film 181 may be disposed between the second sensor 180 and the first passage P1. For example, the waterproof film 181 may be made of a Gore-Tex material. The waterproof film 181 may prevent the aerosol or the liquid from contacting the sensing surface of the second sensor 180 or accumulating thereon.

The connection passage 2314 may be formed separately from the second chamber C2 in the second container 220. The frame 240 may partition the inside of the lower case 230 into the second chamber C2 and the connection passage 2314. The frame 240 may include the chamber inlet 2424.

The chamber inlet 2424 may be formed at a position higher than the bottom of the second chamber C2. The chamber inlet 2424 may be formed at the side portion of the frame 240. The chamber inlet 2424 may be formed at the side wall 2421 of the second frame portion 242. The chamber inlet 2424 may be open in the direction in which the cartridge inlet 224 is open.

The chamber inlet 2424 may allow the second chamber C2 and the connection passage 2314 to communicate with each other. The connection passage 2314 may interconnect the cartridge inlet 224 and the second chamber C2. The connection passage 2314 may interconnect the cartridge inlet 224 and the chamber inlet 2424.

The blocking wall 2317 may protrude from the bottom of the connection passage 2314. The blocking wall 2317 may protrude upwards. The blocking wall 2317 may close the lower portion of the connection passage 2314. The blocking wall 2317 may be disposed between the cartridge inlet 224 and the chamber inlet 2424. The blocking wall 2317 may extend to a position higher than the cartridge inlet 224. The blocking wall 2317 may extend to a position higher than the chamber inlet 2424.

The first chamber C1 and the connection passage 2314 may be formed separately from each other by the first frame portion 241. The first frame portion 241 may be disposed between the first chamber C1 and the connection passage 2314. One side of the first frame portion 241 may cover the upper side of the connection passage 2314. The other side of the first frame portion 241 may be supported by the extension portion 232.

The second frame portion 242 may partition the inside of the lower case 230 into the second chamber C2 and the connection passage 2314. The second frame portion 242 may be disposed between the second chamber C2 and the connection passage 2314. The side wall 2421 of the second frame portion 242 may cover the side portion of the connection passage 2314. The bottom 2422 of the second frame portion 242 may be supported by the bottom 2312 of the lower case 230.

The round surface 2418 may be adjacent to the upper end of the blocking wall 2317. The round surface 2418 may be formed between the first frame portion 241 and the second frame portion 242. The round surface 2418 may extend to form a round shape from the upper end of the connection passage 2314 toward the chamber inlet 2424.

The cartridge inlet 224 may be formed at a position higher than the bottom of the connection passage 2314. The cartridge inlet 224 may be formed at the side wall 2311 of the case portion 231, and may be formed at a position higher than the bottom 2312 of the case portion 231. The cartridge inlet 224 may be open in a direction intersecting the direction in which the blocking wall 2317 protrudes. The blocking wall 2317 may protrude upwards, and the cartridge inlet 224 may face the lateral direction. The cartridge inlet 224 may face the surface of the blocking wall 2317. The cartridge inlet 224 may face the sensing hole 137*a* and the second sensor 180.

When the user inhales air through the stick 400, external air may be introduced into the aerosol-generating device through the cap inlet 304*a*. The air introduced into the cap inlet 304*a* may sequentially pass through the second passage P2 and the first passage P1, and then may be introduced into the cartridge 200 through the cartridge inlet 224. The second sensor 180 may sense the flow of air passing through the first passage P1. The second sensor 180 may sense the flow of air passing through the cartridge inlet 224.

The air that has passed through the cartridge inlet 224 may pass through the connection passage 2314, and then may be introduced into the second chamber C2 through the chamber inlet 2424. The air flowing through the connection passage 2314 may flow toward the chamber inlet 2424 along the round surface 2418. The air introduced into the second chamber C2 may be supplied to the stick 400 inserted into the insertion space 214 together with the aerosol generated in the second chamber C2.

Accordingly, it is possible to prevent the liquid collecting in the second chamber C2 from leaking out of the cartridge 200 through the cartridge inlet 224.

In addition, it is possible to prevent the aerosol generated in the cartridge 200 or the liquid in the cartridge 200 from contacting the sensor 180, thus preventing malfunction of the sensor 180.

In addition, it is possible to increase air flow efficiency outside the cartridge 200 and to increase the sensing performance of the sensor 180.

In addition, it is possible to reduce air flow loss in the cartridge 200.

Referring to FIG. 46, the aforementioned stick 400 may include a medium portion 410. The stick 400 may include a cooling portion 420. The stick 400 may include a filter portion 430. The cooling portion 420 may be disposed between the medium portion 410 and the filter portion 430. The stick 400 may include a wrapper 440. The wrapper 440 may wrap the medium portion 410. The wrapper 440 may wrap the cooling portion 420. The wrapper 440 may wrap the filter portion 430. The stick 400 may have a cylindrical shape.

The medium portion 410 may include a medium 411. The medium portion 410 may include a first medium cover 413. The medium portion 410 may include a second medium cover 415. The medium 411 may be disposed between the first medium cover 413 and the second medium cover 415. The first medium cover 413 may be disposed at one end of the stick 400. The medium portion 410 may have a length of 24 mm.

The medium 411 may contain a multicomponent substance. The substance contained in the medium may be a multicomponent flavoring substance. The medium 411 may be composed of a plurality of granules. Each of the plurality of granules may have a size of 0.4 mm to 1.12 mm. The granules may account for approximately 70% of the volume of the medium 411. The length L2 of the medium 411 may be 10 mm. The first medium cover 413 may be made of an acetate material. The second medium cover 415 may be made of an acetate material. The first medium cover 413 may be made of a paper material. The second medium cover 415 may be made of a paper material. At least one of the first medium cover 413 or the second medium cover 415 may be made of a paper material, and may be crumpled so as to be wrinkled, and a plurality of gaps may be formed between the wrinkles so that air flows therethrough. Each of the gaps may be smaller than each of the granules of the medium 411. The length L1 of the first medium cover 413 may be shorter than the length L2 of the medium 411. The length L3 of the second medium cover 415 may be shorter than the length L2 of the medium 411. The length L1 of the first medium cover 413 may be 7 mm. The length L2 of the second medium cover 415 may be 7 mm.

Accordingly, each of the granules of the medium 411 may be prevented from being separated from the medium portion 410 and the stick 400.

The cooling portion 420 may have a cylindrical shape. The cooling portion 420 may have a hollow shape. The cooling portion 420 may be disposed between the medium portion 410 and the filter portion 430. The cooling portion 420 may be disposed between the second medium cover 415 and the filter portion 430. The cooling portion 420 may be formed in the shape of a tube that surrounds a cooling path 424 formed therein. The cooling portion 420 may be thicker than the wrapper 440. The cooling portion 420 may be made of a paper material thicker than that of the wrapper 440. The length L4 of the cooling portion 420 may be equal or similar to the length L2 of the medium 411. The length L4 of each of the cooling portion 420 and the cooling path 424 may be 10 mm. When the stick 400 is inserted into the aerosol-generating device (refer to FIG. 3), at least part of the cooling portion 420 may be exposed to the outside of the aerosol-generating device.

Accordingly, the cooling portion 420 may support the medium portion 410 and the filter portion 430, and may secure the rigidity of the stick 400. In addition, the cooling portion 420 may support the wrapper 440 between the medium portion 410 and the filter portion 430, and may provide a portion to which the wrapper 440 is adhered. In addition, the heated air and aerosol may be cooled while passing through the cooling path 424 in the cooling portion 420.

The filter portion 430 may be composed of a filter made of an acetate material. The filter portion 430 may be disposed at the other end of the stick 400. When the stick 400 is inserted into the aerosol-generating device (refer to FIG. 3), the filter portion 430 may be exposed to the outside of the aerosol-generating device. The user may inhale air in the state of holding the filter portion 430 in the mouth. The length L5 of the filter portion 430 may be 14 mm.

The wrapper 440 may wrap or surround the medium portion 410, the cooling portion 420, and the filter portion 430. The wrapper 440 may form the external appearance of the stick 400. The wrapper 440 may be made of a paper material. An adhesive portion 441 may be formed along one edge of the wrapper 440. The wrapper 440 may surround the medium portion 410, the cooling portion 420, and the filter portion 430, and the adhesive portion 441 formed along one edge of the wrapper 440 and the other edge thereof may be adhered to each other. The wrapper 440 may surround the medium portion 410, the cooling portion 420, and the filter portion 430, but may not cover one end or the other end of the stick 400.

Accordingly, the wrapper 440 may fix the medium portion 410, the cooling portion 420, and the filter portion 430, and may prevent these components from being separated from the stick 400.

A first thin film 443 may be disposed at a position corresponding to the first medium cover 413. The first thin film 443 may be disposed between the wrapper 440 and the first medium cover 413, or may be disposed outside the wrapper 440. The first thin film 443 may surround the first medium cover 413. The first thin film 443 may be made of a metal material. The first thin film 443 may be made of an aluminum material. The first thin film 443 may be in close contact with the wrapper 440, or may be coated thereon.

A second thin film 445 may be disposed at a position corresponding to the second medium cover 415. The second thin film 445 may be disposed between the wrapper 440 and the second medium cover 415, or may be disposed outside the wrapper 440. The second thin film 445 may be made of a metal material. The second thin film 445 may be made of an aluminum material. The second thin film 445 may be in close contact with the wrapper 440, or may be coated thereon.

Accordingly, when a capacitance sensor for recognizing the stick is inserted in the aerosol-generating device, the capacitance sensor may sense whether the stick 400 is inserted into the aerosol-generating device. Referring to FIG. 47, a cartridge 200' may include at least one of a first container 210, a second container 220', a wick 261, or a heater 262. The cartridge 200' may include a sealing member 250'. The second container 220' may be coupled to the first container 210. The second container 220' may include at least one of a lower case 230' or a frame 240'.

The lower case 230' may include an accommodation portion 231' and an extension portion 232'. A first inclined wall 2313 may form any one of the side walls 2311 of the accommodation portion 231'. The first inclined wall 2313 may cover one side of a connection passage 2314. The first inclined wall 2313 may be inclined such that the cross-sectional area of the accommodation portion 231' gradually increases from the lower part of the accommodation portion 231' to the upper part thereof. A cartridge inlet 224 may be formed at a portion of the first inclined wall 2313.

A guide recess 221*b* may be formed in a manner such that a portion of the side wall 2311 of the accommodation portion 231' is recessed. The guide recess 221*b* may have a shape that is gradually narrowed toward the upper side thereof. The lower end of the guide recess 221*b* may be open downwards. The guide recess 221*b* may be formed below a depressed portion 221*a*.

The extension portion 232' may extend from the upper end of the first inclined wall 2313 to the outside of the accommodation portion 231'. A latching hook 2329 may protrude from the extension portion 232'. The latching hook 2329 may be inserted into and may catch in a latching recess 2419 formed in a first frame 241. The latching hook 2329 may be referred to as a lower case hook 2329. The latching recess 2419 may be referred to as a frame recess 2419.

A sealing member 250' may include a sealing link 2531 interconnecting a first sealing portion 251 and a second sealing portion 252. The sealing link 2531 may be provided in a plural number. The sealing links 2531 may be elongated from the second sealing portion 252 to the first sealing portion 251. The plurality of sealing links 2531 may be radially arranged about the second sealing portion 252.

A first flow guide 2318 may be formed at one side of the accommodation portion 231'. The first flow guide 2318 may be formed in a manner such that a portion of the side wall 2311 of the accommodation portion 231' is concavely recessed outwards from an accommodation space 2310. The first flow guide 2318 may be formed to be rounded in a shape that is convex outwards. The first flow guide 2318 may be contiguous with the accommodation space 2310. The first flow guide 2318 may be formed at a position opposite the cartridge inlet 224. The first flow guide 2318 may be formed at a position opposite the first inclined portion 2313.

Referring to FIGS. 48 and 49, a support bar 2316 may extend upwards from the bottom 2312 of the lower case 230'. The support bar 2316 may protrude from the side wall 2311 of the lower case 230' into the accommodation space 2316. The support bar 2316 may be contiguous with the accommodation space 2310. A pair of support bars 2316 may be respectively formed on two opposite side walls 2311 of the lower case 230'. The support bar 2316 may have a shape that is gradually narrowed toward the upper side thereof.

A second inclined wall 2423 may form any one of the side walls 2421 of a second frame 242'. The second inclined wall 2423 may cover one side of the connection passage 2314. The second inclined wall 2423 may be inclined so as to be gradually widened from the lower portion of the second frame 242' to the upper portion thereof. The second inclined wall 2423 may be inclined so as to correspond to the shape of the support bar 2316. The second inclined wall 2423 may be formed at a position corresponding to the first inclined wall 2313. The support bar 2316 may support the second inclined wall 2423.

Accordingly, when the frame 240' is inserted into the accommodation space 2310, the second inclined wall 2423 may slide along the support bar 2316, whereby positioning thereof may be guided.

The latching hook 2329 may be formed to protrude upwards from the bottom portion 2321 of the extension portion 232'. The latching hook 2329 may extend upwards from the bottom portion 2321, and may be bent toward the insertion space 2310 to form a hook shape.

Referring to FIG. 50, the latching recess 2419 may be formed in one side of the first frame 241'. The latching recess 2419 may be formed to be recessed into the edge or the side wall 2412 of the first frame 241'. The latching recess 2419 may be elongated in the direction in which the first frame 241' extends. The latching recess 2419 may be disposed at a position opposite the second frame 242'. The latching recess 2419 may be open in the direction in which the chamber inlet 2424 is open. The latching hook 2329 may be disposed at a position opposite the accommodation space 2310. The latching hook 2329 may be open in the direction in which the cartridge inlet 224 is open.

Referring to FIGS. 48 to 51, the frame 240' may be inserted into the accommodation space 2310 in the lower case 230'. The bottom portion 2411 of the first frame 241' may be supported by the extension portion 232'. The latching hook 2329 may be inserted into and may catch in the latching recess 2419. The latching hook 2329 may catch in the lower portion of the latching recess 2419. When the frame 240' is inserted into the accommodation space 2310, the second inclined wall 2423 may slide along the support bar 2316, whereby positioning thereof may be guided. The second inclined wall 2423 may be supported by the support bar 2316. The side wall 2421 of the second frame 242' may be supported by the side wall 2311 of the lower case 230'. The bottom 2422 of the second frame 242' may be supported by the bottom 2312 of the lower case 230'. A fastening protrusion 2425 may be inserted into and fastened into a fastening recess 2315.

Referring to FIGS. 52 to 54, the first sealing portion 251 and the second sealing portion 252 may be connected to each other. The second sealing portion 252 may extend from an end of the first sealing portion 251. The end of the first sealing portion 251 may be connected to an end of the second sealing portion 252.

The sealing member 250' may include the sealing link 2531. The sealing link 2531 may interconnect the remaining part other than the end of the first sealing portion 251 and the remaining part other than the end of the second sealing portion 252. The sealing link 2531 may interconnect a second sealing portion body 2521 and a first part 2511 of the first sealing portion 251.

The sealing link 2531 may be provided in a plural number. The sealing links 2531 may be located above the bottom portion 2411 of the first frame 241'. The sealing links 2531 may be radially arranged toward the first sealing portion 251 about the second sealing portion body 2521. The sealing links 2531 may be spaced apart from each other, and a gap may be formed between the sealing links 2531. The sealing hook 2415 may be disposed between the sealing links 2531. For example, four sealing links 2531 may be provided, and three sealing hooks 2415 may be provided such that one of the sealing hooks 2415 is disposed between a corresponding pair of adjacent sealing links 2531 among the four thereof.

At least one pair of sealing links 2531 may be disposed parallel to each other. The pair of sealing links 2531 disposed parallel to each other may extend in the direction in which the first frame 241' extends from the second frame 242'. At least one of the hooks 2415 may be disposed between the pair of sealing links 2531 disposed parallel to each other, and may be engaged with the first sealing portion 251.

The direction interconnecting the pair of depressed portions 221*a* formed at two opposite sides may be defined as a leftward-rightward direction. The direction intersecting the leftward-rightward direction and an upward-downward direction may be defined as a forward-backward direction. The forward-backward direction may be perpendicular to the leftward-rightward direction. The forward-backward direction may be perpendicular to the upward-downward direction. At least one of the sealing links 2531 may be elongated in the forward-backward direction from the second sealing portion 252 toward the first sealing portion 251. At least one of the sealing links 2531 may be elongated in the leftward-rightward direction from the second sealing portion 252 toward the first sealing portion 251. Tension may be applied to the sealing links 2531 in the longitudinal direction of the sealing links 2531. The sealing links 2531 may support the first sealing portion 251 and the second sealing portion 252 in the longitudinal direction, in which the sealing links 2531 extend.

A fitting portion 255 may be connected to one side of a second part 2512 of the first sealing portion 251. The fitting portion 255 may protrude downwards from the inner circumferential surface of the second part 2512 of the first sealing portion 251. The fitting portion 255 and the first part 2511 of the first sealing portion 251 may be spaced apart from each other. The fitting portion 255 may be adjacent to the hook 2415. The fitting portion 255 may be disposed between the plurality of sealing links 2531. The fitting portion 255 may be provided in a plural number.

A fitting groove 254 may be formed between the fitting portion 255 and the first part 2511 of the first sealing portion 251. The fitting groove 254 may be open in the downward direction of the sealing member 250'. The second part 2512 of the first sealing portion 251 may cover the upper side of the fitting groove 254.

A frame rim 2412 may be inserted into the fitting groove 254 to be fitted into the first sealing portion 251. The frame rim 2412 may be force-fitted into the fitting groove 254. The first sealing portion 251 may cover the frame rim 2412. The frame rim 2412 may be in close contact with the fitting portion 255, the first part 2511 of the first sealing portion 251, and the second part 2512 of the first sealing portion 251. The outer circumferential surface of the frame rim 2412 may be in close contact with the first part 2511 of the first sealing portion 251. The upper surface of the frame rim 2412 may be in close contact with the second part 2512 of the first sealing portion 251. A portion of the inner circumferential surface of the frame portion 241' may be in contact with the fitting portion 255.

Accordingly, the sealing member 250' may be tightly fixed to the frame 240', and may thus be prevented from being separated therefrom.

Referring to FIGS. 54 and 55, the inner wall 212 of the first container 210 may be in close contact with the second sealing portion 252 while pressing the same downwards. When the inner wall 212 of the first container 210 presses the second sealing portion 252 downwards, deformation force may applied to the second sealing portion 252 in the radial direction. The deformation force applied to the second sealing portion 252 may be transmitted to the sealing links 2531. The sealing links 2531 may be radially arranged about the second sealing portion 252. The sealing hook 2415 may hold the first sealing portion 251 at a position near the sealing links 2531. The sealing hook 2415 may support the inner circumferential surface of the first sealing portion 251.

Accordingly, when the components of the cartridge 200' are coupled, it is possible to prevent deformation of the shape of the sealing member 250' or movement of the sealing member 250' from the correct position thereof.

Referring to FIGS. 55 and 56, the chamber inlet 2424 may be open in one side of the second chamber C2 in a direction intersecting the longitudinal direction of the insertion space 214. The chamber inlet 2424 may be open in a direction perpendicular to the longitudinal direction of the insertion space 214. The chamber inlet 2424 may communicate with the outside of the second chamber C2. The chamber inlet 2424 may allow the cartridge inlet 224 and the second chamber C2 to communicate with each other therethrough. The chamber inlet 2424 may allow the connection passage 2314 and the second chamber C2 to communicate with each other therethrough.

The first flow guide 2318 may be located on the other side of the second chamber C2 that is opposite the chamber inlet 2424 with respect to the second chamber C2. The first flow guide 2318 may cover the other side of the second chamber C2. The first flow guide 2318 may be contiguous with the other side of the second chamber C2.

The first flow guide 2318 may be concave to the outside of the second chamber C2. The first flow guide 2318 may be formed in a manner such that a portion of the side wall 2311 of the lower case 230' is concavely recessed outwards from the second chamber C2. The first flow guide 2318 may extend so as to be rounded toward the insertion space 214. The first flow guide 2318 may extend upwards so as to be rounded from a position adjacent to the bottom of the second chamber C2. The first flow guide 2318 may have a round shape and may surround the other side of the second chamber C2. The shape of the first flow guide 2318 may include a part of a spherical shape. The first flow guide 2318 may surround the lower portion and the side portion of the second chamber C2. The lower portion of the first flow guide 2318 may be located at a position lower than the height of the chamber inlet 2424.

The inner surface of the first flow guide 2318 may be connected to one side of the outer circumferential surface of the insertion space 214. The inner surface of the first flow guide 2318 may extend so as to be rounded outwards from the lower portion of the second chamber C2 toward the lower end of one side of the outer circumferential surface of the insertion space 214.

The chamber inlet 2424 may be open toward the wick 261. The chamber inlet 2424 may be formed beside the wick 261. The chamber inlet 2424 may be formed at a portion of the second inclined wall 2423. The chamber inlet 2424 may face the wick 261. The chamber inlet 2424 may overlap the wick 261. The wick 261 may be disposed between the chamber inlet 2424 and the first flow guide 2318. The wick 261 may be disposed below the insertion space 214. The wick 261 may overlap the insertion space 214. The wick 261 may be elongated in a direction intersecting the direction in which the chamber inlet 2424 is open. The chamber inlet 2424 may be open in the forward-backward direction, and the wick 261 may be elongated in the leftward-rightward direction. The chamber inlet 2424 may face the center of the wick 261 in the leftward-rightward direction.

A blocking wall 2317 may be located between the first inclined wall 2313 and the second inclined wall 2423. The support bar 2316 may be located between the blocking wall 2317 and the second inclined wall 2423. The support bar 2316 may support the second inclined wall 2423.

The side wall 2311 of the accommodation portion 231' may support the side wall 2421 of the second frame 242'. The bottom 2312 of the accommodation portion 231' may support the bottom 2421 of the second frame 242'.

The outer wall 211 of the first container 210 may be coupled to the border portion 2322 of the lower case 230. The inner wall 212 of the first container 210 may press the second frame 242 downwards toward the lower case 230. The lower case 230 may support the second frame 242. A part of the bottom portion 2411 of the first frame 241 may be supported by the bottom portion 2311 of the extension portion 232'. The extension portion 232' may support the bottom portion 2411 of the first frame 241 at a position between the latching hook 2329 and the inner wall 212 of the first container 210.

The latching hook 2329 may be inserted into the latching recess 2419, and may thus catch in the first frame 241. The latching hook 2329 may protrude upwards from the bottom portion 2321 of the extension portion 232'. The latching hook 2329 may be disposed adjacent to the edge of the extension portion 232'. The latching hook 2329 may have a hook shape that protrudes upwards from the bottom portion 2321 of the extension portion 232' and is bent in a predetermined direction. The first frame 241 and the latching hook 2329 may receive support force from each other in the upward-downward direction.

When the inner wall 212 of the first container 210 presses the second frame 242 downwards toward the lower case 230, the first frame 241, which is connected to the second frame 242, may receive deformation force such that the portion thereof in which the latching recess 2419 is formed is oriented upwards with respect to the extension portion 232', which supports the first frame 241. The first frame 241 may press the latching hook 2329 upwards. The latching hook 2329 may support the first frame 241. The latching hook 2329 may support the first frame 241 in the downward direction.

Accordingly, when the cartridge 200' is assembled, it is possible to prevent deformation of the shape of the frame 240) and to improve the structural stability of the cartridge 200'. In addition, it is possible to minimize the number of parts that are coupled using an adhesive member, thereby improving convenience of assembly of the cartridge 200'.

The inner wall 212 and the outer wall 211 of the first container 210, which surrounds the insertion space 214, may define a pipe 212*a*. The first container 210 may be provided with the pipe 212*a*. The pipe 212*a* may surround the insertion space 214. The pipe 212*a* may be open upwards and downwards. A portion of the lower end of the pipe 212*a* may press the second sealing member 252 downwards. A portion of the lower end of the pipe 212*a* may be coupled to the lower case 230'. The first flow guide 2318 may be connected to the pipe 212*a*. The inner surface of the first flow guide 2318 may form a continuous surface together with a portion of the inner circumferential surface of the pipe 212*a*.

Referring to FIGS. 57 and 58, the first flow guide 2318 may be disposed opposite the chamber inlet 2424 with respect to the second chamber C2. The first flow guide 2318 may be concave to the outside of the second chamber C2, and may extend so as to be rounded toward the insertion space 214. The first flow guide 2318 may cover the other side of the second chamber C2.

The inner surface of the first flow guide 2318 may be connected to a portion of the outer circumferential surface of the insertion space 214. The inner surface of the first flow guide 2318 and the outer circumferential surface of the insertion space 214 may be located in the same plane at the contact portion therebetween. The inner surface of the first flow guide 2318 and the outer circumferential surface of the insertion space 214 may form a continuous surface. The lower portion of the first flow guide 2318 may be located at a position lower than the height of the chamber inlet 2424. The upper portion of the first flow guide 2318 may be connected to one side of the outer wall 211 surrounding the insertion space 214. The other side of the second chamber C2, which is covered by the first flow guide 2318, may be located below the insertion space 214.

The second inclined wall 2423 may extend upwards from the bottom of the second chamber C2. The second inclined wall 2423 may cover one side of the second chamber C2. The chamber inlet 2424 may be formed at a portion of the second inclined wall 2423.

The chamber inlet 2424 may be open toward the wick 261. The chamber inlet 2424 may completely overlap the wick 261. The chamber inlet 2424 may face the wick 261. The height difference W0 between the center of the chamber inlet 2424 and the center of the wick 261 may be 1 mm or less. The height difference W0 between the center of the chamber inlet 2424 and the center of the wick 261 may be 0.5 mm.

The chamber inlet 2424 may be located above the bottom of the second chamber C2. The wick 261 may be located above the bottom of the second chamber C2. The height H from the bottom of the second chamber C2 to the lower end of the chamber inlet 2424 may be approximately equal to the height H from the bottom of the second chamber C2 to the lower end of the wick 261. The height from the bottom of the second chamber C2 to the center of the wick 261 may be greater than the height from the bottom of the second chamber C2 to the center of the chamber inlet 2424. The height from the bottom of the second chamber C2 to the upper end of the wick 261 may be greater than the height from the bottom of the second chamber C2 to the upper end of the chamber inlet 2424. The chamber inlet 2424 may be disposed within a range of the diameter W1 of the wick 261.

The width W2 of the chamber inlet 2424 may be less than the diameter W1 of the wick 261. The width of the chamber inlet 2424 may gradually increase toward the second chamber C2 or the wick 261. The distance between the wick 261 and the chamber inlet 2424 may be approximately equal to or similar to the width W2 of the chamber inlet 2424.

A center line L may be defined as an imaginary line passing through the center of the insertion space 214 in the longitudinal direction of the insertion space 214. The wick 261 may be disposed between the center line L and the chamber inlet 2424. The chamber inlet 2424 and the first flow guide 2318 may be located opposite each other with respect to the center line L. The wick 261 and the first flow guide 2318 may be located opposite each other with respect to the center line L. The wick 261 may be spaced apart from the center line L. The wick 261 may overlap the chamber inlet 2424 and the insertion space 214, but may not overlap the center line L.

The wick 261 may be adjacent to the chamber inlet 2424. The wick 261 may be disposed closer to the chamber inlet 2424 than to the first flow guide 2318. In a cross-sectional view, the wick 261 may be disposed closer to the inner wall 212 of the first container 210 that surrounds the insertion space 214 than to the outer wall 211 of the first container 210 that surrounds the insertion space 214.

When the user inhales air through the stick 400, the air may be introduced into the second chamber C2 from the chamber inlet 2424. The liquid may be supplied from the first chamber C1 to the wick 261, and may be absorbed by the wick 261. When the heater 262 heats the wick 261 in which the liquid is absorbed, an aerosol may be generated. The air introduced into the second chamber C2 from the chamber inlet 2424 may diffuse to the region around the wick 261, and may come into contact with the wick 261 or may pass through the wick 261.

After contacting the wick 261 or passing through the wick 261, the air containing the aerosol may flow above and below the wick 261. The air flowing above the wick 261 may be introduced into the insertion space 214. The air flowing below the wick 261 may move toward the first flow guide 2318. A portion of the air moving toward the first flow guide 2318 may be directly introduced into the insertion space 214, and the remaining portion of the air may come into contact with the first flow guide 2318. The first flow guide 2318 may guide the air contacting the first flow guide 2318 to the insertion space 214.

Accordingly, the air may uniformly move from the chamber inlet 2424 to the wick 261. In addition, since the air flowing toward the second chamber C2 from the chamber inlet 2424 passes through the wick 261, the amount of aerosol contained in the air may increase. In addition, when the air introduced into the second chamber C2 from the chamber inlet 2424 moves toward the insertion space 214, the first flow guide 2318 may prevent the air from remaining in the second chamber C2, or may prevent the generation of a vortex. In addition, the first flow guide 2318 may guide the air contacting the first flow guide 2318 to the insertion space 214.

The inner circumferential surface of the lower portion of the outer wall 211 of the first container 210 that surrounds the insertion space 214 may include an inclined outer wall surface 218, which is gradually widened in a radially outward direction toward the upper side thereof. The inclined outer wall surface 218 may be inclined outwards so as to be gradually widened from the second chamber C2 toward the insertion space 214. The inclined outer wall surface 218 may be located above the first flow guide 2318.

Accordingly, the air and the aerosol introduced into the insertion space 214 from the second chamber C2 may uniformly diffuse to the lower surface of the stick 400 inserted into the insertion space 214.

Referring to FIGS. 59 and 60, the aerosol-generating device may include an upper body 120'. The upper body 120' may be provided with a mount 130'. The upper body 120' may be provided with a column 140'. Hereinafter, descriptions of the same parts as those of the upper body 120 illustrated in FIGS. 1 to 46 may be omitted.

The column 140' may accommodate a PCB assembly 150'. The PCB assembly 150' may provide light to the cartridge 200, or may sense information about the cartridge 200. For example, the information about the cartridge 200 may include at least one of information about a change in the remaining amount of liquid stored in the first chamber C1 in the cartridge 200, information about the type of liquid stored in the first chamber C1 in the cartridge 200, information about whether the stick 400 is inserted into the insertion space 214 in the cartridge 200, information about the type of stick 400 inserted into the insertion space 214 in the cartridge 200, information about the extent of use or the availability of the stick 400 inserted into the insertion space 214 in the cartridge 200, information about whether the cartridge 200 having the stick 400 inserted into the insertion space 214 is coupled to the body 100, or information about the type of cartridge 200 coupled to the body 100. The information about the cartridge 200 is not limited to the aforementioned information. The column 140' may accommodate a light source 153 configured to emit light. The column 140' may accommodate a third sensor 155 configured to sense information about the cartridge 200. The aforementioned cartridge 200 may include a cartridge 200' according to another embodiment.

The PCB assembly 150' may include at least one of a PCB 151, a light source 153, or a third sensor 155. The third sensor 155 may be disposed on the PCB 151. The third sensor 155 may be mounted in a region that does not interfere with the light source 153. The third sensor 155 may be disposed so as to face the insertion space 214. The third sensor 155 may sense information about the stick 400 inserted into the insertion space 214. The third sensor 155 may be a proximity sensor.

The PCB assembly 150' may be mounted in a mounting space 144 in the column 140'. A window 170' may be coupled to the column 140' so as to cover the PCB assembly 150'. The window 170' may be transparent or translucent. The window 170' may be made of a white translucent material or a milky-colored translucent material.

Window rims 1701, 1702, and 1703 may extend along the edge of the window 170'. The window rims 1701, 1702, and 1703 may cover flanges 1451, 1452, and 1453 of the column 140'. The window rims 1701, 1702, and 1703 may be disposed further forwards than a latching protrusion 173.

The front surface 171*a* and the rear surface 172 of the window 170' may be surrounded by the window rims 1701, 1702, and 1703. The front surface 171*a* of the window 170' may have a shape that is concavely recessed backwards. The window rims 1701, 1702, and 1703 may be disposed along the edge of the window 170' at a position between the front surface 171*a* and the rear surface 172 of the window 170'.

A pair of side window rim portions 1701 may be formed at two opposite sides of the window 170'. Each of the side window rim portions 1701 may have a shape that is elongated in the upward-downward direction along a respective one of the side edges of the window 170'. The upper ends of the side window rim portions 1701 may extend so as to be rounded toward an upper window rim portion 1703. A lower window rim portion 1702 may be formed at the lower portion of the window 170'. The lower window rim portion 1702 may be elongated in the leftward-rightward direction along the lower edge of the window 170'. The lower window rim portion 1702 may be connected to the lower ends of the pair of side window rim portions 1701. The upper window rim portion 1703 may be formed at the upper portion 171*b* of the window 170'. The upper window rim portion 1703 may protrude upwards from the upper portion 171*b* of the window 170'. The upper window rim portion 1703 may extend along the shape of the front surface 171*a* of the window 170'. The two ends of the upper window rim portion 1703 may be connected to or adjacent to the upper ends of the pair of side window rim portions 1701.

The window frame 160' may cover the edge of the window 170'. The window frame 160' may be coupled to the column 140'. The window frame 160' may have a shape that extends along the edge of the window 170'. The center of the window frame 160' may be open. The window frame 160' may have a shape that is elongated in the upward-downward direction. The window 170' may be disposed between the window frame 160' and the column 140'. The front surface 171*a* of the window 170' may be exposed through the open center of the window frame 160'.

A pair of side window frame portions 161 may be formed at two opposite sides of the window frame 160'. Each of the side window frame portions 161 may have a shape that is elongated in the upward-downward direction. A lower window frame portion 162 may be formed at the lower portion of the window frame 160'. The lower window frame portion 162 may be elongated in the leftward-rightward direction. The two ends of the lower window frame portion 162 may be connected to the lower ends of the pair of side window frame portions 161. An upper window frame portion 163 may be formed at the upper portion of the window frame 160'. The two ends of the upper window frame portion 163 may be connected to the upper ends of the pair of side window frame portions 161.

Referring to FIGS. 60 and 61, the PCB assembly 150' may be coupled to the rear surface 172 of the window 170'. A first holding arm 151*b* may protrude forwards from the rear surface of the PCB 151. The first holding arm 151*b* may be disposed at the upper side of the PCB 151. The first holding arm 151*b* may be disposed adjacent to the third sensor 155. The first holding arm 151*b* may catch in a gap formed in the upper portion of the rear surface 172 of the window 170'. A second holding arm 151*c* may be disposed at the lower side of the PCB 151. The second holding arm 151*c* may protrude forwards from the rear surface of the PCB 151. The second holding arm 151*c* may catch in a gap formed in the lower portion of the rear surface 172 of the window 170'. The first holding arm 151*b* and the second holding arm 151*c* may fix the window 170' in position on the PCB 151.

The window 170' may include a latching protrusion 173. The latching protrusion 173 may be formed on the opposite surface 171*b* of the window 170'. The latching protrusion 173 may protrude from each side of the rear surface 172 of the window 170'. The latching protrusion 173 may be provided in a plural number, and the plurality of latching protrusions 173 may be arranged in the upward-downward direction. Each of the plurality of latching protrusions 173 may have a shape that is elongated in the upward-downward direction so as to correspond to the side flange portion 1451.

Referring to FIGS. 62 to 64, the latching protrusion 173 may be spaced backwards apart from the side window rim portion 1701 to form a gap. The latching protrusion 173 may be inserted into a gap 1454 formed in the rear side of the side flange portion 1451 in the column 140'. The latching protrusion 173 may catch in the side flange portion 1451. The side flange portion 1451 may be inserted into the gap between the latching protrusion 173 and the side window rim portion 1701. The latching protrusion 173 may be coupled to the side flange portion 1451 and the gap 1454 in a snap-fit manner. The latching protrusion 173 may prevent the window 170' from being separated from the column 140'.

The side window rim portion 1701 may cover the side flange portion 1451. The lower window rim portion 1702 may cover the lower flange portion 1452. The upper window rim portion 1703 may cover the upper flange portion 1453. The window rims 1701, 1702, and 1703 may be adhered to the flanges 1451, 1452, and 1453 of the column 140' using an adhesive member. The adhesive member may be a sheet of double-sided adhesive tape. When the window 170' is coupled to the column 140', the first holding arm 151*b* and the second holding arm 151*c* may be caught by the rear surface of the window 170', so the PCB assembly 150' may be fixed to the window 170' at the correct position. One surface 171*a* or the front surface 171*a* of the window 170' may face a cartridge accommodation space 134. The opposite surface 172 or the rear surface 172 of the window 170' may face the inside of the column 140'.

Accordingly, the window 170' may be coupled to the column 140' in a snap-fit manner so as not to be separated therefrom. In addition, the process of assembling the window 170' to the column 140' may be simplified. In addition, the window 170' may be stably fixed to the column 140'.

Referring to FIGS. 65 and 66, the window frame 160' may have a shape that extends along the shape of the window rims 1701, 1702, and 1703. The window frame 160' may have an open center in order to expose the front surface 171*a* of the window 170'.

The front surface 171*a* of the window 170' may be adhered to the column 140'. The window frame 160' may be adhered to the edge of the window 170', and may cover the edge of the window 170'. The side window frame portion 161 may be adhered to the front surface of the side window rim portion 1701 to cover the side window rim portion 1701. The lower window frame portion 162 may be adhered to the front surface of the lower window rim portion 1702 to cover the lower window rim portion 1702. The upper window frame portion 163 may be adhered to the upper portion of the upper window rim portion 1703 to cover the upper window rim portion 1703. The upper window frame portion 163 may form the upper wall 143 of the column 140'.

The edge of the front surface 171*a* of the window 170' may protrude further forwards than the window rims 1701, 1702, and 1703. The window frame 160' may be inserted into the gap between the front surface 171*a* of the window 170' and the side walls 141 and 142 of the column 140', and may be in contact with the window rims 1701, 1702, and 1703.

Referring to FIGS. 66 and 67, a sensor cover 137' may be disposed on the inner side wall 131 of the mount 130'. The sensor cover 137' may be contiguous with one side of the space 134 in the mount 130'. The sensor cover 137' may be coupled to the mount 130' to be connected to the inner side wall 131 of the mount 130', and may form a portion of the side wall of the mount 130'. A second sensor 180 may be disposed at one side of the mount 130'. The sensor cover 137' may cover the second sensor 180.

The upper wall 1371 of the sensor cover 137' may face the upper side of the mount 130'. The upper wall 1371 of the sensor cover 137' may be disposed on the side wall 1372 of the sensor cover 137'. The side wall 1372 of the sensor cover 137' may face the space 134 in the mount 130'. The side wall 1372 of the sensor cover 137' may be connected to the upper wall 1371 of the sensor cover 137' to form a continuous surface together therewith. The side wall 1372 of the sensor cover 137' may extend obliquely downwards from the upper wall 1371 of the sensor cover 137'. The side wall 1372 of the sensor cover 137' may surround the space 134 in the mount 130' together with the inner side wall 131 of the mount 130'.

The side wall 1372 of the sensor cover 137' may be inclined such that the space 134 in the mount 130' is gradually narrowed toward the lower side thereof. A sensing hole 137*a* may be formed at a portion of the side wall 1372 of the sensor cover 137'. The sensing hole 137*a* may communicate with the second sensor 180. The sensing hole 137*a* may face the space 134 in the mount 130'.

A second flow guide 1373 may be formed near the periphery of the sensing hole 137*a*, and may protrude from the side wall 1372 of the sensor cover 137' toward the space 134 in the mount 130'. The second flow guide 1373 may extend along the periphery of the sensing hole 137*a*. The width to which the second flow guide 1373 protrudes from the side wall 1372 of the sensor cover 137' may be uniform. The second flow guide 1373 may be inclined parallel to the side wall 1372 of the sensor cover 137'.

A first passage P1 may be connected at the downstream portion thereof to the sensing hole 137*a* and the cartridge inlet 224 (refer to FIG. 74). The second flow guide 1373 may surround the downstream portion of the first passage P1, and may be open toward the upstream portion of the first passage P1 (refer to FIG. 74).

The second flow guide 1373 may be formed in a U-shape. The second flow guide 1373 may extend so as to be rounded. The lower portion of the second flow guide 1373 may extend so as to be rounded along the periphery of the lower side of the sensing hole 137*a*. The two opposite side portions of the second flow guide 1373 may extend parallel to each other near the opposite sides of the sensing hole 137*a*.

A recessed cover surface 1374 may be formed in a manner such that a portion of the side wall 1372 of the sensor cover 137' is recessed. The recessed cover surface 1374 may be formed around the sensing hole 137*a*. The sensing hole 137*a* may be formed at a portion of the recessed cover surface 1374. The recessed cover surface 1374 may be surrounded by the second flow guide 1373. The upper end of the recessed cover surface 1374 may be connected to the upper wall 1371 of the sensor cover 137'. The recessed cover surface 1374 may be inclined parallel to the side wall 1372 of the sensor cover 137'. The two opposite sides and the lower portion of the recessed cover surface 1374 may be covered by the second flow guide 1373. The upper portion of the recessed cover surface 1374 may be open toward the upper wall 1371 of the sensor cover 137', rather than being covered by the second flow guide 1373. The recessed cover surface 1374 may face the space 134 in the mount 130'.

A sensing frame 183 may surround the periphery of the second sensor 180. The sensing frame 183 may be integrally formed with the inner side wall 131 of the mount 130'. The sensor cover 137' may be coupled and fixed to the sensing frame 183. The sensing frame 183 may have an open inside to form a space 183*a* therein. The second sensor 180 may face the space 183*a* in the sensing frame 183. The side wall 1372 of the sensor cover 137' may cover the sensing frame 183 and the space 183*a* in the sensing frame 183. The side wall 1372 of the sensor cover 137' may be disposed between the sensing frame 183 and the space 134 in the mount 130'.

Referring to FIGS. 67 to 69, the front surface of the side wall 1372 of the sensor cover 137' may face the space 134 in the mount 130'. The rear surface of the side wall 1372 of the sensor cover 137' may face the second sensor 180 and the sensing frame 183 of the mount 130'.

A sensor cover bar 1375 may protrude from the rear surface of the side wall 1372 of the sensor cover 137'. A pair of sensor cover bars 1375 may be formed so as to be spaced apart from the opposite sides of the sensing hole 137*a*. The pair of sensor cover bars 1375 may be formed parallel to each other. The sensor cover bars 1375 may be elongated in the upward-downward direction.

A sensor cover hook 1376 may be formed on the rear surface of the side wall 1372 of the sensor cover 137'. The sensor cover hook 1376 may be provided in a pair. Each of the pair of sensor cover hooks 1376 may protrude from a respective one of the pair of sensor cover bars 1375 in a direction intersecting the direction in which the sensor cover bars 1375 protrude.

The sensor cover bars 1375 may be inserted into the space 183*a* in the sensing frame 183, and may be supported by the sensing frame 183. The sensor cover hooks 1376 may be inserted into the space 183*a* in the sensing frame 183 together with the sensor cover bars 1375. Each of the sensor cover hooks 1376 may have an inclined end. The sensor cover hooks 1376 may catch in the sensing frame 183. The sensor cover hooks 1376 may be coupled to the sensing frame 183 in a snap-fit manner. The rear surface of the side wall 1372 of the sensor cover 137' may be adhered to the front surface of the sensing frame 183 using an adhesive member.

Accordingly, the sensor cover 137' may be easily coupled and fixed to the mount 130', and may protect the second sensor 180.

Referring to FIGS. 70 to 72, the lower case 230' may be inserted into the cartridge accommodation space 134. The side wall 2311 of the lower case 230' may be in contact with and may be covered by the inner side wall 131 of the mount 130' in the cartridge accommodation space 134. The lower case 230' may be surrounded and supported by the mount 130'. The lower case 230' may be coupled to the mount 130'.

The bottom portion 2321 of the extension portion 232' may cover the upper wall 1371 of the sensor cover 137'. The bottom portion 2321 of the extension portion 232' may be in contact with the upper wall 1371 of the sensor cover 137'. A passage-forming portion 2323 may be spaced upwards apart from the sensor cover 137' to form a gap. A first upper passage portion P11 (refer to FIG. 74) may be formed between the passage-forming portion 2323 and the upper wall 1371 of the sensor cover 137'.

The first inclined wall 2313 of the lower case 230' may cover the side wall 1372 of the sensor cover 137'. The first inclined wall 2313 and the side wall 1372 of the sensor cover 137' may have slopes corresponding to each other. One side of the mount 130' or the sensor cover 137' may support the first inclined wall 2313.

The first inclined wall 2313 and the side wall 1372 of the sensor cover 137' may be spaced apart from each other. The second flow guide 1373 may protrude from the sensor cover 137' toward the cartridge 200', and may be in close contact with the cartridge 200'. The second flow guide 1373 may be in contact with the first inclined wall 2313. Since the second flow guide 1373 is in contact with the first inclined wall 2313, the first inclined wall 2313 may be spaced apart from the recessed cover surface 1374 and the sensing hole 137*a*. The second flow guide 1373 may be referred to as a spacer 1373.

The cartridge inlet 224 may be disposed inside the second flow guide 1373. The cartridge inlet 224 may face the sensing hole 137*a*. A first side passage portion P12 (refer to FIG. 74) may be formed between the sensing hole 137*a* and the cartridge inlet 224. The first side passage portion P12 (refer to FIG. 74) may be formed between the recessed cover surface 1374 and the first inclined wall 2313. The second flow guide 1373 may surround the downstream portion of the first side passage portion P12 (refer to FIG. 74), which is connected to the cartridge inlet 224 and the sensing hole 137*a*, and may be open toward the upstream portion of the first side passage portion P12.

A guide protrusion 131*b* may protrude from the inner side wall 131 of the mount 130' to the cartridge accommodation space 134. The guide protrusion 131*b* may be provided in a plural number. Each of the pair of guide protrusions 131*b* may be disposed below a respective one of the pair of protruding portions 131*a*. The guide protrusions 131*b* may be disposed adjacent to the protruding portions 131*a*. Each of the guide protrusions 131*b* may have a shape that is gradually narrowed toward the upper side thereof. The guide protrusions 131*b* may be in contact with or may be connected to the bottom 132 of the mount 130'.

A guide recess 221*b* may be formed in a manner such that a portion of the side wall 2311 of the accommodation portion 231' is recessed. The guide recess 221*b* may have a shape that is gradually narrowed toward the upper side thereof. The guide recess 221*b* may be recessed in a shape corresponding to the guide protrusion 131*b*. The lower end of the guide recess 221*b* may be open downwards. The guide recess 221*b* may be formed below the depressed portion 221*a*. The guide recess 221*b* may be provided in a pair, and the pair of guide recesses 221*b* may be respectively formed in the two opposite side walls 2311 of the accommodation portion 231'. Each of the pair of guide recesses 221*b* may be disposed below a respective one of the pair of depressed portions 221*a*. The pair of guide recesses 221*b* may be disposed adjacent to the depressed portions 221*a*.

The protruding portions 131*a* may be inserted into the depressed portions 221*a*. The protruding portions 131*a* may be detachably engaged with the depressed portions 221*a* in a snap-fit manner. The guide protrusions 131*b* may be inserted into the guide recesses 221*b*. The guide protrusions 131*b* and the guide recesses 221*b* may not be engaged with each other.

When the cartridge 200' is inserted into the space 134 in the mount 130', the first inclined wall 2313 may slide along the side wall 1372 or the second flow guide 1373 of the sensor cover 137'. When the lower case 230' is inserted into the cartridge accommodation space 134, the guide recesses 221*b* may slide along the guide protrusions 131*b* while contacting the same. The column 140' or the front surface 171*a* of the window 170' may support one surface of the cartridge 200'. When the cartridge 200' is inserted into the space 134 in the mount 130', the surface of the cartridge 200' may slide along the front surface 171*a* of the window 170'.

Accordingly, the protruding portions 131*a* and the depressed portions 221*a* may be easily guided to the engagement position thereof. In addition, the lower case 230' may be easily inserted into and engaged with the space 134 in the mount 130'.

Referring to FIGS. 73 and 74, the first passage P1 may include a first upper passage portion P11 and a first side passage portion P12. The first upper passage portion P11 may be formed between the upper wall 1371 of the sensor cover 137' and the extension portion 232'. The first upper passage portion P11 may be formed between the upper wall 1371 of the sensor cover 137' and the passage-forming portion 2323. The first upper passage portion P11 may be formed between a second passage P2 and the first side passage portion P12. The first side passage portion P12 may be perpendicular to the second passage P2. The first side passage portion P12 may be surrounded by the second flow guide 1373 (refer to FIG. 66).

The first side passage portion P12 may be formed between the side wall 1372 of the sensor cover 137' and the first inclined portion 2313. The first side passage portion P12 may be formed between the recessed cover surface 1374 and the first inclined portion 2313. The first side passage portion P12 may interconnect the first upper passage portion P11 and the cartridge inlet 224. The first side passage portion P12 may interconnect the first upper passage portion P11 and the sensing hole 137*a*. The first side passage portion P12 may interconnect the sensing hole 137*a* and the cartridge inlet 224. The sensing hole 137*a* and the cartridge inlet 224 may face each other, with the first side passage portion P11 interposed therebetween. The first side passage portion P12 may be formed so as to be inclined downwards from the first upper passage portion P11.

When the user inhales air, the air may be introduced into the second passage P2 through the cap inlet 304*a*. The air passing through the second passage P2 may flow to the first upper passage portion P11 and the first side passage portion P12. The air may flow obliquely from the first upper passage portion P11 to the first side passage portion P12. The second flow guide 1373 (refer to FIG. 66) may guide the air flowing from the first upper passage portion P11 to the first side passage portion P12 to the sensing hole 137*a* and the cartridge inlet 224.

Accordingly, it is possible to prevent the air from flowing or leaking outside the sensing hole 137*a* and the cartridge inlet 224. In addition, it is possible to increase the efficiency of flow of air. In addition, the accuracy of the second sensor 180 may be increased.

Referring to FIGS. 75 and 76, a shaft 311 may be formed at one end of the cover 310. The shaft 311 may be elongated in a direction intersecting the cover 310. The cover 310 may pivot about the shaft 311.

The surface 313 of the cover 310 may be in contact with the stick 400 (refer to FIG. 80). The surface 313 of the cover 310 may be referred to as a front cover surface 313 or a contact surface 313. The other surface 314 of the cover 310 may be formed opposite the surface 313 of the cover 310. The other surface 314 of the cover 310 may be referred to as a rear cover surface 314 or a support surface 314. A cover support rod 317 may protrude from the rear surface 314 of the cover 310. The cover support rod 317 may be elongated in the longitudinal direction of the shaft 311.

A cover rim 315 may extend so as to be rounded along the edge of the cover 310. The cover rim 315 may be formed between an end portion of the front cover surface 313 and the edge of the rear cover surface 314. At least a portion of the cover rim 315 may have a shape corresponding to an upper insertion hole 304 (refer to FIG. 78) and a lower insertion hole 3040 (refer to FIG. 78). At least a portion of the cover rim 315 may have a bow shape or an arch shape.

A cover toe 315*a* may be formed at an end portion of the cover 310 or an end portion of the cover rim 315. The cover toe 315*a* may be located opposite the shaft 311 with respect to the cover 310. The cover toe 315*a* may be formed to be convex outwards from the front cover surface 313 to the rear cover surface 314. The cover toe 315*a* may have a shape corresponding to one side of the upper insertion hole 304 (refer to FIG. 78) and one side of the lower insertion hole 3040 (refer to FIG. 78). The cover toe 315*a* may have a shape corresponding to the outer circumferential surface of the upper end of the insertion space 214 (refer to FIG. 79).

A stick grab 316 may be connected to the pivot shaft of the cover 310, and may pivot together with the cover 310. The stick grab 316 may be formed in a manner such that a portion of the shaft 311 is recessed. The stick grab 316 may form one side surface of the shaft 311. The stick grab 316 may be contiguous with the front cover surface 313. The stick grab 316 may protrude further than the front cover surface 313. The stick grab 316 may have a shape corresponding to one side of the outer circumferential surface of the stick 400 (refer to FIG. 3). The stick grab 316 may be formed in a manner such that a portion of the shaft 311 is concavely recessed in a rounded shape. The stick grab 316 may have a shape corresponding to one side of the outer circumferential surface of the insertion space 214 (refer to FIG. 2) or one side of the inner circumferential surface of the inner wall 212 of the cartridge 200 or 200' (refer to FIG. 2).

A grab recess 316*a* may be formed in a manner such that a portion of the shaft 311 is recessed. The stick grab 316 may surround a portion of the grab recess 316*a*. The grab recess 316*a* may be formed in a portion at which the shaft 311 is contiguous with the front cover surface 313. The grab recess 316*a* may be formed in a manner such that a portion of the shaft 311 is recessed in the shaft 311 from the front surface of the cover 310. A portion of the grab recess 316*a* may be concavely recessed in a rounded shape to form a curved surface.

A spring support surface 312*a* may be formed in a portion of the rear cover surface 314. The spring support surface 312*a* may be formed in a manner such that a portion of the rear cover surface 314 is recessed. The spring support surface 312*a* may extend in a direction intersecting the longitudinal direction of the shaft 311. The spring 312 (refer to FIG. 12) may be wound around the shaft 311. One side of the spring 312 (refer to FIG. 12) may support the spring support surface 312*a*.

Referring to FIG. 77, the cover 310 may have a shape that is bent so as to be convex in a predetermined direction. The front cover surface 313 may be convex in a predetermined direction. The front cover surface 313 may be formed in a bow shape or an arch shape. The front cover surface 313 may be convex in a direction intersecting the longitudinal direction of the shaft 311.

The front cover surface 313 may include a convex portion 313*a* and a border portion 313*b*. The convex portion 313*a* may be an elevated portion of the front cover surface 313, which has an arch shape, and the border portion 313*b* may be the remaining portion of the front cover surface 313 other than the convex portion 313*a*. The front cover surface 313 may be formed as a continuous surface, and may be rounded from the convex portion 313*a* to the border portion 313*b*.

The convex portion 313*a* may protrude further than the border portion 313*b* in a predetermined direction. The convex portion 313*a* may be formed between a pair of border portions 313*b*. The convex portion 313*a* may be spaced apart from the stick grab 316 and the grab recess 316*a*. The convex portion 313*a* may be convex in a direction intersecting the longitudinal direction of the shaft 311.

The border portions 313*b* may be provided at two opposite sides of the convex portion 313*a*. Any one of the border portions 313*b* may be adjacent to the shaft 311. Any one of the border portions 313*b* may be closer to the shaft 311 than the convex portion 313*a*. Any one of the border portions 313*b* may be contiguous with the stick grab 316 and the grab recess 316*a*. The other of the border portions 313*b* may be adjacent to the cover toe 315*a*.

A reference line Ls may be defined as an imaginary line interconnecting an end of the convex portion 313*a* and an end of the stick grab 316. The border portions 313*b* may be spaced apart from the reference line Ls.

The outer circumferential surface of one side of the stick 400 may come into close contact with the reference line Ls so as to be parallel thereto. The outer circumferential surface of one side of the stick 400 may pass through the grab recess 316*a*. When the stick 400 comes into close contact with the reference line Ls, the outer circumferential surface of one side of the stick 400 may come into contact with the front cover surface 313 and the shaft 311. When the stick 400 comes into close contact with the reference line Ls, the stick 400 may come into contact with the convex portion 313*a* and the stick grab 316, and may be supported thereby. When the stick 400 comes into close contact with the reference line Ls, the stick 400 may be spaced apart from the border portions 313*b*. When the stick 400 comes into close contact with the reference line Ls, the stick grab 316 may surround and support the outer circumferential surface of one side of the stick 400.

Referring to FIG. 78, a lower insertion hole 3040 may be disposed below an insertion hole 304 in the cap 300. The insertion hole 304 may be referred to as an upper insertion hole 304. The upper insertion hole 304 may be formed in the upper head 340. The lower insertion hole 3040 may be formed in the lower head 330. The lower insertion hole 3040 may communicate with the upper insertion hole 304. The lower insertion hole 3040 may be disposed between the upper insertion hole 304 and the insertion space 214 (refer to FIG. 79).

A peripheral insertion surface 306*b* may surround the periphery of the lower insertion hole 3040. The lower insertion hole 3040 may be open upwards and downwards. The peripheral insertion surface 306*b* may have an arch shape. The peripheral insertion surface 306*b* may have a shape corresponding to the cover rim 315 (refer to FIG. 75). The cover 310 and the shaft 311 may be disposed at one side of the lower insertion hole 3040.

A second stick guide 306 may protrude from the peripheral insertion surface 306*b* toward the lower insertion hole 3040. The second stick guide 306 may be disposed opposite the shaft 311 of the cover 310 with respect to the lower insertion hole 3040. The second stick guide 306 may be inclined so as to be gradually closer to the shaft 311 from the upper side thereof to the lower side thereof. The second stick guide 306 may protrude toward the shaft 311. When the stick 400 passes through the upper insertion hole 304 and the lower insertion hole 3040, the stick 400 may slide along the second stick guide 306 while contacting the same.

A stick support protrusion 306*a* may be formed at the lower end of the second stick guide 306. The stick support protrusion 306*a* may be the most elevated portion of the second stick guide 306. The stick support protrusion 306*a* may have a shape that extends so as to be rounded in a bow shape. The stick support protrusion 306*a* may extend in a shape corresponding to one side of the outer circumferential surface of the insertion hole 304. The stick support protrusion 306*a* may extend in a shape corresponding to one side of the outer circumferential surface of the stick 400 (refer to FIG. 80).

When the stick 400 is inserted into the insertion hole 304 and the insertion space 214, the stick support protrusion 306*a* may surround and support the outer circumferential surface of one side of the stick 400 (refer to FIG. 80). When the stick 400 (refer to FIG. 80) passes through the upper insertion hole 304 and the lower insertion hole 3040 and is fixed, the stick 400 may be spaced apart from the peripheral insertion surface 306*b*.

Referring to FIGS. 79 and 80, the cover 310 may pivot about the shaft 311 to open and close the insertion hole 304 and the insertion space 214. The cover 310 may pivot in a first direction to open the insertion hole 304 and the insertion space 214. When the cover 310 opens the insertion hole 304, the cover 310 may be inserted into the cover recess 215. The cover 310 may pivot in a second direction to close the insertion hole 304 and the insertion space 214. When the cover 310 closes the insertion hole 304, the cover 310 may be separated from the cover recess 215. The cover 310 may receive elastic force in the second direction from an elastic member providing the elastic force. The elastic member may be the spring 312.

The stick 400 may pass through the upper insertion hole 304 and the lower insertion hole 3040, and may then be inserted into the insertion space 214. When the lower end of the stick 400 pushes the cover 310 in order to move to the insertion space 214 through the insertion hole 304, the cover 310 may pivot in the first direction. When the stick 400 is separated from the insertion space 214 and the insertion hole 304, the cover 310 may pivot in the second direction. When the cover 310 pivots in the first direction, the shaft 311 and the stick grab 316 may also pivot in the same direction.

The stick support protrusion 306*a* may be disposed opposite the cover 310. The stick support protrusion 306*a* may protrude toward the cover 310. The stick support protrusion 306*a* may overlap the insertion space 214 in the upward-downward direction. The cover 310 may pivot toward the stick support protrusion 306*a* to close the opening in the insertion space 214. When the stick 400 is inserted into the insertion space 214, the cover 310 may press the stick 400 toward the stick support protrusion 306*a*. The opposite sides of the stick 400 may be supported by the cover 310 and the stick support protrusion 306*a*.

When the cover 310 pivots in the first direction to open the opening in the insertion space 214, the convex portion 313*a* of the cover 310 may be convex toward the stick support protrusion 306*a*. When the cover 310 opens the opening in the insertion space 214, the convex portion 313*a* may overlap the insertion space 214 in the upward-downward direction. When the stick 400 pushes the cover 310 to open the insertion space 214, the end of the stick 400 may slide along the convex portion 313*a* from the border portion 313*b* of the cover 310. When the stick 400 is inserted into the insertion space 214, the stick 400 may come into contact with the convex portion 313*a*, but may not come into contact with the border portion 313*b*. The opposite sides of the stick 400 may be supported by the convex portion 313*a* and the stick support protrusion 306*a*.

The stick grab 316 may be connected to the pivot shaft or the shaft 311 of the cover 310 to pivot together with the cover 310. When the cover 310 closes the insertion space 214, the stick grab 316 may face upwards. When the cover 310 closes the insertion space 214, the stick grab 316 may not overlap the insertion space 214 in the upward-downward direction. When the cover 310 opens the insertion space 214, the stick grab 316 may protrude toward the stick support protrusion 316*a*, and may overlap the insertion space 214 in the upward-downward direction. When the stick 400 passes through the insertion hole 304 toward the insertion space 214, the stick grab 316 may not be caught by or brought into contact with the stick 400. After the stick 400 is inserted into the insertion space 214, the stick grab 316 may support the outer circumferential surface of the stick 400.

The stick grab 316 may have a concave shape so as to correspond to a portion of the outer circumferential surface of the insertion space 214 (refer to FIG. 75). The stick grab 316 may have a shape corresponding to a portion of the outer circumferential surface of the stick 400. The outer circumferential surface of the insertion space 214 may include a shape corresponding to the outer circumferential surface of the stick 400. When the cover 310 opens the insertion space 214, the stick grab 316 may be parallel to or aligned with a portion of the outer circumferential surface of the insertion space 214. The inner circumferential surface of the inner wall 212 of the first container 210 and the stick grab 316 may be in close contact with the outer circumferential surface of the stick 400 inserted into the insertion space 214, thereby supporting or surrounding the outer circumferential surface of the stick 400).

When the cover 310 opens the insertion space 214, the stick support protrusion 306*a* may face the region between the convex portion 313*a* and the stick grab 316. When the cover 310 opens the insertion space 214, the stick support protrusion 306*a* may be located at a height corresponding to the position between the convex part 313*a* and the stick grab 316. The stick 400 inserted into the insertion space 214 may be in contact with and supported by all of the convex portion 313*a*, the stick grab 316, and the stick support protrusion 306*a*.

When the cover 310 opens the insertion space 214, the convex portion 313*a*, the stick grab 316, and the outer circumferential surface of the lower portion of the insertion space 214 may be parallel to each other. The stick 400 inserted into the insertion space 214 may be in contact with and supported by all of the convex portion 313*a*, the stick grab 316, and the outer circumferential surface of the lower portion of the insertion space 214.

A cover support wall 307 may be formed in the cap 300 at a position adjacent to the cover 310. The cover support wall 307 may be disposed opposite the stick support protrusion 306*a* with respect to the lower insertion hole 3040. The cover support wall 307 may face the lower insertion hole 3040. The cover support wall 307 may be disposed adjacent to the lower side of the shaft 311.

When the cover 310 pivots in the first direction to open the insertion hole 304, the cover support rod 317 may be brought into contact with and supported by the cover support wall 307. When the cover support rod 317 is brought into contact with the cover support wall 307, the cover 310 may be prevented from moving further in the first direction. When the cover support rod 317 is supported by the cover support wall 307, the cover 310 may be spaced apart from the inner wall 212 of the first container 210, which surrounds the cover recess 215, rather than being in contact therewith.

The width W10 or the diameter W10 of the lower end of the insertion space 214 may be less than the width W20 or the diameter W20 of the insertion hole 304. The width direction may be a direction perpendicular to the longitudinal direction of the insertion space 214. When the cover 310 opens the insertion hole 304, the distance W10 between the stick grab 316 and the stick support protrusion 306*a* in the width direction may be approximately equal to the width W10 or the diameter W10 of the insertion space 214. When the cover 310 opens the insertion hole 304, the distance W10 between the convex portion 313*a* of the front cover surface 313 and the stick support protrusion 306*a* in the width direction may be approximately equal to the width W10 or the diameter W10 of the insertion space 214.

The width of the insertion space 214 may gradually decrease toward the lower side thereof. The insertion space 214 may have a tapered shape. The width W10 or the diameter W10 of the lower end of the insertion space 214 may be less than the width W30 or the diameter W30 of the upper end of the insertion space 214. The outer wall 211 and the inner wall 212 of the first container 210, which surround the insertion space 214, may be inclined such that the distance therebetween gradually decreases downwards.

The diameter W10 of the lower end of the insertion space 214 may be approximately equal to the diameter W10 of the outer circumferential surface of the stick 400. The diameter W20) of the insertion hole 304 may be greater than the diameter W10 of the outer circumferential surface of the stick 400. The diameter W30 of the upper end of the insertion space 214 may be greater than the diameter W10 of the outer circumferential surface of the stick 400. Based on the width direction, the distance W10 between the stick grab 316 and the stick support protrusion 306*a* may be approximately equal to the diameter W10 of the outer circumferential surface of the stick 400. Based on the width direction, the distance W10 between the convex portion 313*a* of the front cover surface 313 and the stick support protrusion 306*a* may be approximately equal to the diameter W10 of the outer circumferential surface of the stick 400.

When the stick 400 is inserted into the insertion space 214, the stick 400 may pass through the insertion hole 304, and may slide downwards while contacting at least one of the insertion hole wall 305, the shaft 311, the stick grab 316, the front cover surface 313, the second stick guide 306, or the stick support protrusion 306*a*. When the stick 400 is inserted into the insertion space 214, the stick 400 may slide downwards along the outer circumferential surface of the insertion space 214.

When the stick 400 is inserted into the insertion space 214, the convex portion 313*a* of the front cover surface 313 may come into contact with and support one side of the outer circumferential surface of the stick 400. When the stick 400 is inserted into the insertion space 214, the stick grab 316 (refer to FIGS. 75 and 77) may surround and support a portion of the outer circumferential surface of the stick 400. When the stick 400 is inserted into the insertion space 214, the stick support protrusion 306*a* (refer to FIG. 78) may surround and support a portion of the outer circumferential surface of the stick 400. When the stick 400 is inserted into the insertion space 214, the outer wall 211 and the inner wall 212 of the first container 210, which surround the lower end portion of the insertion space 214, may come into close contact with and surround the lower end portion of the stick 400.

Accordingly, the stick 400 may be easily inserted into the insertion space 214. In addition, the position of the stick 400 may be stably fixed in the state in which the stick 400 is completely inserted into the insertion space 214.

Referring to FIG. 81, light LT may be emitted from the light source 153 of the PCB assembly 150' (refer to FIG. 59). The first container 210 may be formed of a transparent material or a translucent material through which the light LT passes. The side wall 301 of the cap 300 may be formed of a transparent material or a translucent material through which the light LT passes.

At least a portion of the light LT emitted from the light source 153 may travel toward the outer wall 211 of the first container 210. The light LT traveling toward the outer wall 211 of the first container 210 may be defined as first light LT. At least a portion of the light LT emitted from the light source 153 may travel toward the upper wall 212 of the first container 210 and the cap inlet 304*a*. The light LT traveling toward the upper wall 212 of the first container 210 and the cap inlet 304*a* may be defined as second light LT2.

The cap inlet 304*a* may be formed at a portion of the upper end of the cap 300. The cap inlet 304*a* may include a first cap inlet 3041. The cap inlet 304*a* may include a second cap inlet 3042. The cap inlet 304*a* may include a third cap inlet 3043. The first cap inlet 3041 may be located above the second cap inlet 3042. The second cap inlet 3042 may be located between the first cap inlet 3041 and the third cap inlet 3043. The third cap inlet 3043 may be located below the second cap inlet 3042. The second cap inlet 3042 may communicate with the first cap inlet 3041 and the third cap inlet 3043. The first cap inlet 3041 may communicate with the outside of the aerosol-generating device. The third cap inlet 3043 may be connected to the upper end of the second passage P2.

An inlet wall 308 may be formed to have a height corresponding to the cap inlet 304*a*. The inlet wall 308 may be formed in heads 330 and 340 of the cap 300. The inlet wall 308 may cover or surround one side of the cap inlet

304*a*. The upper portion of the side wall 301 of the cap 300 may cover or surround the other side of the cap inlet 304*a*. The cap inlet 304*a* may be surrounded by the upper portion of the side wall 301 of the cap 300 and the inlet wall 308. The first container 210 may be located between the cap inlet 304*a* and the light source 153.

The inlet wall 308 may include a first inlet wall 3081, a second inlet wall 3082, and a third inlet wall 3083. The first inlet wall 3081 may be formed at a height corresponding to the first cap inlet 3041. The first inlet wall 3081 may cover or surround one side of the first cap inlet 3041. The second inlet wall 3082 may be disposed below the first inlet wall 3081. The second inlet wall 3082 may be disposed between the first inlet wall 3081 and the third inlet wall 3083. The second inlet wall 3082 may be connected to the first inlet wall 3081 and the third inlet wall 3083. The second inlet wall 3082 may be formed at a height corresponding to the second cap inlet 3042. The second inlet wall 3082 may cover or surround one side of the second cap inlet 3042. The third inlet wall 3083 may be disposed below the second inlet wall 3082. The third inlet wall 3083 may be formed at a height corresponding to the third cap inlet 3043. The third inlet wall 3083 may cover or surround one side of the third cap inlet 3043.

A light shield 307 may protrude from the side wall 301 of the cap 300 toward the inside of the cap inlet 304*a*. The light shield 307 may be disposed above the second passage P2. The light shield 307 may be disposed between the cap inlet 304*a* and the second passage P2. The light shield 307 may be disposed above the upper wall 213 of the first container 210. The light shield 303 may be made of a material that does not transmit light.

The light shield 307 may be formed at a position corresponding to the third cap inlet 3043 and the third inlet wall 3083. The light shield 307 may protrude from the upper portion of the side wall 301 of the cap 300 to the third cap inlet 3043. The light shield 307 may be disposed between the second cap inlet 3042 and the second passage P2. The side surface of the light shield 307 may face the third cap inlet 3043 and the third inlet wall 3083. The third cap inlet 3043 may be surrounded by the light shield 307 and the third inlet wall 3083. The light shield 307 may be disposed below the first cap inlet 3041 and the second cap inlet 3042, and may cover the first cap inlet 3041 and at least a part of the lower portion of the second cap inlet 3042.

The width to which the light shield 307 protrudes toward the third cap inlet 3043 may be approximately equal to or similar to the width of the first cap inlet 3041. The first cap inlet 3041 may completely overlap the light shield 307 in the upward-downward direction. The second inlet wall 3082 and the third inlet wall 3083 may not overlap the light shield 307 in the upward-downward direction. The end portion of the light shield 307 and the end portion of the first inlet wall 3081 may intersect or overlap each other in the upward-downward direction.

The first inlet wall 3081 may protrude further than the second inlet wall 3082 toward the cap inlet 304*a*. The second inlet wall 3082 may protrude further than the third inlet wall 3083 toward the cap inlet 304*a*. The first cap inlet 3041, the second cap inlet 3042, and the third cap inlet 3043 may be disposed such that the centers thereof are misaligned from each other.

The second inlet wall 3082 may be disposed above the third cap inlet 3043, and may cover a portion of the third cap inlet 3043. The third cap inlet 3043 may overlap the second inlet wall 3042 in the upward-downward direction. The third cap inlet 3043 and the second cap inlet 3042 may be connected to each other. The first inlet wall 3081 may be disposed above the third cap inlet 3043 and the second cap inlet 3042, and may cover a portion of the third cap inlet 3043. The third cap inlet 3043 may overlap the first inlet wall 3081 in the upward-downward direction. The third cap inlet 3043 may completely overlap the first inlet wall 3081 and the second inlet wall 3082 in the upward-downward direction.

The first light LT1 emitted from the light source 153 may pass through the first container 210) and the side wall 301 of the cap 300, and may be provided to the outside. The second light LT2 emitted from the light source 153 may pass through the first container 210, and may travel toward the cap inlet 304*a*. A portion of the second light LT2 may collide with the lower end of the light shield 307, rather than passing through the third cap inlet 3083, may be absorbed or reflected by the lower side of the light shield 307, and may then be provided to the outside through the side wall 301 of the cap 300. A portion of the second light LT2 may pass through the third cap inlet 3083, and may collide with and be absorbed by the light shield 307, or may be reflected to the inlet walls 3081, 3082, and 3083. The size of the light shield 307, such as the height or the width, may be set such that the second light LT2 emitted from the light source 153 collides with the light shield 307.

Accordingly, the light emitted from the light source 153 may pass through the first container 210 and the side wall 301 of the cap 300, and may then be provided to the outside. In addition, the light emitted from the light source 153 may be prevented from leaking outside through the cap inlet 304*a*.

Referring to FIGS. 1 to 81, a cartridge in accordance with one aspect of the present disclosure may include a container 210 provided therein with a first chamber C1 and an insertion space 214 formed to be elongated, a second chamber C2 in communication with the insertion space 214, a wick 261 mounted in the second chamber C2 and in communication to the first chamber C1, a heater 262 configured to heat the wick 261, a chamber inlet 2424 open at in one side of the second chamber C2 in a direction intersecting the longitudinal direction of the insertion space 214, and a first flow guide 2318 disposed opposite the chamber inlet 2424 with respect to the second chamber C2 to cover the opposite side of the second chamber C2 and including a curved surface recessed so as to be curved toward the insertion space 214.

In addition, in accordance with another aspect of the present disclosure, the first flow guide 2318 may extend so as to be rounded to surround the lower portion and the side portion of the second chamber C2.

In addition, in accordance with another aspect of the present disclosure, the first flow guide 2318 may include a lower portion located at a position lower than the height of the wick 261 and the height of the chamber inlet 2424.

In addition, in accordance with another aspect of the present disclosure, the first flow guide 2318 may have an inner surface connected to a portion of the outer circumferential surface of the insertion space 214.

In addition, in accordance with another aspect of the present disclosure, the first flow guide 2318 may have a shape including a part of a spherical shape.

In addition, in accordance with another aspect of the present disclosure, the chamber inlet 2424 may be open toward the wick 261 such that the chamber inlet 2424 may overlap the wick 261.

In addition, in accordance with another aspect of the present disclosure, the chamber inlet 2424 may have a width W2 less than the diameter W1 of the wick 261.

In addition, in accordance with another aspect of the present disclosure, the chamber inlet 2424 may be disposed within a range of the diameter of the wick 261.

In addition, in accordance with another aspect of the present disclosure, the chamber inlet 2424 and the wick 261 may be disposed such that the height difference W0 between the center of the chamber inlet 2424 and the center of the wick 261 is 1 mm or less.

In addition, in accordance with another aspect of the present disclosure, the wick 261 may be disposed adjacent to the chamber inlet 2424.

In addition, in accordance with another aspect of the present disclosure, when an imaginary line passing through the center of the insertion space 214 in the longitudinal direction of the insertion space 214 is defined as a center line L, the wick 261 may be disposed between the center line L and the chamber inlet 2424.

In addition, in accordance with another aspect of the present disclosure, the wick 261 may be disposed below the insertion space 214, and may overlap the insertion space 214.

In addition, in accordance with another aspect of the present disclosure, the wick 261 may be disposed between the chamber inlet 2424 and the first flow guide 2318.

An aerosol-generating device in accordance with one aspect of the present disclosure may include the cartridge described above and a body 100 to which the cartridge is coupled.

In addition, in accordance with another aspect of the present disclosure, the aerosol-generating device may further include a cartridge inlet 224, which is open in the cartridge to allow the chamber inlet 2424 to be in communication with the outside of the cartridge therethrough, and a sensor 180, which is mounted in the body 100 so as to be disposed adjacent to the cartridge inlet 224 and senses the flow of air passing through the cartridge inlet 224.

In addition, in accordance with another aspect of the present disclosure, the aerosol-generating device may further include a sensor cover 137', which is disposed between the sensor 180 and the cartridge to cover one side of the sensor 180 and has a sensing hole 137*a*, and an inflow passage P, which includes at least a portion formed between the sensor cover 137' and the cartridge and is connected at the downstream portion thereof to the sensing hole 137*a* and the cartridge inlet 224.

In addition, in accordance with another aspect of the present disclosure, the aerosol-generating device may further include a second flow guide 1373, which protrudes from the sensor cover 137' so as to be in close contact with the cartridge, surrounds the downstream portion of the inflow passage P connected to the cartridge inlet 224 and the sensing hole 137*a*, and is open toward the upstream portion of the inflow passage P.

In addition, in accordance with another aspect of the present disclosure, the second flow guide 1373 may have a U-shape.

In addition, in accordance with another aspect of the present disclosure, the inflow passage P may include a portion inclined from the upstream portion of the inflow passage P toward the cartridge inlet 224 at a position between the sensor cover 137' and the cartridge.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A cartridge comprising:

a container provided therein with a first chamber and an elongated insertion space;

a second chamber in communication with the insertion space;

a wick disposed in the second chamber and in communication with the first chamber;

a heater configured to heat the wick;

a chamber inlet open at one side of the second chamber in a direction intersecting a longitudinal direction of the insertion space; and a first flow guide disposed opposite the chamber inlet with respect to the second chamber to cover an opposite side of the second chamber, wherein the first flow guide comprises a curved surface recessed to be curved toward the insertion space.

2. The cartridge according to claim 1, wherein the first flow guide extends to be rounded to surround a lower portion and a side portion of the second chamber.

3. The cartridge according to claim 2, wherein the first flow guide further comprises a lower portion located at a position lower than a height of the wick and a height of the chamber inlet.

4. The cartridge according to claim 1, wherein the first flow guide has an inner surface connected to a portion of an outer circumferential surface of the insertion space.

5. The cartridge according to claim 1, wherein the first flow guide has a shape comprising a part of a spherical shape.

6. The cartridge according to claim 1, wherein the chamber inlet is open toward the wick such that the chamber inlet overlaps the wick.

7. The cartridge according to claim 6, wherein the chamber inlet has a width less than a diameter of the wick.

8. The cartridge according to claim 7, wherein the chamber inlet is disposed within a range of the diameter of the wick.

9. The cartridge according to claim 1, wherein the wick is disposed adjacent to the chamber inlet.

10. The cartridge according to claim 9, wherein, when an imaginary line passing through a center of the insertion space in the longitudinal direction of the insertion space is defined as a center line, the wick is disposed between the center line and the chamber inlet.

11. The cartridge according to claim 10, wherein the wick is disposed below the insertion space and overlaps the insertion space.

12. The cartridge according to claim 1, wherein the wick is disposed between the chamber inlet and the first flow guide.

13. An aerosol-generating device comprising:

a cartridge comprising:

a container provided therein with a first chamber and an elongated insertion space, a second chamber in communication with the insertion space, a wick disposed in the second chamber and in communication with the first chamber, a heater configured to heat the wick, a chamber inlet open at one side of the second chamber in a direction intersecting a longitudinal direction of the insertion space, and a first flow guide disposed opposite the chamber inlet with respect to the second chamber to cover an opposite side of the second chamber, wherein the first flow guide comprises a curved surface recessed to be curved toward the insertion space; and a body configured to allow the cartridge to be coupled to the body, a cartridge inlet open in the cartridge to allow the chamber inlet to be in communication with an outside of the cartridge through the cartridge inlet; and a sensor mounted in the body and disposed adjacent to the cartridge inlet, wherein the sensor is configured to sense flow of air passing through the cartridge inlet, a sensor cover disposed between the sensor and the cartridge to cover one side of the sensor, wherein the sensor cover comprises a sensing hole; and an inflow passage comprising at least a portion formed between the sensor cover and the cartridge, wherein the inflow passage is connected at a downstream portion of the inflow passage with respect to the sensing hole and the cartridge inlet.

14. The aerosol-generating device according to claim 13, further comprising:

a second flow guide protruding from the sensor cover so as to be in close contact with the cartridge, the second flow guide surrounding the downstream portion of the inflow passage connected to the cartridge inlet and the sensing hole, the second flow guide being open toward an upstream portion of the inflow passage.

15. The aerosol-generating device according to claim 13, wherein the inflow passage further comprises a portion inclined from an upstream portion of the inflow passage toward the cartridge inlet at a position between the sensor cover and the cartridge.

* * * * *